US010927557B1

(12) United States Patent
Holdredge et al.

(10) Patent No.: US 10,927,557 B1
(45) **Date of Patent: *Feb. 23, 2021**

(54) PERSONAL WORKSPACE ASSEMBLY

(71) Applicant: Steelcase Inc., Grand Rapids, MI (US)

(72) Inventors: Russell T. Holdredge, Alto, MI (US); Sean Corcorran, Grand Rapids, MI (US); David K. Jones, Grand Rapids, MI (US); Duck Young Kong, Beaverton, OR (US); Todd David Krupiczewicz, Alto, MI (US); Keith Robert Machin, Hopkins, MI (US); Mark McKenna, East Grand Rapids, MI (US); Gordon Peterson, Rockford, MI (US); Mark Spoelhof, Grand Rapids, MI (US); Pradeep Mydur, Wyoming, MI (US); David J. Battey, Caledonia, MI (US)

(73) Assignee: STEELCASE INC., Grand Rapids, MI (US)

( * ) Notice: Subject to any disclaimer, the term of this patent is extended or adjusted under 35 U.S.C. 154(b) by 102 days.

This patent is subject to a terminal disclaimer.

(21) Appl. No.: 16/247,077

(22) Filed: Jan. 14, 2019

Related U.S. Application Data

(63) Continuation of application No. 15/357,376, filed on Nov. 21, 2016, now Pat. No. 10,233,659, which is a (Continued)

(51) Int. Cl.
*E04H 1/12* (2006.01)
*E04B 2/74* (2006.01)

(52) U.S. Cl.
CPC ..... *E04H 1/125* (2013.01); *E04B 2/7405* (2013.01); *E04B 2002/7483* (2013.01)

(58) Field of Classification Search
CPC ..... E04B 2002/7486; E04B 2002/7483; A47B 21/00; A47B 2200/0066;
(Continued)

(56) References Cited

U.S. PATENT DOCUMENTS 540,515 A 6/1895 Rowlett
817,969 A 4/1906 Galbraith
(Continued)

FOREIGN PATENT DOCUMENTS

FR 2952285 A1 5/2011
GB 2331237 A 5/1999
(Continued)

OTHER PUBLICATIONS

PCT International Search Report and Written Opinion, PCT/US2016/017438, dated May 2, 2016.

*Primary Examiner* — Jose V Chen
(74) *Attorney, Agent, or Firm* — Quarles & Brady LLP

(57) ABSTRACT

A lounge assembly comprising a lower wall structure including at least first and second spaced apart side walls and a rear wall that together form an assembly space, each of the side walls and rear wall including an internal surface, a seat assembly supported between the first and second side walls, a first coupler mounted to the internal surface of the first side wall, a support arm having an arm length dimension between proximal and distal ends, the proximal end mounted to the first coupler adjacent the internal surface of the first side wall for rotation about a first vertical axis and a tablet member supported at the distal end of the support arm for rotation about a second vertical axis through a second range of motion with respect to the support arm.

44 Claims, 108 Drawing Sheets

Related U.S. Application Data continuation of application No. 14/642,902, filed on Mar. 10, 2015, now Pat. No. 9,622,570.

(60) Provisional application No. 62/115,906, filed on Feb. 13, 2015.

(58) Field of Classification Search

CPC .... A47B 2200/0072; A47B 2200/0075; A47B 2200/0079; A47B 2200/01

USPC ..... 108/50.01, 50.02, 42, 152; 312/223.3; 52/220.7, 238.1; 297/217.1, 217.7, 136, 297/135, 147

See application file for complete search history.

(56) References Cited

U.S. PATENT DOCUMENTS 995,410 A 6/1911 McClure
1,007,498 A 10/1911 Spencer
1,094,812 A 4/1914 Reck
1,234,309 A 7/1917 Dubben
1,391,222 A 9/1921 Fleet
1,489,982 A 4/1924 Dailey
1,502,353 A 7/1924 Simonson
1,548,334 A 8/1925 Sebell
1,659,572 A 2/1928 Klemm
1,661,003 A 2/1928 Miller
1,894,991 A 1/1933 Hayes
1,992,903 A 2/1935 Potashnik
D95,588 S 5/1935 Holsman
2,026,011 A 12/1935 Wright
2,160,724 A 5/1939 Fletcher
2,266,854 A 12/1941 Davis
2,287,079 A 6/1942 Anderson
2,339,647 A 1/1944 Meyer
2,343,077 A 2/1944 Parrish
D148,242 S 12/1947 Horsewood
2,636,224 A 4/1953 Murdoch
2,694,614 A 11/1954 Dent
D181,945 S 1/1958 Saarinen
D183,416 S 8/1958 Bellmann
2,845,699 A 8/1958 Wwoodard
2,887,154 A 5/1959 Morningstar
2,942,924 A 6/1960 Stangert
2,973,028 A 2/1961 Celeste
2,981,576 A 4/1961 Robinson
2,981,583 A 4/1961 Eisenberg
2,982,344 A 5/1961 Berlin
2,989,112 A 6/1961 Sonnleitner
3,013,642 A 12/1961 Hammitt
3,027,214 A 3/1962 Curatolo
D193,889 S 10/1962 Buzzitta
3,078,133 A 2/1963 Schauer
3,128,137 A 4/1964 Dokter
3,142,514 A 7/1964 Ginat
3,226,161 A 12/1965 Platner
D205,939 S 10/1966 Laverne
3,281,185 A 10/1966 Albinson
3,295,283 A 1/1967 Griffith
3,326,147 A 6/1967 Toney
D208,413 S 8/1967 Ball
3,371,454 A 3/1968 Anderson
D211,464 S 6/1968 Platner
3,389,246 A 6/1968 Shemitz
3,425,171 A 2/1969 Propst
3,441,310 A 4/1969 Gale
3,521,929 A 7/1970 Pearson
3,528,717 A 9/1970 Kinnebrew
D219,376 S 12/1970 Pearson
3,582,170 A 6/1971 Schaeffer
D226,648 S 4/1973 Sebel et al.
D227,832 S 7/1973 Leaver
3,744,868 A 7/1973 Reiter
3,811,728 A 5/1974 Redemske
3,841,042 A 10/1974 Siegal
D242,099 S 11/1976 Casey
D242,100 S 11/1976 Casey
D246,082 S 10/1977 Friedrich
4,097,918 A 6/1978 Anderson
4,109,429 A 8/1978 Whisson
4,164,009 A 8/1979 Maguire, Jr.
4,191,420 A 3/1980 Fassett
4,226,190 A 10/1980 Ashton
D257,601 S 12/1980 Cyplik
D257,604 S 12/1980 Cyplik
4,307,672 A 12/1981 Shikimi
4,312,515 A 1/1982 Allori
D264,402 S 5/1982 Yellen
4,351,475 A 9/1982 Hudson
4,367,370 A 1/1983 Wilson
4,427,232 A 1/1984 Malm
4,448,003 A 5/1984 Hasbrouck
D278,003 S 3/1985 Gagliano
4,616,798 A 10/1986 Smeenge
4,624,083 A 11/1986 Diffrient
D286,956 S 12/1986 Lockwood
4,631,881 A 12/1986 Charman
D288,506 S 3/1987 Ochsner
4,666,118 A 5/1987 Busche
4,685,255 A 8/1987 Kelley
4,687,167 A 8/1987 Skalka
4,712,336 A 12/1987 Backer
4,715,154 A 12/1987 Baloga
D293,981 S 2/1988 Ball
D296,731 S 7/1988 Hollington
4,761,922 A 8/1988 Black
4,779,540 A 10/1988 Dion
4,795,355 A 1/1989 Dorn
4,826,245 A 5/1989 Entratter
4,830,614 A 5/1989 Schricker
4,835,915 A 6/1989 Nilssen
4,844,388 A 7/1989 Kuba
4,852,500 A 8/1989 Ryburg
4,865,111 A 9/1989 Perutz
4,876,835 A 10/1989 Kelley
D304,529 S 11/1989 Hontz
4,914,873 A 4/1990 Newhouse
4,974,808 A 12/1990 Ball
4,979,554 A 12/1990 Nelson
4,980,998 A 1/1991 Amstutz
4,986,038 A 1/1991 Backer
4,986,194 A 1/1991 Bollman
RE33,593 E 5/1991 Herst et al.
5,038,539 A 8/1991 Kelley
5,048,585 A 9/1991 Miller
D321,407 S 11/1991 Heidmann
5,092,385 A 3/1992 Beaulieu
5,097,643 A 3/1992 Wittler
5,104,183 A 4/1992 Madsen
D330,638 S 11/1992 Moschini
5,169,210 A 12/1992 Fricano
5,228,761 A 7/1993 Huebschen
5,230,289 A 7/1993 George
5,238,300 A 8/1993 Slivon
5,246,240 A 9/1993 Romich
5,277,512 A 1/1994 Dwillies
5,282,341 A 2/1994 Baloga
5,333,928 A 8/1994 Rollinson
5,339,576 A 8/1994 Fussler
D350,242 S 9/1994 Lohmeyer
D351,294 S 10/1994 Fleishman
5,368,359 A 11/1994 Eakin
D353,946 S 1/1995 Fischer et al.
5,377,598 A 1/1995 Kirchner
5,394,668 A 3/1995 Lim
5,398,901 A 3/1995 Brodmann
D358,514 S 5/1995 Lovegrove
5,429,336 A 7/1995 Ko
5,473,994 A 12/1995 Foley
5,537,766 A 7/1996 Nickens
5,564,667 A 10/1996 Copeland
5,577,818 A 11/1996 Sayre
D382,122 S 8/1997 Thorp et al.
5,653,499 A 8/1997 Goodall

(56) References Cited

U.S. PATENT DOCUMENTS 5,660,432 A 8/1997 Davis
D385,423 S 10/1997 Shields
5,683,064 A 11/1997 Copeland
5,692,815 A 12/1997 Murphy
D390,021 S 2/1998 Smith
D392,114 S 3/1998 Thorp et al.
5,727,841 A 3/1998 Morley
5,743,193 A 4/1998 Kakuta
5,765,315 A 6/1998 Nagamitsu
5,816,649 A 10/1998 Shields
5,826,639 A 10/1998 Miller
5,826,941 A 10/1998 Olsen
D402,476 S 12/1998 Thorp et al.
D406,228 S 3/1999 Vogels
5,875,597 A 3/1999 Gingrich
D409,419 S 5/1999 Wilkinson
5,906,079 A 5/1999 Brickner
5,931,102 A 8/1999 Grahl
5,931,528 A 8/1999 Shields
5,947,034 A 9/1999 Belka
5,967,600 A 10/1999 Jelacic
D415,901 S 11/1999 Arko et al.
5,979,118 A 11/1999 Gortsema
6,000,560 A 12/1999 Barkan
6,015,120 A 1/2000 Sweere
D425,321 S 5/2000 Tholkes et al.
6,059,364 A 5/2000 Dryburgh
6,086,034 A 7/2000 McAllister
6,101,954 A 8/2000 Rein
6,102,476 A 8/2000 May
6,142,559 A 11/2000 Sorel
6,145,926 A 11/2000 Lin
6,170,786 B1 1/2001 Park
D439,063 S 3/2001 Round et al.
D439,425 S 3/2001 Park et al.
D440,064 S 4/2001 Deacon
6,213,191 B1 4/2001 Nitzsche
D441,968 S 5/2001 Lin
6,250,019 B1 6/2001 Simons, Jr.
D446,659 S 8/2001 Ludwig et al.
6,286,275 B1 9/2001 Edwards
D449,169 S 10/2001 Bennie et al.
6,295,764 B1 10/2001 Berridge
6,296,216 B1 10/2001 Law
D452,559 S 12/2001 Schonberger et al.
6,327,982 B1 12/2001 Jackson
D456,182 S 4/2002 Hamilton et al.
6,375,119 B2 4/2002 Park
6,375,257 B1 4/2002 Wooding
6,378,255 B1 4/2002 Eich
D457,359 S 5/2002 Chan
6,386,723 B1 5/2002 Eberlein
6,394,689 B1 5/2002 Kuo
D460,274 S 7/2002 Bennie et al.
D460,630 S 7/2002 Ritch et al.
6,422,646 B1 7/2002 McNally
6,453,826 B1 9/2002 Fookes
D465,049 S 10/2002 Ludwig
6,484,647 B2 11/2002 Lininger Jr.
6,487,978 B1 12/2002 Hamberg
6,497,075 B1 12/2002 Schreiner
6,527,406 B1 3/2003 Slesinger
6,629,722 B1 10/2003 Tang
D482,536 S 11/2003 Williams et al.
6,644,748 B2 11/2003 Tholkes
6,659,159 B2 12/2003 Fritsche
6,662,732 B2 12/2003 Birsel
6,663,267 B2 12/2003 Newhouse
6,688,563 B1 2/2004 Waxham
6,695,270 B1 2/2004 Smed
D488,163 S 4/2004 Hunt
6,742,307 B2 6/2004 Briskman
6,748,710 B2 6/2004 Gresham
6,769,747 B2 8/2004 Chan
D503,549 S 4/2005 Nicoletti
D506,331 S 6/2005 Quintal
D508,787 S 8/2005 Natuzzi
D510,816 S 10/2005 Lee
7,032,523 B2 4/2006 Forslund, III
D520,263 S 5/2006 Nobles et al.
7,036,438 B2 5/2006 Okamoto
7,082,882 B2 8/2006 Heimbrock
7,134,719 B2 11/2006 Moglin
7,178,469 B2 2/2007 Goza
D538,060 S 3/2007 Golino et al.
D540,565 S 4/2007 Nakamura
7,207,629 B2 4/2007 Goetz
D552,362 S 10/2007 Bouroullec et al.
D553,400 S 10/2007 Kassanoff et al.
D557,916 S 12/2007 Dietrich
D558,993 S 1/2008 Saint-Jalmes et al.
D559,002 S 1/2008 Williams et al.
7,318,622 B2 1/2008 Rezag
D564,764 S 3/2008 Springer et al.
7,357,086 B2 4/2008 Petrick
D568,062 S 5/2008 Newhouse
D569,647 S 5/2008 Mezger
7,419,214 B2 9/2008 Plant
7,427,101 B1 9/2008 Zernov
D579,224 S 10/2008 Fancelli
D582,173 S 12/2008 Dordoni
D583,579 S 12/2008 Pearson et al.
D584,901 S 1/2009 Massaud
7,481,170 B2 1/2009 Sommerfield
7,506,772 B2 3/2009 Chen
7,517,010 B2 4/2009 Saint-Jalmes
7,523,888 B2 4/2009 Ferry
D591,520 S 5/2009 Orson et al.
D596,864 S 7/2009 Bergmann et al.
D599,122 S 9/2009 Feldpausch et al.
D600,930 S 9/2009 Overthun et al.
7,641,962 B2 1/2010 Sutton
D609,037 S 2/2010 Miller et al.
D610,377 S 2/2010 Kita
7,677,182 B2 3/2010 Mueller
D615,919 S 5/2010 Bock
D616,209 S 5/2010 Singler et al.
7,721,991 B2 5/2010 Johnson
7,726,732 B1 6/2010 Keating
D621,329 S 8/2010 Bock
D621,330 S 8/2010 Bock
D621,331 S 8/2010 Bock
7,827,920 B2 11/2010 Beck
7,887,014 B2 2/2011 Lindblad
7,938,372 B2 5/2011 MacLeod
D640,074 S 6/2011 Hamilton et al.
7,958,683 B2 6/2011 Abusada
D643,042 S 8/2011 Saelid
7,997,211 B2 8/2011 Peterson
7,997,531 B2 8/2011 Bettell
7,997,654 B2 8/2011 Ferry
8,011,723 B2 9/2011 Park
D646,085 S 10/2011 Overthun et al.
D648,553 S 11/2011 Wilson et al.
8,046,957 B2 11/2011 Towersey
D653,884 S 2/2012 Ferry et al.
8,162,519 B2 4/2012 Salter
D659,427 S 5/2012 Nicolas et al.
D659,428 S 5/2012 Nicolas et al.
8,177,165 B2 5/2012 Bettell
8,191,487 B2 6/2012 Theesfeld
8,201,885 B2 6/2012 Thompson
D663,256 S 7/2012 Collins et al.
8,215,041 B2 7/2012 Hill
8,215,065 B2 7/2012 Gallant
8,225,723 B2 7/2012 Nakamura
8,272,600 B2 9/2012 Copeland
D668,257 S 10/2012 Tsai
8,276,867 B2 10/2012 Hung
8,291,833 B2 10/2012 Skiba
8,312,653 B2 11/2012 Fritsche
8,313,060 B2 11/2012 Darbyshire
8,322,802 B2 12/2012 Boxenbaum
8,327,589 B2 12/2012 Sutton

(56) References Cited

U.S. PATENT DOCUMENTS

| | | | |
|---|---|---|---|
| 8,365,798 | B2 | 2/2013 | Feldpausch |
| D677,477 | S | 3/2013 | Agati et al. |
| 8,414,076 | B2 | 4/2013 | Plant |
| 8,434,825 | B2 | 5/2013 | Wesselink |
| 8,485,470 | B2 | 7/2013 | Hankinson |
| 8,596,206 | B2 | 12/2013 | Legeay |
| 8,616,137 | B2 | 12/2013 | Collins |
| D701,089 | S | 3/2014 | Lee |
| 8,667,908 | B2 | 3/2014 | Martin |
| 8,668,257 | B2 | 3/2014 | Wu |
| D702,068 | S | 4/2014 | Mitten et al. |
| 8,690,254 | B2 | 4/2014 | Cailleteau |
| 8,740,166 | B2 | 6/2014 | Hamilton |
| D720,160 | S | 12/2014 | Lloyd et al. |
| 8,955,905 | B2 | 2/2015 | Boenigk |
| 8,979,189 | B2 | 3/2015 | Henshaw |
| 9,022,320 | B2 | 5/2015 | Wallace |
| D736,549 | S | 8/2015 | Andersen |
| 9,140,406 | B2 | 9/2015 | Simon |
| D758,115 | S | 6/2016 | McKenna et al. |
| D758,776 | S | 6/2016 | McKenna et al. |
| D758,777 | S | 6/2016 | McKenna et al. |
| D778,653 | S | 2/2017 | Spoelhof et al. |
| 9,622,570 | B1 | 4/2017 | Holdredge |
| 10,233,659 | B1 * | 3/2019 | Holdredge ..... A47B 23/043 |
| 2001/0003960 | A1 | 6/2001 | Lininger et al. |
| 2002/0181229 | A1 | 12/2002 | Wei |
| 2003/0085597 | A1 | 5/2003 | Ludeke et al. |
| 2003/0132356 | A1 | 7/2003 | Copeland |
| 2004/0007904 | A1 | 1/2004 | Lin et al. |
| 2004/0065235 | A1 | 4/2004 | de Oliveira |
| 2004/0250480 | A1 | 12/2004 | Matthai |
| 2005/0011138 | A1 | 1/2005 | Ball et al. |
| 2005/0022699 | A1 | 2/2005 | Goza |
| 2005/0034637 | A1 | 2/2005 | Heimbrock |
| 2005/0067865 | A1 | 3/2005 | Yu |
| 2005/0140184 | A1 | 6/2005 | Williams et al. |
| 2006/0097553 | A1 | 5/2006 | Spurlock et al. |
| 2006/0174807 | A1 | 8/2006 | Dral et al. |
| 2006/0261228 | A1 | 11/2006 | Hung |
| 2007/0261315 | A1 | 11/2007 | Ludwig et al. |
| 2007/0271856 | A1 | 11/2007 | Ludwig et al. |
| 2007/0278361 | A1 | 12/2007 | May et al. |
| 2009/0050740 | A1 | 2/2009 | Saint-Jalmes et al. |
| 2009/0146005 | A1 | 6/2009 | Bettell |
| 2009/0146006 | A1 | 6/2009 | Park et al. |
| 2009/0212184 | A1 | 8/2009 | Bourgeois et al. |
| 2009/0212669 | A1 | 8/2009 | Robert-Reitman et al. |
| 2009/0243352 | A1 | 10/2009 | Cailleteau |
| 2009/0302158 | A1 | 12/2009 | Darbyshire et al. |
| 2010/0163674 | A1 | 7/2010 | Bock |
| 2010/0201165 | A1 | 8/2010 | Dankovich |
| 2010/0301162 | A1 | 12/2010 | Hankinson |
| 2011/0011977 | A1 | 1/2011 | Olliges |
| 2011/0186682 | A1 | 8/2011 | Collins et al. |
| 2011/0210204 | A1 | 9/2011 | Collins et al. |
| 2011/0253838 | A1 | 10/2011 | Bettell |
| 2011/0289859 | A1 | 12/2011 | Picchio |
| 2012/0037776 | A1 | 2/2012 | Hung |
| 2012/0186164 | A1 | 7/2012 | Pensi |
| 2012/0235453 | A1 | 9/2012 | Bechtold et al. |
| 2012/0313406 | A1 | 12/2012 | Darbyshire et al. |
| 2012/0318918 | A1 | 12/2012 | Johnson et al. |
| 2013/0180940 | A1 | 7/2013 | Tsai |
| 2013/0327255 | A1 | 12/2013 | Pajic |

FOREIGN PATENT DOCUMENTS

| | | | |
|---|---|---|---|
| GB | 2362095 | A | 11/2001 |
| GB | 2510765 | A | 8/2014 |
| JP | H03101248 | U | 10/1991 |
| JP | H08258796 | A | 10/1996 |
| JP | 2003135163 | A | 5/2003 |
| JP | 2005334407 | A | 12/2005 |
| WO | 2006078961 | A2 | 7/2006 |
| WO | 2008031506 | A1 | 3/2008 |
| WO | 2008133953 | A1 | 11/2008 |
| WO | 2013144845 | A2 | 10/2013 |

* cited by examiner

PERSONAL WORKSPACE ASSEMBLY

CROSS-REFERENCE TO RELATED APPLICATIONS

This application is a continuation of U.S. patent application Ser. No. 15/357,376, filed on Nov. 21, 2016 and entitled "PERSONAL WORKSPACE ASSEMBLY," which is a continuation of U.S. patent application Ser. No. 14/642,902, filed Mar. 10, 2015 and entitled "PERSONAL WORKSPACE ASSEMBLY," which claims priority to U.S. provisional patent application Ser. No. 62/115,906, filed on Feb. 13, 2015 and entitled "PERSONAL WORKSPACE ASSEMBLY", all of which are incorporated herein in their entirety by reference.

FIELD OF THE DISCLOSURE

The field of the invention is personal work spaces and more specifically arrangements of furniture that facilitate individual focused work within generally open facility spaces.

BACKGROUND OF THE DISCLOSURE

Years ago companies located many employees in specific office spaces and the employees could arrange those spaces to customize for their specific needs. Typically, an employee would arrange work surfaces, a computer including a display screen and a keyboard, a task chair, lighting, and perhaps other affordances within their personally assigned space to meet their needs.

Business models have changed and so too have the demands on employees such that many employees are now required to travel among many different locations throughout the country and indeed around the world to perform work activities. For instance, a sales manager may need to travel between three different mid-western cities to meet with three regional sales representatives during the course of a day. Here, each meeting may be scheduled for one hour so that the manager has several hours of down time while not in one of the meetings or traveling between meeting locations. For instance, the manager may have two hours of "free" (e.g., unscheduled) time between the first and second meetings and another three hours of "free" time between the second and third meetings. The first two hours may be spent in an airport and the three later hours may be spent at a company facility.

In the above example, while the manager has unscheduled time when not traveling between meetings or attending meetings, most employees have plenty of personal or work activities to perform during these unscheduled times. For instance, the manager in the above example may need to work on a quarterly sales presentation due in three weeks, may need to work on setting up additional meetings or travel plans for coming weeks, may need to participate in an impromptu teleconference call with her boss located at a company headquarters on the west coast, may need to place a personal phone call to her husband, etc.

To facilitate these personal tasks, many companies have built out and fitted spaces with affordances designed to support personal activities that can be used by traveling employees on a temporary basis. For instance, in some cases, small offices have been constructed for temporary use that include computers linked to a network, a work surface, a task chair, etc. Here, an employee at a company location with unscheduled time may locate and use one of these personal spaces for an hour, half a day, or more if needed. Temporary use of an office is often referred to in the industry as "hotelling".

While hotelling and publically located furniture are useable to accomplish personal and individual work activities, these solutions have several shortcomings. First, in the case of temporary office spaces, often times the purpose of these affordances (e.g., to support hotelling activity) are not apparent to temporarily located employees. For instance, hotelling offices often have essentially the same appearance and affordances as personal offices used daily by local employees so that the hotelling use is not apparent. In addition, it may not be apparent to a traveling employee that an office with a closed door is available for hotelling. Even if an employee knows a specific office is reserved for hotelling, the employee may be confused by a closed door to the space as to whether or not the space is currently available, is scheduled for use by another employee currently or in the near future, etc.

Second, because of their structural requirements and general appearance, hotelling offices are often provided in out of the way locations as opposed to right in the open where traveling employees are most likely to encounter the arrangements. For instance, it is atypical for walls that constitute a small office space to be constructed in the middle of an open generally common space (e.g., an airport lobby, a facility cafeteria, etc.) as the structure would break up the space and severely degrade the overall look and feel of the space. Where hotelling arrangements are positioned in out of the way locations, use of those arrangements is substantially reduced.

Third, in many cases, while a company may want to provide spaces optimized for individual work activities when traveling employees are unscheduled for a time, many companies also want travelling employees at least somewhat "visible" to others in their facilities to encourage impromptu meetings or conversations between employees. Out of the way small hotelling offices do not facilitate impromptu meetings. Exacerbating the problem, walled hotelling offices typically form a complete barrier between a traveling employee and local employees within a facility.

Fourth, while walled spaces are often optimized for some employees to accomplish focused work activities, in many cases employees feel claustrophobic within walled spaces and therefore avoid using such spaces. This is particularly true in the case of small hotelling offices where full wall structures exacerbate the closed in feeling.

Fifth, because hotelling spaces are often fitted out with "nice" affordances, in many cases hotelling spaces cannot be located in particularly useful "public" spaces. For instance, a hotelling space that includes a high end task chair or plug in task light cannot typically be located in an airport lobby as the chair and light may be taken from the space. Similarly, local employees recognizing the value of a high end task chair or other non-fixtured (e.g., not permanently attached) affordances may be inclined to swap their chair for the high end chair either temporarily or permanently which defeats the purpose of providing the high end affordance to the traveling employee.

Sixth, while most employees and others (e.g., visiting customers or clients, services providers, etc.) do not abuse space affordances, sometimes affordances become damaged or just simply show wear over time. This is particularly true where a set of affordances includes some affordances that can move and collide with other affordances which can cause damage to the set. For instance, where a task chair is moveable relative to a work surface, chair arms may collide with a work surface and damage both an arm of the chair and the edge of the work surface. Where a work surface is supported for movement within a space, the work surface may collide with another work surface or with a space defining wall structure resulting in damage to the overall arrangement. While people typically continue to use affordances in their own personal space as they become worn or somewhat damaged, these degradations almost always substantially reduce use of hotelling accommodations. For instance, a somewhat worn chair in a hotelling space typically substantially reduces the use of that space. Damage to a cubicle or office wall or work surface often substantially reduces use of that space.

To address many of the problems with walled hotelling office spaces, partial wall cubicle spaces have been used to configure hotelling spaces in some cases. Here, the cubicle wall leaves an upper open area which reduces claustrophobic feelings and enables persons passing by a space to determine who is temporarily located within the space. While cubicles solve some of the problems described above, they do not address most of the problems. For instance, the appearance of most cubicle configurations is not suitable for use in many open common spaces and therefore, like small offices, cubicle type hotelling spaces are often tucked away and are not as easily identifiable as would be optimal. Where arrangement affordances are moveable and not restricted from collision, component damage is likely. Cubicles do nothing to eliminate the possibility of non-fixtured affordances being removed from hotelling spaces.

In other cases companies provide couches or lounge chairs in public spaces that can be used on a temporary basis by employees to attend to personal or work activities during unscheduled time. While couches or lounge chairs in open spaces are useful, these options clearly do not afford any sense of privacy to travelling employees. In addition, in most cases these options often do not provide optimized affordances like lighting, supporting work surfaces, etc. Even where some type of supporting work surface is provided, those surfaces are typically relatively small and may not support substantial weight.

Similar needs exist in other public and semi-public spaces for affordances that enable a user to have some privacy in a comfortable environment while still being generally disposed n a public space. For instance, these needs are also prevalent in a library or educational environment, in a school campus environment, etc.

Thus, there is a need for a new type of workspace arrangement that is aesthetically appealing so that it can be placed at any location within a facility including generally open common spaces which provides at least some sense of privacy to a user yet still feels open and enables the user to have a sense of persons proximate the user's space. It would also be advantageous if such an arrangement is particularly inviting to users, has an intuitive design and has a design that minimizes or substantially eliminates the possibility of affordance use or movement damaging arrangement features.

SUMMARY OF THE DISCLOSURE

It has been recognized that temporary workspace arrangements can be designed that are optimized for individual work activities in generally open spaces within facilities that are particularly inviting, include personally appealing affordances, are ergonomically correct, that are optimized for most individual work activities, and that have built in optimized restrictions which minimize the possibility of damage to arrangement affordances and also restrict relative juxtapositions of the affordances so that all such arrangements have a neat and similar appearance. To this end, in at least some embodiments an exemplary arrangement will include a lounge chair (e.g., a "lounge") that is substantially surrounded on at least three sides by a partial wall/screen structure including a back wall and first and second lateral wall members which close off the space about the chair to the rear and sides thereof. Here, the lounge is stationary with respect to the surrounding wall structure so that a backrest member generally resides proximate the rear wall and a front surface thereof faces away from an internal surface of the rear wall member. In this arrangement, a lounge seat is open for a user to assume and a sense of being welcomed into the space is created.

In some cases the wall/screen structure may rise up to a height that is at or above the height of a user's eyes when seated in the lounge so that a user has at least some sense of privacy when seated in the chair.

In at least some cases a portion of the wall/screen structure may be at least somewhat transparent so that a user seated in the lounge that cannot see over the top edge of the screen still has some visual perception of movement outside and proximate the arrangement so that if another person is adjacent the arrangement, the seated user has the ability to sense that the person is near and to adjust activities within the space if appropriate. For instance, a user participating in a telephone call while seated in one of the arrangements may reduce the volume or change the content of words spoken when another person is perceived to be proximate the arrangement.

In some embodiments the wall structure may include a lower wall structure that includes an opaque wall assembly and an upper screen structure that is at least somewhat transparent. In some cases the upper screen structure, for instance, may be formed of a relatively thin (when compared to the lower wall structure) plastic material akin to the plastic used to form milk cartons so that some light passes through the screen to facilitate perception of movement proximate a location outside the arrangement space.

In some cases the lower wall structure may have a thickness or width dimension that is substantially greater than the thickness of the screens supported there above. For instance, the lower wall structure may generally have a thickness of between one inch and three inches and in particularly useful embodiments between one and one half inches and two inches while the screens there above may have a thickness of between one sixteenth of an inch and one quarter of an inch. Here, the difference in structure thickness results in a relatively stable and robust structure due to the substantial feel of the lower wall structure while the upper screens provide privacy and still have a sense of openness (e.g., the thinner screens operate as less of a physical barrier due to their less heavy nature). The combination of thinner screens and transparency is particularly advantageous to causing an intended perception of openness. In addition, all configuration components to which substantial force is applied during use may be mounted to or supported by the more substantial lower wall structure as opposed to the screen structure. For instance, the lounge, shelf structure and work surfaces may all be supported by the relatively more substantial lower wall structure.

In some cases the wall structure may also include additional wall members to further define an arrangement space. For instance, in some cases, while a left wall member may end proximate the front end of a lounge seat, the right wall member may extend forward to define a larger space so that a seated user's legs occupy a location proximate the extended portion of the right wall member. In still other cases a front wall member may be provided where the front wall member extends in front of the lounge and includes at least a portion that is substantially parallel to the rear wall member. Here, the front wall member and the extended portion of the right wall member increase the sense of privacy for a space user seated on the chair. In this case, there is an egress opening into the arrangement space between a front edge of the left wall member and a distal vertical edge of the front wall member.

It has been recognized that corners of work spaces and work surfaces are generally underutilized and therefore that structure that defines corners, in effect, results in wasted space. For this reason, in at least some embodiments the wall members that define an arrangement space may include curved portions between flat planar sections so that the arrangement space includes curved corner portions. In addition to minimizing wasted space, the curved wall sections also soften the appearance of the overall arrangement.

In some embodiments the upper screen portions of the wall structures include rigid vertical brackets and screen insert portions that fill the space between the vertical upright brackets. In some cases there may only be two vertical upright brackets for each screen insert and the brackets may be arranged so that portions of the screen insert that are received thereby are not coplanar. For instance, in some cases a screen insert will form a curved section of a wall structure where opposite vertical lateral edges of the screen are directed along trajectories that form a 90 degree angle and are received by the brackets so that the screen insert forms a 90 degree bend or curve. Here, there may be intermediate brackets or some type of mechanical track member along a lower edge of a curved screen insert to support an intermediate portion of the screen insert and to help maintain the shape of the insert. In some cases the insert may be preformed with a general shape of a lower wall assembly above which the screen member will reside and the brackets may rein in any slight variance therewith upon installation.

In some embodiments the brackets may be designed to angle inward from a lower end toward an upper end so that when a screen insert is supported thereby, the screen angles inward from a bottom edge toward the top edge at least slightly into the arrangement space. Thus, in some cases a screen insert may form a general angle with vertical and may also form a curve along its horizontal length. Here, in addition to presenting an aesthetically pleasing arrangement, the angled screen shape increases the sense of privacy within the configuration space. In this regard, even where the screens form a relatively small angle (e.g., 5 or less degrees) with vertical, the feeling of privacy is substantially increased.

In some cases sections of the wall assembly may have substantially vertically upright external surfaces and other sections of the wall assembly may form angles with a vertical plane. For instance, in some embodiments the side wall members may have substantially vertical surfaces while the rear wall member slopes rearward from a lower edge toward an upper edge so that external surfaces thereof are sloped with respect to a vertical plane. Here, it has been recognized that the backrest of a lounge typically slopes rearward and therefore that space between the rear surface of a backrest and a rear wall member is typically wasted. By angling the portion of a lower wall structure rearward from bottom to top behind the lounge, a stylized aesthetic is presented without a space penalty within the configuration space (e.g., only space that is typically unutilized in the configuration is required to present the aesthetic).

In some cases foot members are provided to hold the wall members up above (e.g., 4 to 8 inches) a supporting ambient floor surface. By holding the wall members above the ambient supporting floor, the arrangement takes on an appearance that is different than a conventional cubicle wall structure and provides a greater sense of openness to an arrangement user. In some cases the foot members may have different shapes or dimensions. For instance, in some cases foot members that support the side and front wall members may be substantially vertical while foot members that support the rear wall member may be angled with vertical to present a different appearance.

In some cases single wall sub-assemblies and screen assemblies may form portions of two adjacent wall sections such as, for instance, the left wall and a portion of the rear wall, a portion of the right wall and an adjacent portion of the rear wall, a portion of the right wall and the front wall, etc. In these cases the oppositely facing internal and external surfaces of each wall sub-assembly may be substantially seamless to provide a finished appearance.

In some cases where a screen insert or the like is supported above a supporting lower wall assembly, the screen brackets may hold the insert up so that a lower edge thereof is spaced above a top edge of the lower wall assembly by a small gap (e.g., one to two inches). While the gap is below the eye level of a user seated on the arrangement lounge and therefore does not allow the space user to see out, the gap can operate to allow another person outside the arrangement space see into the space and ascertain, from many vantage points, if someone is currently located within the space (e.g. general movement within the space can be distinguished through the gap. In at least some cases the lower wall member will have a width dimension that is substantially greater than a thickness of a screen supported there above so that the thickness of the lower wall structure blocks a lounge user's view through the gap below at least the side screen inserts. Thus, while a seated user may sense movement via light passing through transparent screen members or via visual perception through the gap between a front wall member and a screen insert there above, the user is generally undisturbed by visual perception through the laterally disposed gaps.

In at least some embodiments the lounge is integrated into or securely attached to the overall assembly or workspace arrangement and this restriction has several advantages. First, the lounge cannot be removed from the workspace and therefore a high quality chair structure can be provided and is always available to an arrangement user. Second, by rendering the lounge stationary, the lounge cannot be moved within the workspace and therefore there is no chance of the lounge colliding with other workspace affordances and damaging either the lounge (e.g., an armrest) or some other affordance (e.g., an internal surface of one of the wall members). Third, each of the arrangements generally has the same appearance and lounge position within the arrangement and therefore, where several workspace arrangements are provided within a single large space, the set of workspace arrangements always has a similar neat appearance with lounges are in the same relative juxtapositions with respect to the surrounding wall structures.

In some embodiments the lounge assembly is supported by the surrounding wall structure so that additional supporting leg members are not required. For instance, the rear and lateral wall members may support the lounge assembly in a suspended fashion there between. Where the lounge structure is supported by the wall members, a space below the lounge seat may be completely open to the ambient floor for storage of a book bag, a briefcase, etc., below the seat member.

In some embodiments the seat and lounge assembly may have a width dimension that is less than a dimension between facing surfaces of the left and right lateral wall members so that a space may exist between at least one side of the lounge assembly and an adjacent surface of one of the lateral wall members. For instance, a space of between eight inches and two feet may exist between a right edge of the lounge assembly and a facing surface of the right wall member. In particularly useful embodiments the side space may be between eight and fourteen inches. In some cases it is contemplated that there may be side spaces on each side of a lounge structure of between six inches and two feet.

In some embodiments a side work surface is provided between the lounge assembly and a facing surface of one of the side wall members. For instance, a side work surface may extend forward from the rear wall member to a location proximate or just in front of the space between the wall member and a lounge and to the side of the lounge. In some cases the side work surface may be at or at least substantially at the height of a top end of the side wall member (e.g., proximate the bottom edge of an upper screen insert). In some cases an edge of the work surface that extends along the side of the lounge assembly may angle toward the side wall member when moving forward from the rear wall member so that the overall shape of the work surface opens generally forward to invite a user to assume a seated position on the lounge.

In some embodiments a cap member may be provided along a top end of he lower wall structure that forms a top surface and the top surface of the work surface member may be substantially flush with the top surface of the cap member. For instance, in some cases the top cap member may have a width dimension of between one and three inches. Where the cap member extends about the top end of the entire lower wall structure, the upper screen member may extend upward above an outer edge of the cap member so that the cap member forms a one to three inch shelf about the interior of the lounge space.

In some cases a lower shelf member may be located within the space between a lounge assembly and the surface of a spaced apart lateral wall member for storing a book bag, a brief case or the like. In some cases the shelf member may form a top surface that is below the top surface of the lounge seat so to accommodate a relatively large book bag or other supplies. In some cases the lower shelf member may be supported by the lateral wall members or the rear wall member of an arrangement so that the shelf member resides above a lower edge of each of the arrangement wall members out of sight when the arrangement is viewed from outside the arrangement space. Thus, in some cases both the lounge arrangement and the lower shelf may be suspended between the supporting wall members and by supporting leg members that support the wall members. In this case, when a book bag or other resources are stored on the lower shelf, the resources are held up above the lower edge of the lower wall structure and therefore out of sight from a vantage point outside the configuration. The end result is easily accessible yet relatively hidden storage space within the arrangement.

In at least some embodiments a side work surface may be provided above the lower shelf member. Here, an arrangement user seated on the lounge seat with a book bag or the like supported by the lower shelf member should be able to access the book bag through an open space formed between a side portion of the lounge and a side edge of the work surface without having to leave her seated position.

In particularly advantageous embodiments a tablet is supported by the wall structure by an articulating support arm such that the tablet can be moved into and out of a use position in front of the lounge. When in the use position, a top surface of the tablet located in front of the lounge can be used to support a laptop, a pad type computing device (e.g., an i-Pad), or some other type of computing device, a pad of paper or a book or other supplies or resources used by an arrangement user. In some cases the tablet may be rotatable about a horizontal axis into different tilted positions to accommodate user preferences. The arm allows a user to move the tablet out of the way to gain access to the lounge or to leave a seated position on the lounge.

In some embodiments movement of the tablet and articulating arm may be limited or restricted such that the tablet cannot collide with any other assembly structure so as to substantially minimize the possibility of damage to the tablet and/or other assembly structure. For instance, while the tablet may be moveable from a use position toward a stowed position in which a user can exit the lounge, the stowed position may not allow the tablet to move flat up against the supporting wall members and instead may space the tablet slightly from the wall even when the tablet is in the fully stored position. As another instance, the arm may limit tablet movement so that the tablet cannot collide with a side work surface adjacent a lounge.

In some embodiments it does not matter where a proximal end of the articulating arm opposite the tablet mounts to the other assembly structure. For instance, here, the articulating arm may mount to an underside of a side work surface member or to an internal surface of a side wall structure. In a particularly advantageous case, the proximal end of an articulating tablet support arm is mounted to a supporting lateral wall member. It has been recognized that when an articulating tablet is provided for routine use by many hotelling or other temporary users, the articulating structure needs to be particularly robust to avoid wear and other damage thereto. By securing the arm to the supporting wall structure, a robust base is provided for the arm and the associated tablet.

In at least some embodiments the articulating arm is mounted to a supporting lateral wall member just below a side work surface member so that the arm moves about under the work surface member proximate an undersurface thereof so as not to obstruct front access to a storage space under the side work surface. In some cases the arm will include first and second arm sections where the first arm section mounts at a proximal end to the supporting wall for rotation about a first vertical axis and the second arm section is pivotally mounted to the distal end of the first arm section for rotation about a second vertical axis, and the tablet may be mounted to the second arm section for rotational motion about a horizontal axis that resides below a top surface of the tablet and that extends along a direction parallel to a length direction of the second arm member. In at least some embodiments, while the first arm member resides at a height generally below the bottom surface of the side work surface member, a top surface of the tablet, when the tablet is in a substantially horizontal position, resides above or at least at the same height as the top surface of the side work surface member.

When a user sits down on the lounge, the tablet may be moved into the use position in front of the lounge and the user. After use, the tablet is moved from the use position to a side or generally lateral position in order for the user to leave the lounge space. Here, in most cases when a user leaves a space, the user will leave the tablet in the lateral position so that the space and more specifically the lounge space is open to invite a next user to use the lounge space. Here, in addition to leaving the lounge space open for a next user, the position of the tablet to the side yet in open view makes it particularly intuitive for a next user to see that the tablet exists and to determine how to use the tablet once a seated position on the lounge is assumed.

The tablet may include some feature for supporting a pad type computing device. For instance, a slot may be provided in a top surface of the tablet that is dimensioned to receive an edge of a pad type device to support the device in a generally upright position in front of the lounge chair. Here, a rubbery or otherwise tacky insert may be provided within the slot for gripping under the force or friction or the like the edge of a pad type device. As another instance, an upwardly extending lip may be provided proximate at least one edge of the top surface of the tablet to contact an edge of a device supported on the top surface of the tablet.

In some cases power receptacles are provided in one or more locations within a work space arrangement at advantageous locations. For instance, a receptacle box may be mounted to one of the wall structures, to the lower shelf member, to an undersurface of the side work surface member, etc. The receptacle box will typically include a three prong outlet as well as a USB or other port structure to support different types of power delivery. While not shown, data ports such as Ethernet or other port types may also be provided within a receptacle box.

In some cases a lighting device may be securely mounted to the wall structure or other assembly components that can be turned on to provide light within the assembly space. Other affordances may be provided within the work space arrangement. For instance, in some cases speakers, a camera, a dedicated flat panel display screen, etc., may be mounted within the work space arrangement that can be used to provide other functionality to a space user. As another instance, digital signage or a digital scheduling interface flat screen display may be provided on the outside surface of one of the wall or screen structures or at the top of one of the screen support brackets for indicating use status of the arrangement or for allowing a user to see scheduled activities for the arrangement or to schedule use of the arrangement. There are several advantages associated with the disclosed tablet and support arm. First, when a laptop or the like is resting on a top surface of the tablet and the tablet is pivoted into an angled supporting position so the top surface is angled generally toward a lounge user's upper torso, the rear edge of the tablet (e.g., the edge away from the user) is elevated which tends to elevate the laptop screen or a tablet type computing device which tends to reduce neck strain. Second, when the tablet is angled, a front edge of the tablet (e.g., the edge near a user) is lowered which allows the tablet surface near the front edge to support a lounge user's wrists or forearms. Here, by adjusting the angle of tilt of the tablet, the height of the forearm supporting surface is adjustable in a simple, intuitive and cost effective manner. Third, a particularly advantageous support arm structure includes two vertically oriented pivot joints which allow the tablet to be positioned at different distances from a lounge chair to accommodate differently sized user's of the assembly.

While many different aspects of different embodiments are described herein, it should be appreciated that different arrangements will includes different subset of the aspects and features.

DETAILED DESCRIPTION OF THE DISCLOSURE

Figure 1:
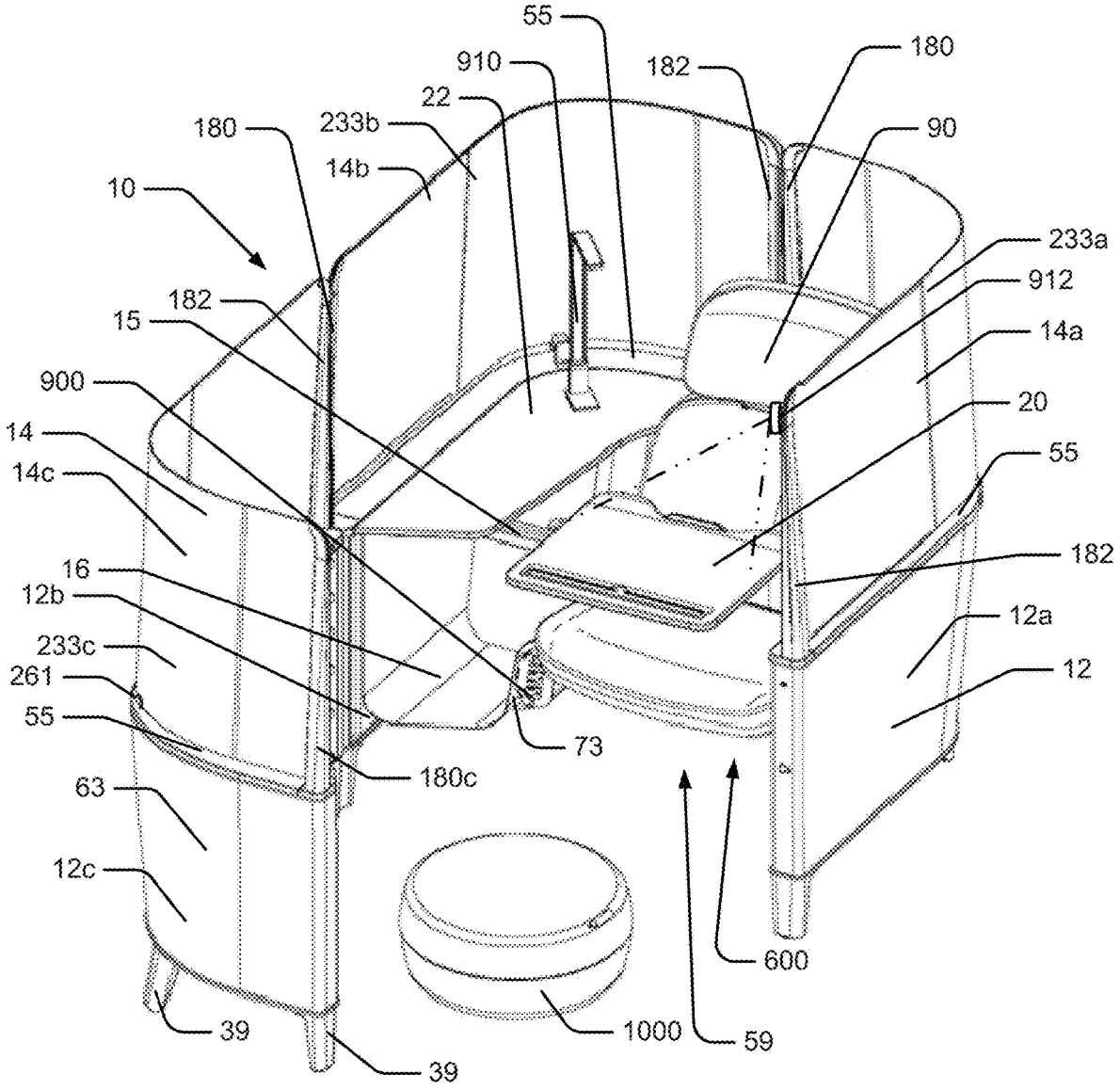
FIG. 1 is a perspective view of an exemplary personal workspace assembly that is consistent with at least some aspects of the present disclosure.
Figure 2:
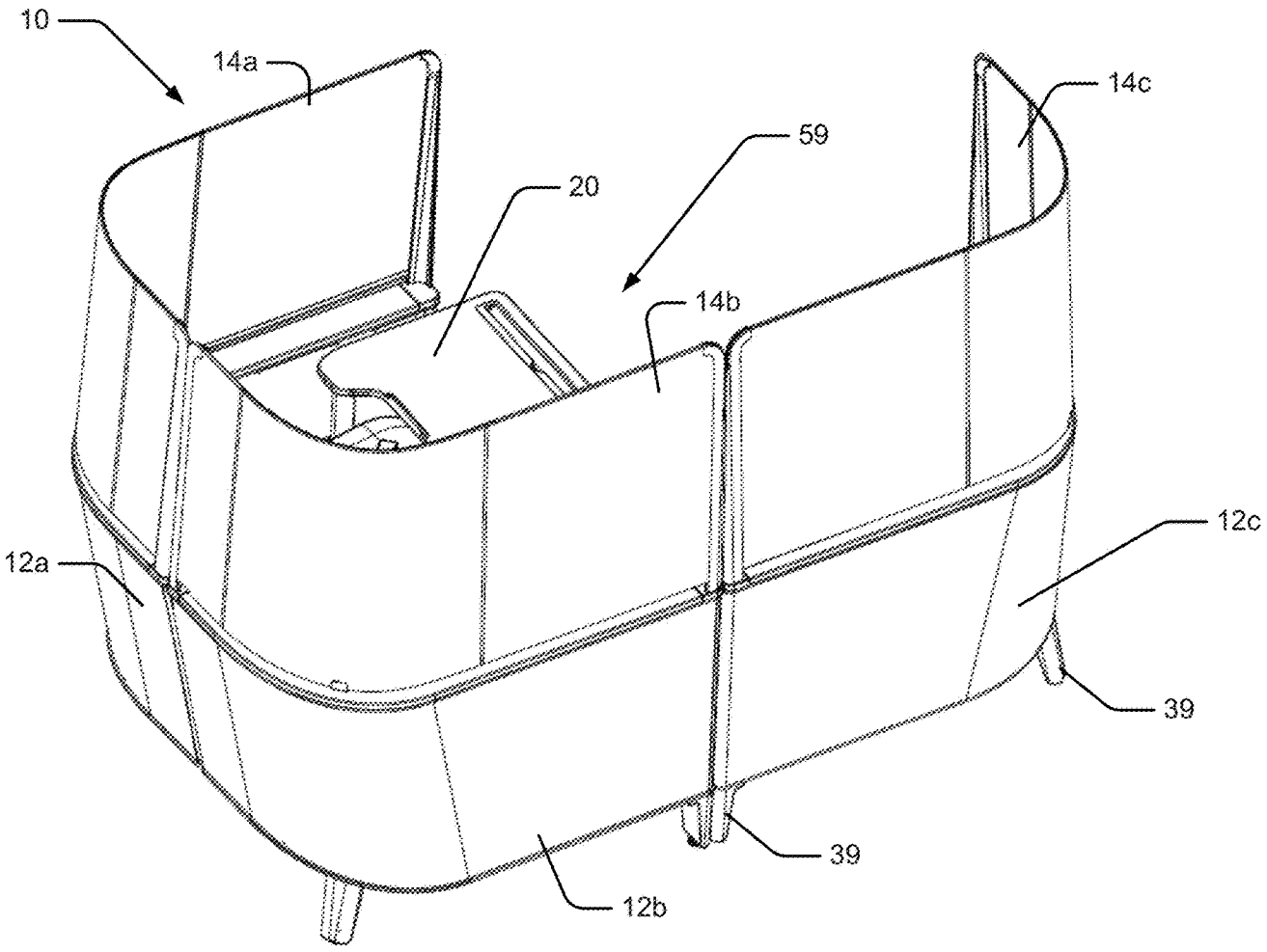
FIG. 2 is a perspective view of the assembly shown in FIG. 1, albeit from a different relative juxtaposition.

Referring now to the drawings wherein like reference numerals correspond to similar elements throughout the several view and more specifically, referring to FIGS. 1 through 5, the present disclosure will be described in the context of an exemplary personal workspace assembly or arrangement 10 that includes a lounge subassembly 90 mounted within an assembly space 59 defined by a space defining structure including a lower wall subassembly 12 and an upper screen subassembly 14. In addition to the lounge subassembly, other structure and features are provided within space 59 including, in the illustrated embodiment, a lower shelf subassembly 16, a side upper shelf member or work surface member 22 and related assembly and a tablet assembly 20 that is supported for movement within the space 59 by an articulating arm assembly 15.

Referring still to FIGS. 1 through 5, the lower wall subassembly 12 includes three separate wall section subassemblies labeled 12*a*, 12*b* and 12*c*. While each of the wall section subassemblies has a somewhat unique shape, each of the wall section subassemblies is generally constructed in a similar fashion and therefore, unless indicated otherwise, only wall section subassembly 12*c* will be described here in detail. Referring also to FIG. 6, wall section subassembly 12*c* includes an internal skeletal frame structure 69*c* that includes four vertical post members, each labeled 32 in FIG. 6, that are spaced apart along a length of the subassembly. Horizontal lower, intermediate, and upper rail members 33*c*, 35*c* and 37*c*, respectively, extend between and connect the post members 32 so that the post and rail members together form the shaped skeletal frame structure 69*c* to support other components that form subassembly 12*c*. The posts and rails may be formed using any rigid material including wood, steel, aluminum or any other suitable material, and are fastened together using mechanical fasteners such as screws, bolts, rivets, adhesive, or both adhesive and mechanical fasteners. In at least some embodiments, posts 32 at the ends of the skeletal structure 69*c* have finished outer fascia 31 and form finished surfaces after section 12*c* is assembled.

Foot members 39 are mounted to an undersurface of lower rail member 33*c* and extend downward there from to contact a supporting ambient floor surface there below to support subassembly 12*c* in an upright use position upon installation. In at least some embodiments, each foot member has a length dimension within a range between one and eight inches and in some embodiments the length is between two and five inches and in a particularly useful embodiments the foot members each have a height of substantially 4 inches so that a bottom end of the wall section subassembly 12*c* is held above the supporting floor surface.

Figure 4:
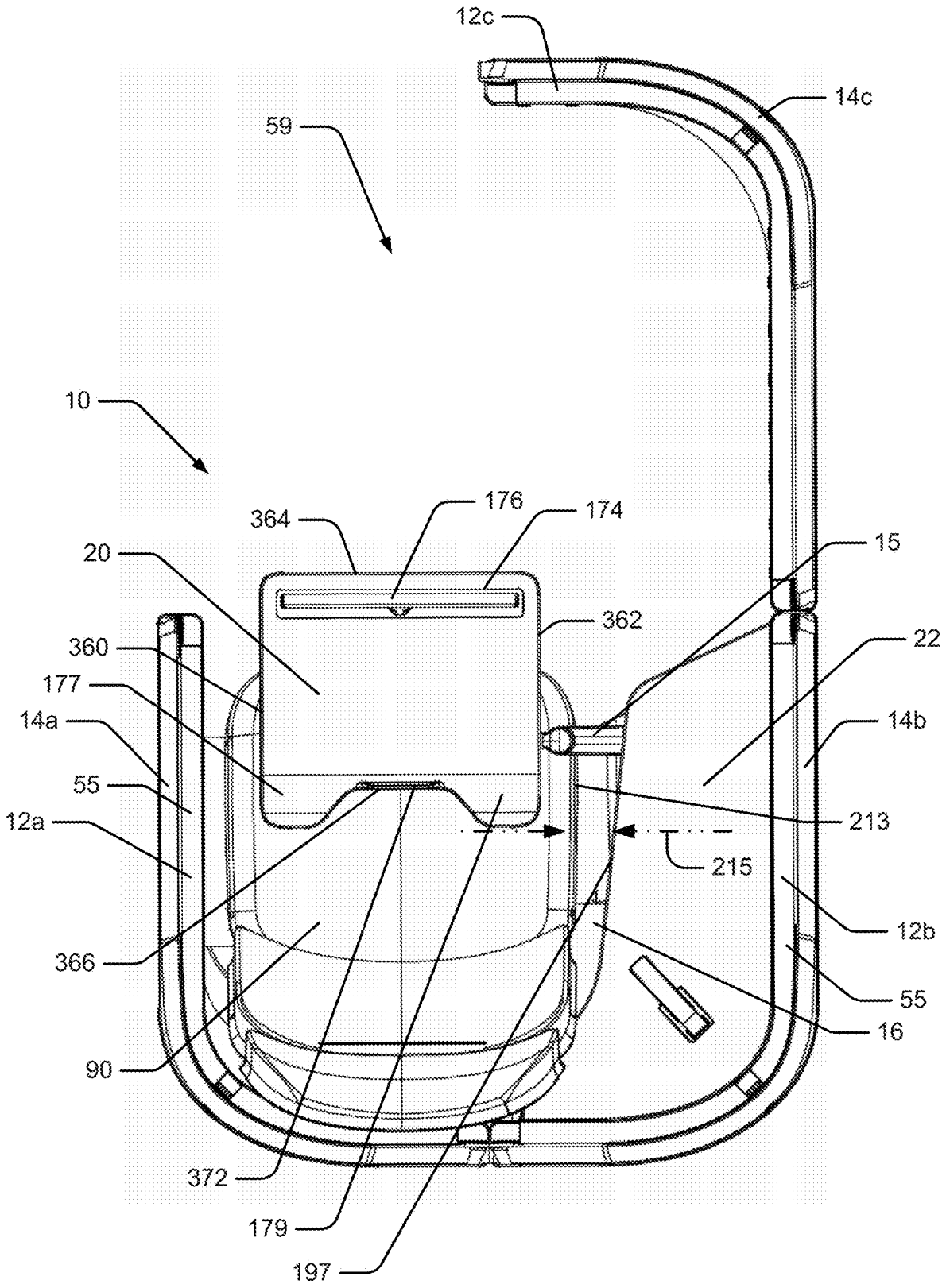
FIG. 4 is a top plan view of the exemplary assembly shown in FIG. 1.

Referring still to FIGS. 4 and 6, each of the rail members 33*c*, 35*c* and 37*c* is substantially J-shaped when viewed from a top plan view having long and short ends that extend in directions that substantially form a 90 degree angle with a curved wall section between the two end sections. In at least some embodiments the radius of curvature of the curved section is within a range between 5 and 15 inches and in a particularly preferred embodiment the range is between 8 and 12 inches. Thus, the overall shape of the skeletal frame structure 69*c* formed by the posts and rails is substantially J-shaped.

In at least some embodiments the wall subassemblies 12*a*, 12*b*, 12*c* will include a generally uniform thickness dimension so that at a top end thereof the thickness is within a range between one inch and eight inches and in particularly useful embodiments the thickness will be within a range between two and one half inch and three and one half inches or between one and three inches.

Referring again to FIG. 1, curved fascia panel members 63 mount to internal and external surfaces of the frame structures to provide a rigid finished appearance to the wall section subassembly 12*c*. For instance, rigid or semi-rigid wood, metal or plastic fascia member may be mounted to the internal and external surfaces of the frame structure to provide a finished appearance. In other cases a fabric or other material covering may be mounted to or attached to the frame structure to finish off the appearance. Mechanical fasteners for securing the fascia members to the skeletal frame 69*c* are not illustrated but may include any type of mechanical fastener. In at least some cases the mechanical fasteners may include locking couplers so that the fascia members cannot inadvertently fall off the structure without an affirmative step to unlock the members.

The upper rail members of each of the subassemblies 12*a*, 12*b* and 12*c* forms various slots and other mounting features for securing various arrangement components to the wall section subassemblies. To this end, see FIG. 8 that shows an upper rail member 37*a* of section subassembly 12*a* adjacent an upper rail member 37*b* of section subassembly 12*b*. Upper rail member 37*a* forms a separate slot 51 at each of its distal ends for receiving a lower end of a screen support bracket 185 to be described in detail hereafter. Similarly, upper rail member 37*b* forms a slot 51 at each of its distal ends for receiving a lower end of a screen support bracket 185 and the upper rail member that forms part of assembly 12*c* forms similar bracket receiving slots (not illustrated). In addition, referring also to FIG. 9, upper rail member 37*a* and each of the other upper rail members forms a pair of L-shaped openings 284 and 286 for mounting an intermediate bracket subassembly 261 to be described in more detail below. Other openings as well as threaded apertures or fastening holes are formed in the upper rail members.

Referring again to FIG. 8, each subassembly 12*a*, 12*b* and 12*c* also includes a spacer cap member 53 and a finished fascia cap member 55. Each cap member 53 and 55 includes a generally flat member that has a shape that mirrors the shape of the top end of the wall assembly that the cap member is to be attached to. To this end, each cap member 53 and 55 has a generally J-shaped contour when viewed from a top view vantage point. Each cap member 53 and 55 forms an intermediate notch or opening 41 and 43, respectively, that aligns with an associated intermediate bracket assembly 261 upon installation so that a top portion of the intermediate bracket assembly 261 extends up through the notch to support a screen assembly there above. In at least some embodiments the notches 41 and 43 are along an internal edge of each cap member 53 and 55 as shown so that after installation, from an external location with respect to the assembly space 59, the lower portion of the intermediate bracket assembly 261 is at least somewhat hidden by the supported screen assembly to provide a unique aesthetic to the overall assembly.

An exemplary dual screen support bracket 185 includes a dual base member 183 and first and second lower flanges 117. Base member 183 that has a thickness dimension and that rests on a top surface of the upper rail member 37*a* upon installation to ensure that the bracket is fully support of the rail structure. Flanges 117 extend from lower edges of member 183 in opposite directions. Similarly, an exemplary single screen support bracket 221 (see FIG. 21) includes a base member 218 that has a thickness dimension similar to the thickness dimension of base member 183 and is supported on a top surface of the upper rail member 37*a* of an associated lower wall structure 12*a*. The spacer cap member 53 has a shape that conforms to the J-shape of an upper rail member 37*a* that the cap member 53 is to be attached to upon assembly and has a thickness dimension that is a fraction of the thickness of a base plate 183 so that a top surface of each base member stands slightly proud of the top surface of each adjacent spacer cap member 53 after installation of the spacer cap member 53.

Figure 8:
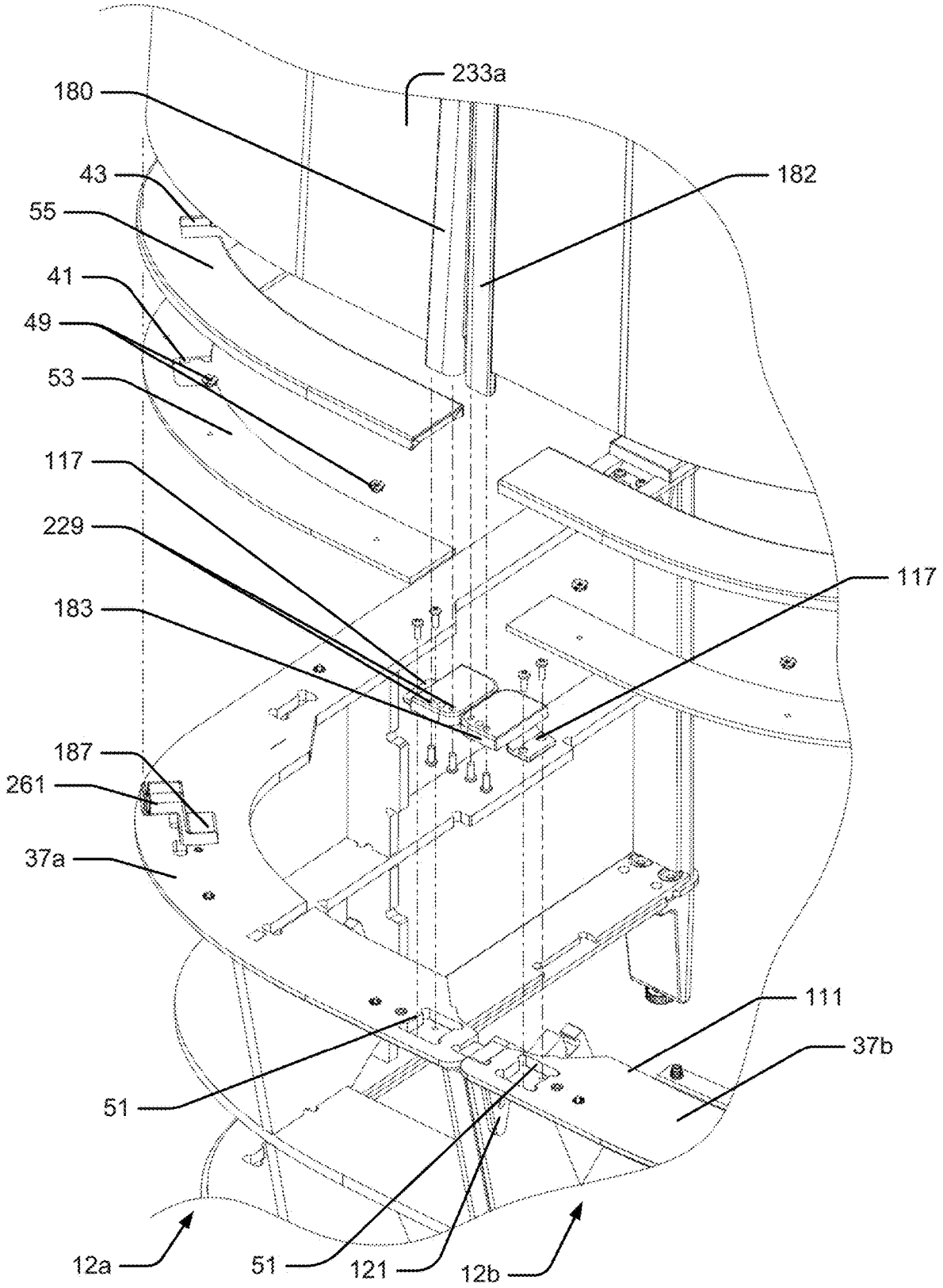
FIG. 8 is a perspective view of a different subset of the assembly components shown in FIG. 6.

Referring to FIG. 8, in at least some embodiments, the spacer cap members 53 are attached to the top surfaces of the top rails 37*a* via screws or nut and bolt fasteners (not shown) that extend through openings in the upper rail 37*a* and through the cap members 53. Other ways of fastening the spacer cap members are contemplated including use of an adhesive.

Each finishing cap member 55 includes a top finished surface that is substantially unobstructed by holes or other fastening features so that the finishing cap has a finished top and side edge appearance after installation. Here, the finishing cap member 55 has a thickness that brings the top surface thereof up to a flush level with the top surface of adjacent bracket base members 183 and 218 upon installation over the spacer cap. In at least some embodiments the finishing cap is formed of plastic or a rubbery material so that the cap has a rich appearance and feel upon touch. Other materials for the finishing cap are contemplated. The finishing cap member 55 may be secured to the spacer cap member via adhesive or via a mechanical friction fit where the finishing cap member forms a downwardly opening channel for tightly receiving the edges of the spacer cap therein. In other cases the cap member 55 may be formed around metal inserts 49 (see again FIG. 8) that form downwardly opening threaded apertures and screws (not illustrated) may be fed up through openings in top rail member 37*a* and into the threaded apertures to hold the finishing cap member in an installed position.

Referring again to FIG. 6, while the skeletal frame structures 69*a* and 69*b* for each of the wall section subassemblies 12*a* and 12*b* are similar to the frame structure 69*c* that forms the general shape of section subassembly 12*b*, there are several differences. For instance, while frame structure 69*a* includes four generally vertical post members and three rail members that form the structure, only two of the posts 71 that form a side wall section of the subassembly 12*a* are substantially vertical and the other two posts 73 are angled rearward when moving from bottom to top ends. In addition, while each of posts 71 has a substantially uniform width dimension along its length, each of posts 73 has edges that define a tapering width that narrows when moving from bottom to top. Moreover, each of the posts 73 includes an extending section 75 that extends forward there from to form a distal extended edge on which a lounge mounting bracket 77 resides. The edges of posts 73 that are angled with respect to vertical result in wall structures or sections that are angled upon assembly as illustrated at 81 in FIG. 3. This arrangement saves space as space behind the lounge assembly backrest portion is wasted if the wall there behind is completely vertical. In addition to saving space, this arrangement results in an aesthetic which helps distinguish the overall assembly from a traditional cubical type arrangement.

Figure 6:
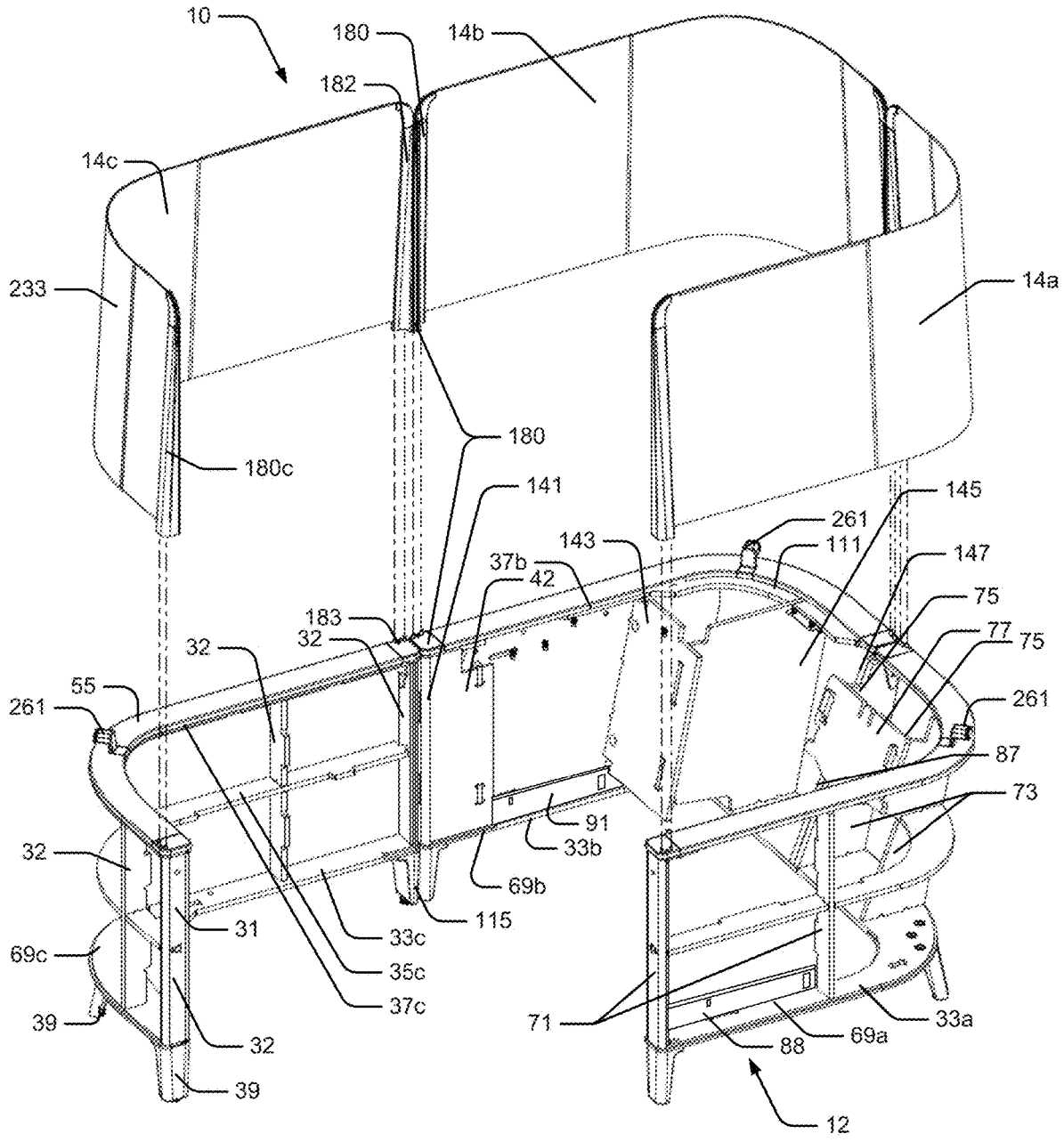
FIG. 6 is a partially exploded view of a subset of the components shown in FIG. 5.
Figure 6A:
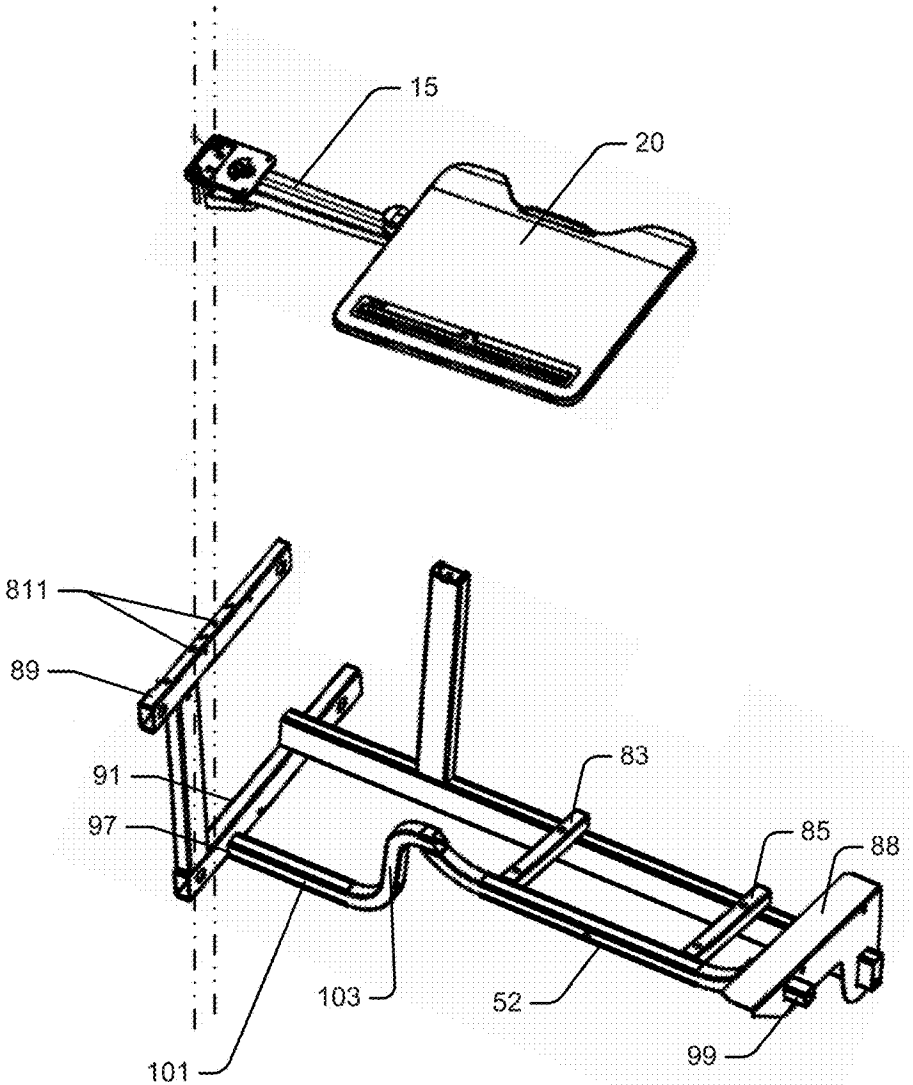
FIG. 6A is a partially exploded view showing a bridging support structure for shelving and a lounge assembly as well as the tablet support arm and tablet assembly shown in FIG. 1.
Figure 13:
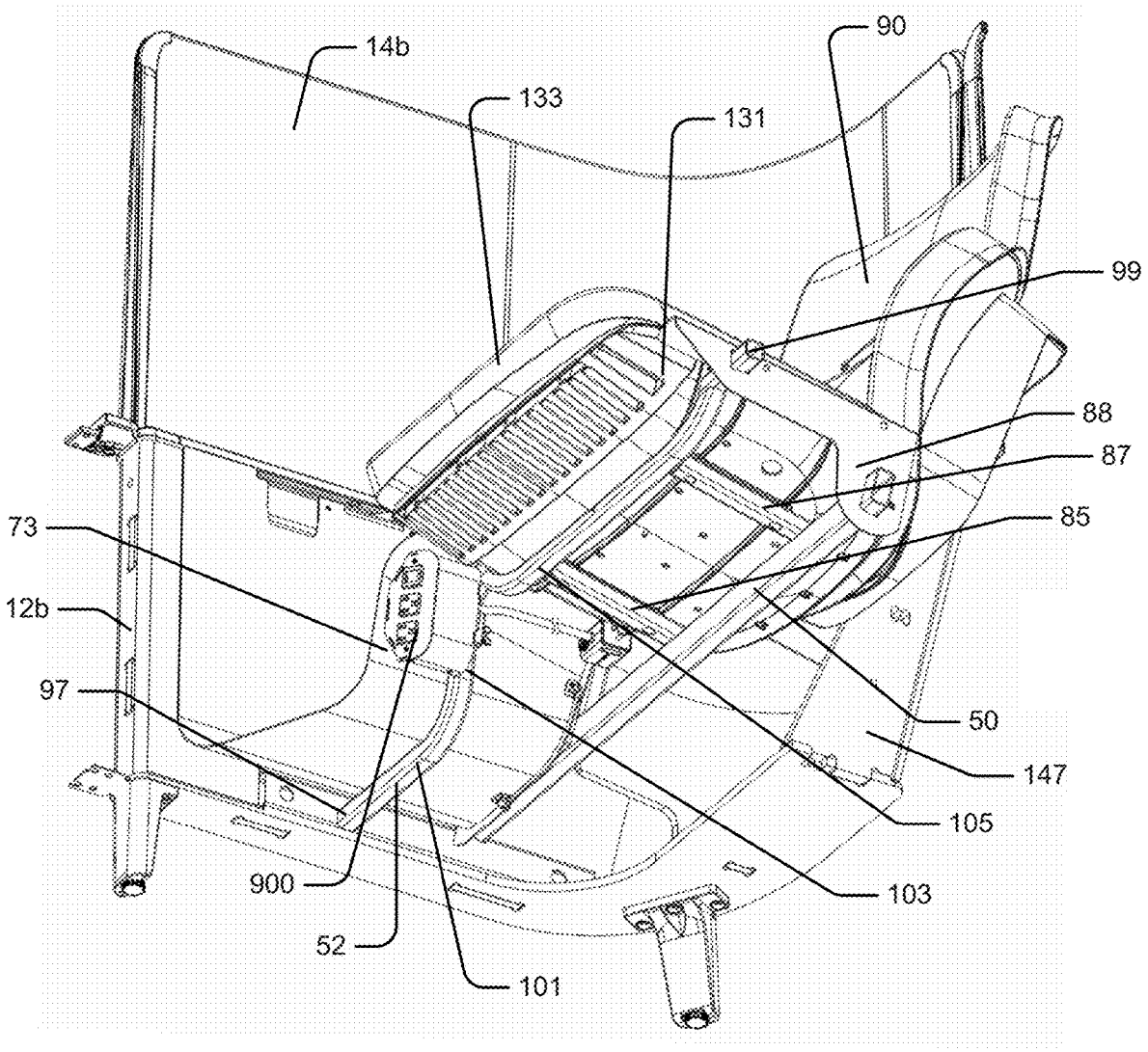
FIG. 13 is a view of the components shown in FIG. 12, albeit in an assembled configuration.

Referring still to FIG. 6 and now also to FIGS. 6A and 13, a rigid metal bracket 88 is mounted within frame structure 69*a* along the straight section of the lower rail member 33*a* that forms subassembly 12*a*. Bracket 88 is used to support additional rails that in turn support the lounge assembly 90 in a fashion described hereafter.

Referring again to FIG. 3, while some of the foot members (e.g., 39) extend substantially vertically along their length, each foot member 39 that supports one of the vertically angled wall sections is angled to further distinguish the arrangement from other space defining wall structures. For instance, each of foot members 39 may form an angle with vertical within a range of between 5 degrees and 30 degrees and in particularly interesting embodiments that angle will be substantially 15 degrees.

Referring again to FIGS. 5 and 6, frame structure 69*b*, includes four generally vertical members 141, 143, 145 and 147 and rail members 33*b* and 37*b* that form the structure. Here, end post 141 is generally vertically upright and has a shape similar to the shape of an end post 32 in structure 69*c* that post 141 is positioned next to upon installation. The other end post or member 147 (see FIG. 5) has angled front and rear edges that conform to the general shape of the member 73 in structure 69*a* (see FIG. 6) that post 147 is positioned next to upon installation. Each of members 143 and 145 is plate like and extends into the space formed by structure 12*b* generally. In this regard, plate 143 is angled slightly rearward between a bottom edge and a top edge and extends from a substantially vertical outer edge to an inner edge. Plate 145 extends forward from a rear edge that is angled with vertical to an inner edge 149 that is secured to the inner edge of plate 143. Plate 143 extends about 10 to 12 inches into the configuration space and plate 145 extends into the configuration space a similar distance.

Referring to FIGS. 6 and 8, top rail member 37*b* includes an extended edge section 111 which extends inward along the concave edge of the member 37*b*. See in FIG. 8 that the spacer cap 53 and finishing cap members 55 have widths that are substantially uniform along their lengths so that, when the cap members 53 and 55 are installed on top of member 37*b*, the extended edge portion 111 of member 37*b* extends outward from below the cap members.

Figure 11:
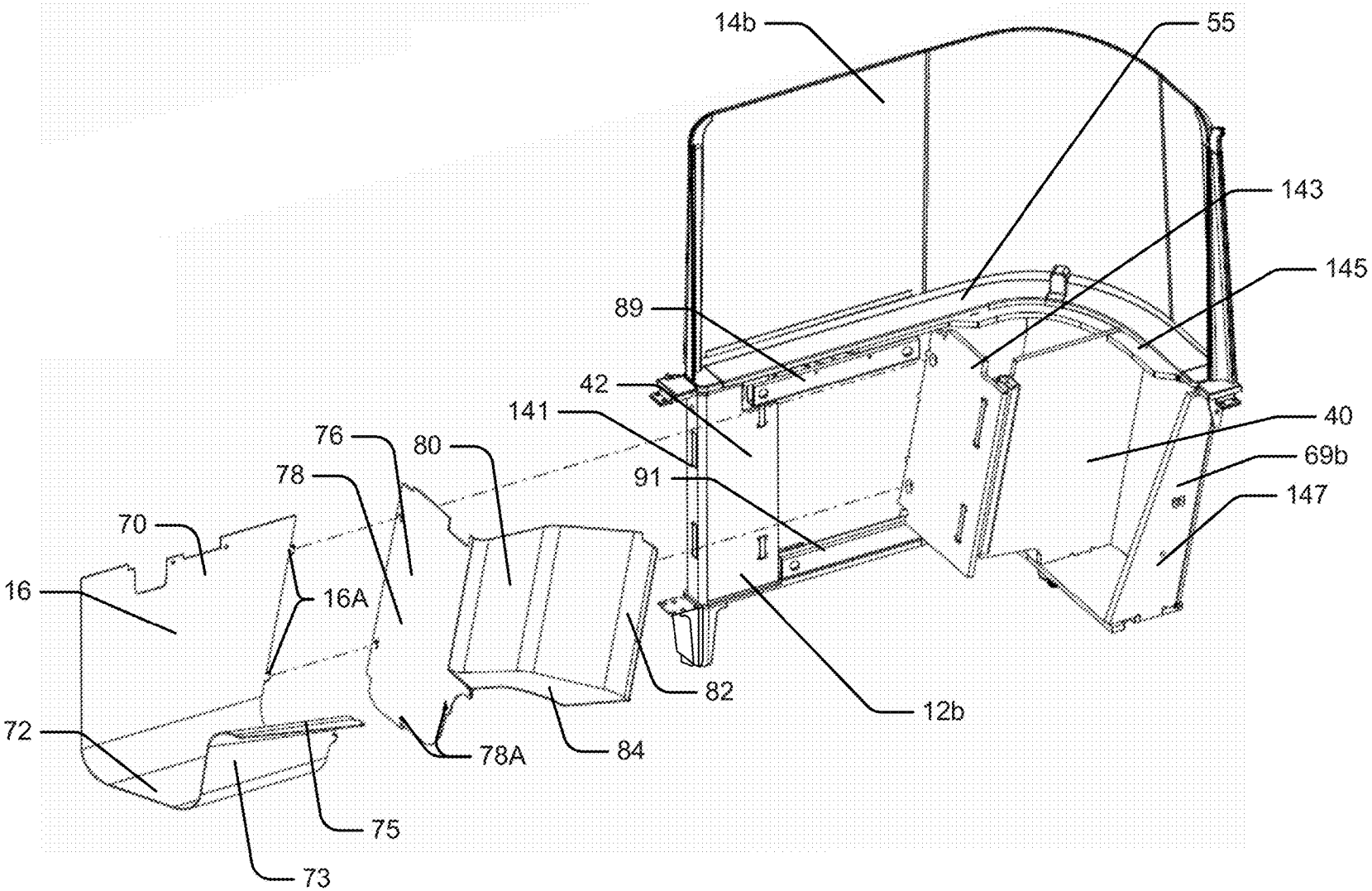
FIG. 11 is a partially exploded view showing components that comprise a lower wall assembly as well as an upper screen assembly.

Referring still to FIGS. 6 and 11, a rigid side plate member 42 is mounted within a straight lateral section of skeletal frame structure 69*b*. Plate member 42 may include a steel plate member or may be formed of some other metal or rigid material and serves as a robust foundational structure for mounting other components as described hereafter. Additional upper and lower horizontal rail members 89 and 91, respectively, are mounted within structure 69*b* generally along upper and lower ends thereof as best shown in FIGS. 6A and 11. Each of rail members 89 and 91 is formed of steel and may be mounted via welding, mechanical fasteners such as screws or rivets, etc.

To secure adjacent wall assemblies 12*a*, 12*b* and 12*c* to each other in an end to end fashion, dual leg and dual screen support bracket members are contemplated. To this end, see the exemplary dual leg member 115 shown best in FIG. 6 which, while appearing to be two legs, in fact is an integrally formed (e.g., molded or otherwise formed) member where the two leg sections are formed as a unitary piece. Here, the dual leg member 115 includes first and second plates at a top end, each of which forms holes for screws or bolts to pass through into undersurfaces of lower rail members 33*b* and 33*c* on adjacent frame structures 69*b* and 69*c*. Similarly, see the exemplary dual screen support bracket assembly 185 shown in FIGS. 6 and 7 that includes dual base member 183 where screws, bolts or other mechanical fasteners are used to secure dual member 183 to each of the upper rail members on adjacent frame structures 69*b* and 69*c* (see example in FIG. 8).

Figure 7:
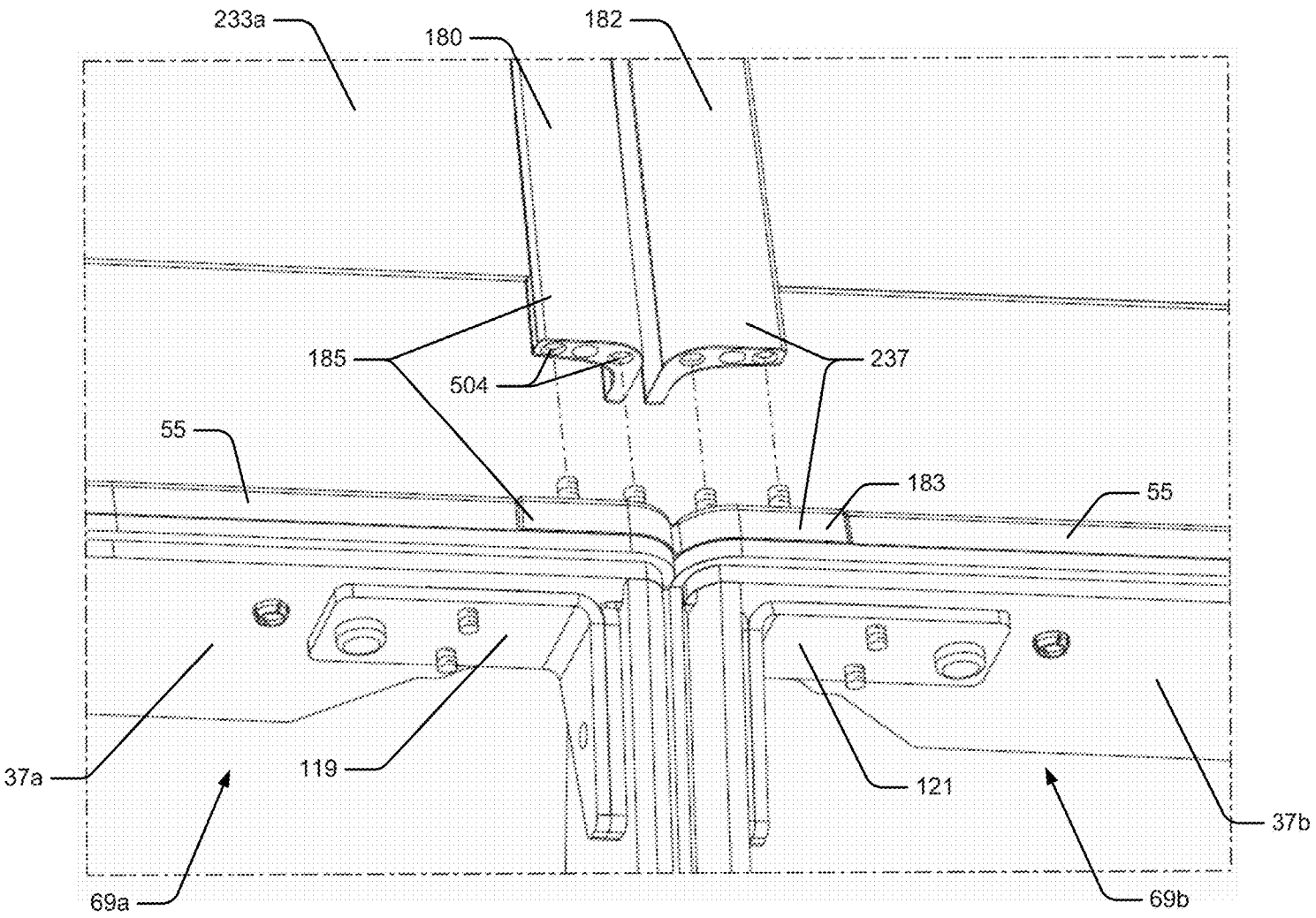
FIG. 7 is a perspective view of a subset of the components shown in FIG. 6.

Referring still to FIG. 7, to provide additional structural integrity to joined adjacent wall subassemblies 12*a*, 12*b* and 12*c*, internal L-shaped brackets 119 and 121 are provided within adjacent skeletal frame structures 69*a* and 69*b*, respectively. In FIG. 7, bracket 119 is mounted below upper rail 37*a* in structure 69*b* while bracket 121 is mounted below upper rail 37*b* in structure 69*b*. Screws or other fasteners (not shown) are provided that pass through rails 37*b* and 37*c* to connect brackets 119 and 121 to base member 183. Threaded apertures 504 are formed in the undersurfaces of screen support members 180*a* and 182*b* for receiving threaded shafts of bolts (see FIG. 8) to connect base member 183 to the support members.

Figure 5:
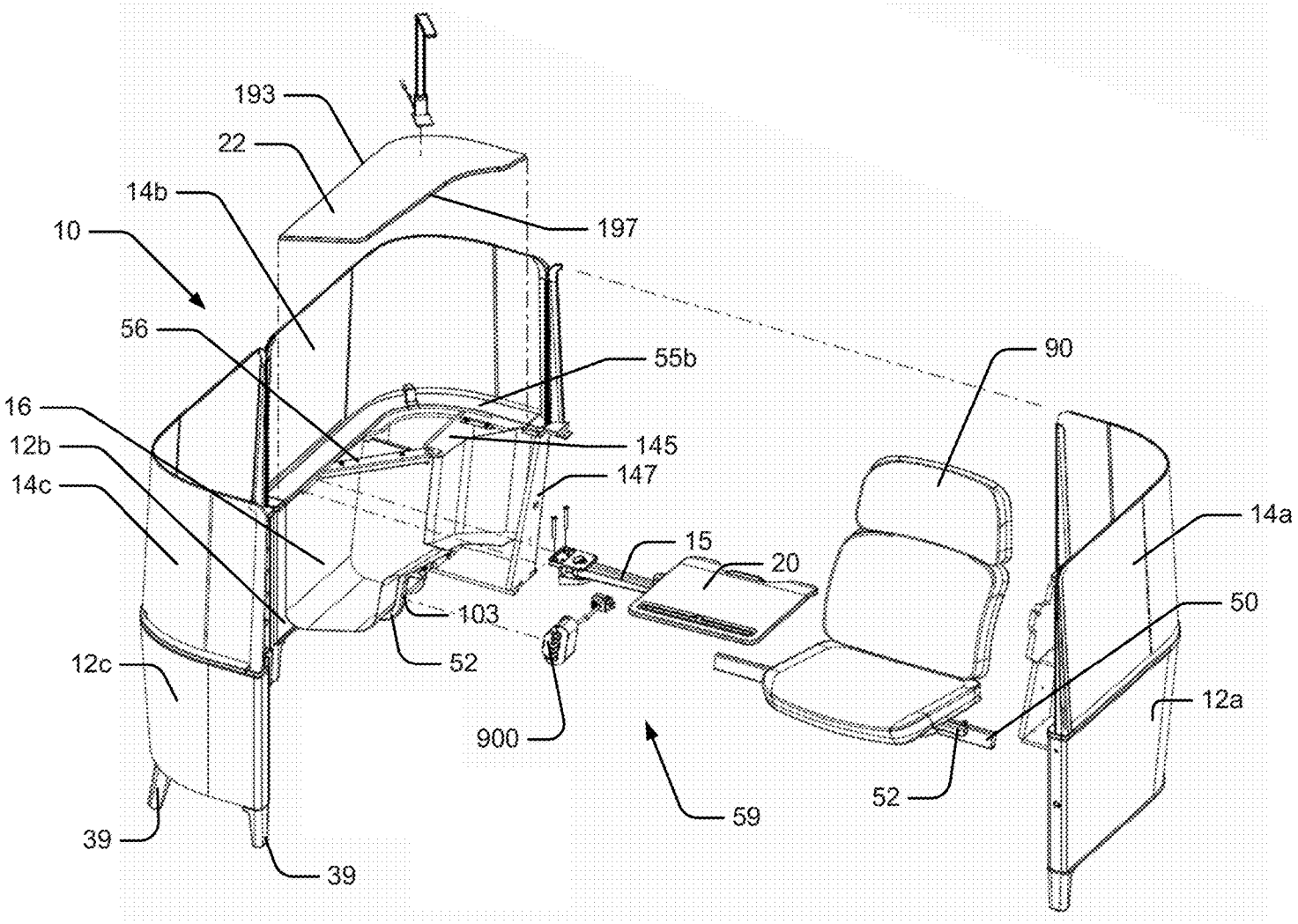
FIG. 5 is a partially exploded view of the workspace assembly shown in FIG. 1.
Figure 12:
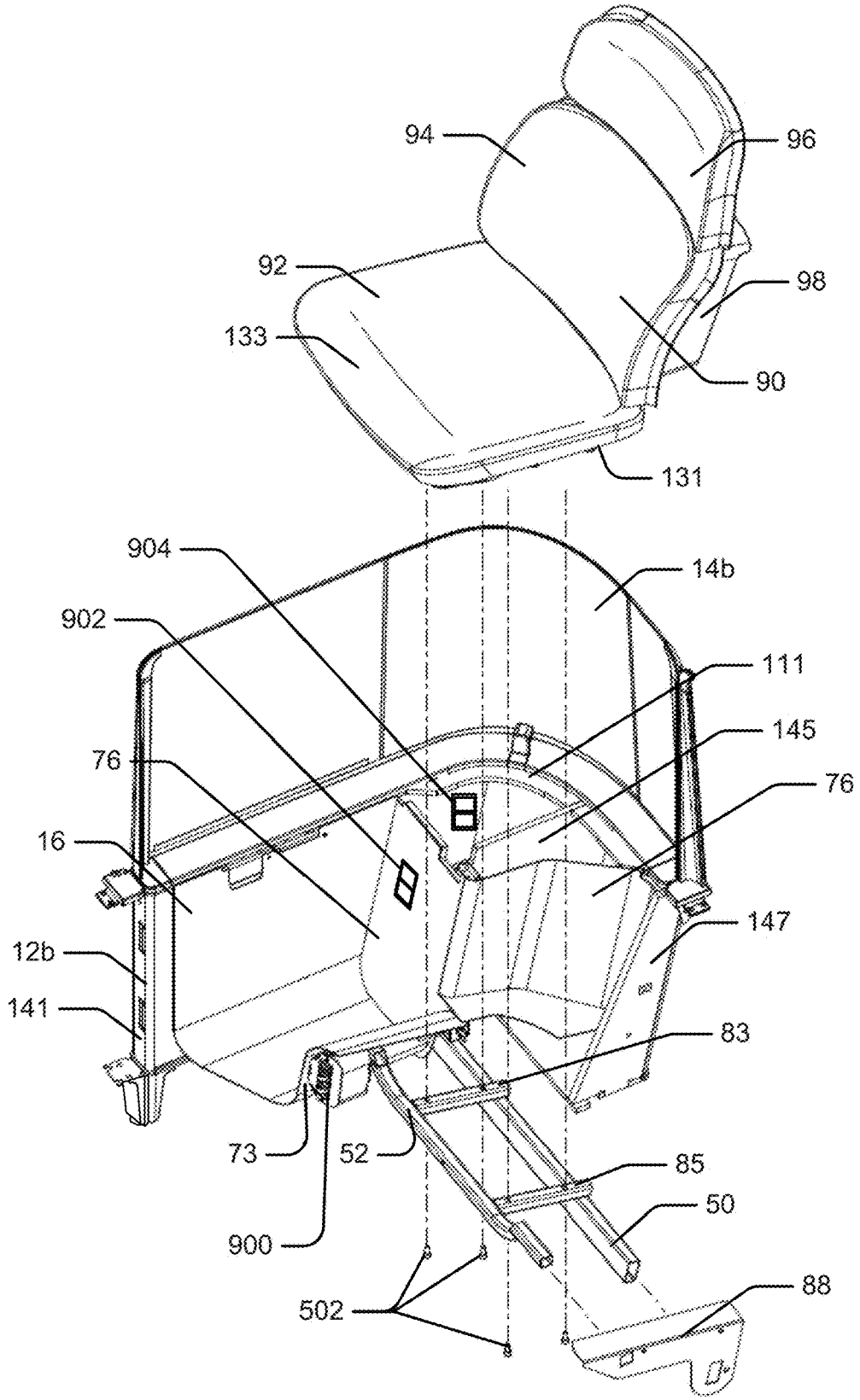
FIG. 12 is a partially exploded view showing a lounge sub-assembly, a lower wall sub-assembly and an upper screen sub-assembly that are consistent with at least some aspects of the present disclosure.

Referring to FIGS. 5, 6A and 12, a bridge assembly for supporting the lounge assembly 90 and other components includes first and second bar members 50 and 52. Each of the bars 50 and 52 is formed of rigid steel bar stock that has a substantially rectangular cross section which increases the rigidity of the bar along its length. Bar 50 is substantially straight and extends between rail members 91 and 88 (see FIG. 6A) and therefore between the wall subassemblies 12*a* and 12*b* (see FIG. 6). Bar 50 is located rearward of internal wall member 145 upon installation (see FIG. 12).

Bar 52 is not straight and instead is contoured to accommodate the lounge assembly 90 and other assembly components. To this end, bar 52 forms a top surface which is contoured to support undersurfaces of a shelf member 16 and a seat portion 92 of the lounge assembly 90, each of which resides at a different height upon installation. See again FIG. 1 that shows that seat 92 is generally at a height above the shelf member 16. To follow the contours of the undersurface of the shelf member 16 and the lounge 90, referring to FIGS. 6A, 12 and 13, bar 52 has opposite first and second ends 97 and 99 that extend in opposite directions along generally parallel trajectories. Moving from the first end 97 toward the second end 99, bar 52 includes a first straight horizontal section 101 that forms a top surface which contacts an undersurface of member 16 to support that member upon installation. Section 101 curves into a straight substantially vertical section 103 which extends upward generally to the height of an edge of a seat pan member and then curves downward and again back up into a second straight horizontal section 105 which forms a top surface that contacts the undersurface of the seat pan member to support that member upon installation. At the end of the second straight section 105 opposite substantially vertical section 103, member 52 curves upward and then into the second end 99 that extends horizontally. The first and second ends 97 and 99 are mounted to rail member 91 and 88, respectively (see again FIG. 6A) and therefore between the wall subassemblies 12*a* and 12*b* (see FIG. 6).

Figure 3:
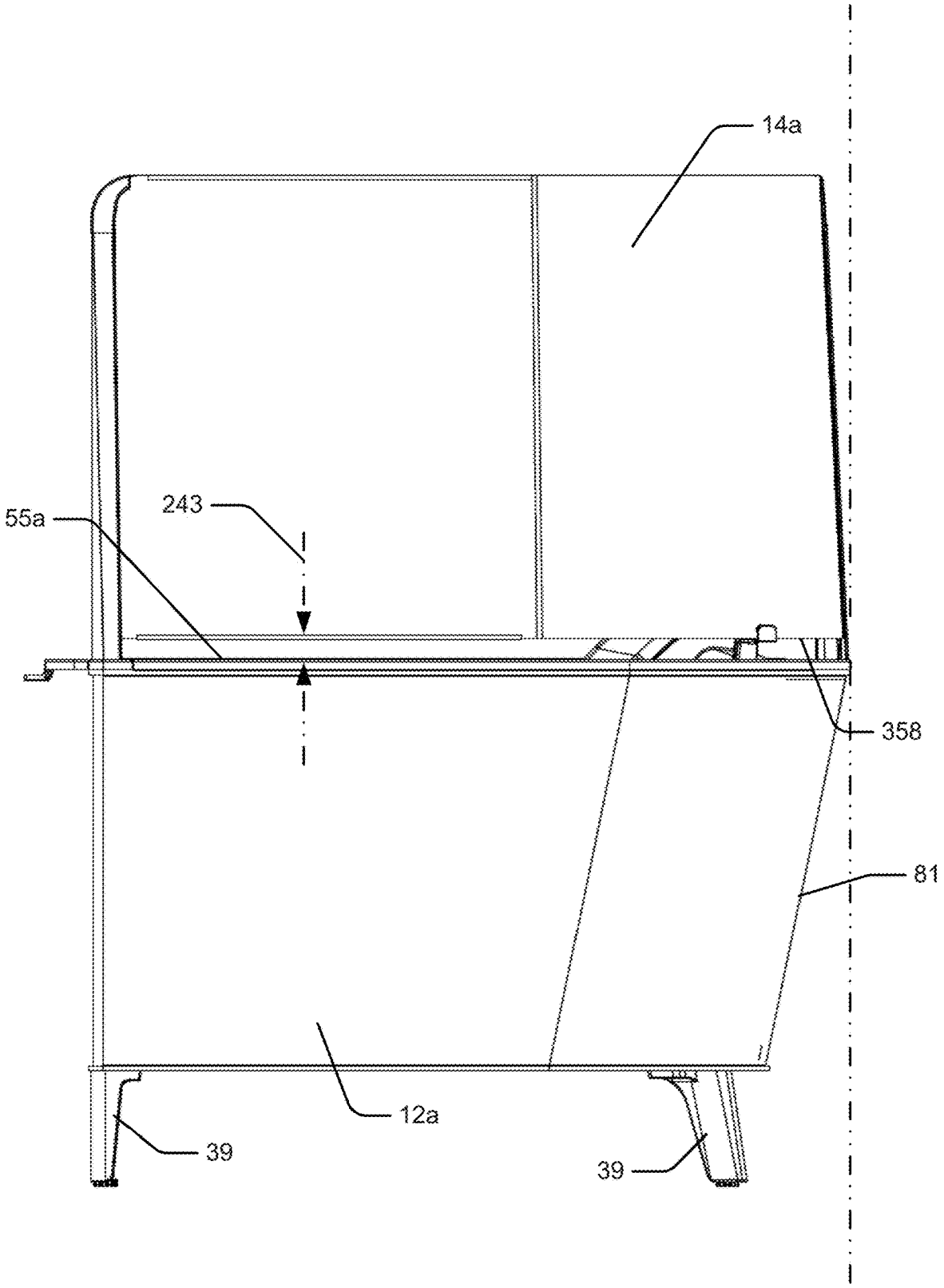
FIG. 3 is a side plan view of a portion of the assembly shown in FIG. 1.

Advantageously, referring to FIG. 3, once installed between wall assemblies 12*a* and 12*b*, each of bars 50 and 52 and components supported thereby reside completely above lower edges of the lower wall assemblies (e.g., 12*a*) so that no part thereof can be viewed from outside the configuration space. In addition, because bar 52 is contoured to follow the general shape of the lower surface of the seat pan member, bar 52 is tucked up tight against the lower surface of the seat pan and member 16 and an essentially unobstructed storage space 600 (see FIG. 1) is provided below the lounge assembly 90 and member 16. As shown in FIGS. 6A, 12 and 13, cross bar members 83 and 85 may be welded to or otherwise secured between intermediate portions of bars 50 and 52 to increase rigidity of the bridge assembly.

Referring again to FIGS. 11 and 12, a contoured finishing panel member 76 is provided to present a finished appearance and to seal off view of some of the support structure within the arrangement 10. To this end, member 76 is formed by bending sheet metal into a contoured shape that includes a front wall 78, an intermediate wall 80 and a wrapping rear wall 82 as well as a floor member 84. The front wall 78 is flat and is formed to cover a front surface of internal wall member 38. Front wall 78 curves into intermediate wall 80 that extends generally at a right angle from wall 78 and rearward along a surface of plate member 143 part way to the fame structure 69*b* upon installation. Intermediate wall 80 curves into rear wall 82 which is angled away from member 143 as it extends to the frame structure 69*b*. Floor member 84 extends from wall members 80 and 82 and generally away from plate member 143. Panel member 76 may be mounted to the supporting wall structures 143 and 145 and other frame structure via welding, mechanical fasteners or in any other suitable fashion. Panel member wall 78 forms slots 78A for receiving tabs 16A that extend from a rear edge of shelf member 16.

Figure 33:
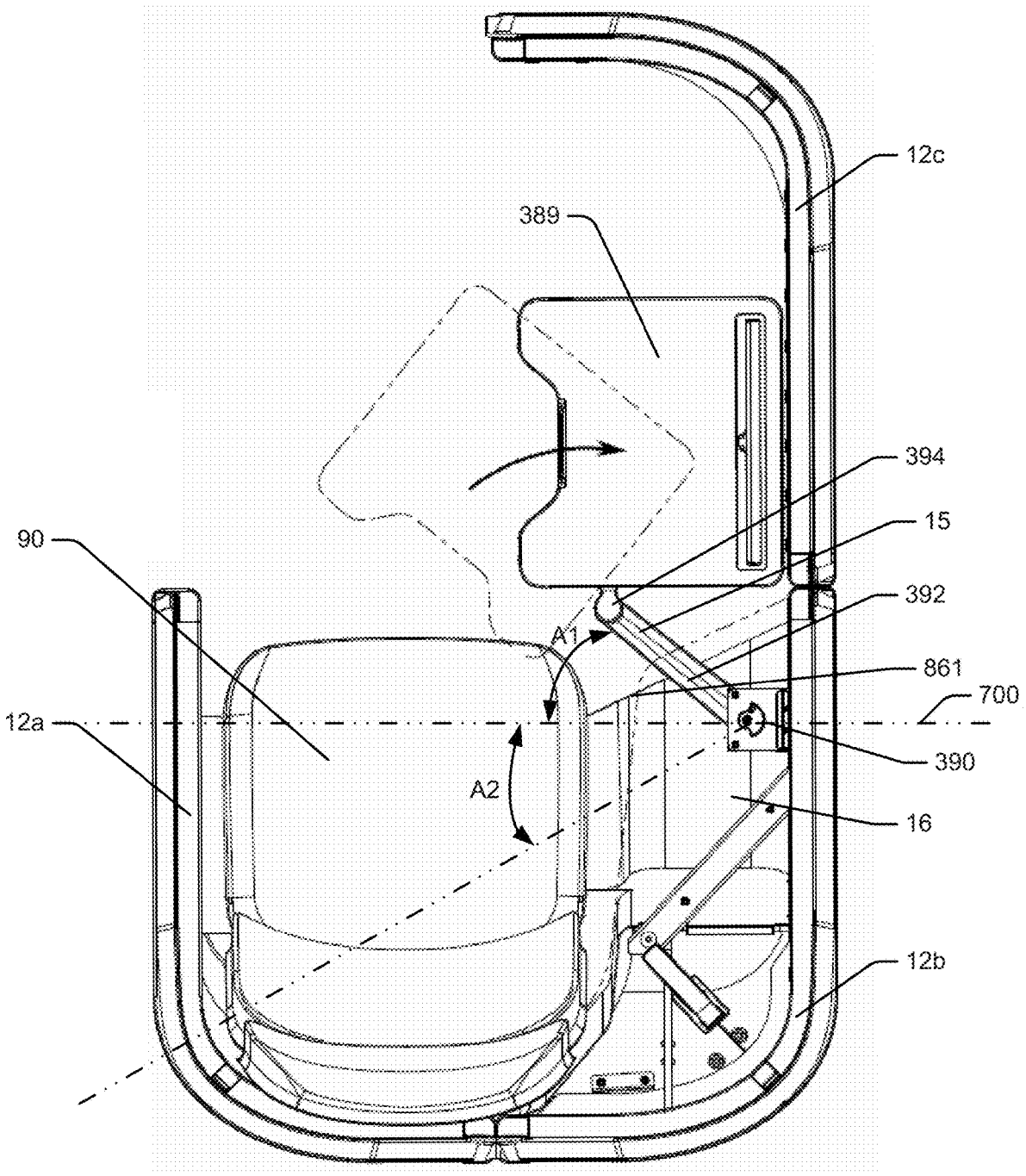
FIG. 33 is similar to FIG. 32, albeit showing the tablet and support arm in yet a different relative juxtaposition with respect to other components of the assembly.

Referring again to FIGS. 5 and 11 and now also to FIGS. 1 and 12, shelf member 16 is formed by bending sheet metal into a contoured shape that includes a first upright wall member 70 that includes a distal upper edge and that curves at a lower end into a first horizontal floor member 72. Opposite the first upright wall member 70, the first floor member 72 curves up and into a second upright wall member 73 that is generally opposite the first wall member 70. Opposite the first floor member 72, second upright wall member 73 curves into a horizontal end member 75. As shown, second wall member 73 has a height dimension that is only a fraction of the height dimension of first wall member 70. Wall member 73 extends from the level of member 72 to a height that is generally at or below (e.g., 1-2 inches) the height of the lounge seat 92 upon assembly (e.g., the seat 92 is at a higher level than floor member 72 upon installation). Tabs 16A align with slots 78A in wall 78. As best seen in FIG. 33, a front edge 861 of shelf member 16 is angled rearward from a lateral end toward the lounge 90. In at least some cases, the angle of front edge 861 may be substantially identical to the angle formed by the front edge portion of the side work surface member (see phantom in FIG. 33).

Shelf member 16 can be mounted to frame assembly 69*b* and the top surface of bar 52 in any manner including via screws, bolts, tabs and slots or any other type of mechanical fastener or via welding or other joining processes. Once installed, an outer surface of member 70 is generally adjacent an inner surface of plate 42 extending from just under the finishing cap 55 down to bar 52 and an undersurface of member 72 contacts or is very close to an upper surface of bar 52. Wall member 73 extends up bar section 103 to give the shelf surface a curved finished appearance.

Referring to FIGS. 1, 5 and 12, lounge assembly 90 includes a seat subassembly 92 and a backrest subassembly 89. Seat subassembly 92 includes a seat pan member or structure 131 and a cushion structure 133 (e.g., foam and a fabric cover) mounted to the top thereof. Pan member 131 includes a molded plastic integral single member that has a generally contoured undersurface which is convex downward and forms a convex upward surface for receiving and supporting cushion structure 133. Cushion structure 133 defines an upper shape that is contoured to support a user's buttocks as is known in the seating industry. Again, the upper surface of bar section 52 is contoured to follow the general shape of the undersurface of pan member 131. Seat assembly 92 is mounted via mechanical fasteners (e.g., see screws 502 in FIG. 12) to the top surfaces of bars 50 and 52 between lower shelf member 16 and wall subassembly 12*a* (see FIG. 1).

Figure 14:
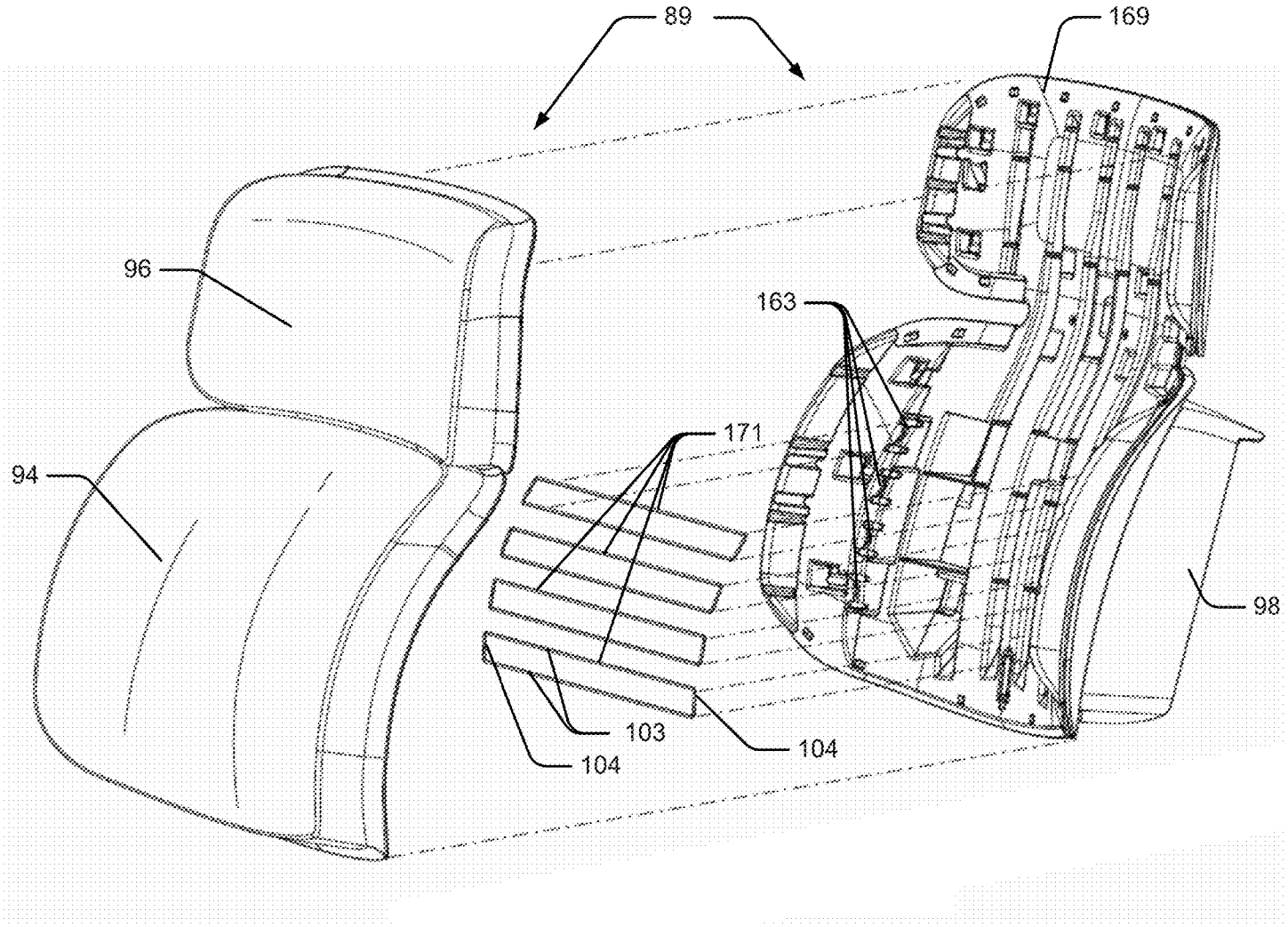
FIG. 14 is an exploded perspective view of the lounge sub-assembly shown in FIG. 12.
Figure 15:
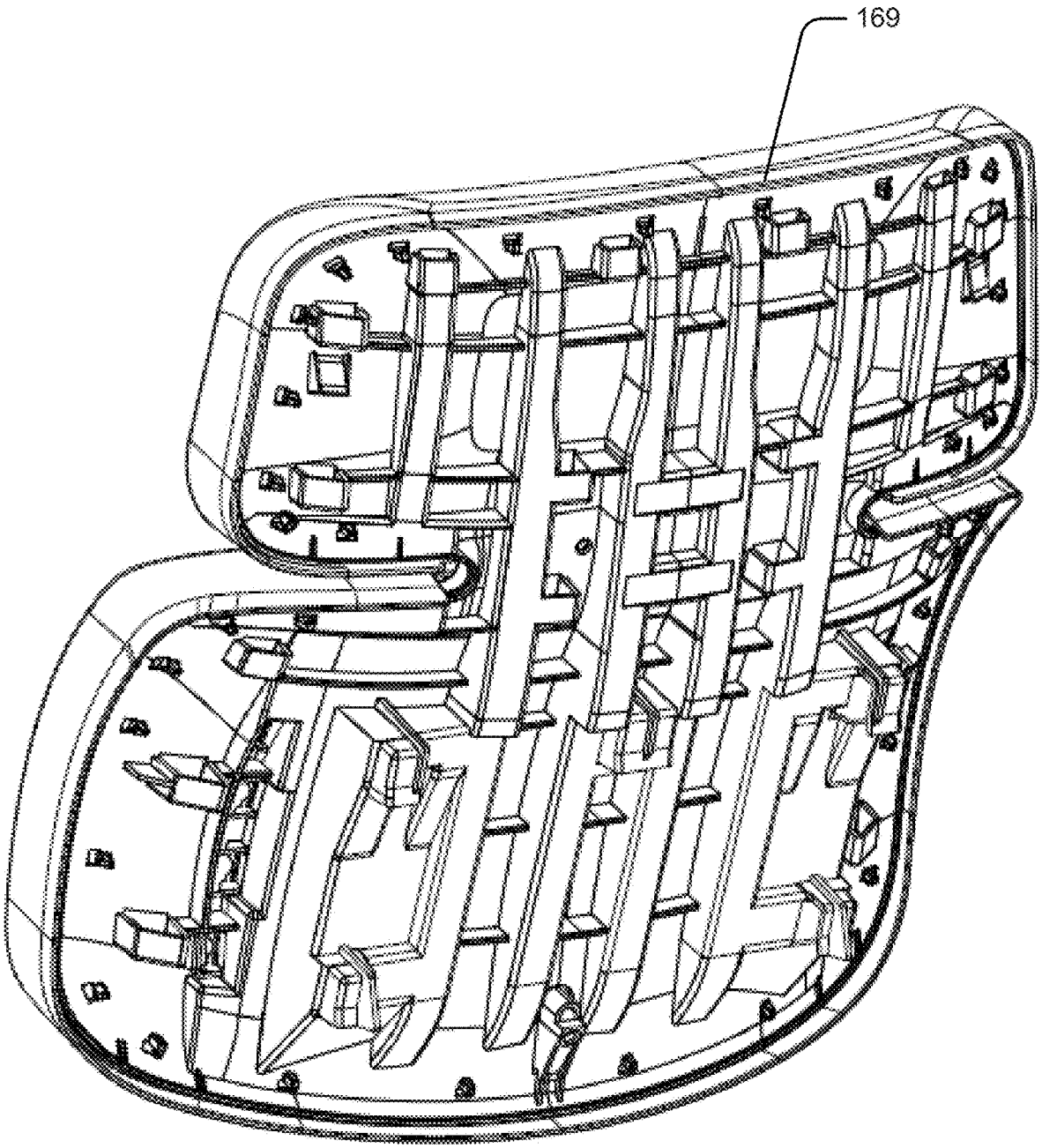
FIG. 15 is a rear perspective view of the backrest sub-assembly shown in FIG. 14.

Referring to FIG. 14, backrest subassembly 89 includes a backrest pan or shell or pan member 169, a shroud member 98, a plurality of spring members 171 and a cushion assembly including a lumbar section 94 and an upper backrest section 96. Pan member 169 includes a molded plastic integrated single member that forms a contour that is concave forward generally along a height dimension, is convex forward along a central line along a lumbar area, is concave forward along a central line through a neck region and is generally flat along an upper section along a central line. Spring members 171 are attached to pan member 169 within the lumbar region to provide resilient lumbar support as described in greater detail hereafter. The cushion assembly 94/96 is mounted to a front surface of the pan member 169 over the spring members 171 to provide a finished surface. The cushion subassembly may include a foam material formed into a desired shape as well as a fabric cover. Techniques for mounting a cushion assembly to a pan member are well known in the art and therefore will not be described here in detail.

Referring again to FIGS. 12 and 14, shroud member 98 is an assembly that mounts to the rear of pan member 169 and extends rearward there from. In at least some embodiments shroud member 98 forms a passageway (not shown) for hiding bracket 77 and the extending portions 75 (see FIG. 6) of post members 73 after the backrest shell 169 is mounted to supporting lower wall assembly 12*a*. The shroud member 98 may be molded out of plastic or formed via bent sheet metal.

Referring again to FIG. 14, a front edge of shroud member 98 mounts to the rear surface of shell member 169 and extends backward there from. In addition, referring to FIG. 6, bracket 77 mounts to the rear surface of shell 169 within the space formed by shroud member 98. Once installed, as seen in FIGS. 1, 5 and 13, backrest assembly 89 extends generally upwardly from the rear edge of the seat assembly 92. The shape of the backrest assembly 89 is such that the lumbar section 94 angles generally rearward from a lower end to an upper end while the upper back section 96 angles slightly forward or is generally vertical. With this general shape, an arrangement user is positioned in an optimal position for focused work with shoulders rolled slightly forward by the contour of the supporting surface of the lounge assembly.

Figure 16:
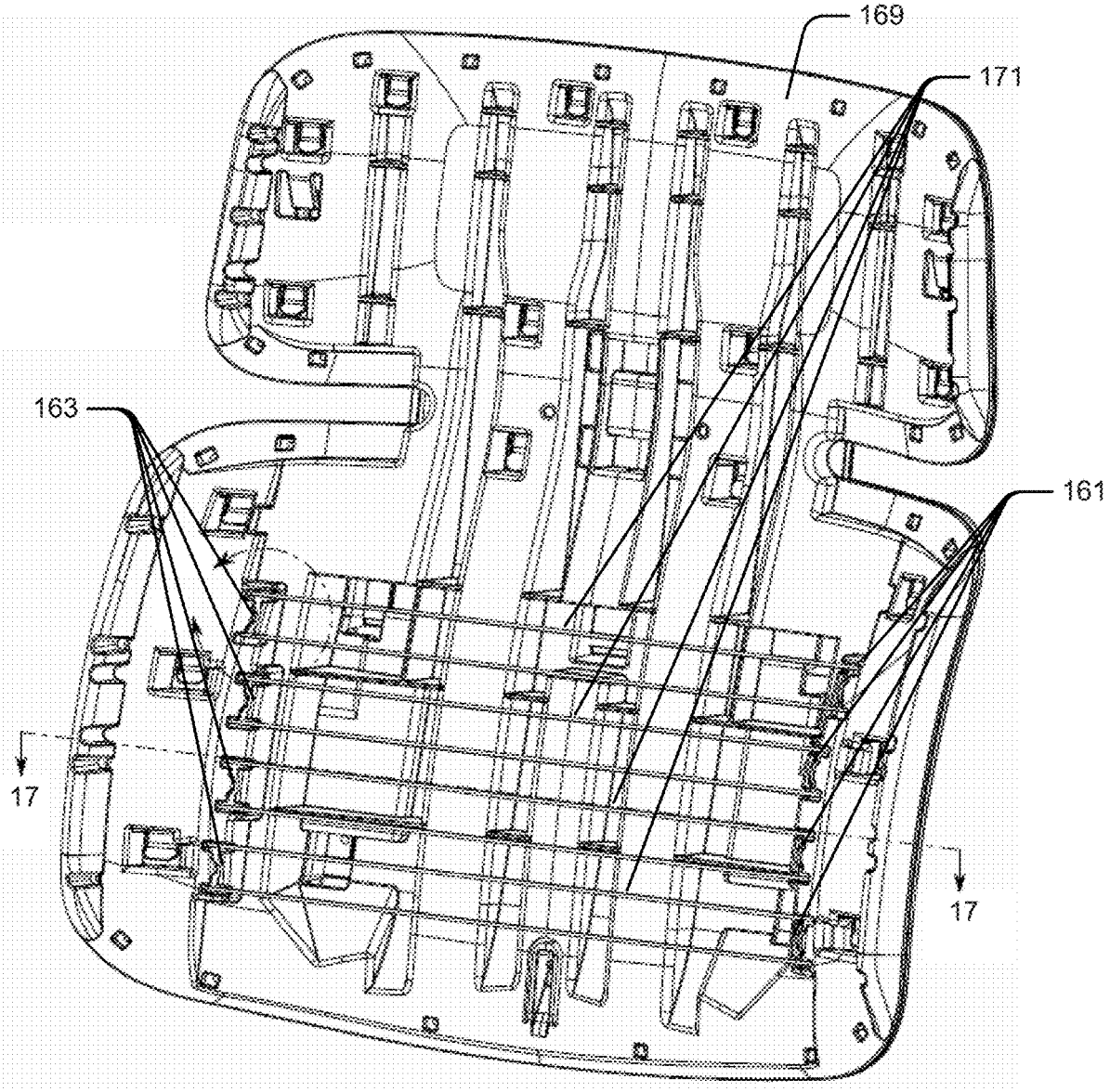
FIG. 16 is a front perspective view of the backrest sub-assembly shown in FIG. 15.
Figure 17:
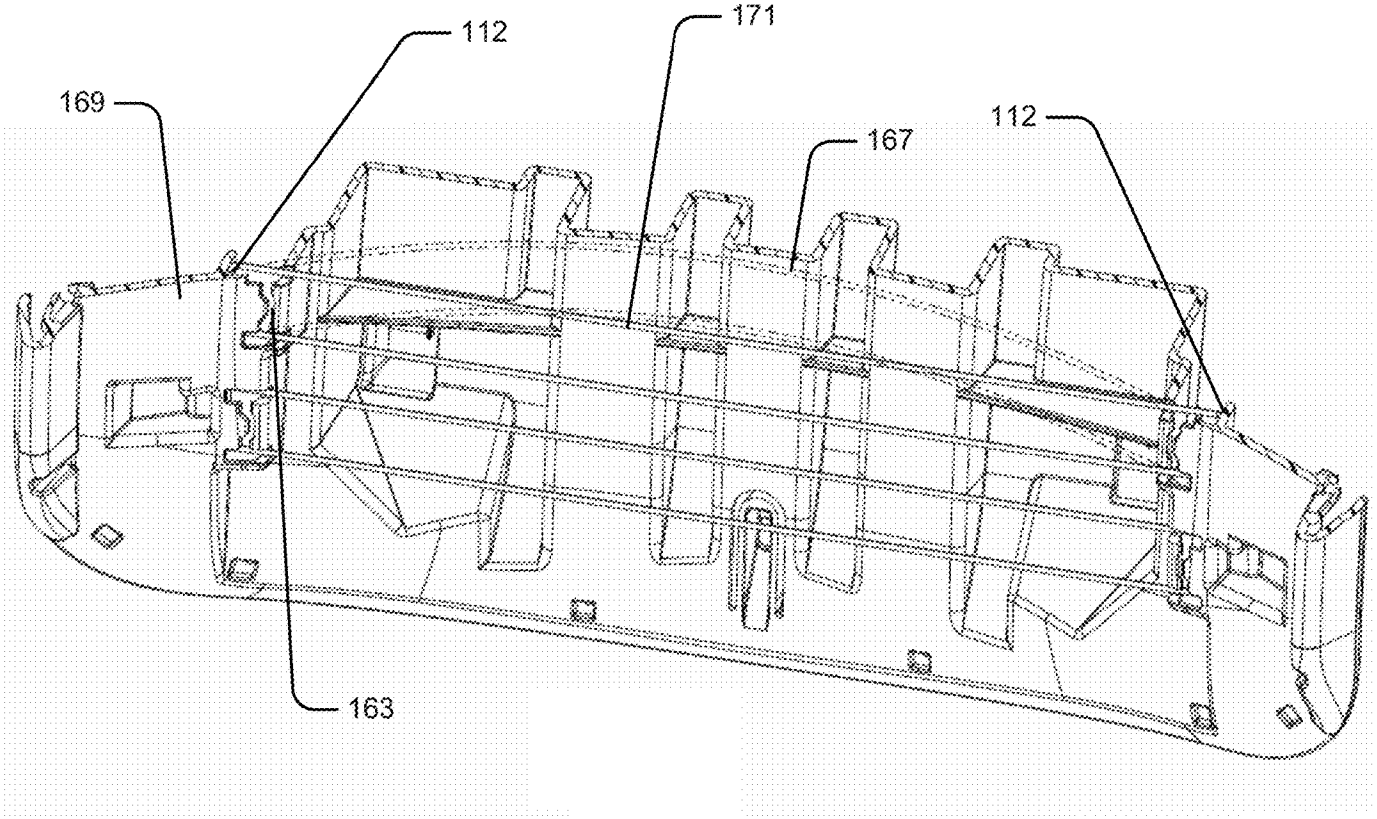
FIG. 17 is a cross-sectional view taken along the line 17-17 in FIG. 16.
Figure 18:
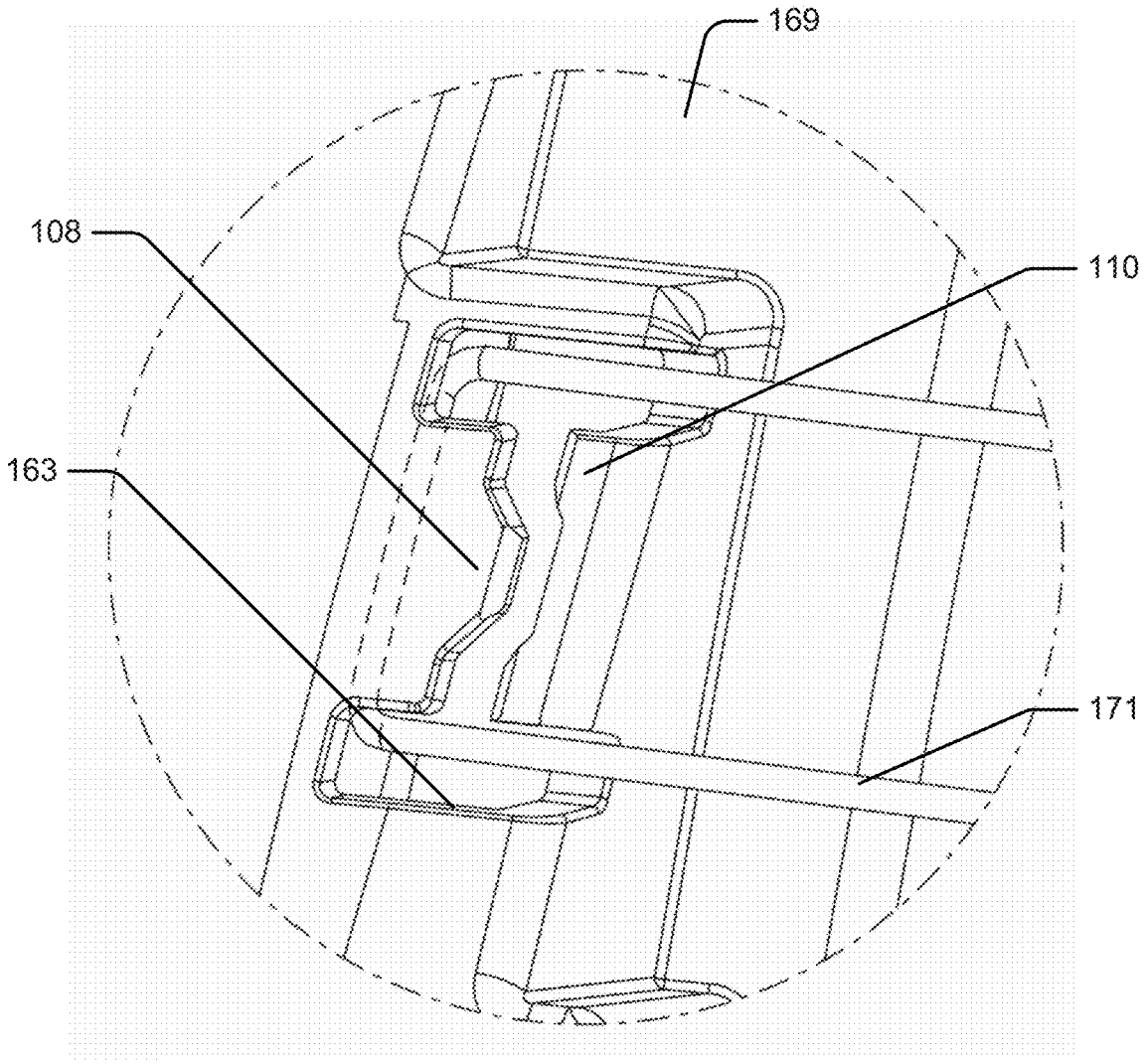
FIG. 18 is a close-up perspective view of the end of a backrest spring member received within a slot.

Referring again to FIG. 14 and also to FIGS. 16 through 17, each spring member 171 forms a rectangular spring loop having first and second ends at opposite ends of a length dimension. Each loop 171 is received in the molded plastic back shell or pan member 169. At a lumbar region, the shell 171 forms eight slots including four slots 161 vertically aligned along a left side and four similar slots 163 vertically aligned along a right side. Referring to FIG. 18, each slot includes a gap between tabs 108 and 110 for installing one end of one of the spring loops and for retaining the end of an installed loop during movement of the loop. Referring now also to FIG. 17, within each slot, the shell member 169 forms a bearing surface 112 for restricting an end of one of the spring loops 171 upon installation.

Referring again to FIG. 14, each loop 171 is similarly constructed and therefore only one loop will be described here in detail. An exemplary loop 171 includes two generally vertical end members 104 and two elongated and parallel horizontal members 103 that extend between the end members 104. Each loop 171 is formed of a flexible material such as steel so that the loop 171 can be bent when a load is applied, but returns to its original shape when the load is removed. The end members 104 are dimensioned to be received within slots 161 and 163.

Although not shown, a Duon or other fabric backer layer may be applied to a rear surface of the lumbar cushion member 94 where the cushion member contacts the spring loops 171 upon installation. The backer layer may provide a relatively rigid surface for the lumbar wires 171 to press against when a force is applied, and protects the rear surface of cushion 94 from the loops 171. The backer may be adhered to or otherwise attached to the foam member.

Referring still to FIGS. 14 and 16 though 18, to attach the spring loops 171 to the shell 169, one end of a first loop 171 is worked into a slot 161 and is generally retained therein by the tabs 108 and 110 unless affirmatively worked out of the slot. The second end of the first loop is similarly worked into a slot 163 on the opposing side of the shell 169. After the spring loop 171 is installed, as seen in FIGS. 14 and 17, end member 104 contacts bearing surface 112 on either side of the shell 169 so that the loop 171 is slightly loaded and stressed and each member 104 is, when not deformed by a force applied to the chair, retained by an adjacent tab 108. The pre-stress on each loop causes the loop to be "live" and ready to provide support as opposed to being loose after installation. The loading also results in a support structure where the loop 171 does not move around after installation and therefore that is relatively less noisy than a configuration where the loops are not live and loaded. The other spring loops are installed in the same fashion.

After loops 171 are installed, lumbar foam cushion assembly 94 can be installed with the backer pressed against loops 171. In addition, upper cushion assembly 96 is installed and fabric (not shown) is applied or installed over the cushions and the shell member 89 to finish off the configuration.

In operation, as shown in FIG. 17, when no force is applied against the backrest structure, the spring loops 171 are in the live state under some stress between bearing surfaces 112 and ends 104 are retained by tabs 108 (see FIG. 18). When a force, such as a person sitting back against the structure, is applied, each spring loop 171 operates independently of the others and is flexed as shown by phantom loop 167 in FIG. 17. The distal ends 104 of a flexed loop 171 slide inward but are retained under surfaces of tabs 108 from moving out of the retaining slot (e.g., tabs 110 operate like retaining hooks to restrict movement of the loops 171 out of the slots 161 and 163). When the person leans forward and away from the lumbar support, each spring loop returns to its original pre-loaded state.

Referring again to FIGS. 5 and 19, a brace support member 56 is mounted at one end to upper rail member 37*b* of the wall assembly 12*b* and at a second end to a top end of the wall member 145. Support member 56 is a rigid steel bar member and provides additional support for plates 143 and 145. Member 56 also forms a substantially flat and horizontal upper surface that contacts and supports the undersurface of side work surface member 22 after installation. Member 56 may be connected at opposite ends to the other structure via any type of suitable mechanical fasteners (e.g., screws, bolts, etc).

Figure 19:
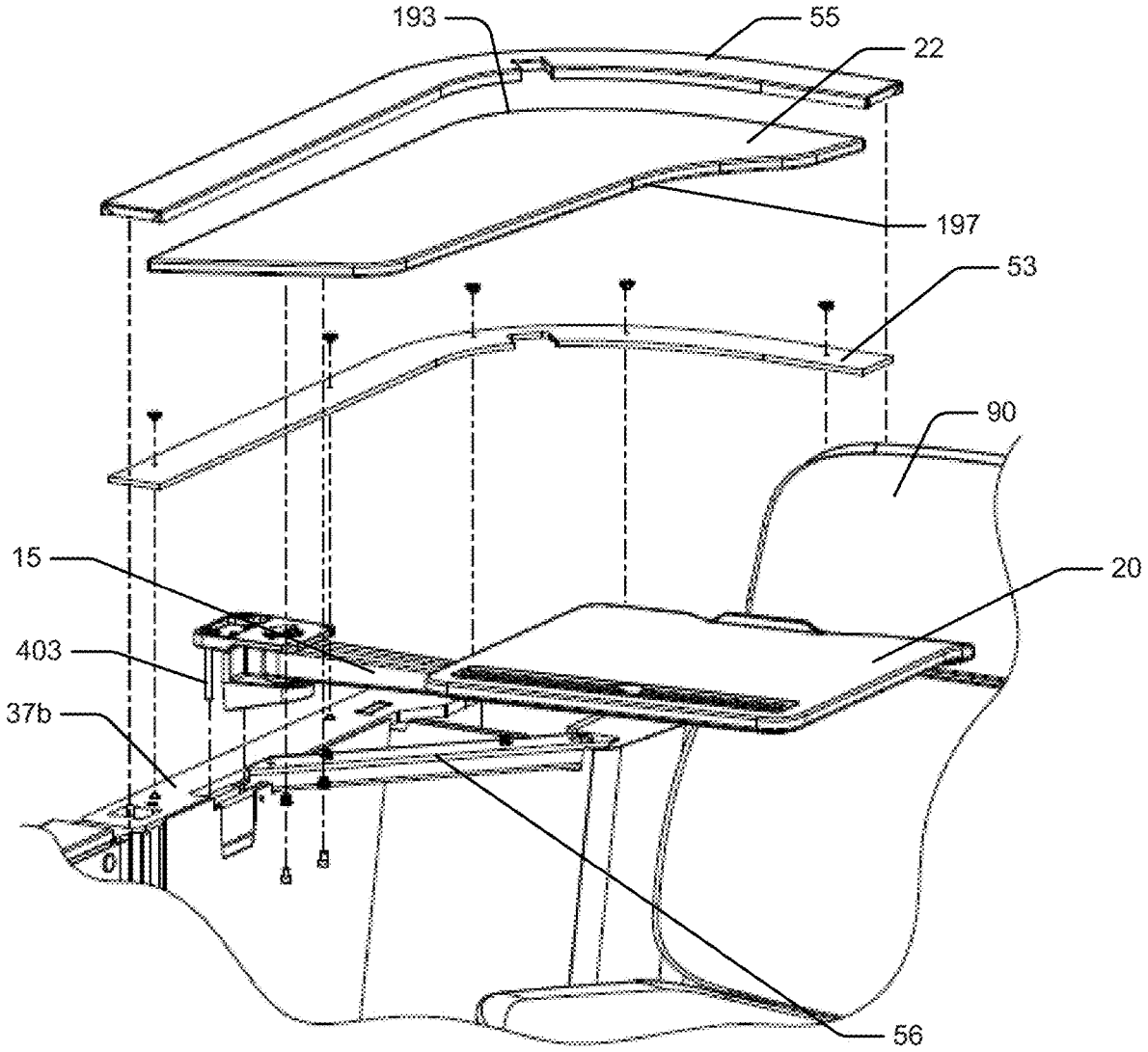
FIG. 19 is a partially exploded view of a subset of the components that comprise the assembly shown in FIG. 1.

Referring still to FIGS. 5 and 19, upper shelf member or side work surface member 22 includes a rigid flat member that has an outer edge 193 and an inner edge 197. The outer edge 193 defines a shape that mirrors the shape of an inner edge of the cap member 55 (see also FIGS. 1 and 4) so that the outer edge butts up against an inner edges of the cap member 55 along the entire outer edge 193 length. To this end, the outer edge includes front and rear sections that extend along trajectories that form a substantially right angle and an intermediate portion that curved between the front and rear sections. The inner edge 197 generally starts at and extends rearward from a front end of the outer edge to form an acute angle and then curves rearward to a greater degree along an intermediate portion thereof which forms a smaller acute angle (e.g., within the range of between 5 and 20 degrees) with the outer edge. At a rear end, the inner edge 197 curves back away from the outer edge and intersects the outer edge at a rear distal end. A front edge portion of the inner edge that intersects the outer edge forms an acute angle with the outer edge that is within a range between 40 degrees and 80 degrees and, in a particularly advantageous embodiment, is within a range between 55 and 65 degrees. The intermediate portion of the inner edge is substantially straight. The rear portion of the inner edge forms an acute angle with the outer edge that is within a range between 15 and 40 degrees and, in particularly advantageous embodiments, forms an acute angle within a range between 30 and 35 degrees.

To install side work surface member 22, the member is placed on top of brace support member 56 and the extended edge portion 111 of the upper rail member 37*b* (see again FIGS. 6 and 12. Then, screws or bolts are used to secure the top member 22 via holes through support member 56. Member 22 has a thickness dimension that is substantially equal to the combined thickness of the cap members (e.g., 53 and 55) so that, after being installed, the top surface of member 22 is substantially flush with the top surface of the finishing cap member 55 and member 22 appears to float within the space adjacent the cap member 55.

Referring again to FIG. 4, after lounge assembly 90 and the side work surface member 22 are installed, when the arrangement 10 is viewed in top plan view, there is a space 215 or gap that occurs between a side edge 213 of the lounge assembly 90 and the inner edge 197 of the side work surface member 22. The gap 215 is useful as it makes it relatively easier for an arrangement user to access materials below the work surface member 22 while seated in the lounge chair. For instance, if an arrangement user places an open book bag on the top surface of shelf member 16 below member 22 resting on the side edge 213 of lounge assembly 90, the additional gap clearance 215 enables the user to reach down and access materials in the open bag relatively easily.

Referring still to FIG. 4, the angled intermediate portion of inside edge 197 opens forward within the space 59 and therefore provides a relatively open feel to the space in general and makes it easier for a person to assume a position on the lounge chair 90. The top surface of member 22 is at the same height as the top surface of the finishing cap 55*b* that caps off wall subassembly 12*b*. In at least some embodiments the height of the tops surface of the finishing cap surface is within a range between 20 inches and 30 inches and in a particularly advantageous embodiment the height is approximately 24 inches. At 24 inches, the top surface of the top cap is at a typical arm rest height and therefore, if desired, a lounge user can rest her forearms on the top surfaces of member 22 and cap 55*a* while seated in the lounge chair. In at least some embodiments, as shown in FIG. 4 and as described in greater detail below, screen members (e.g., 14*b* in FIGS. 11 and 12) have an internal surface that is spaced from an inner edge of the top caps (e.g., 55) so that, even when a screen is mounted to and extends upward form the top surface of a cap 55, the inner portion of the top cap is open upwardly to support a lounge user's arm if desired.

Figure 20:
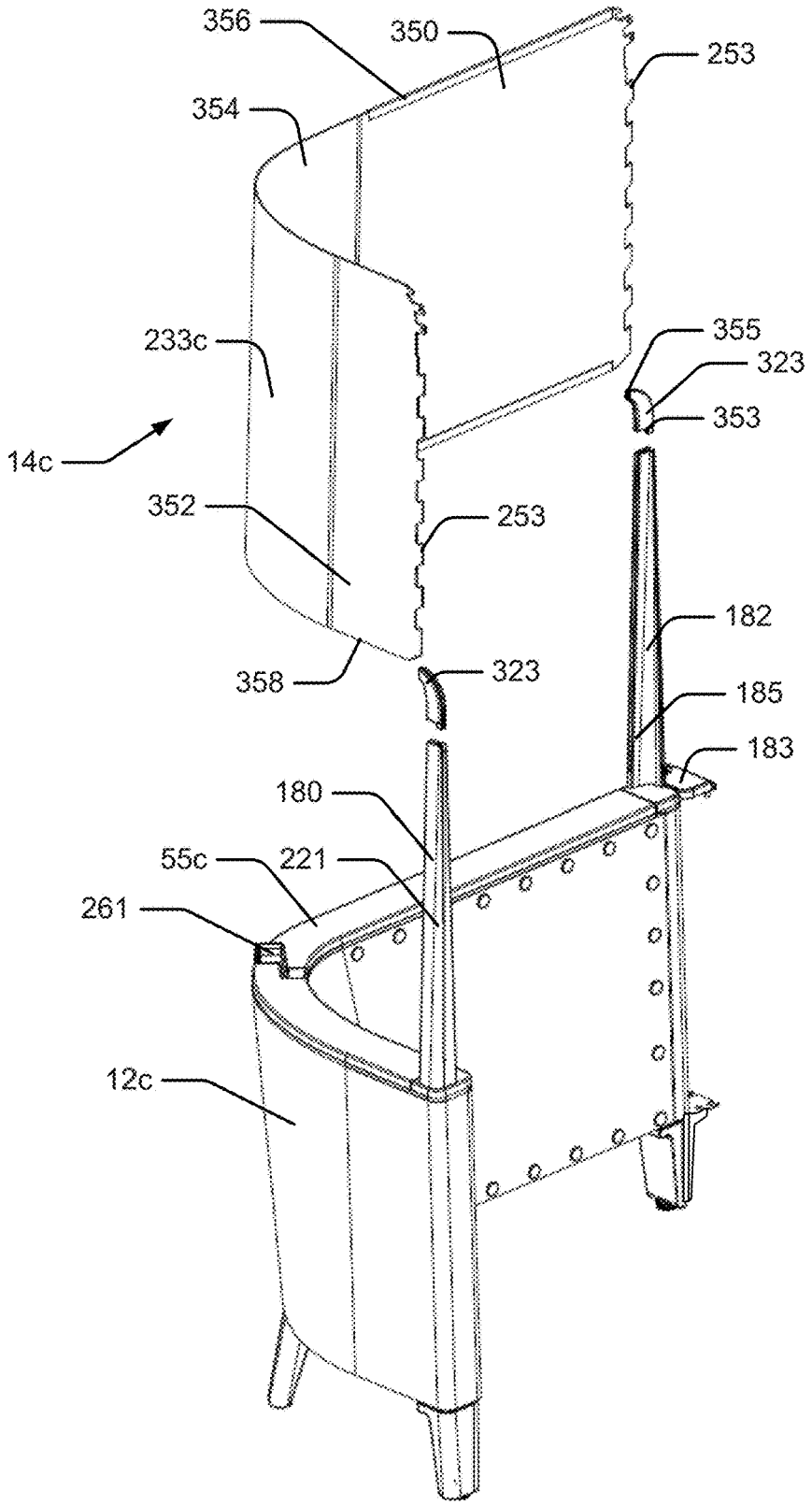
FIG. 20 is a partially exploded perspective view of a lower wall assembly and an upper screen assembly that form part of the assembly shown in FIG. 1.
Figure 21:
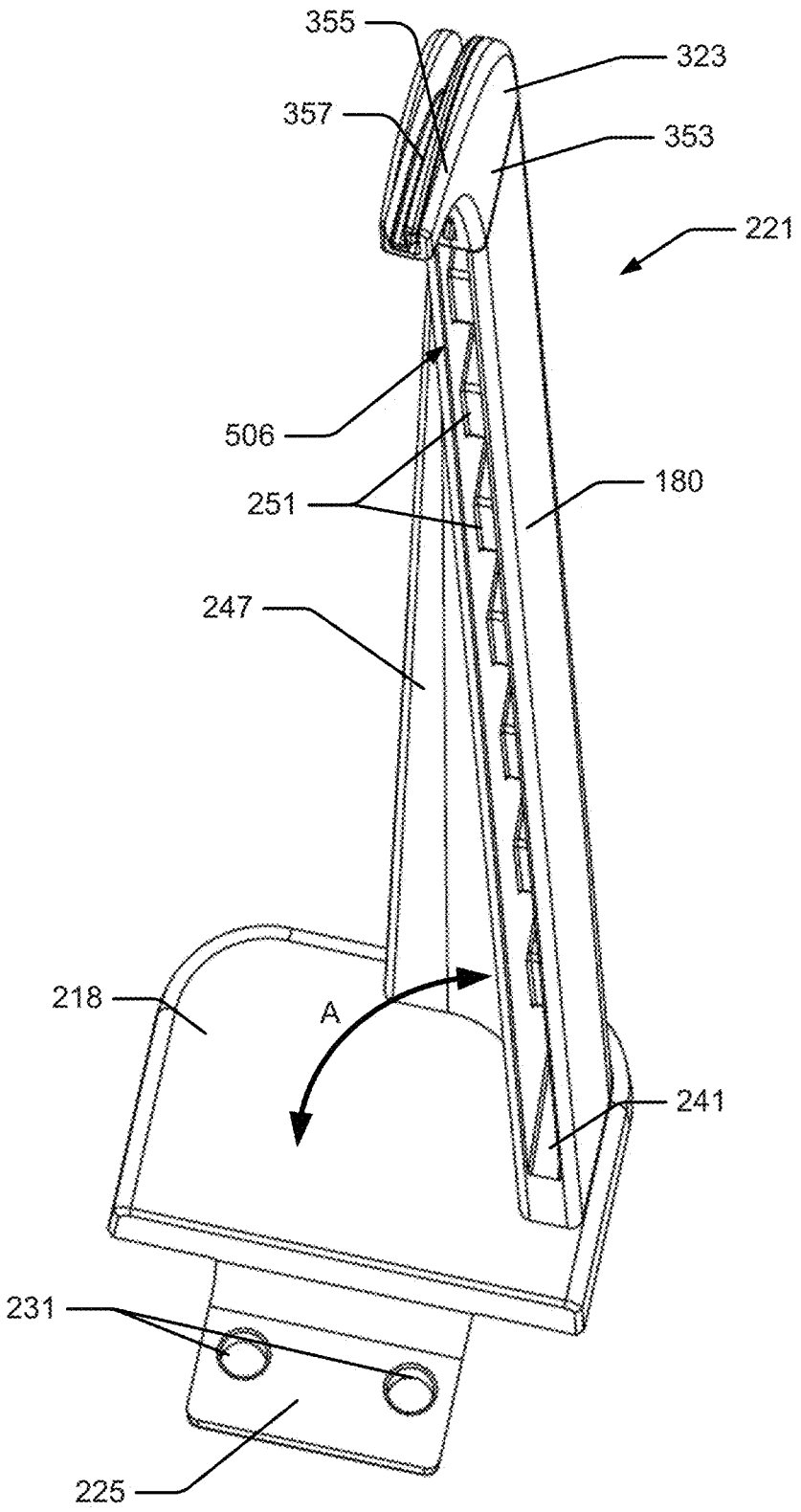
FIG. 21 is a perspective view of one of the bracket sub-assemblies shown in FIG. 20.
Figure 21A:
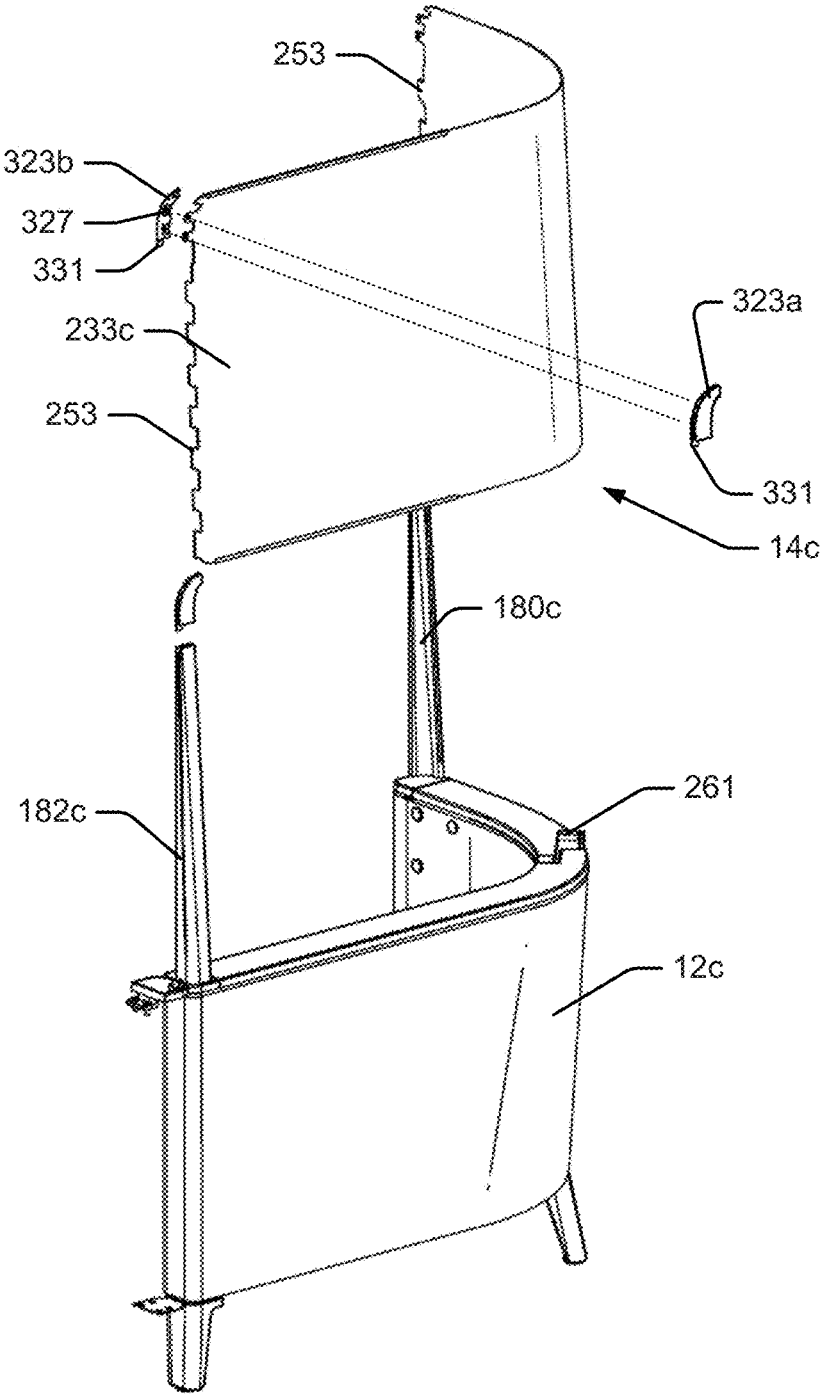
FIG. 21A is a perspective view showing a partially exploded screen sub-assembly and lower wall sub-assembly that are consistent with at least some aspects of the present disclosure.

Referring now to FIGS. 1 and 6, the upper screen assembly 14 includes first, second and third screen subassemblies 14*a*, 14*b* and 14*c*. Referring also to FIGS. 20 and 21, exemplary screen subassembly 14*c* includes first and second bracket subassemblies 221 and 185, an intermediate support bracket subassembly 261, and a screen insert assembly 233*c*. Bracket subassembly 221 includes a base member 218, an upright post member 180, a top cap member 323 and a mounting flange 225. Base member 218 is a flat rectangular member that has two rounded corners at one end and two right angle corners at the other end and has a width dimension between lateral edges that is identical to the width dimension of the finishing cap member 55 (see again FIG. 8) and a thickness dimension that is substantially identical to the combined thickness of the spacer cap 53 and the finishing cap 55 (see FIG. 8). Although not shown in FIG. 21, base members 218 forms mounting holes that align with threaded openings 504 (see again FIG. 7) in the undersurface of upright bracket member 180. To this end, see the exemplary holes 229 in the dual base member 183 shown in FIG. 8. Base member 218 forms holes similar to holes 229 in FIG. 8.

Referring still to FIG. 21, flange member 225 is a rigid rectilinear member that extends from an underside of base member 218 and from the edge opposite the two rounded corners. In some embodiments flange member 225 is integrally formed (e.g., via molding) with the base member 218. Flange member 225 forms two mounting holes 231.

Referring again to FIG. 20, the base member 183 that forms part of bracket subassembly 185 is similar to based member 218, albeit where the base member 183 is a dual base member (see also the base member in FIG. 8) that supports two adjacent post members (e.g., 180 and 182 in FIG. 8) and that mounts to first and second adjacent lower wall subassemblies as described above with respect to FIG. 8.

Referring again to FIG. 21, upright post member 180 has a tapering shape that is generally larger at a bottom end and that tapers to a relatively smaller top end. The bottom end has a rounded V-shape in cross section that includes first and second arm members that form a substantially 90 degree angle. To this end, see the exemplary bottom cross sectional shape of the exemplary post member 180 shown in FIG. 7. The post 180 in FIG. 21 has a similar bottom cross sectional shape. Post member 180 forms threaded mounting holes (see exemplary holes 504 in FIG. 7) in its underside that align with the openings 229 (see exemplary openings in FIG. 8) formed by the base member 218.

Referring yet again to FIG. 21, a first of the post member 180 arm members (e.g., one arm member of the V-shape) forms an elongated channel 506 that opens to one side along its entire length except for at a bottom end where a shelf member 241 closes off the bottom end of the channel. The shelf member 241 has a top surface that is spaced above the lower end of member 180 by a dimension that is within a range between one quarter inch and three inches and that, in particularly interesting embodiments, has a dimension between three quarters of an inch and one and a quarter inches. The shelf member 241 supports the screen member 233*c* in a raised position after installation is complete so that a gap 243 (see also FIG. 3) is formed between a bottom edge 358 of the screen member (e.g., 233 in FIG. 3) and the top surface of the finishing cap 55.

Referring again to FIGS. 20 and 21, the first post member 180 arm members that forms the channel 506 forms an acute angle A with the top surface of the base member 218 upon installation. Here, the angle A may be within the range between 60 degrees and 85 degrees and in a particularly interesting embodiment may be within the smaller range between 75 degrees and 80 degrees. While each of the angles A formed by each of the bracket subassemblies may be identical in an arrangement, in some embodiments it is contemplated that different brackets may form different angles so that the angles at which different sections of screens in a single arrangement are held may be different to provide a different aesthetic result. In addition, in some cases one or more of the bracket assemblies may include a channel that forms a right angle with an associated base member 218 so that a screen supported thereby extends substantially vertically after installation. In still other embodiments each of the two brackets at different ends of a single screen insert member may form a channel that defines a different acute angle. For instance, in FIG. 20, post member 180 may form an angle A of 85 degrees and post member 182 may form an angle of 70 degrees.

Referring again to FIG. 21, within channel 506, upright member 221 forms a set of generally equi-spaced rectangular teeth 251 that are designed to engage a series of notches or teeth 253 formed along a side edge of screen 233*c* (see again FIG. 20) that is to be supported by the bracket assembly 180.

Referring still to FIG. 21, the second of the post member arm members (e.g., the second arm member of the V-shape) which does not form channel 237, tappers from the bottom end to the top end of the post member 180. To this end, an edge 247 of the second arm member opposite the first arm member is substantially vertically aligned upon installation and tapers to a substantially zero width at the top of post member 180.

Referring still to FIGS. 20 and 21, top cap 323 is a rigid angle member that is designed to be mounted at the top end of the upright member 221 to secure screen assembly 233*c* thereto. To this end, cap member 323 includes a lower mounting section 353 which curves into an upper shoulder section 355 and forms a curved channel 357 to receive and engage the top end of screen assembly 233*c*. The channel 357 aligns with the top end of channel 506 upon installation. Cap member 323 may be secured to the top end of upright post member 180 via any type of mechanical fasteners (e.g., screws, friction snap fit, etc.).

Referring yet one more time to FIGS. 7, 8 and 21, to secure upright post member 180 to a base 218, the threaded apertures 504 (FIG. 7) formed in the underside of the post member 180 are aligned with the openings 229 in the base 218 and bolts are fed through the holes and are received in the apertures.

Figure 9:
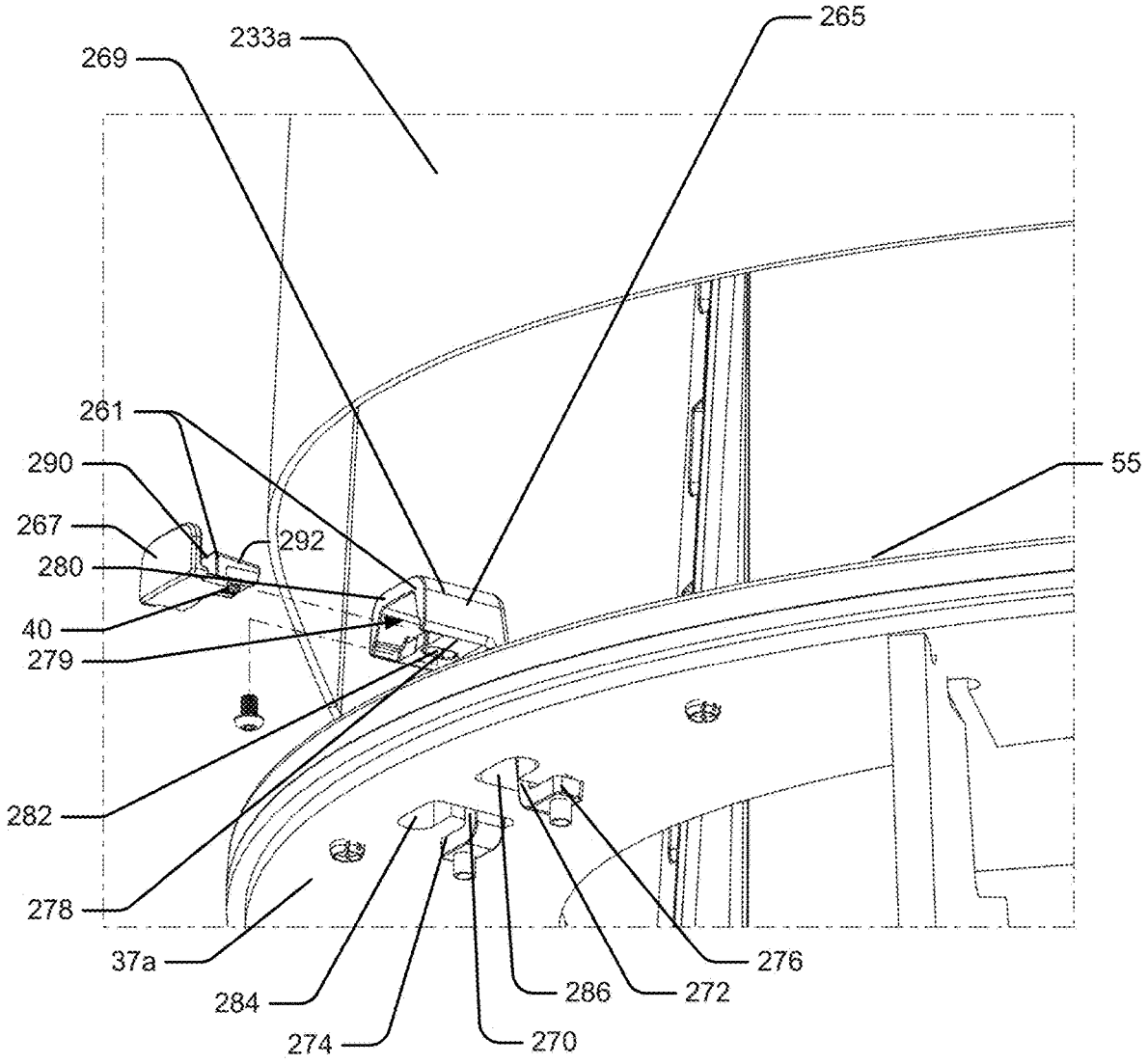
FIG. 9 is a perspective view showing a subset of the components shown in FIG. 8.
Figure 10:
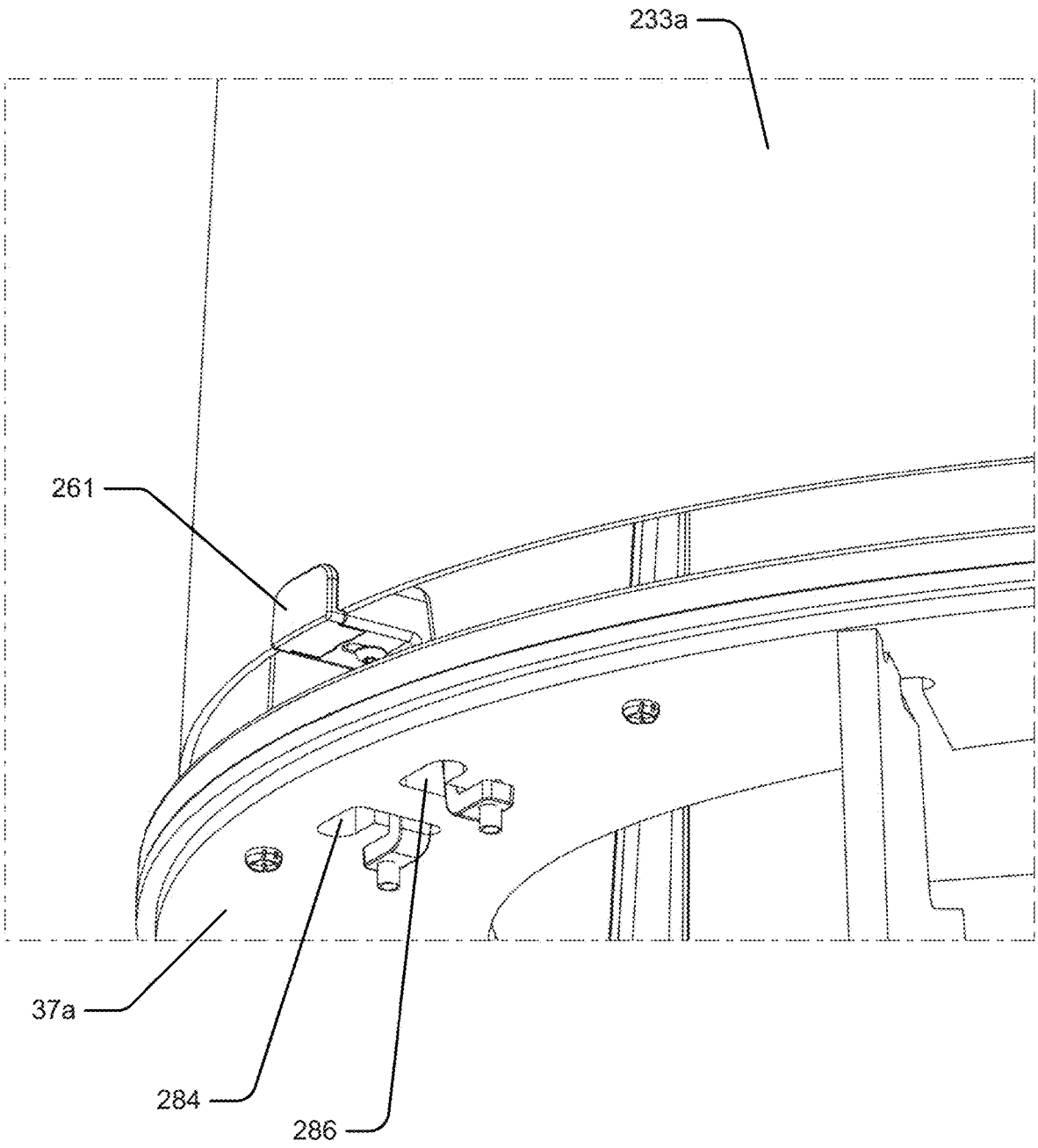
FIG. 10 is similar to FIG. 9, albeit showing the components of FIG. 9 in an assembled configuration.

Referring now to FIGS. 8, 9 and 10, the intermediate bracket subassembly 261 includes an assembly of components that mounts generally to the top end of and at an intermediate location along the length of one of the lower wall subassemblies (e.g., 12*a*) described above and extends upward to engage and support a lower edge of one of the upper screen members (e.g., 233*a* in FIG. 8). As best seen in FIG. 9. subassembly 261 includes a bracket 265 and a clamp member 267. Bracket 265 includes a shoulder member 269 and two spaced apart leg members 270 and 272 that extend in the same direction from the shoulder member 269. Toe members 274 and 276 extend from the distal ends of the leg members 270 and 272 and each forms a mounting aperture (not labeled in the figures). Two L-shaped openings 284 and 286 are formed in upper rail 37*a* that are spaced and dimensioned to receive the leg and toe members as shown in FIG. 9. Once the toe members are inserted through the slots and slid into an engaging position as in FIG. 9, screws or other mechanical fasteners are used to secure bracket 265 in place. After installation, the shoulder member 269 is spaced above a top surface of a finishing cap 55.

Referring still to FIG. 9, shoulder member 265 includes a bottom surface 278 and a side bearing surface 280. A channel 279 is formed in the bearing surface 280 and a slot 282 is formed in bottom surface 278.

Clamp member 267 forms an upwardly opening slot 290 and includes a tab 292 that extends sideways from an upper edge of the slot 290. The slot 290 has a width dimension that is slightly greater than the width dimension of the lower edge of a screen member (e.g., 233*a*) to be supported thereby. Member 267 forms a threaded aperture 40 in tab 292. Member 267 is dimensioned to be receivable within channel 279 for sliding motion therein.

Referring again to FIG. 20, exemplary screen member 233*c* may take any of several different forms. One particularly useful form includes a substantially uniform thickness acrylic sheet that is preformed into the general shape that the screen will take after installation is complete. To this end, the exemplary screen 233*a* has a generally planar first section 350, a generally planar second section 352 and a curved section 354 that connects the first and second planar sections 350 and 352. Top and bottom edges 356 and 358 of screen member 223, respectively, are located within parallel first and second planes that, upon installation, are each substantially horizontal. The bottom edge 358 is longer than the top edge 356 so that after installation, an outer surface of the screen member forms a non-right angle with vertical. See that screen member 223 in FIG. 1 angles generally inward from bottom to top so that the outer surface forms an acute angle with vertical. The angles with vertical may be within a range between 1 degrees and thirty degrees and, in particularly advantageous embodiments may be within a smaller range between 1 degrees and 10 degrees. A particularly useful embodiment includes screens juxtaposed to form a 3 degree angle with vertical.

In some embodiments the acrylic screen has a thickness that is within a range between one sixteenth of an inch and one inch and in particularly advantageous embodiments the screen has a thickness within a range between one eighth of an inch thick and one quarter of an inch thick.

In some embodiments the acrylic may be at least somewhat translucent or transparent. For instance, in some cases the screen member 233*c* may be formed of a milky white plastic like a milk carton so that a person within the arrangement space 59 has at least some ability to visually perceive persons moving outside of the arrangement space and so that persons outside the arrangement space 59 have at least some ability to perceive a human form located within the arrangement space.

Another form for the screen may include an acrylic or other frame type member (e.g., a metal frame) that forms the screen shape shown in FIG. 20 where a fabric is applied over the screen or screen frame to cover one or both sides. Here, the fabric may be sock like and stretched over the frame member or may be adhered to both sides of an acrylic sheet so that the fabric strictly follows the shape of the underlying frame structure (e.g., the sheet shape).

As indicated above, referring again to FIGS. 20 and 21, teeth or notches 253 are formed in the lateral edges of the sheet member 223 that interlink with the teeth 251 within the bracket channels upon installation.

To mount a screen subassembly to a lower wall structure, first the bracket subassemblies 221 and 185 are mounted to the lower wall structure along with intermediate bracket member 265. To mount a bracket subassembly 221 to a wall structure, referring again to FIGS. 7 and 21, an angle bracket 119 is secured within the wall structure below a top rail 37*a* where the top rail 37*a* forms an opening 51 above the angle bracket 119. Next, the flange portion 225 of subassembly 221 is aligned with opening 51 and inserted therein so that an undersurface of the tab member 225 contacts a top surface of the angle bracket 119 and an undersurface of the base member 218 contacts the top surface of rail member 37*a* adjacent an end thereof. Two screws or bolts are used to secure flange 225 to angle bracket 119. Bracket subassembly 185 is secured at the other end of the lower wall structure 12*a* in a similar fashion.

As described above, intermediate member 265 is next mounted to the top surface of the lower wall structure via two bolts. Spacer cap 53 and finishing cap 55 are installed on the top surface of the upper rail member 37*a* (see again FIG. 8). At this point the wall structure and bracket subassemblies are in the intermediate installation state shown in FIG. 20.

Continuing, screen member 233*a* (see FIG. 8) may be flexed slightly and the opposite lateral edges may be aligned with the bracket channels 506 (see FIG. 21) formed by the bracket subassemblies 221 and 185 while aligning an intermediate portion of member 233*a* with the intermediate support bracket 261. Then, the lateral edges of member 233*a* are forced into engagement with the teeth 251 formed within the aligned channels 506 and the lower edge 358 is placed within the slot 290 formed by clamp member 290 (see again FIG. 9). Clamp member 290 is slid inward so tab 292 moves further into slot 279 until the lower edge of screen member 223 is tightly sandwiched between bearing surface 280 and the facing surface of member 265. Cap members 323 are next installed to maintain the screen member 223 in its assembled position.

Referring to FIG. 1 and now also to FIGS. 22 through 30 and FIGS. 98 through 103, tablet assembly 20 includes a top tablet structure 170, a lower tablet body or housing structure 172, a cover member 130 and a channel insert 176. Referring also to FIG. 4, tablet structure 170 has a general rectangular shape when viewed in top plan view with first and second lateral edges 360 and 362, respectively, a front edge 364 and a rear edge 366. A main portion structure 170 forms a generally flat upper or top surface. The lateral edges are substantially parallel and the front edge and a central portion of the rear edge are substantially straight and parallel as well.

The portions of the tablet along lateral edges 360 and 362 extend rearward past the rear edge 366 to form first and second forearm rests 177 and 179, respectively. The forearm rests 177 and 179 curve downward proximate the central portion of rear edge 366 and form flat top surfaces that are angled with respect to the top surface of the larger portion of the tablet structure 170 (see 179 in FIG. 24). The angle formed between the flat top surface of the larger portion of the tablet structure 170 and the flat surfaces of the rests 177 and 179 is within a range between 5 degrees and thirty degrees and in particularly advantageous embodiments the angle is within a range between ten and fifteen degrees.

The top surface of tablet structure 170 has a width dimension between the lateral edges that is within a range between 12 and 24 inches and in particularly useful embodiments will have a width within a range between 17 and 19 inches. A depth dimension of the main portion of the top surface of tablet structure 170 between the central portion of rear edge 366 and front edge 364 is within a range between 10 and 15 inches and in particularly useful embodiments is within a range between 12 and 14 inches. The forearm rest sections 177 and 179 extend rearward from the central section of the rear edge to extend the depth dimension by an amount within a range between 2 inches and five inches and in particular useful embodiments by approximately 3 inches. The tablet top dimensions described here have been selected based on experiments that have proven that these dimensions are particularly advantageous given the form factors of currently available electronic devices (e.g., laptops, pad type devices, etc.) and average characteristics of assembly users (e.g., height, arm length, etc.).

Figure 24:
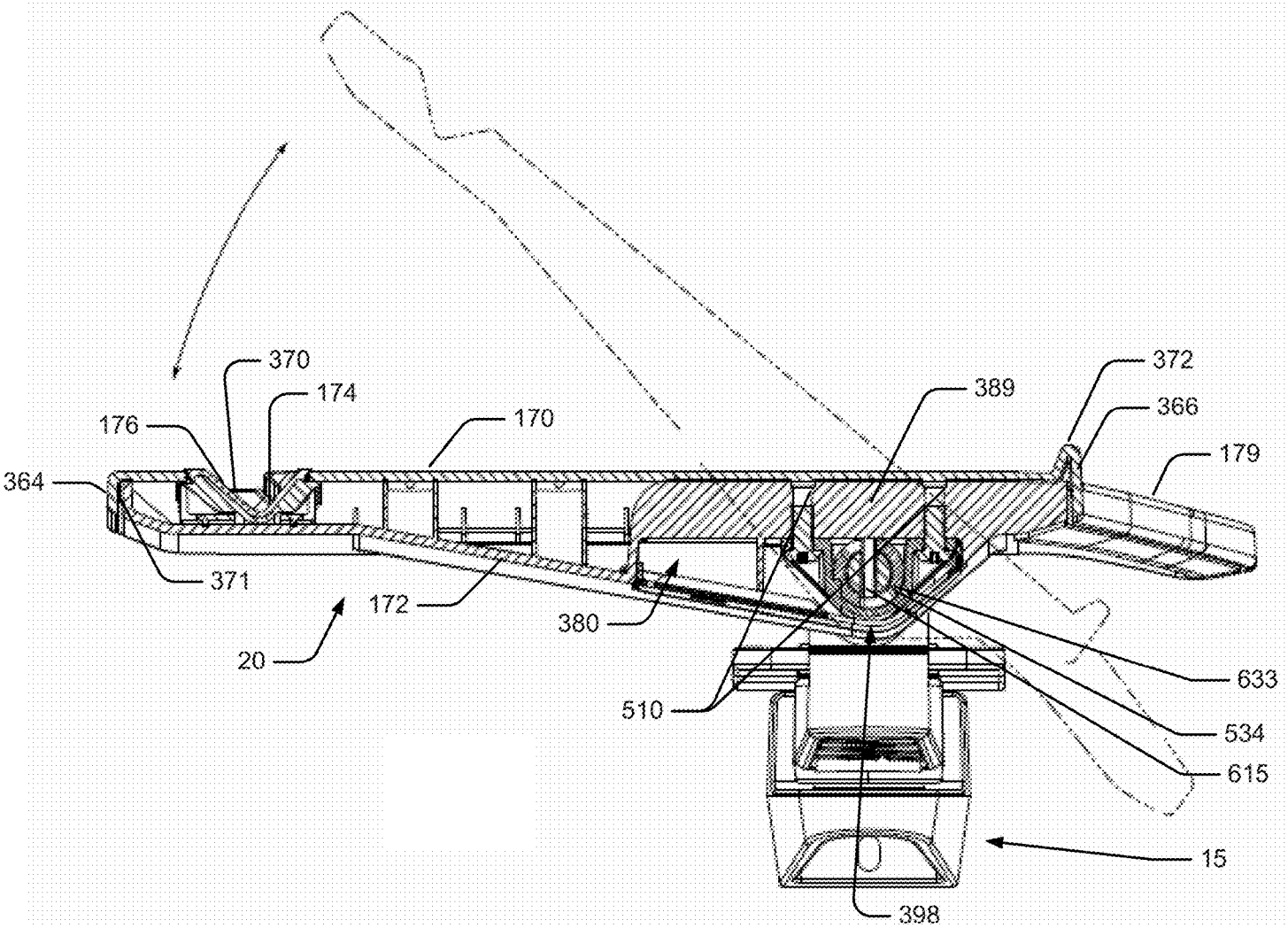
FIG. 24 is a cross-sectional view of the tablet and support arm sub-assemblies taken along the line 24-24 in FIG. 23.

Referring still to FIGS. 4 and 24, tablet structure 170 forms an elongated channel or groove 174 in its top surface proximate and parallel to front edge 362. In at least some embodiments the channel 174 stops short of extending to the lateral edges of the tablet assembly 20 so that the channel 174 is effectively closed at opposite distal ends. Channel insert 176 includes an elongated member that has a bottom surface that is designed to be received within channel 174 and includes a top surface that forms an upwardly opening channel that extends substantially along the length of channel 174. Here, the channel formed by insert 176 is dimensioned to have a width dimension that is slightly larger than the width dimension of a tablet type computing device (e.g., an I-pad or the like) and has a bottom wall member 370 that is angled forward. Insert 176 is formed of a tacky rubber or plastic type material that is at least somewhat resiliently deformable so that pad or cell phone type devices with edges of different thicknesses can be accommodated within the insert channel. The angled bottom wall 370 surface supports a device received in the insert channel at an angled orientation for use by a person residing on the assembly lounge 90. Insert 176 may include mechanical structure that mates with mechanical features adjacent channel 174 so that the insert can be press fit and frictionally received within the channel 174. In other cases insert 176 may be adhered within the channel 174 or otherwise secured therein.

Referring still to FIGS. 4 and 24, a rib 372 is formed along the central portion of rear edge 366 and extends upward there from out of the plane formed by the top surface of tablet structure 170. Rib 372 is provided as a stop member to limit movement of materials or resources that an assembly user may place on the top surface of the tablet assembly 20. For instance, a user may place a laptop or the like on the top surface and an edge of the base portion of the laptop proximate a user may rest on rib 372 when the tablet assembly 20 is tilted toward the user. The rib 372 may have a height dimension within a range between one eighth of an inch and one inch and in a particularly advantageous embodiment may be within a range between one quarter of an inch and one half an inch. In some embodiments rib 372 has a length dimension within a range between two inches and twelve inches Referring still to FIG. 24, tablet structure 170 forms a downwardly extending lip member 371 about substantially its entire circumference that extends downward from each of its lateral, rear and front edges. Lip member 371 forms a finished tablet assembly edge after assembly is complete.

Figure 22:
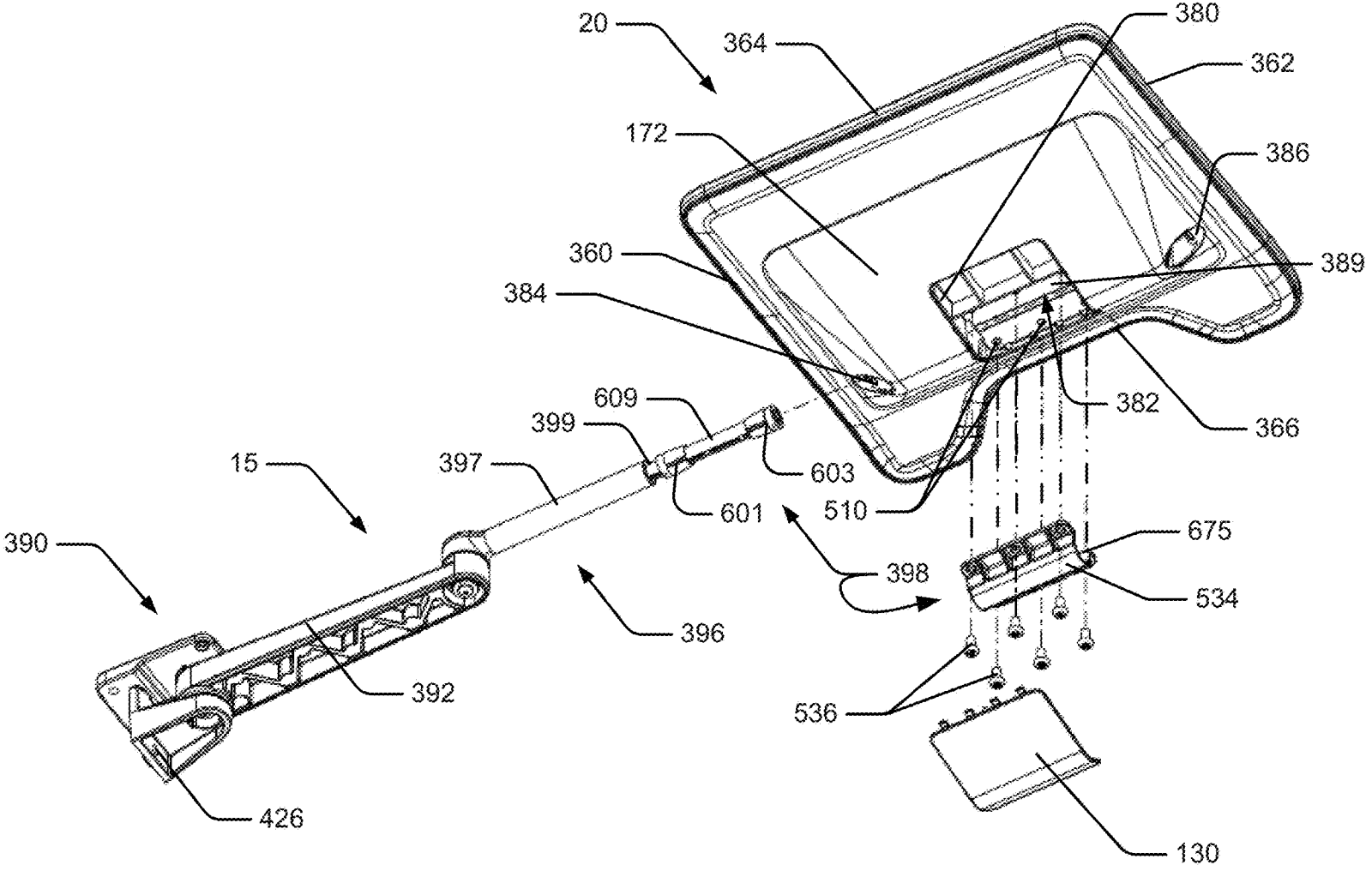
FIG. 22 is a partially exploded perspective view of the arm and tablet assembly shown in FIG. 1.

Referring to FIGS. 22 and 24, the lower tablet housing structure 172 is a molded plastic or metal structure that mounts to structure 170 within the space defined by the lower lip member 371 and operates in conjunction with a tilt assembly 398 to secure the tablet assembly 20 to a distal end of the support arm structure 15. To this end, structure 172 includes several rigid wall members 380 that form features for securing to the undersurface of structure 170 and for mounting to the distal end of assembly 15. In the illustrated embodiment, at least a subset of the walls 380 form a shape that frictionally fits within the space defined by the circumferential lip members 371 that extend down from the edges of structure 170. In addition to or instead of the friction fit, vibrational welding, mechanical fasteners or adhesive may be used to secure the lower structure 172 to the upper structure 170. For instance, in at least some cases screws or other fasteners may pass through upper structure 170 and into apertures in the lower structure 172 in channel 174 region of structure 170 below the insert 176 so that the screws are not observed after assembly is complete.

Referring still to FIGS. 22 and 24, wall members 380 form a mounting platform 389 at a central location between the lateral edges 360 and 362 proximate the straight central section of rear edge 366. Six threaded apertures 510 are formed in the undersurface of platform 389 for mounting the pivot assembly 398 as described here after. In addition, the wall members 380 form a downwardly opening chamber 382 (see specifically FIG. 22) below mounting platform 389 and exterior wall members that slope from the front, rear and lateral edges of structure 172 to the lower end of the open chamber 382. First and second openings 384 and 386 are formed in first and second lateral sloped wall members that are aligned along a single axis and that are aligned with the open chamber 382. Openings 384 and 386 allow a distal end of the arm assembly 15 to pass through the wall structure 380 and into the open chamber 382 to be secured to mounting platform 389 from either side of structure 172.

Housing structure 172 also forms eight mechanical couplers that cooperate with mechanical couplers on cover member 130 to secure the cover 130 to close off chamber 382 after assembly is complete. The cover member 130 includes an external bottom surface that, upon being mounted to housing structure 172, forms an external surface that is substantially flush at its edges with the sloping lower surfaces formed by the external walls 380.

Referring again to FIGS. 22 and 24, mounting platform 389 is disposed relatively closer to the rear edge 366 than to the front edge 364. In particularly advantageous embodiments, if a depth dimension of member 170 between front and rear edges 364 and 366 were divided into 4 sections between the two edges, the platform 389 would be within the quarter of the depth closest to the rear edge 366 (e.g., in the one of four sections closest to the rear edge 366). By providing the platform 389 near rear edge 366, force required on proximate the rear edge of the tablet assembly 20 to rotate the assembly out of a set position is increased appreciably. In at least some applications tablet assembly 20 is to be set in a use position and it is desirable to have the tablet assembly 20 stay in the set position unless affirmatively moved so increased required rotational force is advantageous.

Referring again to FIG. 23 and now also to FIGS. 25 through 29, arm assembly 15 includes a first pivot subassembly 390, a first arm member 392, a second pivot subassembly 394, a second arm structure 396 and a tilt subassembly 398. First pivot assembly 390 mounts to a supporting wall structure (e.g., 12*b* in FIG. 1), first arm member 392 mounts at a proximal end to subassembly 390 for rotation about a first vertical axis 630 through a range of motion and includes a second distal end opposite the proximal end. Second pivot subassembly 394 is located at the distal end of first arm member 392 and second arm structure 396 is mounted via the second pivot assembly 394 for rotation about a second vertical axis 632 spaced from the first vertical axis 630. Tilt subassembly 398 is mounted to a distal end of second arm structure 396 for rotation about a substantially horizontal axis 634 that extends along a length dimension of the second arm structure 396.

Figure 25:
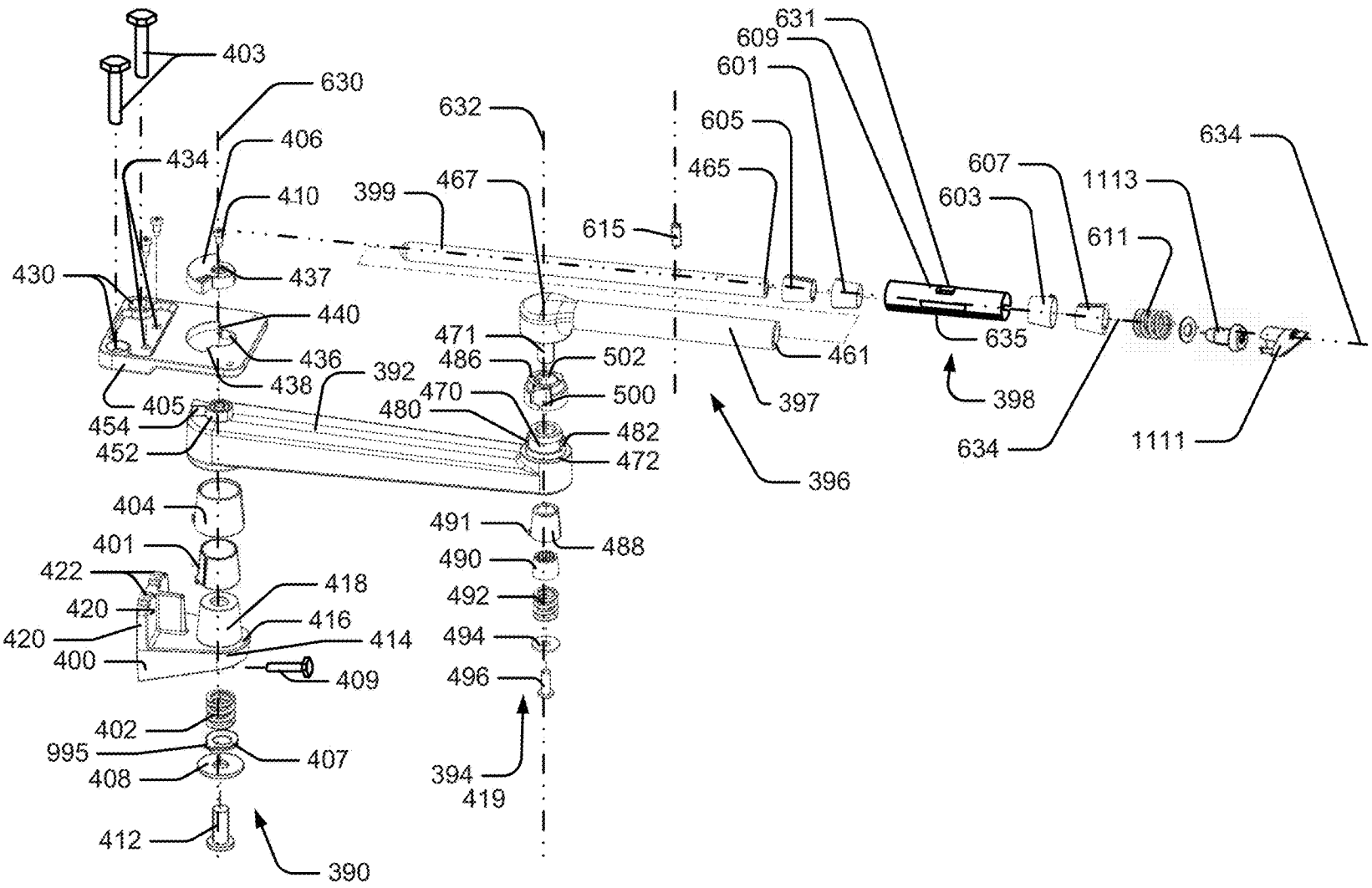
FIG. 25 is an exploded view of the support arm sub-assembly of FIG. 22.
Figure 25A:
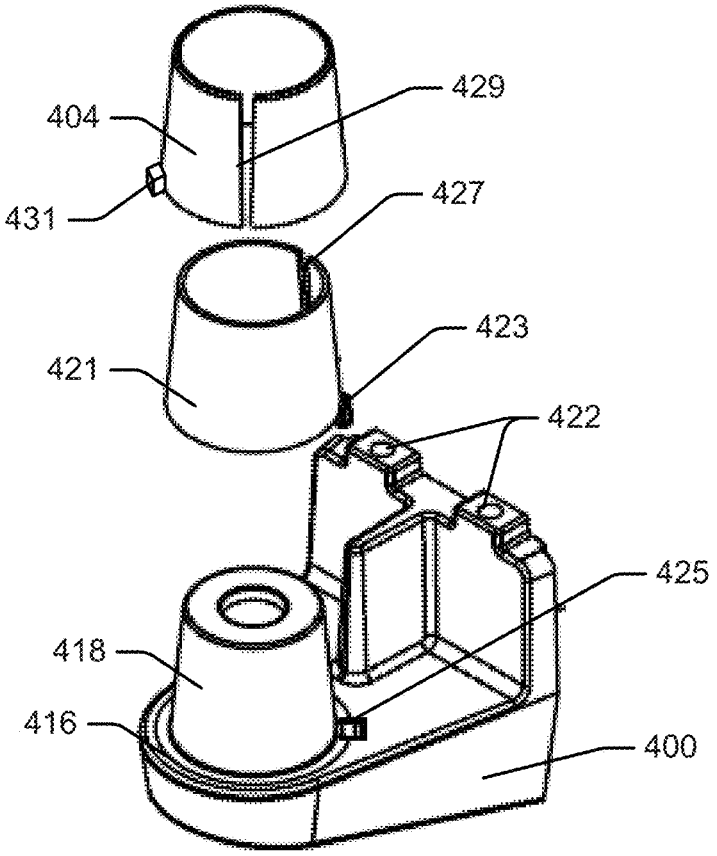
FIG. 25A is an exploded view of a subassembly of the arm assembly from FIG. 1.
Figure 26:
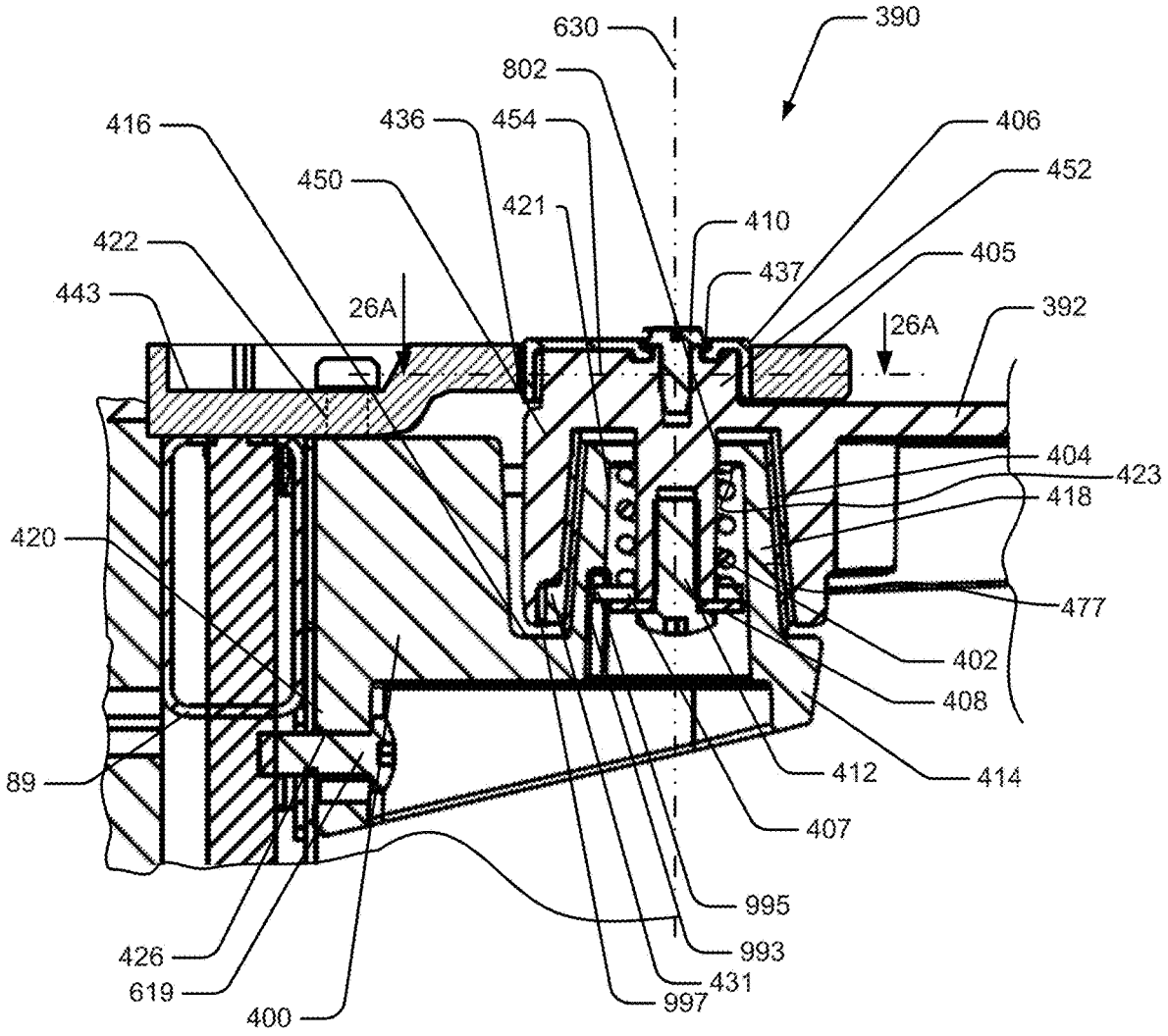
FIG. 26 is a cross-sectional view of a portion of the support arm sub-assembly shown in FIG. 23.
Figure 26A:
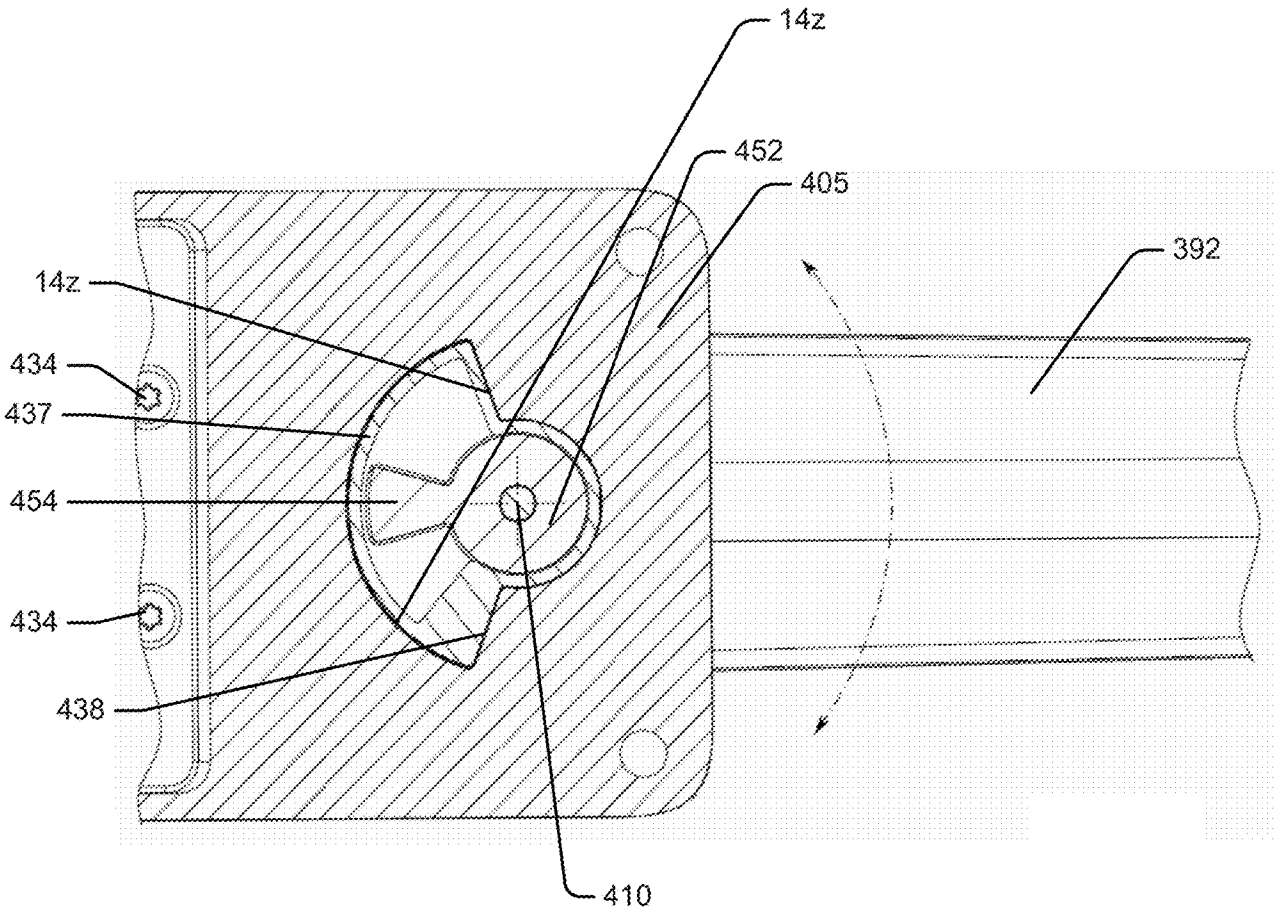
FIG. 26A is a cross-sectional view showing support structure at one of the vertical axes of the arm assembly of FIG. 22.

Referring to FIGS. 25 and 26, first pivot subassembly 390 includes a support bracket member 400, a spring 402, first and second bushings 401 and 404, a cap bracket 405, a cushion insert 406, a keyed washer 407, washer 408 and first and second screws 410 and 412. Referring also to FIG. 25A, support bracket member 400 is formed of a rigid metal material (e.g., steel, aluminum, etc.). Member 400 includes a base member 420, a shoulder member 414 and turret post 418. Base member 420 includes a substantially flat plate type member that includes a rear bearing surface (not shown) opposite a front surface 419. Base member 420 has a thickness dimension between the bearing and front surfaces and forms two threaded apertures 422 in an upper edge for securing cap bracket 405 to the base member 420. Base member 420 also forms a single mounting hole 426 (see FIGS. 22 and 23) proximate its lower edge that extends horizontally for passing a screw 409 used to secure bracket 400 to a supporting wall structure as described here after.

Shoulder member 414 is integrally formed with the base member 420 and extends outward from front surface 419 above opening 426 to form an upwardly facing support surface 416. Turret post 418 extends upward from surface 416 and forms a frusto-conical external surface that tappers from a bottom end to a top end. A cavity or bore 421 is formed in the undersurface of post 418 that extends up into post 418 and a reduced diameter opening 802 opens through the top end of post 418 into the cavity 421 so that there is an internal downwardly facing lip 423 within the cavity that circumscribes opening 802. The cavity 421 has a frusto-conical shape that is wider at a bottom end than at a top end. The diameter of post 418 at its bottom end is smaller than the dimensions of upwardly facing surface 416 that surrounds the post 418 such that surface 416 forms an upwardly extending lip that circumscribes the post 418.

As seen in FIG. 25A, a keyed recess 425 is provided at the base of post 418 in surface 416. The recess 425 is dimensioned and located to receive a finger member 423 that extends from bushing 421 so that the bushing 421 is keyed to and stationary with respect to post 418 after assembly.

As seen in FIG. 26, another recess 993 is formed within the bottom opening of post 418 for receiving a key finger 995 of washer 407 upon assembly so that the washer 407 is held stationary with respect to the internal surface of the post opening.

Referring again to FIG. 25 and also to FIG. 25A, bushing 401 is formed to be received on the external surface of post 418. Bushing 401 is formed of a hard plastic material selected to have a low coefficient of friction with the external surface of post 418. Bushing 401 has a frusto-conical shape that is wider at a lower edge than at a top edge and the finger member 423 that is received in recess 425 upon assembly extends downward from the lower edge and an external surface. Bushing 401 forms a thin slot 427 between its top and lower edges.

Second bushing 404 is formed to be received on the external surface of bushing 401 and is formed of a hard plastic material selected to have a low coefficient of friction with the external surface of bushing 401. Bushing 404 has a frusto-conical shape that is wider at a lower edge than at a top edge and forms a finger member 431 that extends from an external surface and that is received in a keyed recess 997 (see FIG. 26) formed by arm member 392 so that the second bushing is keyed to and rotates with arm member 392 after assembly. Bushing 404, like bushing 401, forms a thin slot 429 between its top and lower edges. The slots 429 and 427 are formed at radial locations about the two bushings 404 and 401 so that the slots are always misaligned regardless of where along a range of juxtapositions the second arm 397 is with respect to the first arm 392. Other dual bushing subassemblies described herein are arranged and operate in a similar fashion to bushings 401 and 404 to compensate for imperfect manufacturing tolerances.

Thus, after assembly, bushing 401 is keyed to and stationary with respect to post 418 and second bushing 404 is keyed to and stationary with respect to arm 392 and bushing 404 is free to rotate with respect to bushing 401 within the limited range associated with arm member 392. The slits 427 and 429 enable the bushings to compensate for manufacturing tolerance issues upon assembly. To this end, it has been determined that, upon assembly, the force applied to the bushing 401 and 404 can cause the slits to substantially or even entirely close taking up any gap between adjacent arm components. In fact, in some cases, adjacent edges of one or each of the bushings 404 and 401 that form the slots may overlap somewhat upon assembly.

Cap bracket 405 is a metal member (e.g., steel, aluminum, other metal, etc.) and includes a rectilinear, substantially plate like member that forms a first pair of mounting openings 430 and a second pair of mounting openings 434. Openings 434 are spaced apart so as to align with the threaded apertures 422 formed in the upper edge of member 400. A recess 443 (see FIG. 26) is formed about openings 434 so that screw heads may be seated therein after assembly such that the top surfaces of the screw heads are flush with or below a top surface of member 405. Openings 430 are provided proximate an edge of member 405 and are used to mount the first pivot subassembly to a supporting wall structure (see FIG. 23) via bolts 403 in a manner to be described hereafter.

Referring to FIGS. 25 and 26, member 405 also forms a keyed opening 436 in an end opposite the end in which openings 430 are formed. The keyed opening 436 includes a hole having a reduced diameter circular section and an overlying enlarged diameter circular section such that radial edges of the opening between the reduced and enlarged diameter sections form first and second stop surfaces 438 and 440, respectively. The stop surfaces 438 and 440 operate along with a key 454 on arm member 392 to limit first arm member 392 rotation with respect to member 400 in a manner to be described hereafter.

Cushion insert member 406 is provided to form a cushioned barrier between rigid surfaces of cap bracket 405 and the first arm member 392 so that surfaces thereof do not directly contact. In addition to reducing component wear, the insert member 406 also reduces noise created when arm member 392 reaches one of its limit positions during rotation about axis 630. To this end, insert member 406 is a low friction member (e.g., formed using a material akin to bushing 404 in at least some embodiments) that has an outer shape that mirrors the shape of opening 436 so that member 406 is generally receivable within opening 436 and covers the circumferential edge of opening 436 at all locations including the portions of the edge that form stop surfaces 438 and 440. Member 406 forms an opening 437 for mounting insert 406 to arm member 392. Member 406 also forms a downwardly opening cavity (see specifically FIG. 26) that has a shape similar to the shape of opening 436 so that when insert 406 is inserted in opening 436, a wall of insert 406 is adjacent each section of the internal edge of the opening 436.

Referring still to FIGS. 25 and 26, spring 402 is dimensioned to be received within the cavity 421 with one end bearing against lip surface 423. Keyed washer 407 includes a finger that is received in recess 993 upon assembly so that the washer is stationary with respect to member 400. Washer 408 has an outer diameter that also allows the washer 408 to be received within cavity 421.

Referring to FIGS. 25 and 26, first arm member 392 is an elongated rigid member that has opposite proximal and distal ends that form integral features for mounting and for limiting rotation with respect to adjacent arm assembly components. In some cases arm member 392 may have a substantially horizontal top surface and an undersurface may taper from the proximal end to the distal end slightly (see specifically FIG. 23 where a slight taper is perceivable).

At the proximal end of arm 392 shown in FIG. 26, the arm member 392 forms a downwardly facing cup 450 that forms a downwardly opening frusto-conical cavity 477 that is substantially similar to the shape of the external surface of bushing 404. Arm member 392 also forms an upwardly extending post 452 (see FIG. 25) that is formed about vertical axis 630 that passes through the center of downwardly opening cavity 477. A key member 454 extends from post 452 to the proximal end of arm member 392. Post 452 has a diameter dimension similar to the diameter of the reduced diameter circular portion of opening 436 (less a thickness of a wall of insert 406) and key member 454 extends laterally from post 452 so that a distal end thereof extends to the diameter of the enlarged diameter circular section of opening 436 (less a thickness of a wall of insert 406). A threaded opening 437 is formed along axis 630 in the top surface of post 452.

Figure 27:
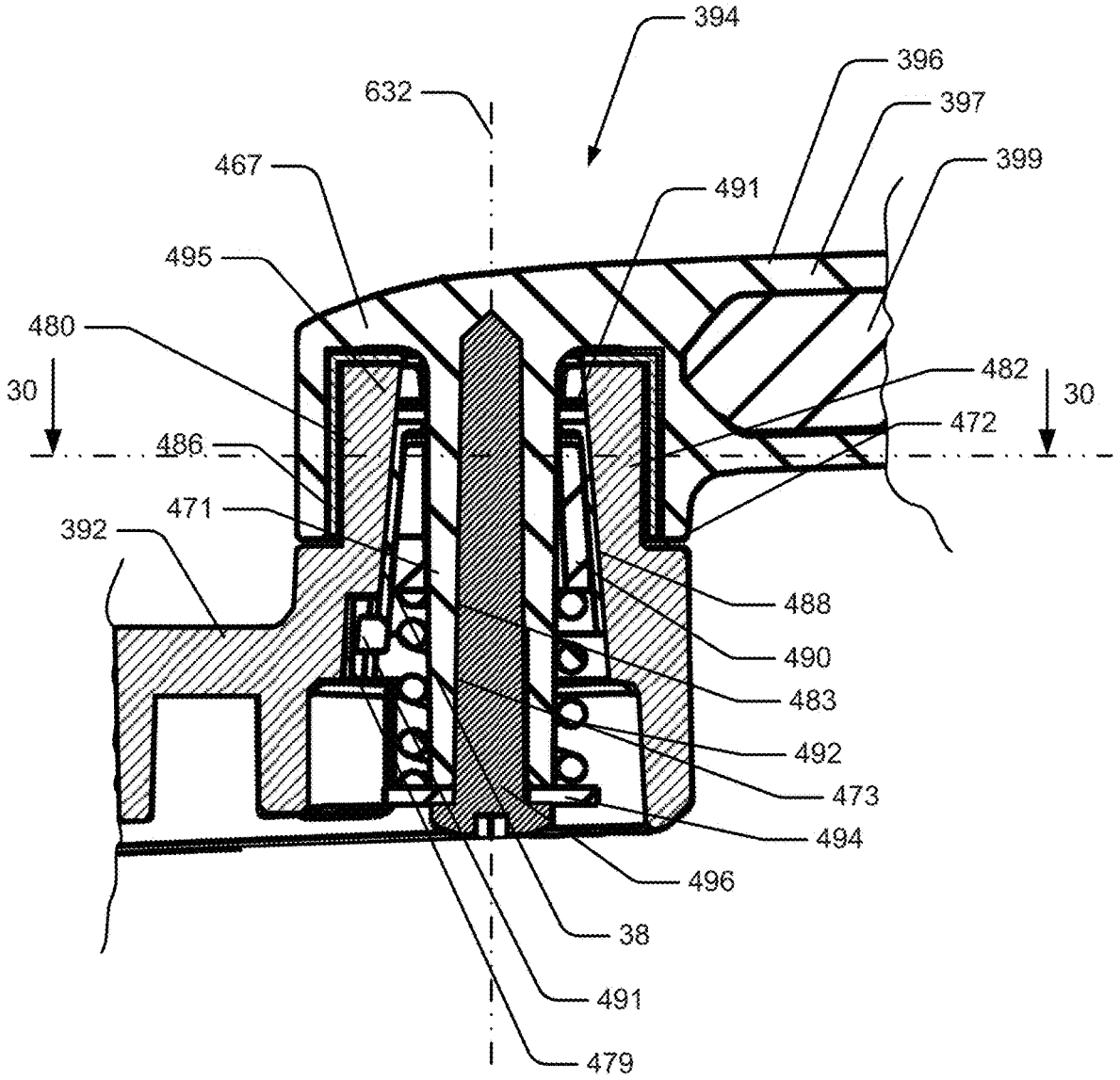
FIG. 27 is a cross-sectional view of a portion of the support arm sub-assembly shown in FIG. 23.
Figure 30:
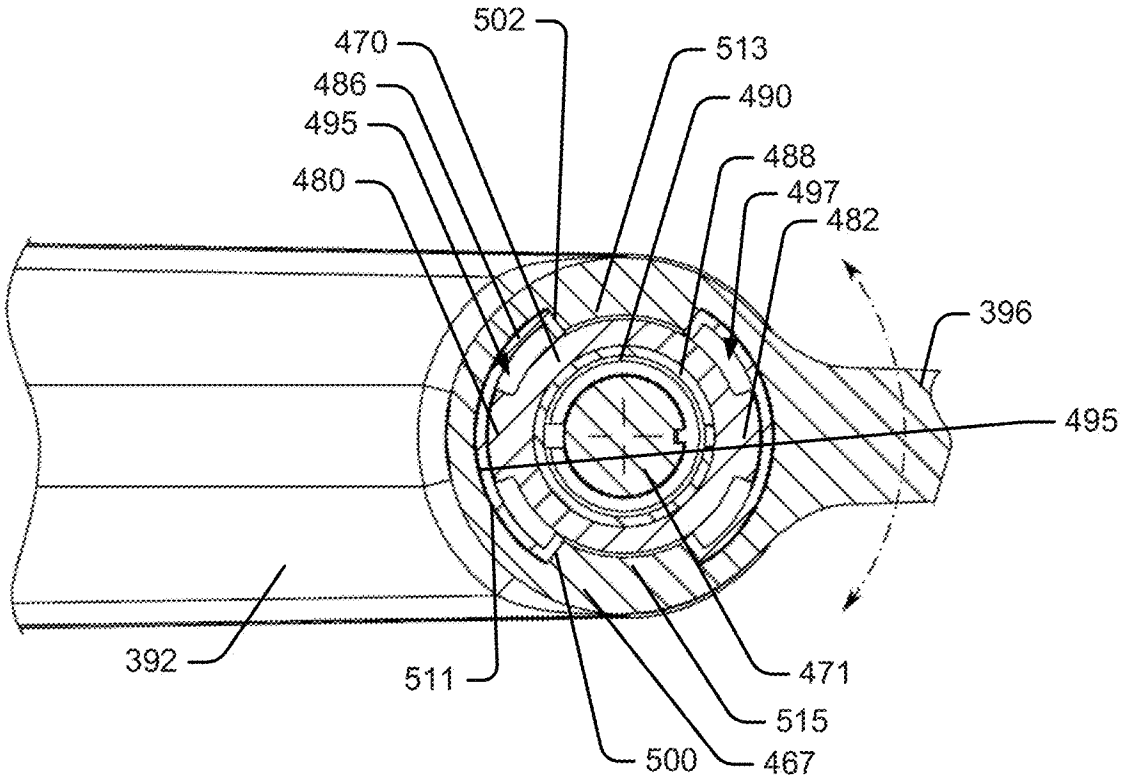
FIG. 30 is a cross-sectional view taken along the line 30-30 in FIG. 27.

Referring to FIGS. 25 and 27 and now also to FIG. 30, at its distal end, member 392 forms an upwardly extending post member 470 that extends from the top surface of member 392. Post member 470 has a diameter dimension that is less than the dimensions of the top surface of member 392 about the post 470 so that there is an upwardly facing bearing surface 472 that circumscribes post 470. A downwardly opening frusto-conical cavity 438 is formed in the undersurface of arm member 392 that extends upward and into and through the top end of post 470. On the inside of the cavity 438, the internal wall forms a recess 479 at a single radial location for receiving and coupling a finger 491 that extends from bushing 488 (see FIGS. 25 and 27) upon assembly.

Referring still to FIGS. 25, 27 and 30, first and second lateral projections 480 and 482 extend from post 470 in opposite directions. Each projection 480 and 482 extends about a fraction (e.g., 15-45 radial degrees) of the circumference of post 470 and the projections cooperate with other arm components to limit or restrict the range of pivoting of the second arm assembly 396 about the first arm member 392 at the second pivot assembly 394 in a manner described hereafter.

Referring still to FIGS. 25, 27 and 30, second pivot subassembly 394 includes a cushion member 486, a bushing 488, a cork member 490, a spring 492, a washer 494 and a bolt 496. Cushion member 486 is generally provided to separate stop surfaces that limit rotation of the second arm member 396 about the first arm member 392 so that noise from colliding stop surfaces and part wear are minimized. To this end, member 486 is formed of a resilient plastic material and forms a plastic barrier between stop surfaces of arm members 396 and 392. In this regard, member 486 forms a downwardly opening cup shaped cavity that is generally received over post 470 with internal sub-cavities 495 and 497 for receiving protrusions 480 and 482 as well as external sub-cavities 500 and 502 (see FIG. 30) for receiving inwardly directed protrusions 513 and 515 that extend from second arm member 396. Member 486 forms plastic wall members between the adjacent stop surfaces of the protrusions.

Referring to FIGS. 25 and 27, bushing 488, like bushing 404, has a frusto-conical shape and is formed of a low friction material, forms a slit (now shown) along a height dimension and includes a finger member 491 that extends outwardly adjacent a lower edge to couple or mate with the recess 479 so that the bushing is locked to member 397 after assembly. Bushing 488 includes an external surface that mirrors the surface of the opening 438 in the lower end of post 470. Cork member 490 is a frusto-conical member that includes an external surface that mirrors the dimensions and shape of the internal surface of bushing 488. Cork member 490 forms a central opening there through and forms a plurality of fins that extend inward. Member 490 is formed of a rigid plastic material and the internal fins thereof may or may not be deformable when pressure is applied axially to the member 490. In at least some cases member 490 includes a slit like the slits formed in bushings 404 and 421 described above. Spring 492 and washer 494 are dimensioned to be received in the opening 438 in the bottom of post 470.

Second arm assembly 396 includes a tube member 397 and a rod member 399. Tube member 397 extends from a proximal end to a distal end and forms a cylindrical internal passageway open at its distal end. Rod member 399 is received in the tube passageway and extends there from to a distal end. Rod 399 is secured within the tube passageway so that the tube member and rod are effectively one component. To this end, in at least some embodiments, tube member 397 may include aluminum that is over molded onto rod 399 so that the two parts effectively become one. Once the rod and tube are integrally attached, the distal end edge 461 of tube 397 forms a flange that circumscribes a portion of tube 399 about midway along the length of the rod 399. Rod member 399 forms one pass through opening 463 approximately midway between distal edge 461 and the distal end of the rod 399 that extend through the rod substantially perpendicular to the length thereof. Rod 399 also forms a threaded opening 465 at its distal end.

Referring to FIG. 27, at its proximal end, tube member 397 forms a head member 467 that forms a downwardly opening substantially cylindrical cavity 495. Referring also to FIG. 30, a mounting post 471 extends downward from a central portion of the cavity 495 and forms a central threaded aperture 483 in a distal lower end. Post 471 has a diameter dimension that is tightly receivable within the opening formed by cork member 490. An internal wall surface 511 of head member 467 that forms cavity 495 also forms the two inwardly projecting protrusions 513 and 515. The protrusions 513 and 515 extend radially toward post 471 and form stop surfaces thereabout.

Referring to FIGS. 22 through 25, 28 and 29, tilt subassembly 398 includes first and second bushing members 601 and 603, third and fourth bushing members 605 and 607, a stop sleeve member 609, a pin member 615 (e.g., a threaded set screw or the like), a clamp member 534, a plurality of screws 536, a helical spring member 611, a washer 1113, an end bolt 613 and a cap member 1111.

Figure 25B:
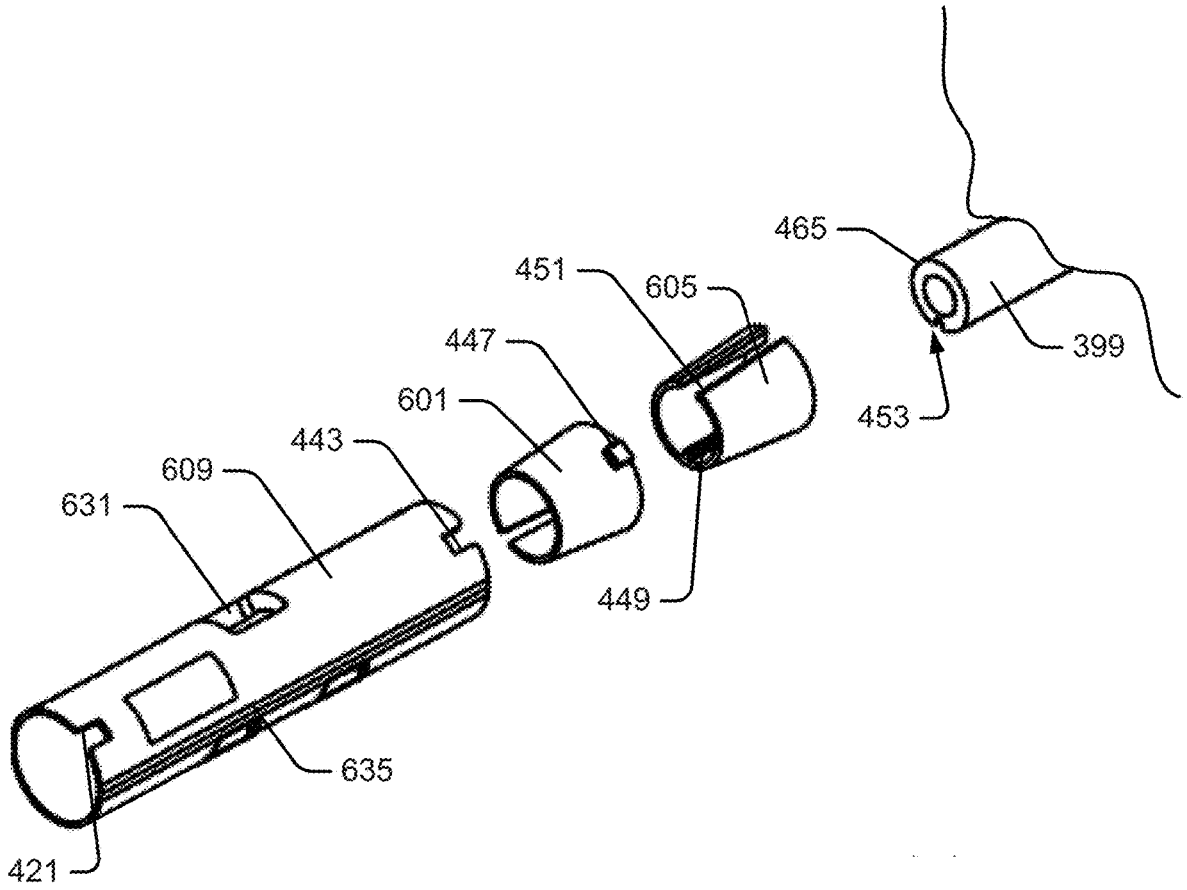
FIG. 25B is an exploded view of a different subassembly of the arm assembly from FIG. 1.

Referring also to FIG. 25B, each of bushings 601 and 603 (not shown in FIG. 25B) is frusto-conical in shape, forms a through hole along its axis, forms a slit 445 along its length dimension and includes an outwardly extending finger member 447 proximate the edge at its wider end for mating with a slot 443 in an adjacent end of sleeve 609 so that the bushings 601 and 603 are locked to the sleeve 609 upon assembly. Bushing member 601 is dimensioned to generally pass the distal end of rod member 399 and to rest on the flange surface 461 formed by tube member 397. Bushing member 603 has similar dimensions and, upon assembly, is located proximate the distal end of rod member 399.

Similarly, bushing 605 (see again FIG. 25B) is frusto-conical in shape, forms a through hole along its axis, forms a slit 451 along its length dimension, but includes an inwardly extending rib member 449 for mating with a slot 453 formed in an external surface of rod 399 so that the bushing 605 is locked to member 399 upon assembly. Bushing member 605 is dimensioned to generally pass the distal end of rod member 399. Bushing 607 is constructed in a fashion similar to bushing 605 and also locks to slot 453 formed by the external surface of rod 399.

Referring still to FIGS. 22, 25, 25B and 29, stop sleeve member 609 is a cylindrical plastic, metal or otherwise rigid member that forms a cylindrical passage along its length that has a radius substantially similar to the radius of rod member 399. Sleeve member 609 also forms first and second radially opening windows 631 and 633 that open in opposite directions and that extend along mid-sections of the sleeve member as well as the slots 441 and 443 shown in FIG. 25B for receiving the bushing finger members that extend from bushings 601 and 603. Edges of each window that extend along a trajectory parallel to the length dimension of the sleeve member 609 form stop surfaces.

In at least some embodiments each window 631 and 633 traverses a radial arc within a range between 5 degrees and 60 degrees and in particularly advantageous embodiments the arc is within a range between fifteen degrees and forty-five degrees. A particularly useful embodiment based on empirical data forms an arc of 40 degrees. Sleeve member 609 also includes an external substantially cylindrical surface which forms a slot 635 that extends along at least a portion of the entire length thereof.

Figure 28:
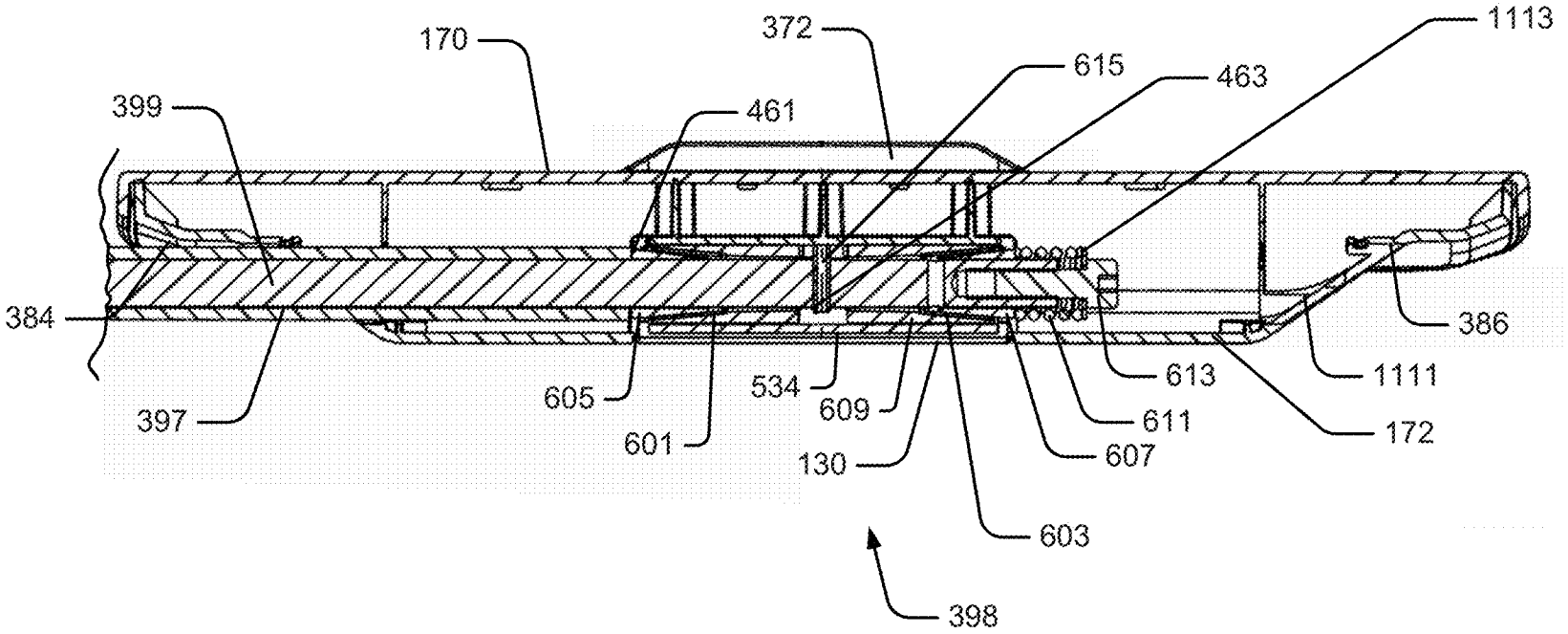
FIG. 28 is a cross-sectional view of the tablet sub-assembly and a portion of the arm sub-assembly shown in FIG. 23.

Referring still to FIGS. 25 and 28, spring 611 is dimensioned to be received on a distal edge of bushing 607 and the threaded shaft of screw 1113 is designed to be received within the threaded opening 465 at the distal end of member 399 with washer 634 between spring 611 and the head of screw 1113.

Referring to FIGS. 22, 24, 28 and 29, clamp member 534 is an elongated generally C-shaped clamp member that forms a channel 675 and includes oppositely extending flanges that form holes for passing screws 536. Member 534 forms a rib 677 (see FIG. 29) along the length of the passageway that is dimensioned to be receivable within and lock to the channel 635 formed in the external surface of sleeve member 609.

To install the tablet assembly 20 and arm assembly 15, arm member 392 is mounted between shoulder member 414 and bracket member 405 with the other components shown in FIG. 25 sandwiched there between. Here, key member 454 is received in slot 436 so that stop surfaces 438 and 440 cooperate with opposite sides of the member 454 to restrict rotation of the arm member 392 to within first and second limit positions relative to bracket 405.

Next, with member 399 connected to member 397, that subassembly is mounted to the distal end of arm member 392. Here, also, the mounting structure limits rotation of the second arm assembly 396 to a range within first and second limit positions with respect to the first arm member 394. In this regard, as best seen in FIG. 30, head member 467 and integrally formed post member 470 are limited in their ability to rotate by contact (e.g., interaction through the cushion member 486 walls) between stop surfaces on protrusions 480 and 482 that are formed by first arm member 394 and stop surfaces on protrusions 513 and 515 that are formed by second arm member 397.

Figure 29:
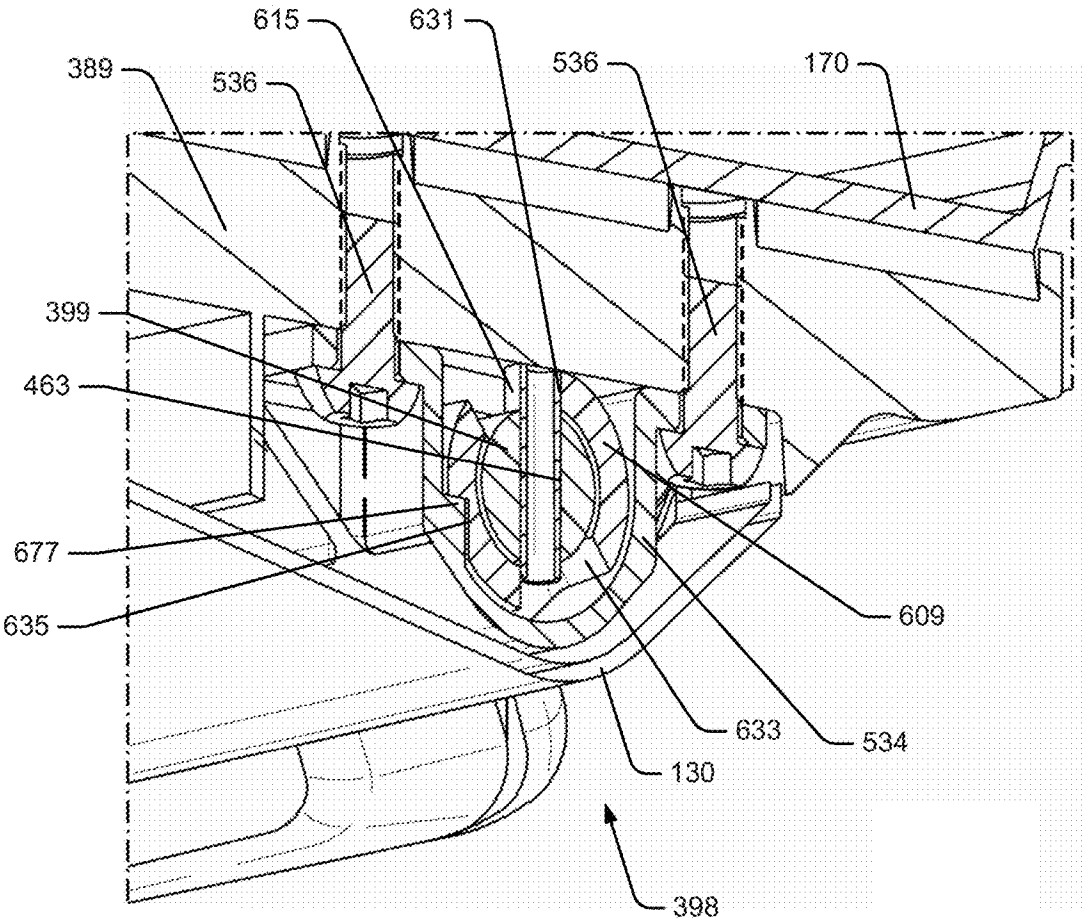
FIG. 29 is a cross-sectional view taken along the line 29-29 in FIG. 28.

Continuing, referring again to FIGS. 22, 25, 28 and 29, members 605, 601, 609, 603, 607, spring 611 and washer 1113 are slid onto the distal end of rod member 399 and screw 613 is installed in opening 465 to hold all of those members in place on shaft 399. As seen in FIG. 29, windows 631 and 633 are aligned with the opening 463 in rod 399 and pin 615 is fed through one of the windows 611, through opening 463 and then through the second window 613 formed by member 609. At this point the arm assembly 15 should be in the partially assembled state shown in FIG. 22.

Next, the distal end of assembly 15 at 603 is aligned with opening 384 formed by the tablet assembly 20 and the distal end is slid through the opening 384. Movement of end 603 continues until the subassembly at distal end 603 is located within cavity 382 adjacent mounting platform 389 (see FIG. 28). Clamp member 534 is next secured within cavity 382 via screws 536 received in threaded apertures 510 formed within the mounting platform 389. Here, as shown in FIG. 29, rib 677 is aligned with channel 635 so that sleeve 609 is effectively locked to clamp 534 and thereby to the bottom tablet housing structure 172 so that sleeve 609, clamp 534 and tablet assembly 20 are stationary relative to each other. Cover member 130 is next installed via a friction fit or the like to close off cavity 382 and provide a finished appearance to the bottom of the tablet assembly 20.

To mount the arm and tablet subassembly to a support wall, referring again to FIGS. 19, 22, 23 and 25, prior to installing the cap member 53 and 55 and upper shelf member 22, two bolts 403 are fed through mounting openings 430 and are threadably received in holes formed by a rigid support member within the wall structure. Next, a single screw 691 is fed through opening 426 (see FIG. 26) and into a supporting wall structure. After the assembly 15/20 is installed, the cap members 53 and 55 and shelf member 22 are secured to assembly structure as described above.

Referring again to FIG. 1, and 23, after the table assembly 20 is mounted to the lower wall structure and the upper shelf member 22 is also mounted, a portion of the arm assembly 15 resides below the side shelf 22 member regardless of the position of the tablet assembly. To this end, see in FIG. 23 that a large portion of the length of arm member 392 resides below member 22 and that only the distal end of member 392 extends past the side edge of member 22. As shown, only a small gap occurs between a top surface of arm member 392 and the undersurface of shelf member 22. In some cases the gap between the two surfaces will be less than two inches and in particularly useful embodiments the gap is less that ¼th of an inch or even as small as ⅛th of an inch so that the arm member does not operate to obstruct the space between the upper and lower shelf members appreciably.

Figure 23:
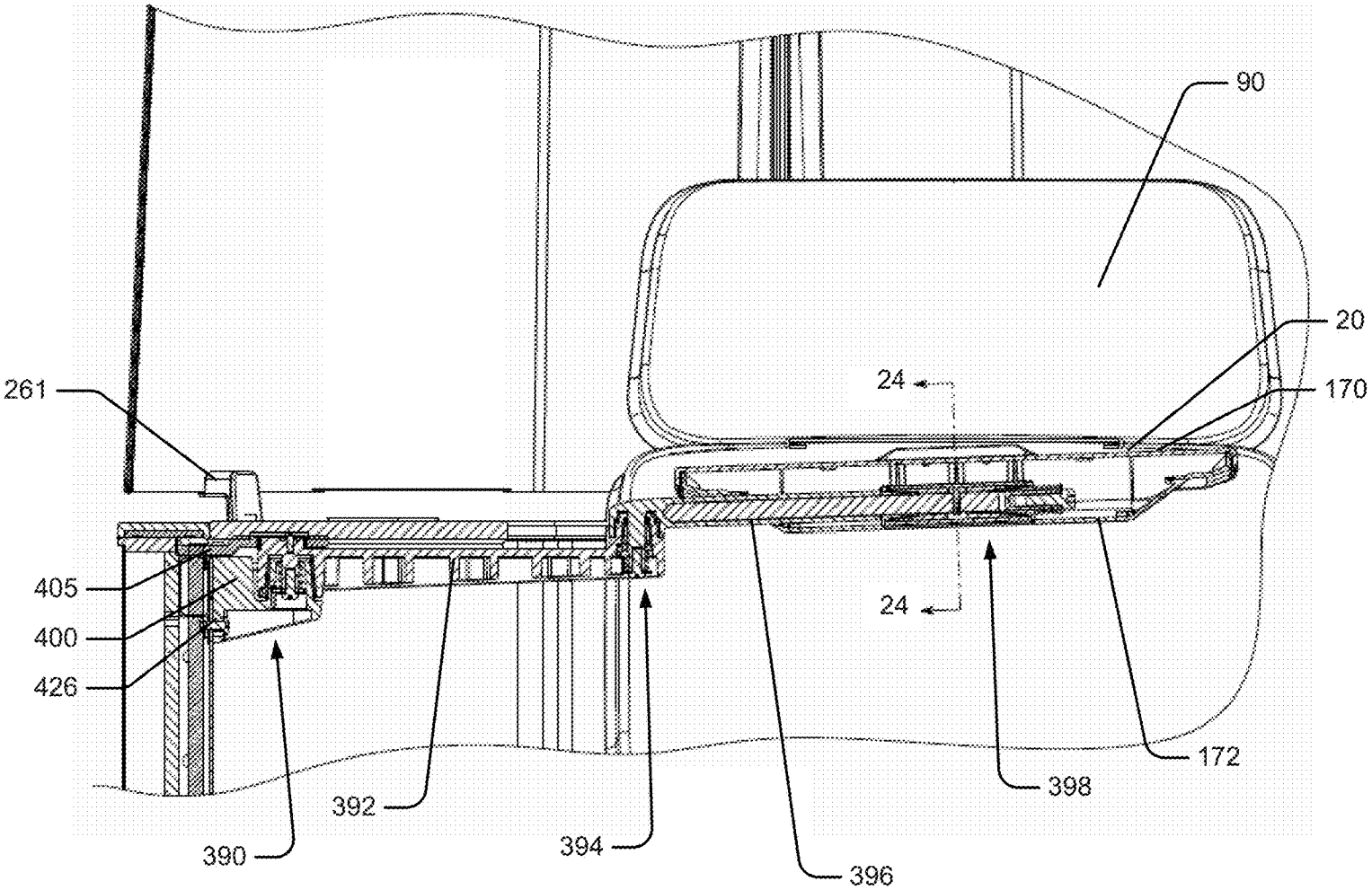
FIG. 23 is a cross-sectional view of the tablet and arm sub-assemblies taken along the line 23-23 in FIG. 24.
Figure 31:
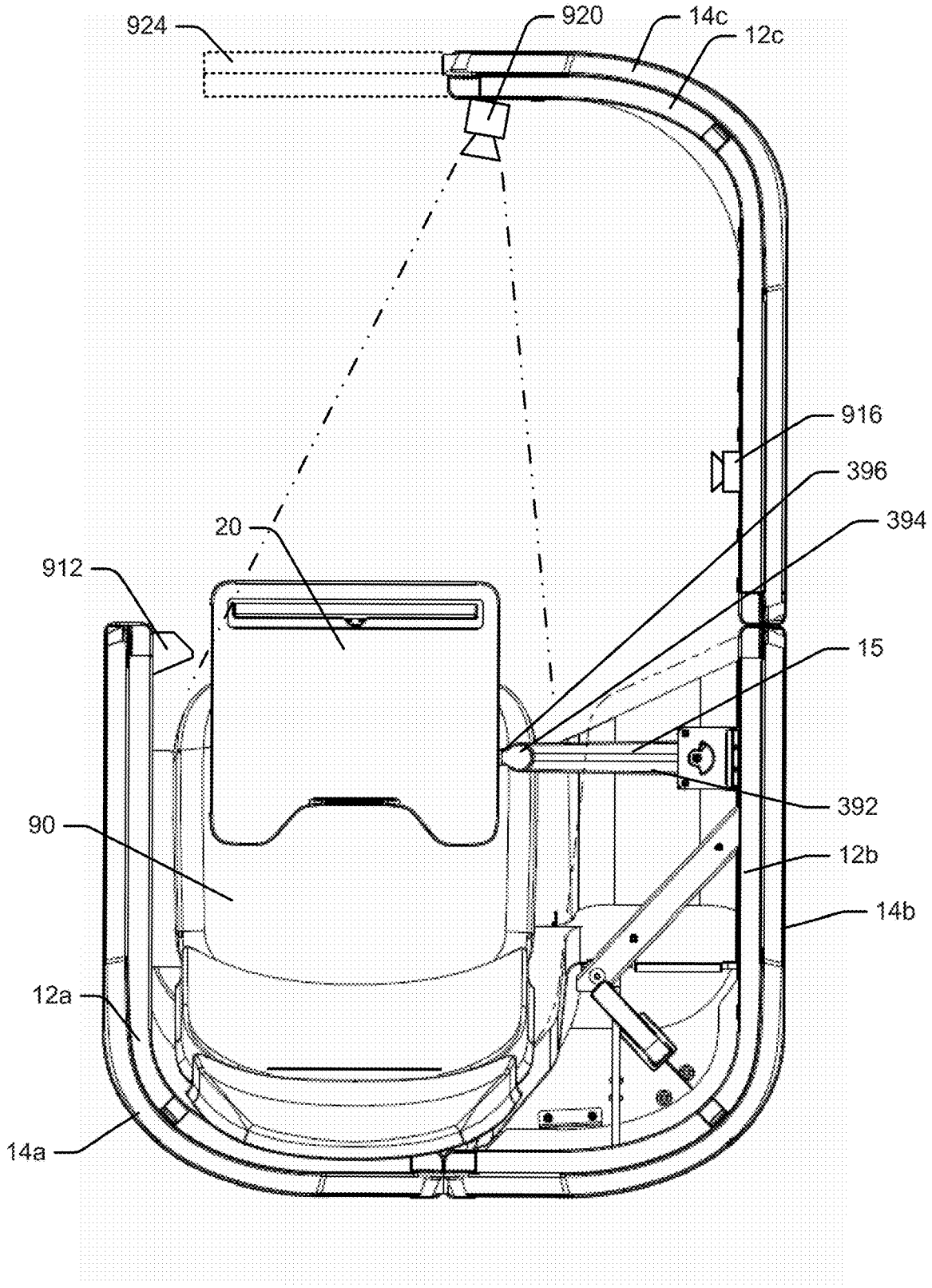
FIG. 31 is a top plan view of the assembly shown in FIG. 1, albeit with an upper shelf member shown in phantom and additional features including cameras and lighting shown.
Figure 32:
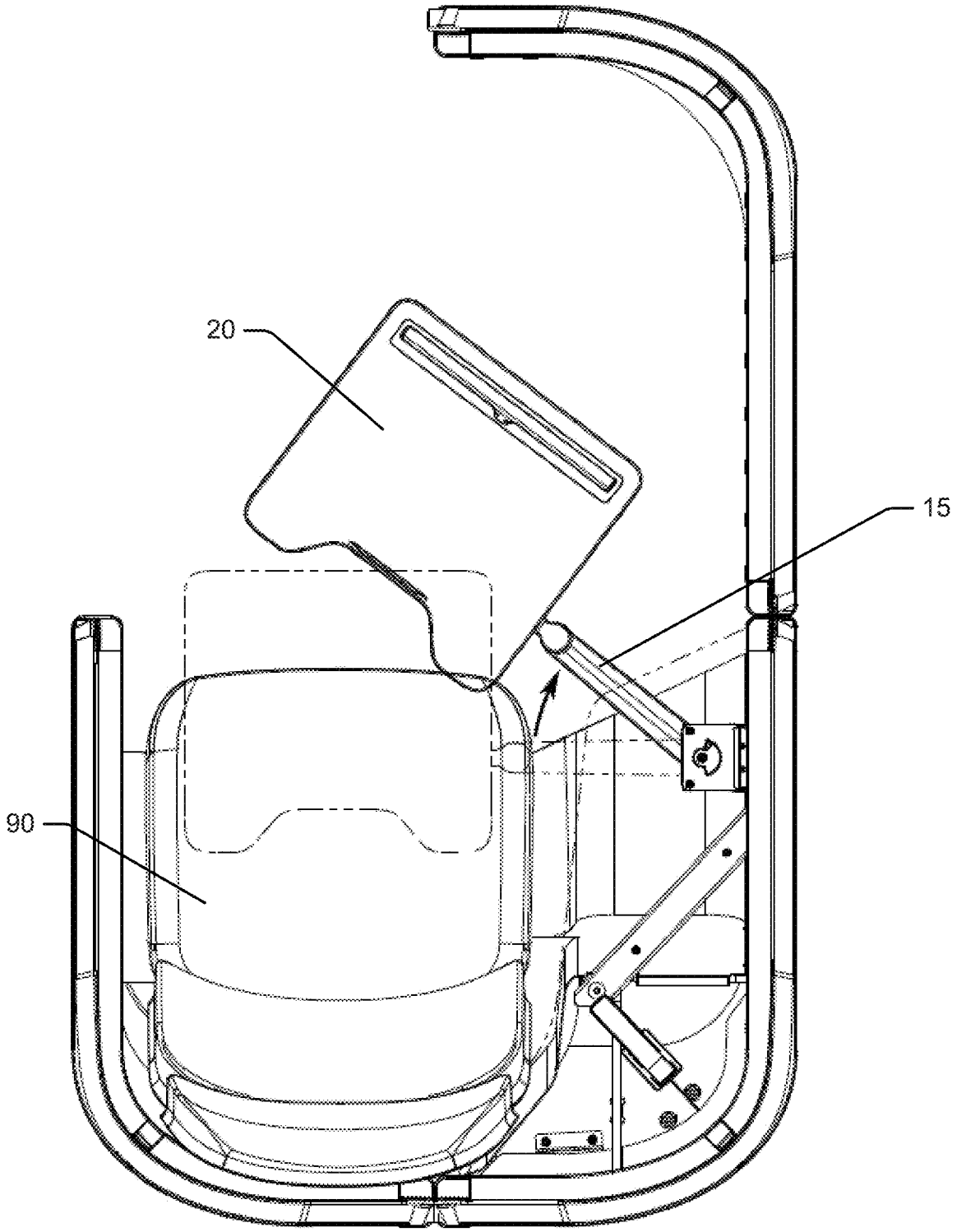
FIG. 32 is similar to FIG. 31, albeit showing a support arm and tablet supported thereby in a different position than shown in FIG. 31.

Referring now to FIGS. 31 through 33, the upper shelf member 22 is shown in phantom in each of those figures and the tablet assembly 20 is shown in three different positions including a use position in FIG. 31, a storage position in FIG. 33 and an intermediate position in FIG. 32. As shown, in each of the positions, the distal end of the arm member 392 extends past the side edge of the shelf member 22. The distal end of member 392 extending past the side edge of the shelf member is important as, in at least some embodiments, as shown in FIG. 23, the second or extension arm assembly 396 is mounted to the top surface of arm member 392 and therefore extends upward there from. Member 392 extending past the shelf edge ensures that at least the proximal end of assembly 396 will not collide with or otherwise contact the shelf member edge during movement.

Referring again to FIGS. 31 and 33, in at least some embodiments, arm member 392 rotation and assembly 396 rotation ranges are limited such that the tablet member 170 never contacts or collides with other rigid configuration structure. For example, rotation of first arm member 392 may be limited as in FIG. 33 to a maximum forward rotational position and tablet 20 rotation about the second vertical axis at pivot assembly 394 may be limited to a maximum forward position such that the tablet assembly 20 can come near the internal surface of lower wall structure 12*c* but cannot contact the internal surface. Thus, here, the combined limitations on angular rotation of the first arm member 392 and the arm assembly 396 along with the dimensions of the tablet and the relative location of the wall surface of wall structure 12*c* may prohibit collision of tablet 20 with the wall. Similarly, rotation about pivot assemblies 390 and 394 may be limited in the opposite directions so that the tablet cannot contact any other wall surfaces of the wall structures in the overall assembly 10.

Referring still to FIG. 33, in at least some embodiments, the range of rotation afforded by pivot assembly 390 may be less than 120 degrees and in some cases may be 90 degrees or less while the range of rotation afforded by pivot assembly 394 may be less than 120 degrees and may in some cases be less than 90 degrees. In particularly advantageous embodiments the range of rotation afforded by pivot assembly 390 is substantially 90 degrees and the range of rotation afforded by pivot assembly 394 is substantially 70 degrees, 35 degrees to either side of an axis that extends along the length of first arm member 392.

In at least some cases the range of rotation afforded by assembly 390 may be skewed to one side of a line tangent to the wall to which the arm assembly 15 is mounted. For instance, referring again to FIG. 33 where 700 represents an axis that is tangent to the surface of a wall to which arm assembly 15 is mounted, the ranges of motion forward and rearward about assembly 390 are represented by angles A1 and A2, respectively. Here, while A1 and A2 may be the same angles, in at least some particularly advantageous cases, angle A1 may be larger than angle A2. For instance, angle A1 may be 55 degrees while angle A2 is 35 degrees. Here, the smaller angle A2 may be selected in conjunction with other assembly characteristics (e.g., angles and length dimensions and locations of components) to eliminate the possibility of the tablet 20 colliding with other components (e.g., the side table member 22).

In some cases the length of the arm members that form assembly 15 may be considered when selecting rotation range limits of assemblies 390 and 394. For instance, where arm member 392 is relatively short, the range of rotation afforded by assembly 390 may have to be reduced to avoid collision.

Referring again to FIG. 24, the range of rotation afforded by the pivot assembly 398 may be less than 90 degrees and in some particularly useful embodiments the range may be 40 degrees or less. As shown in FIG. 24 in solid view, at one limit position the top surface of the tablet assembly 20 may be substantially horizontal. As shown in phantom, the other limit position may be angled downward from the front edge 364 to the rear edge 366 to form an acute angle with horizontal.

While the tilting action shown in FIG. 24 enables a user to tilt the tablet assembly 20 to a preferred position during use, typically there is no need to facilitate further tilting action. To this end, while some prior art tablet and support arm assemblies allow a user to stow a tablet substantially vertically, in the present case the stowed position is still out in the open (see again FIG. 33) and therefore there is no need for vertical positioning of the tablet assembly 20. In the present case, the tablet assembly remains in an exposed position at all times so that a potential user can understand how to use the tablet in an intuitive manner.

While the assembly 15 disclosed above facilitates placement of the tablet assembly 20 in a large number of positions with respect to the lounge 90, it is contemplated that other arm assemblies may also be used to perform the same functions. For instance, an arm assembly that does not include the second rotation assembly at 394 may still include rotation assembly 390 and tilt assembly 398 to support a reduced set of tablet positions. As another instance, an arm assembly may include rotation assemblies 390 and 394 but may not include tilt assembly 398. Other arm assemblies are contemplated.

In addition to the components above, an exemplary assembly 10 may include other options or affordances. For instance, see that a power receptacle 900 is mounted to an external surface of member 73 below the right hand side of the lounge assembly 90. Here, the faceplate of the receptacle may be recessed back from the front edge of the lounge assembly seat so that, while the receptacle is readily available and observable, the receptacle is located such that it will not substantially impede use of the space under the lounge. The illustrated receptacle includes two three prong outlets and a single USB power outlet configurations (e.g., just three prong and no USB, etc) are contemplated. Similarly, the receptacle arrangement 900 may also include one or two additional power outlets formed in a rear faceplate (not shown). One or more receptacles may be placed at other useful locations as well. For instance, in at least some cases a receptacle may be mounted to wall 76 as shown at 902 in FIG. 12. In other cases a receptacle may be mounted or otherwise located within a space behind wall 76 as shown in FIG. 12 at 904 for linking lighting or other devices that require power in a hidden fashion.

Referring again to FIG. 1, another additional alternative may include one or more light devices 910 supported by or integrally attached to side table member 20. In other embodiments a light device may be mounted to one of the upright screen posts. For instance, referring to FIG. 31, a low profile light 912 may be mounted to the top end of screen post 914 to direct light downward toward the top surface of tablet 20. In some cases there may be some type of sensor 916 (see again FIG. 31) within or associated with space 59 for sensing when someone is located within the space or assumes a seated position on lounge assembly 90. Here, the sensor 916 may trigger one or more lighting devices to turn on those devices automatically when a person assumes a trigger position (e.g., enters space 59, is seated, etc.). The sensor 916 may be a motion sensor, a noise sensor, a presence sensor, etc. In some cases lighting may default on and there may be a controller for a space user to adjust or turn off lighting when desired.

Referring still to FIG. 31, another accessory may include a camera 920 for video conferencing. In at least some embodiments the camera may be mounted to a wall or screen spaced in front of lounge assembly 90 so that a field of view of the camera id directed toward and includes the space in front of the lounge. In this case, in some embodiments, the distal end of the wall assembly 12*c* and screen assembly 14*c* may be constructed to extend further as shown at 924 in phantom so that the camera can be placed directly in front of a person residing on the lounge assembly 90.

Figure 34:
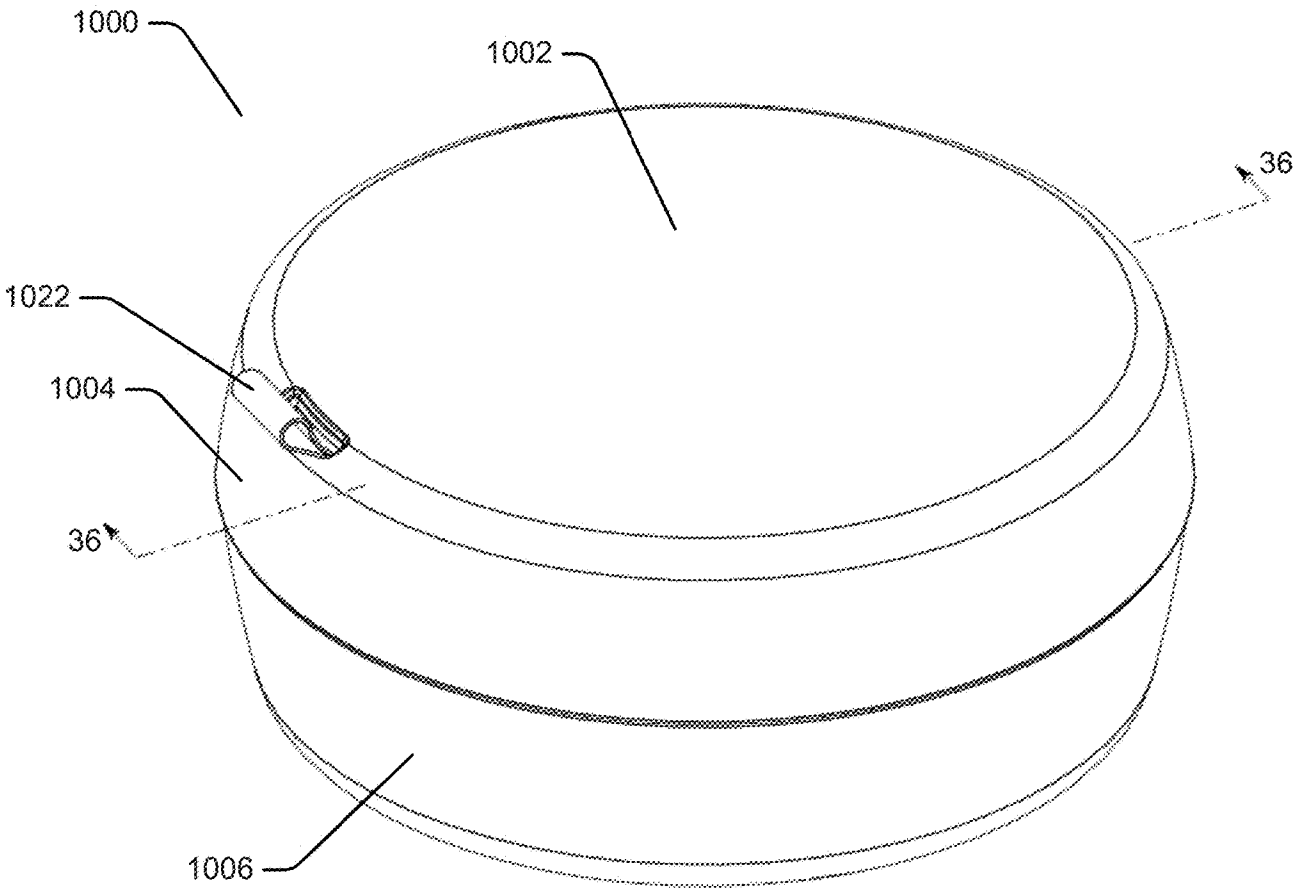
FIG. 34 is a perspective view of a footstool that may be included with the FIG. 1 assembly.
Figure 35:
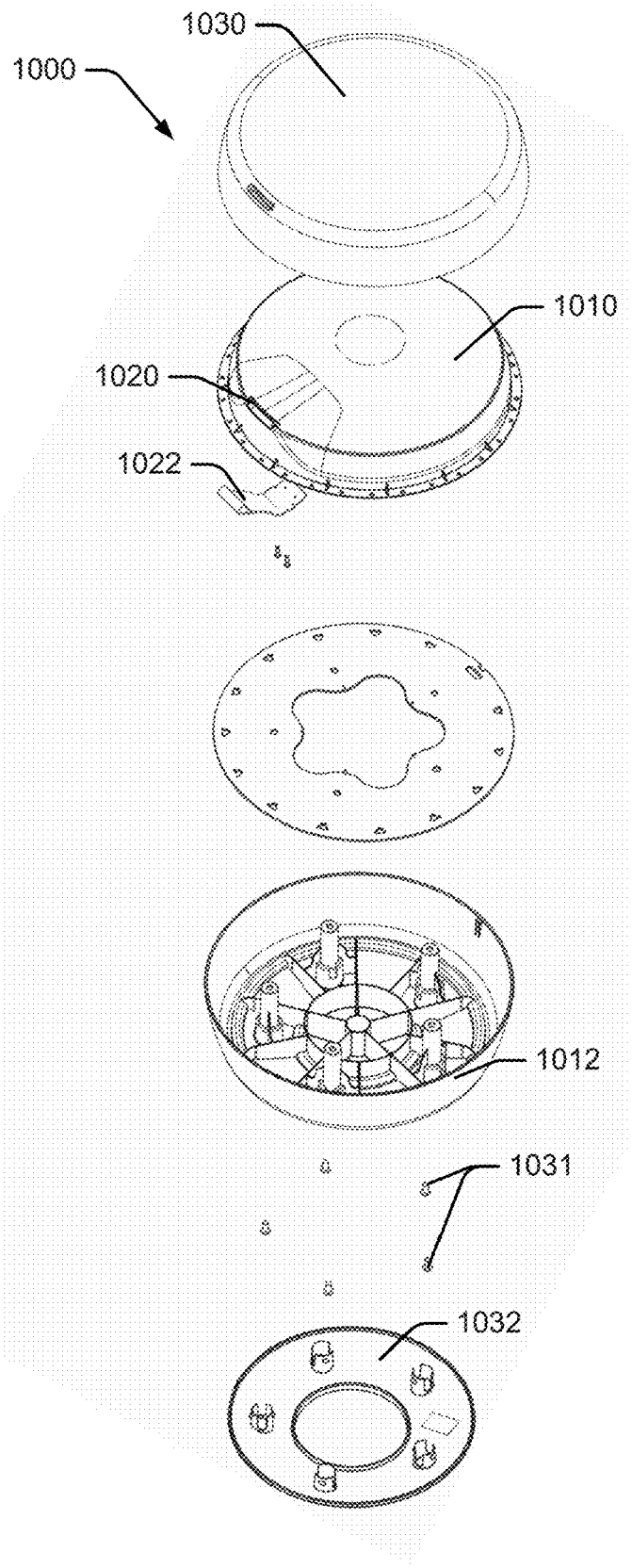
FIG. 35 is an exploded view of the footstool shown in FIG. 34.
Figure 36:
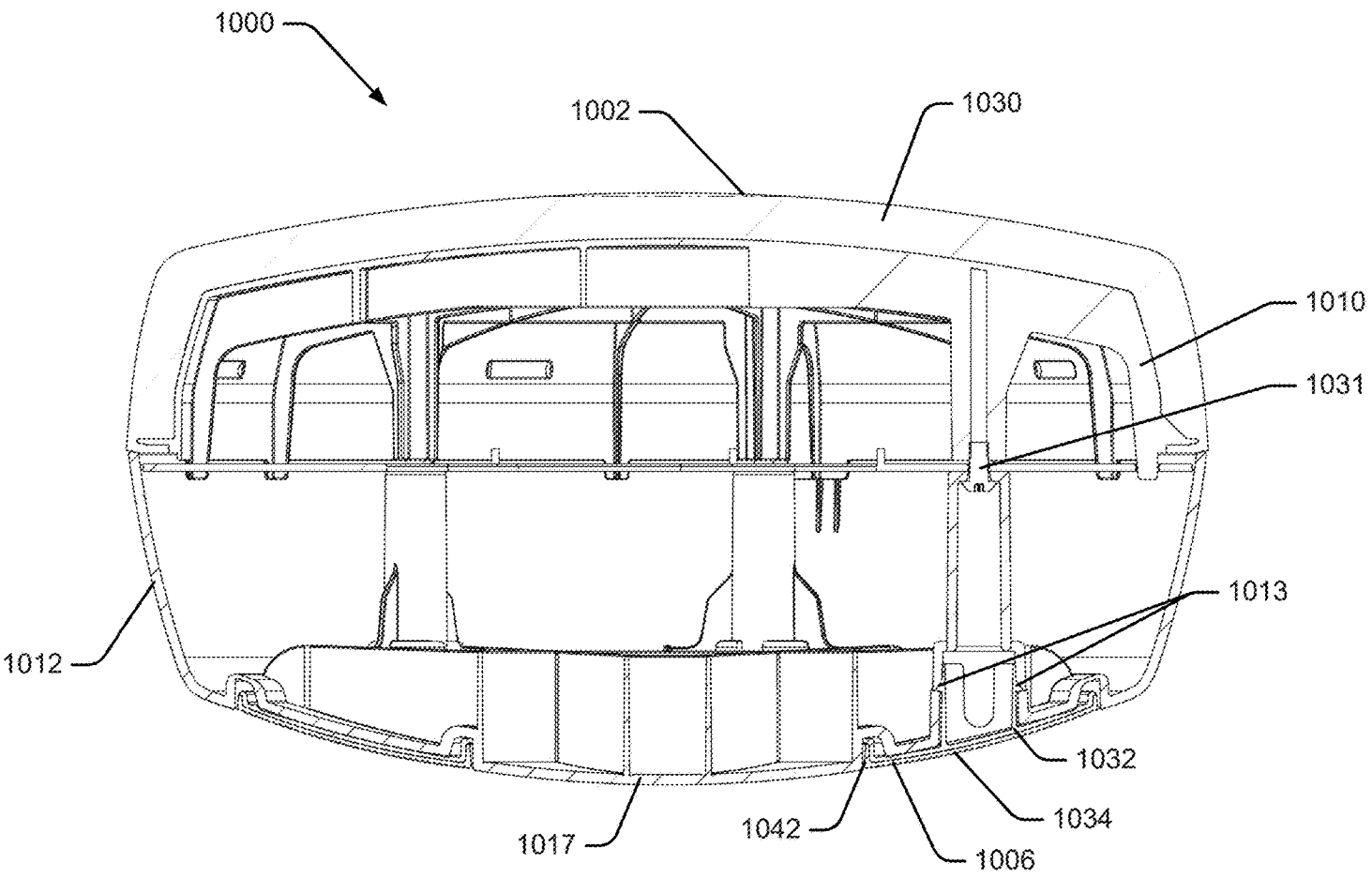
FIG. 36 is a cross-sectional view taken along the line 36-36 in FIG. 34.

In at least some embodiments a footrest may be provided along with each assembly 10. An exemplary footrest 1000 is shown in FIGS. 34 through 36. Footrest 1000 has a generally contoured external cylindrical or barrel shape with a top surface 1002, a barrel shaped side surface 1004 and an undersurface 1006. As seen in FIGS. 35 and 36, the basic shape of assembly 1000 is created using upper and lower molded structural components 1010 and 1012, respectively, that are screwed together via screws 1031 that pass through channels formed in lower structure 1012 and pass into threaded apertures that are formed by the upper structural member 1010. In some embodiments the molded components are formed out of plastic or metal. The upper structural component 1010 forms a slot opening 1020 near a top end and forms two posts 1024 that form threaded apertures in an internal portion of component 1010 proximate the slot opening 1020. A loop shaped handle 1022 may be fed through the slot opening 1020 and secured to the posts 1024 via screws. In at least some embodiments the handle 1022 may be formed out of mesh metal, cable, etc., so that the loop can be used to secure the assembly 1000 in some fashion to the assembly 10. For instance, a security cable may be mounted to loop 1022 and to a portion of assembly 10 (e.g., the lower shelf structure 16 or other structure) so that a system user is encouraged to leave the assembly 1000 with assembly 10. To increase security, posts 1024 may be metal or otherwise reinforced.

Referring still to FIGS. 34 through 36, a cushion member 1030 is secured to the top surface of member 1010 to provide a comfortable support surface. In at least some embodiments the cushion member may be over molded onto the upper structural member 1010.

A lower base member 1032 that is formed of metal or rigid plastic is mounted to an undersurface of the lower structure 1012. To this end, base member 1032 forms five upwardly extending post members that include mechanical couplers (e.g., resilient finger members 1013 *see FIGS. 35 and 36) adjacent top edges that frictionally cooperate with coupling structure within the screw passages formed by lower member 1012 so that the posts can be friction fit into the passages to connect member 1032 to member 1012. A rubber skid disc 1034 with a central opening 1007 is adhered or otherwise attached to a lower surface of member 1032. Disc 1034 is tacky so that the assembly 1000 will not slide easily on an ambient floor surface when the disc portion of the bottom of the footrest is contacting the floor surface below. A central portion 1017 of lower member 1012 extends through an opening 1041 in disc 1034 and stands proud of the rubber disc 1034 and in at least some cases may be convex downward so that the footrest can be slid easily on a supporting floor surface when balanced on the central portion of the undersurface. Referring yet again to FIGS. 34 through 36, the convex downward shape of the overall footrest configuration enables the rest assembly 1000 to rock to any side when force is applied to a lateral portion of the top surface of cushion 1030. Thus, assembly 1000 has several stable positions when different forces are applied thereto and a user may set the assembly in any comfortable position she chooses. When rest 1000 is tilted slightly so that a surface of disc 1034 contacts a supporting floor surface, friction between the undersurface of the disc and the floor surface causes the rest to remain stationary.

In at least some embodiments assembly 1000 will have a height that is less than the lowermost portion of the structure that forms lounge 90 so that assembly 1000 may be slid under and stored under the lounge seat in storage space 600 (see FIG. 1) when not in use.

Figure 37:
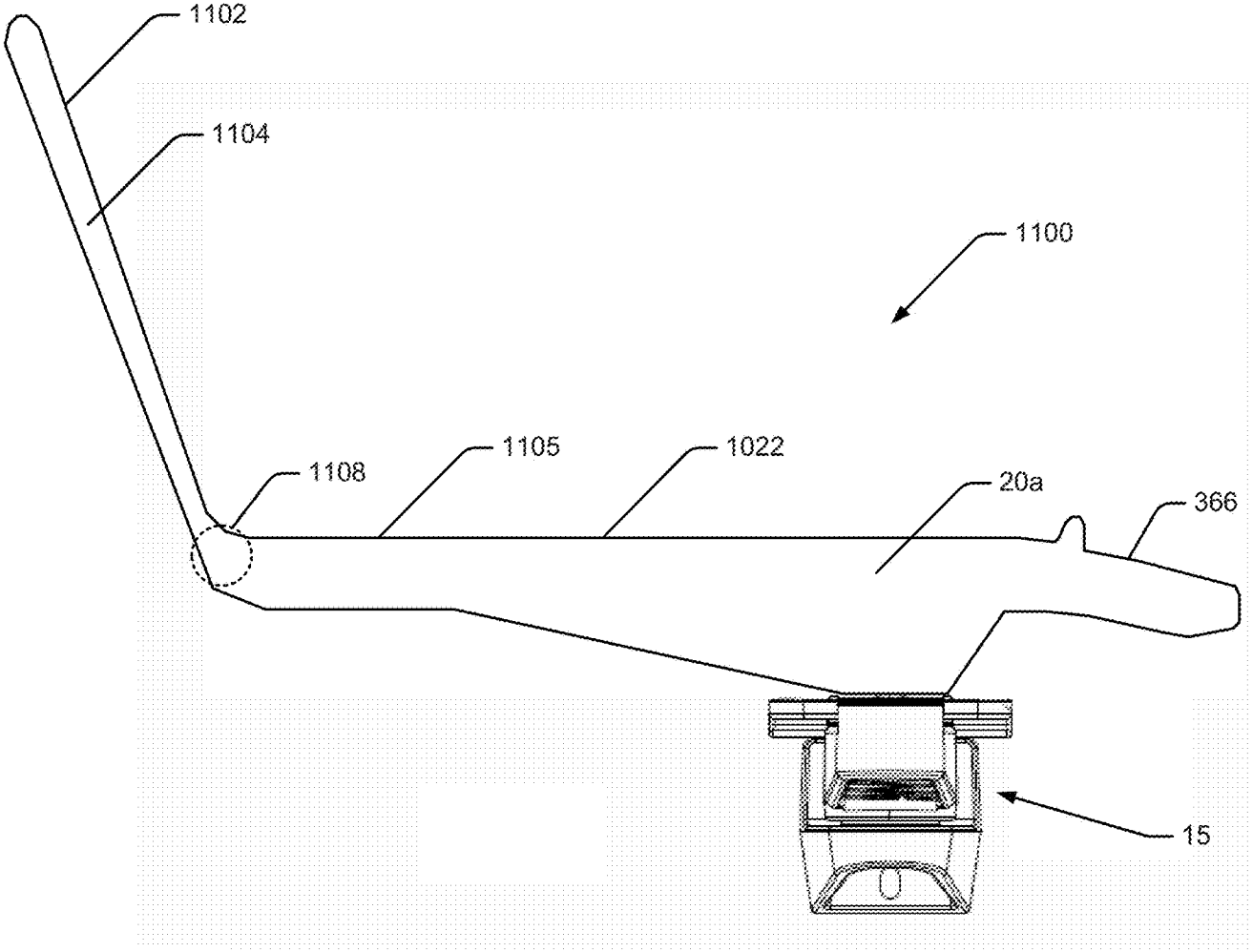
FIG. 37 is a schematic view showing a differently shaped tablet sub-assembly that may or may not include one or more emissive surfaces.

It has been recognized that devices used to access information, communicate, etc., have been changing rapidly and that, in at least some cases, interfaces may be provided for general use in some cases so that traveling persons need not carry their own devices to access information. To this end, in at least some embodiments it is contemplated that some type of display for interfacing may be presented as part of an assembly 10. For instance, see FIG. 37 where a modified tablet assembly 1100 includes a built in display screen 1102. In the exemplary assembly 1100, in at least some embodiments all of the components would be identical to or similar to the components described above. In FIG. 37 the primary difference is that the tablet assembly 20*a* includes a portion 1104 that extend upward at a set angle from a top work surface 1105 of the tablet assembly near the rear edge and screen 1102 is built into portion 1104 to generally face a rear tablet edge 366. In this case, when a person intends to use screen 1102, the user has to log on to a server that drives screen 1102 in some fashion after which content may be displayed on screen 1102. Log on may require entry of a user's name and password or may be automated based on the server identifying a user via biometrics (e.g., face, eye, finger print, etc.) or some personal device carried by the user (e.g., a smart phone, an ID badge, etc.).

In still other cases, an entire upper surface of a tablet assembly (see again 20 in FIG. 1) may be emissive to operate as an interface device for a travelling user. In FIG. 37, the entire upper surface 1105 and the rearward facing surface of display 1102 may be emissive with emissive surface 1105 being used primarily for input (e.g., via virtual control tools) and the emissive surface of 1102 being used primarily for output (e.g., as a content display).

Referring yet again to FIG. 37, in still other embodiments, a hinge or the like may be provided at 1108 so that the angle of display 1102 relative to surface 1105 can be adjusted to suit specific preferences of a user.

Figure 38:
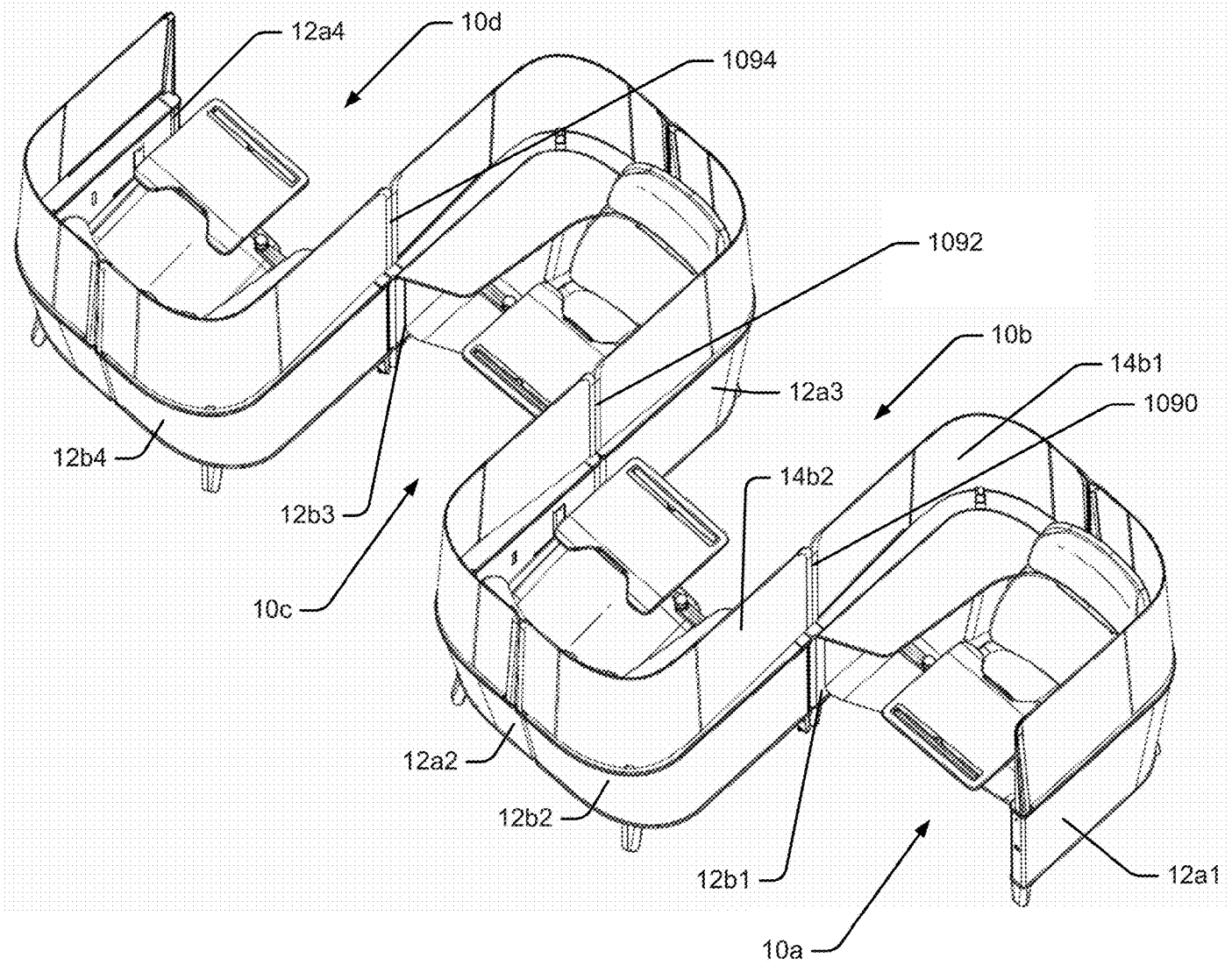
FIG. 38 is a perspective view of four lounge assemblies similar to the lounge assembly shown in FIG. 1, arranged to support four individuals within a work environment.

While the assemblies 10 described above include structure for supporting a single occupant or user at a time, it is contemplated that two or more assemblies like those described above or having slight modifications could be arranged to support two or more occupants in a space efficient arrangement. To this end, see for instance FIG. 38 where four partial assemblies 10*a*, 10*b*, 10*c* and 10*d* are illustrated in a zigzag arrangement to accommodate four space users. Here, each partial assembly includes most of the structure described above with respect to assembly 10. There are two primary differences between each of the partial subassemblies 10*a* through 10*d* and assembly 10 described above. First, while assembly 10 includes three lower wall subassemblies 12*a*, 12*b* and 12*c* and associated upper screen assemblies, each subassembly 10*a* through 10*d* only includes the two rear lower wall subassemblies. For instance, first partial assembly 10*a* only includes lower wall subassemblies 12*a*1 and 12*b*1, second partial assembly 10*b* only includes lower wall subassemblies 12*a*2 and 12*b*2, etc. Second, the end of wall assembly 12*b*1 opposite wall assembly 12*a*1 is aligned with the end of wall assembly 12*b*2 instead of being aligned with the missing wall assembly 12*c* as in assembly 10 above. Here, a hybrid dual bracket assembly 1090 is required to link the adjacent screen assemblies 14*b*1 and 14*b*2. In this regard, if a hybrid dual bracket were not used, adjacent screen assemblies 14*b*1 and 14*b*2 would angle in opposite directions (e.g., one into the space formed by assembly 10*a* and one into the space formed by assembly 10*b*). The hybrid bracket at 1090 would likely include two vertically upright bracket members centrally located with respect to the thickness dimension of the top caps on the lower wall assemblies 12*b*1 and 12*b*2 so that there would be a relatively smooth transition between the upper screens associated with the first and second partial assemblies 10*a* and 10*b*. Similar hybrid dual bracket members would be provided at 1092 and 1094 between adjacent screen sections associated with partial assemblies 10*b* and 10*c* and with partial assemblies 10*c* and 10*d*, respectively.

Figure 39:
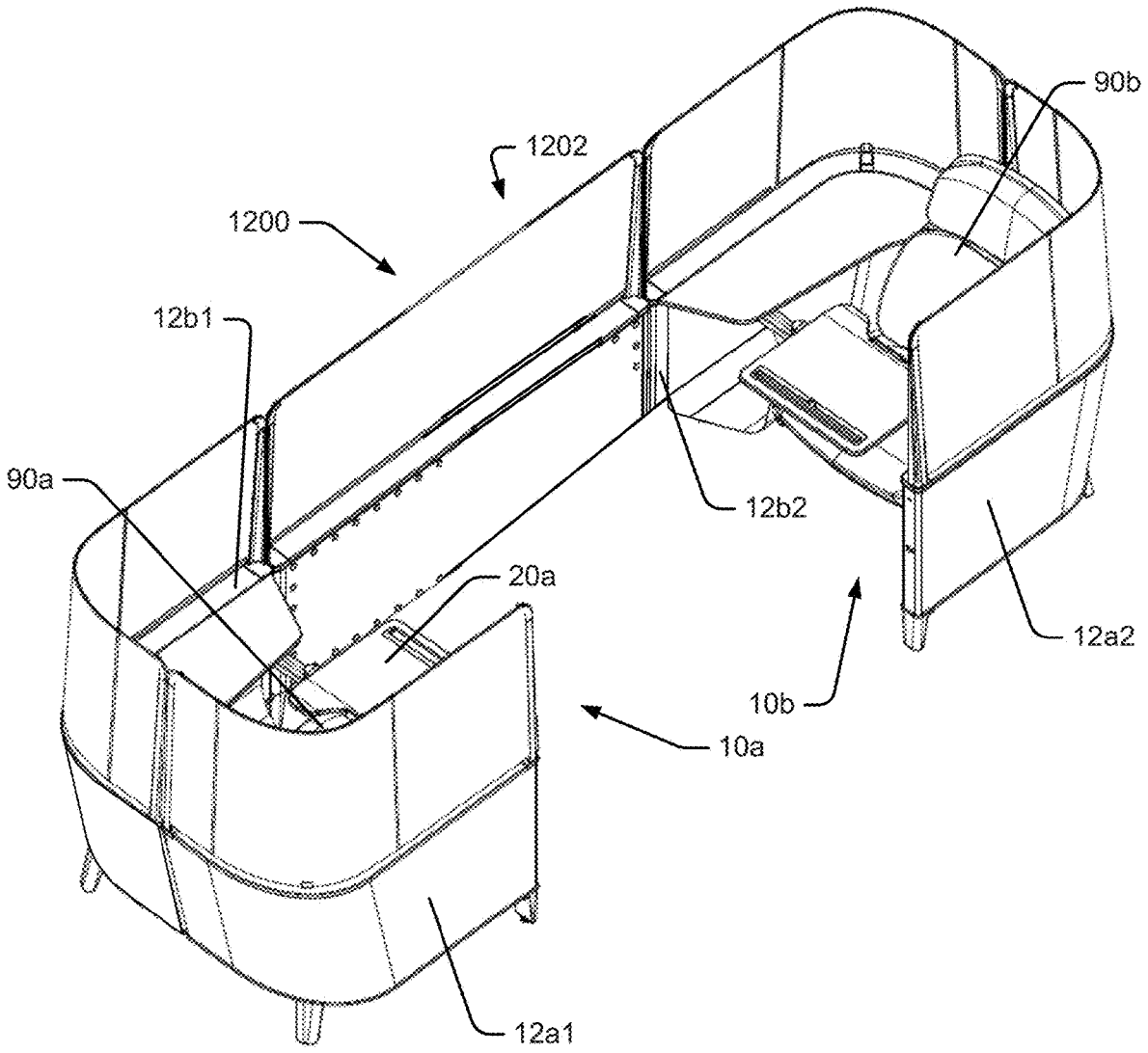
FIG. 39 shows two sub-assemblies similar to the assembly shown in FIG. 1 arranged to support two facing persons.

Referring to FIG. 39, a two person personal space arrangement 1200 is shown that includes two partial assemblies 10*a* and 10*b* and an intermediate wall assembly 1202. Here, each partial assembly 10*a* and 10*b* is essentially identical to assembly 10 described above except that each partial assembly 10 and 10*b* does not include the third lower wall assembly 12*c* and associated upper screen assembly described above. Instead, intermediate straight wall assembly 1202 is mounted to wall assemblies 12*b*1 and 12*b*2. As shown, lounges 90*a* and 90*b* face each other and there is a common entry to the assembly 1200 for both space users.

Figure 40:
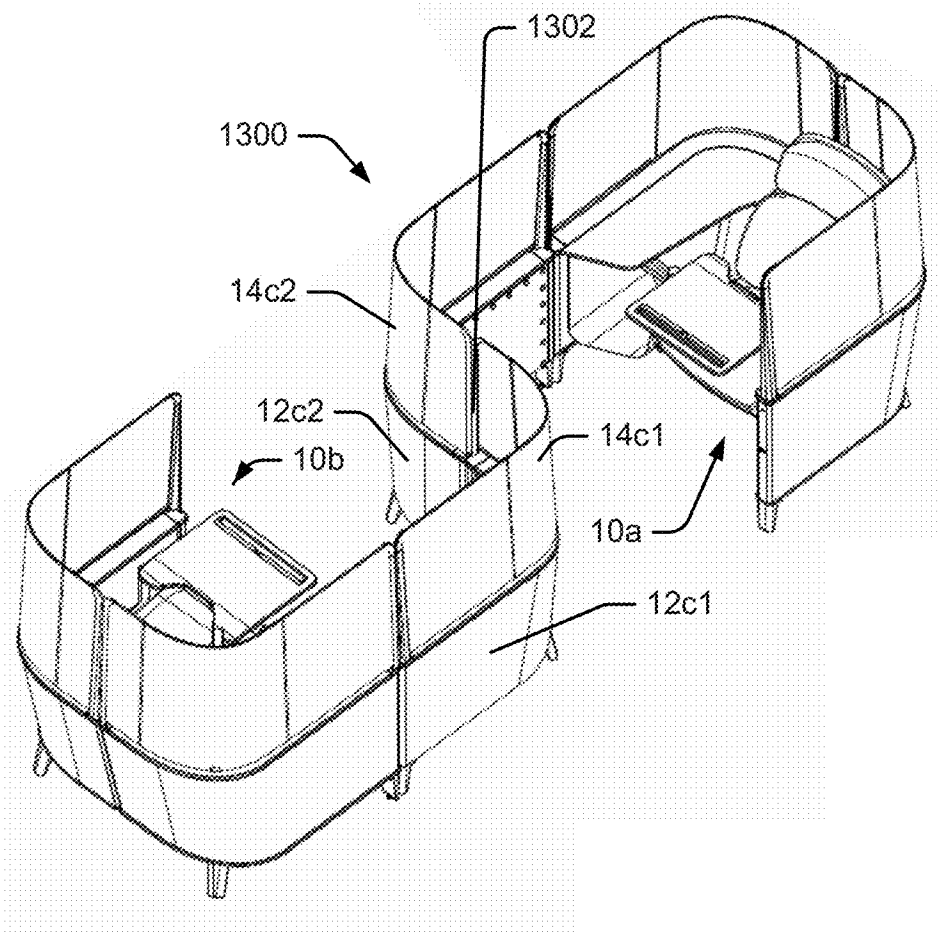
FIG. 40 includes two sub-assemblies similar to the assembly shown in FIG. 1 arranged in a particularly advantageous configuration to support two users.

Referring to FIG. 40, yet another configuration 1300 is illustrated that includes two assemblies 10*a* and 10*b* that are each essentially identical to assembly 10 described above. Here, the six wall subassemblies that make up assemblies 10*a* and 10*b* are arranged so as to form an S-shape when viewed from above with distal ends of wall assemblies 12*c*1 and 12*c*2 aligned with each other. In the illustrated case, while distal ends of wall structures 12*c*1 and 12*c*2 are aligned and immediately adjacent each other, those wall structures are not securely attached to each other in any fashion. In the alternative, a hybrid dual bracket assembly 1302 akin to the dual bracket assembly 1090 described above with respect to FIG. 38 may be provided to secure screen assemblies 14*c*1 and 14*c*2 together.

Still other embodiments that are based on the basic structures described above are contemplated. To this end, see FIG. 41 that shows another configuration 1400 that includes a set of lower wall subassemblies 12*x*, 12*y* and 12*z* and upper screen subassemblies 14*x*, 14*y* and 14*z*, two intermediate straight wall subassemblies 1402 and 1404, a sofa type seating arrangement 1410 and other components. Lower wall subassemblies 12*x*, 12*y* and 12*z* are akin to lower wall subassemblies 12*a*, 12*b* and 12*c*, respectively, described above and upper screen subassemblies 14*x*, 14*y* and 14*z* are akin to screen subassemblies 14*a*, 14*b* and 14*c*, respectively, described above. Intermediate wall assemblies 1402 and 1404 are similar to the straight intermediate wall assembly 1202 described above with respect to FIG. 39. Intermediate wall subassembly 1402 is secured between assemblies 14*x* and 14*y* in the manner described above using dual bracket members and wall subassembly 1404 is secured between assemblies 14*y* and 14*z* in a similar fashion to form a larger space 1459.

Figure 41:
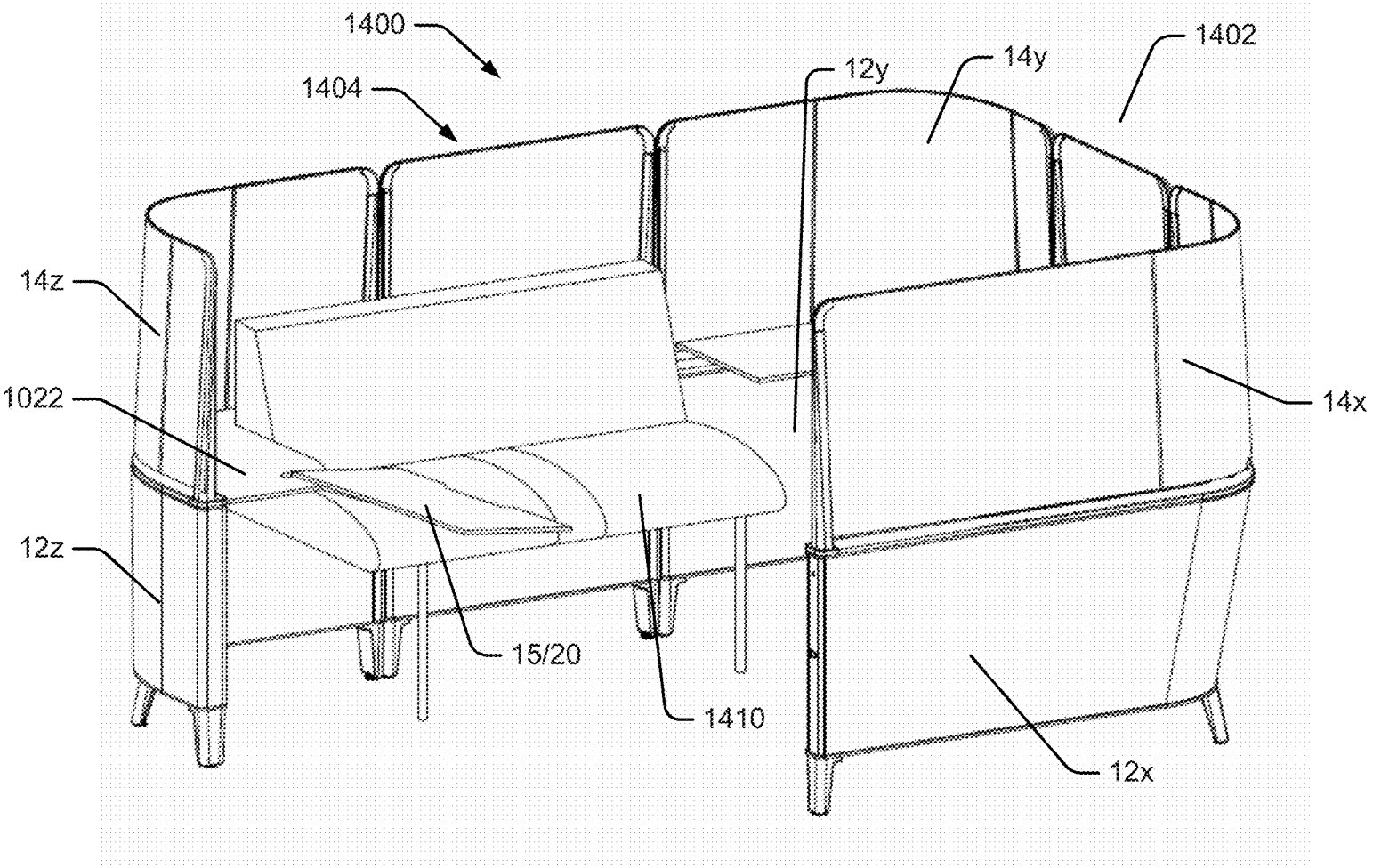
FIG. 41 shows yet another embodiment including a lounge assembly and additional wall and screen sub-assemblies that is consistent with at least some aspects of the present disclosure.
Figure 42:
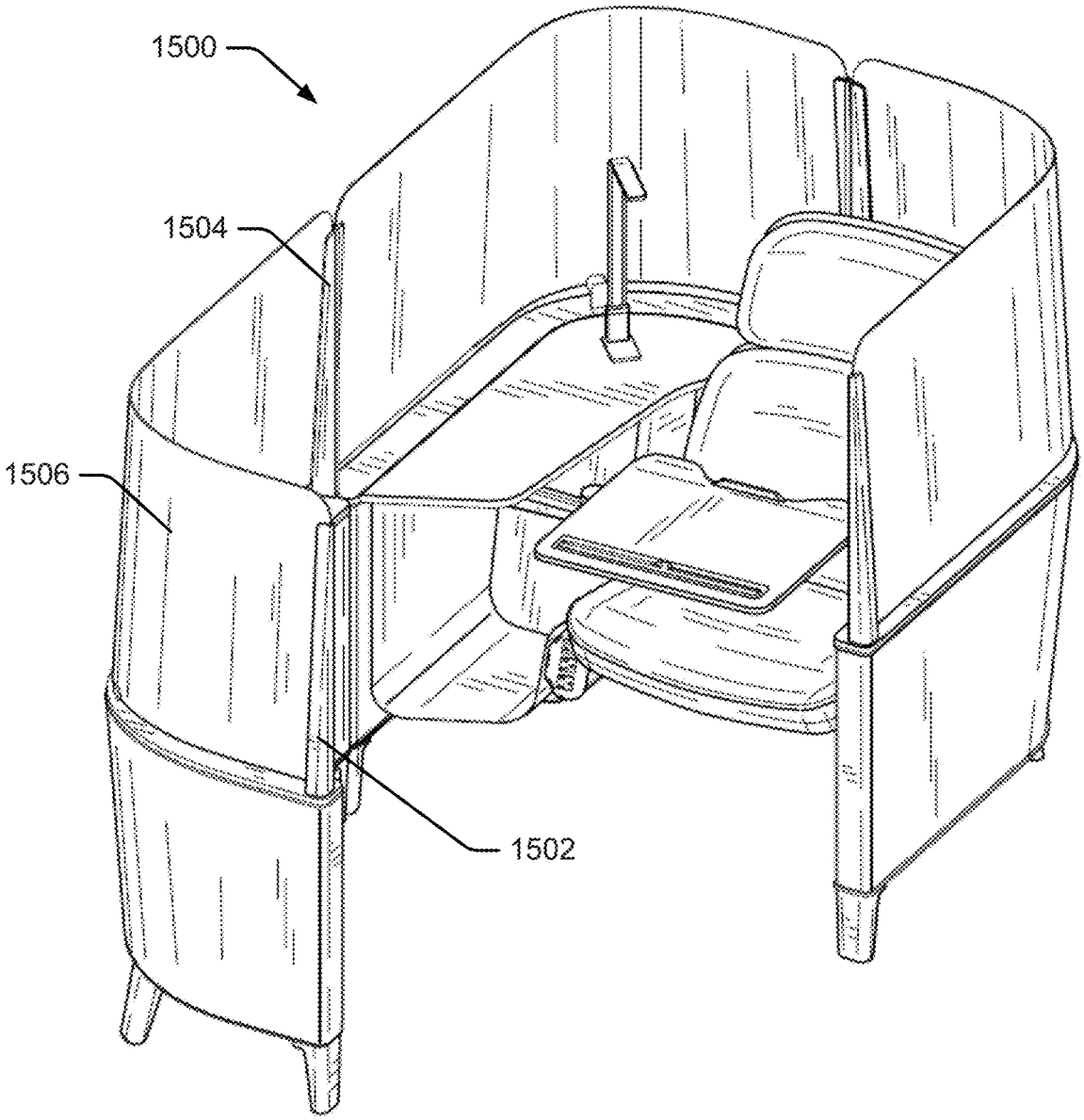
FIG. 42 is a perspective view of one other exemplary personal workspace assembly, albeit where the assembly includes brackets and associated upper screen structures that have a different configuration than that shown in FIG. 1.
Figure 43:
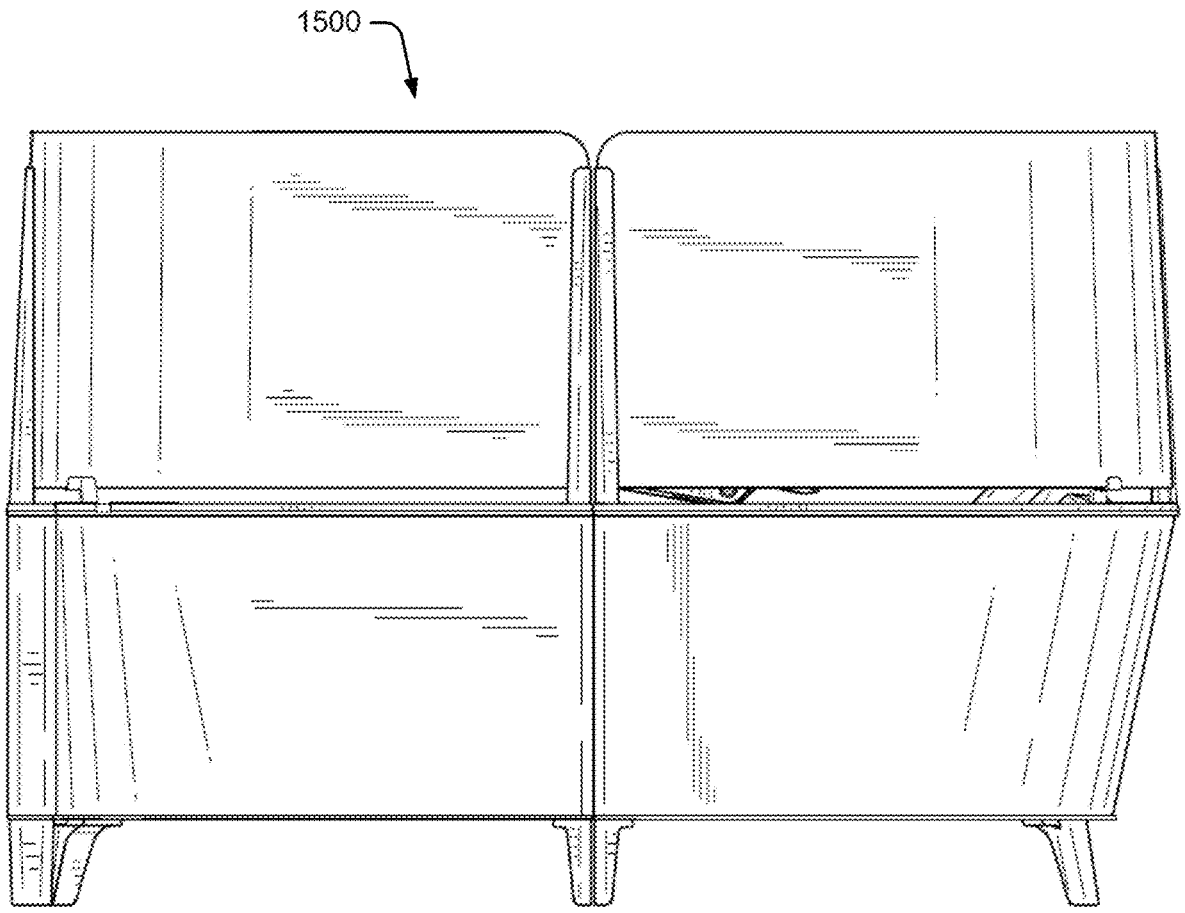
FIG. 43 is a side plan view of the assembly shown in FIG. 42.
Figure 44:
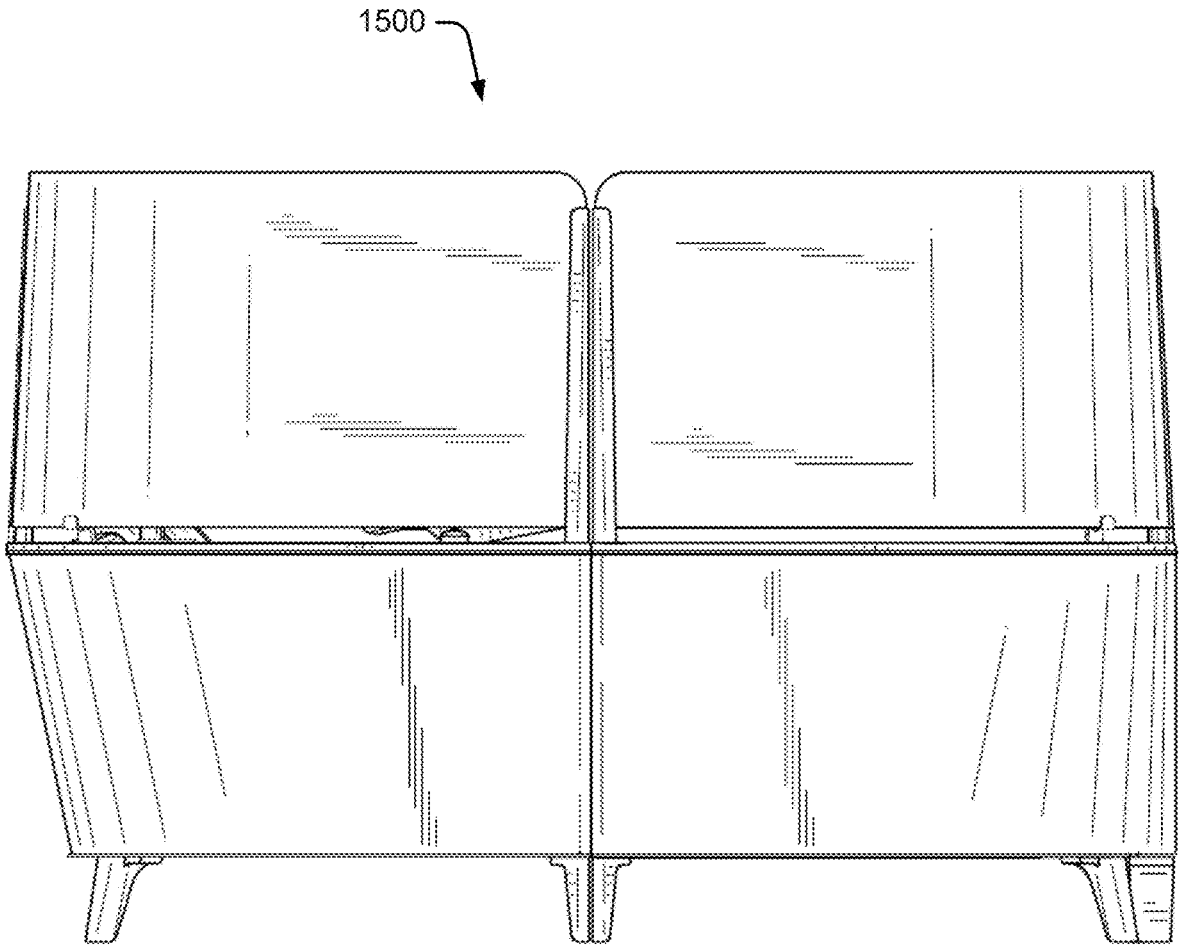
FIG. 44 is an opposite side plan view of the assembly shown in FIG. 42.
Figure 45:
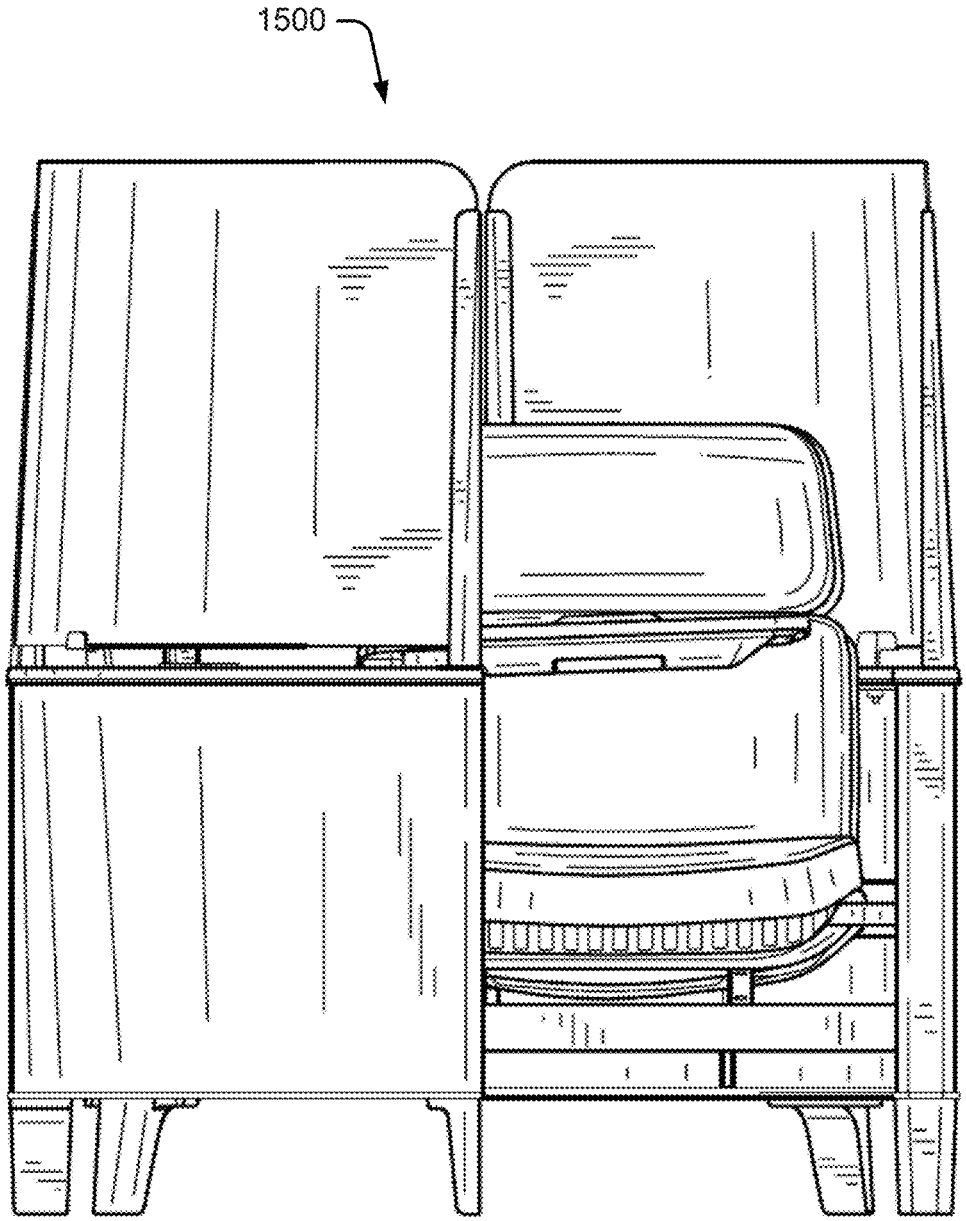
FIG. 45 is a front plan view of the assembly shown in FIG. 42.
Figure 46:
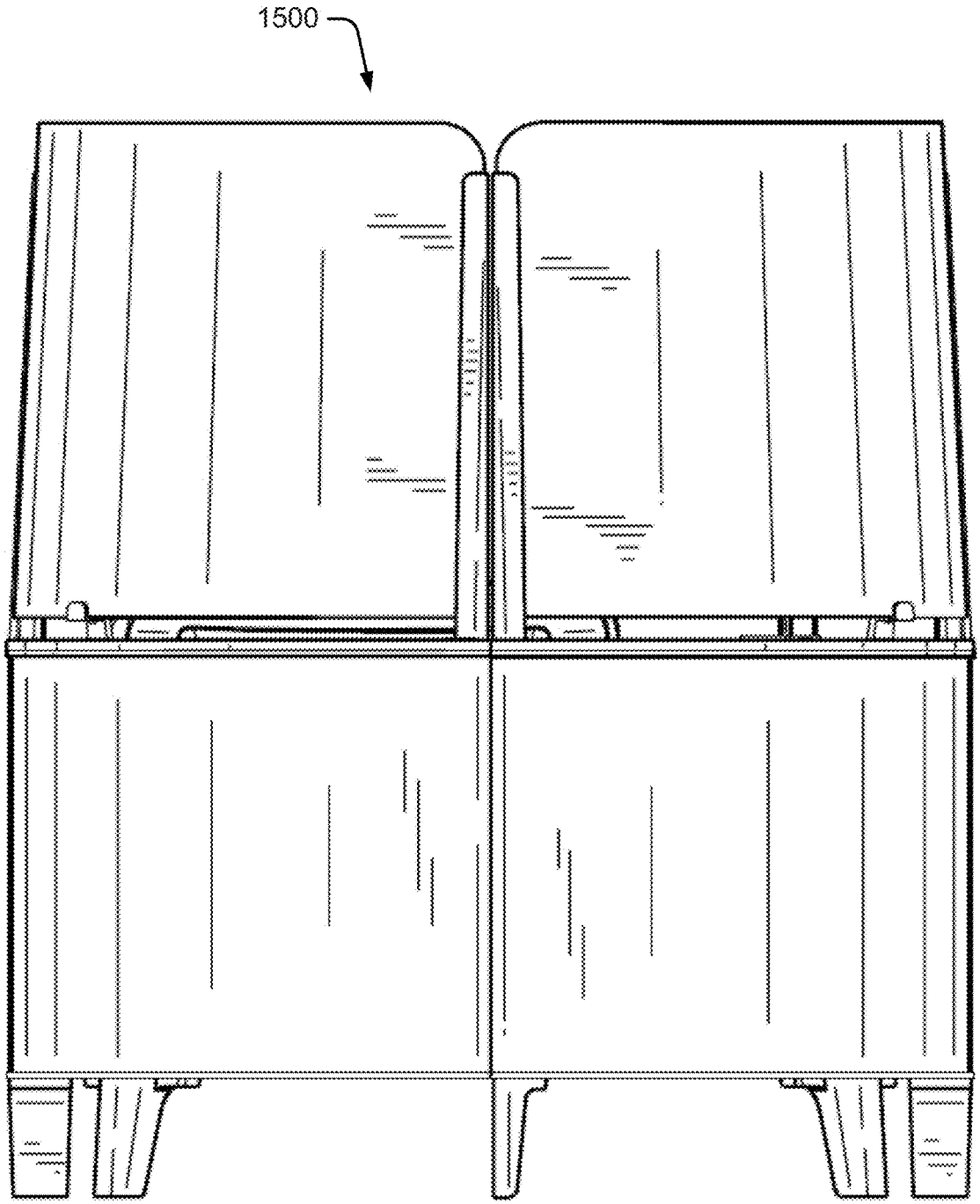
FIG. 46 is a rear plan view of the assembly shown in FIG. 42.
Figure 47:
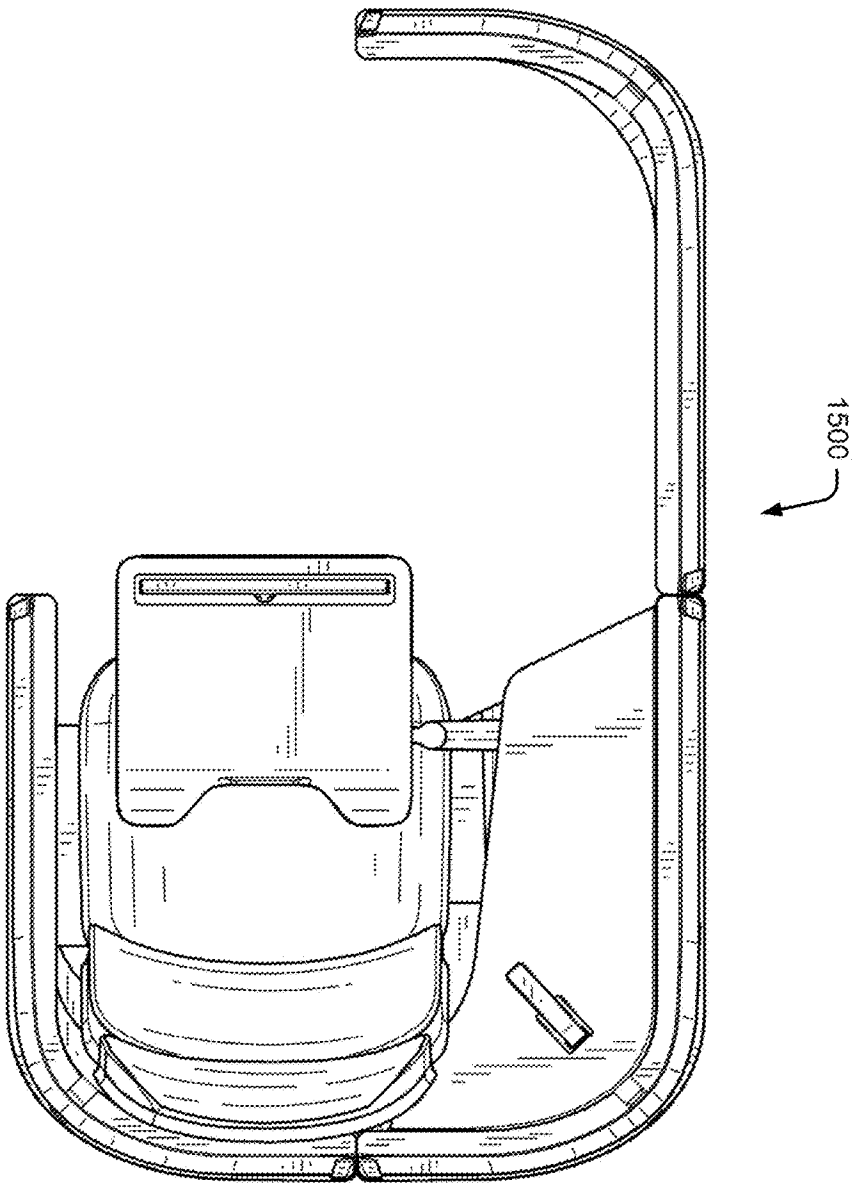
FIG. 47 is a top plan view of the assembly shown in FIG. 42.
Figure 48:
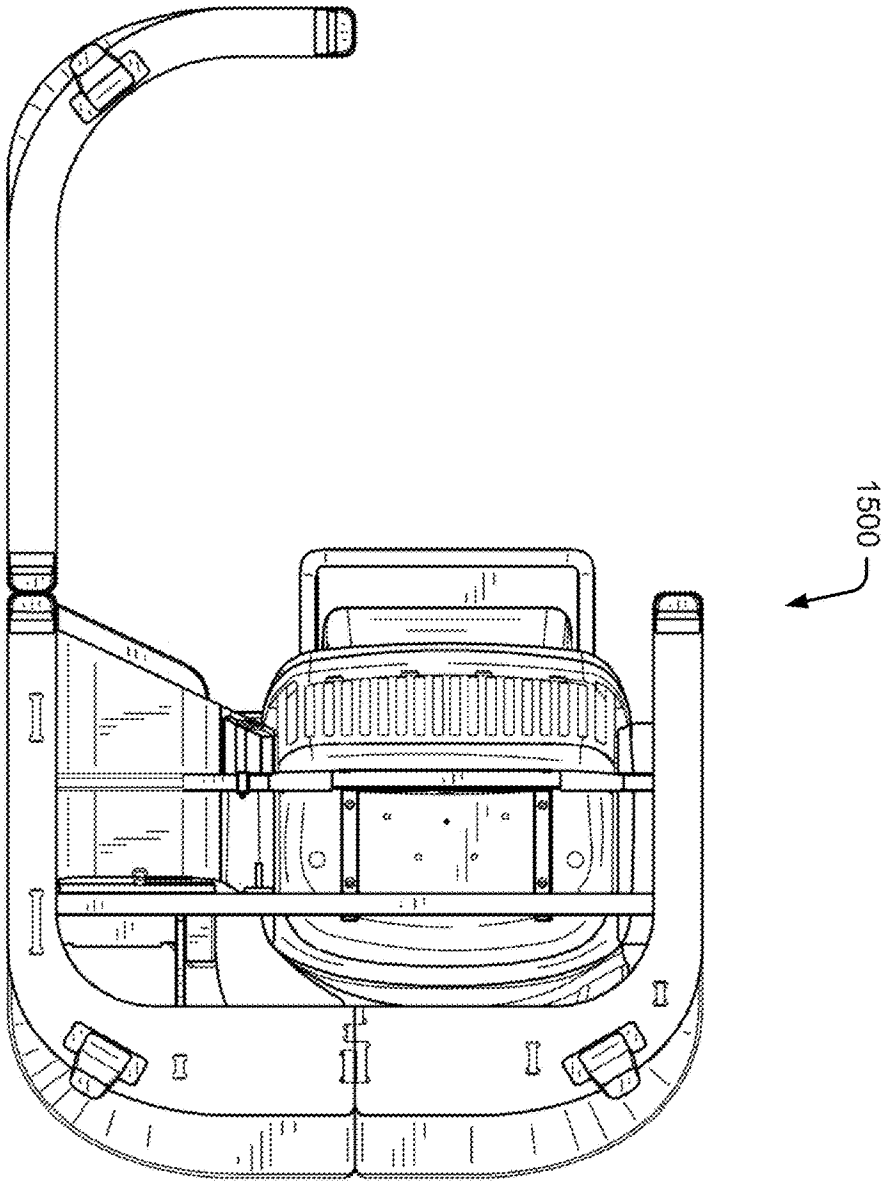
FIG. 48 is a bottom plan view of the assembly shown in FIG. 42.
Figure 49:
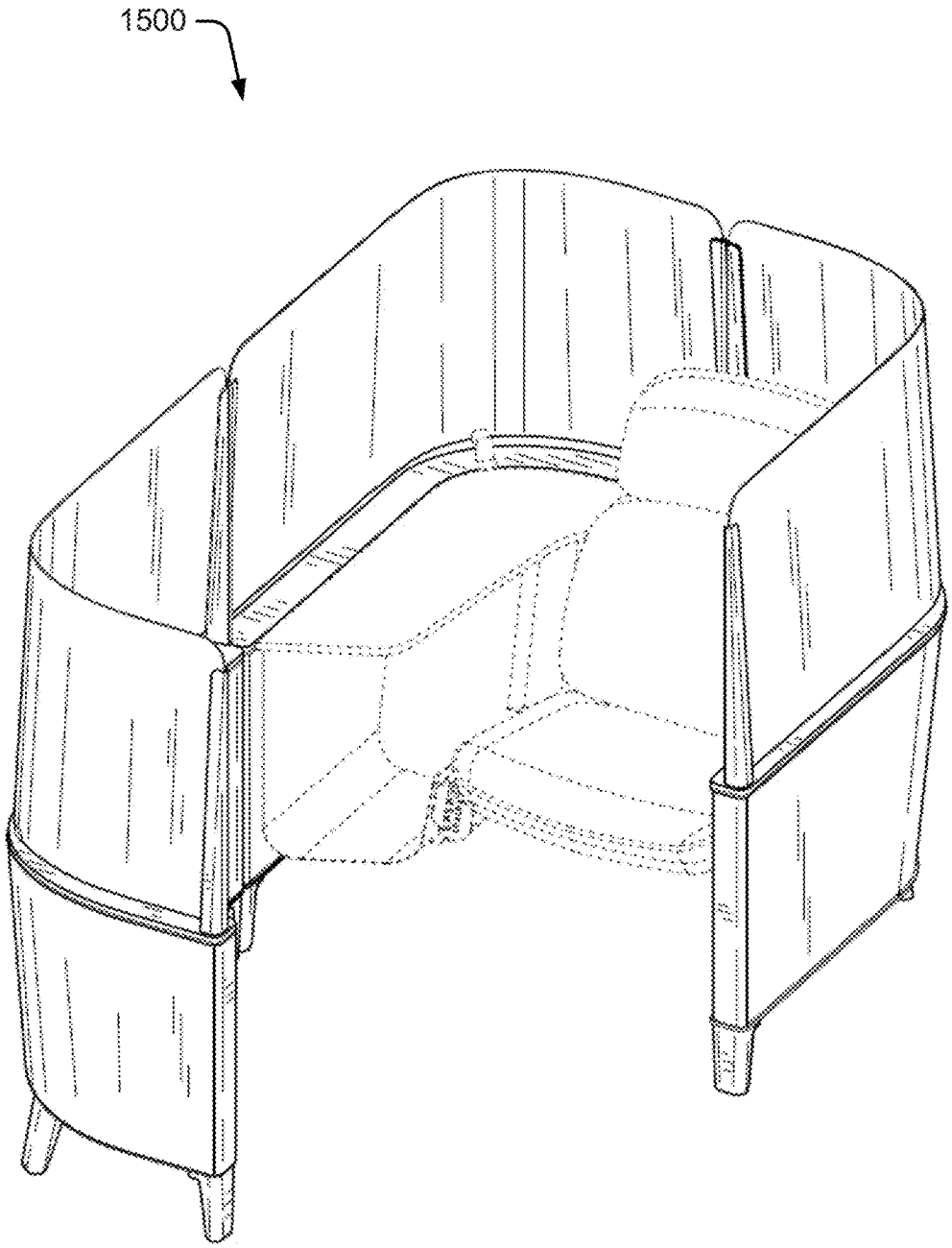
FIG. 49 is similar to FIG. 42, albeit showing a lounge and shelf storage structure in phantom.
Figure 50:
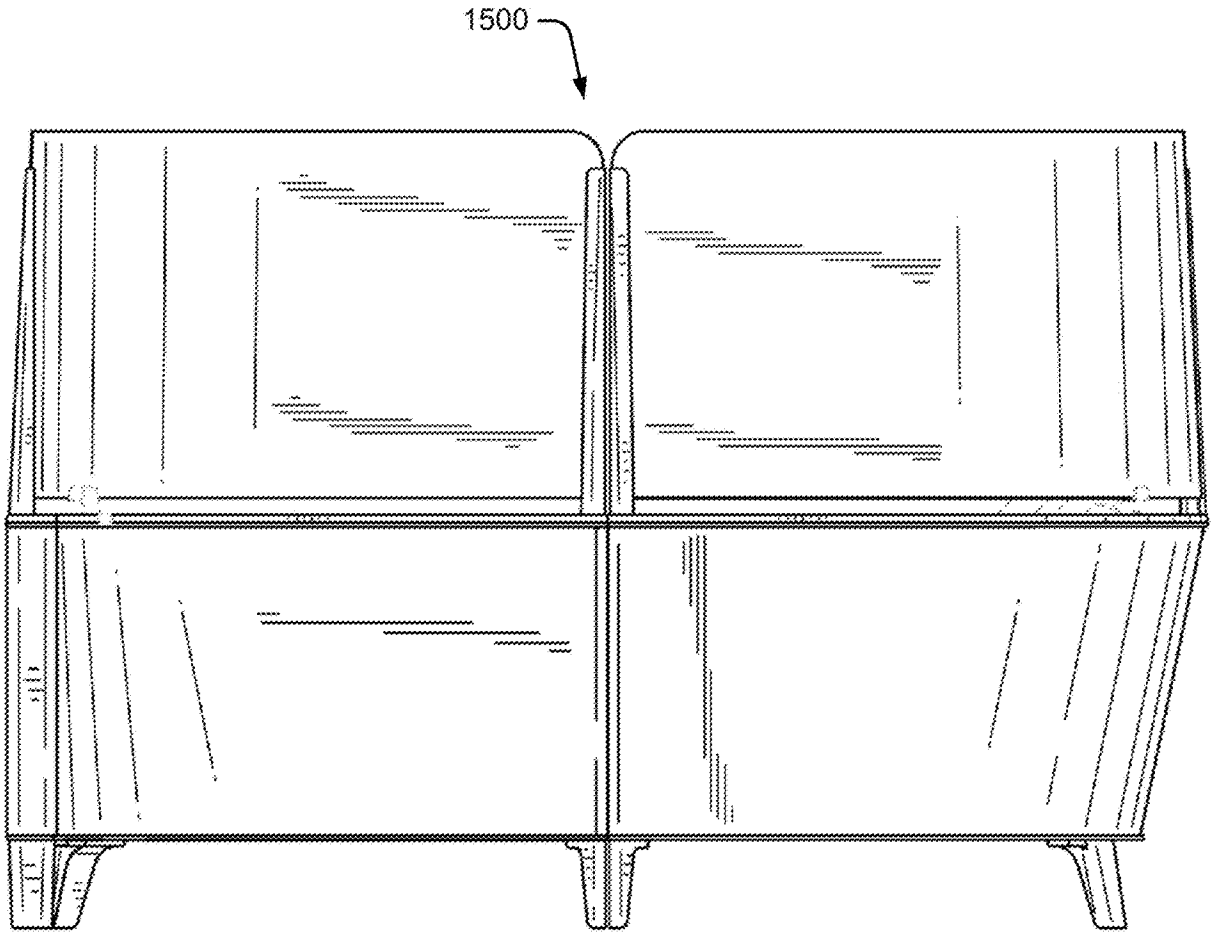
FIG. 50 is a side plan view of the assembly shown in FIG. 49.
Figure 51:
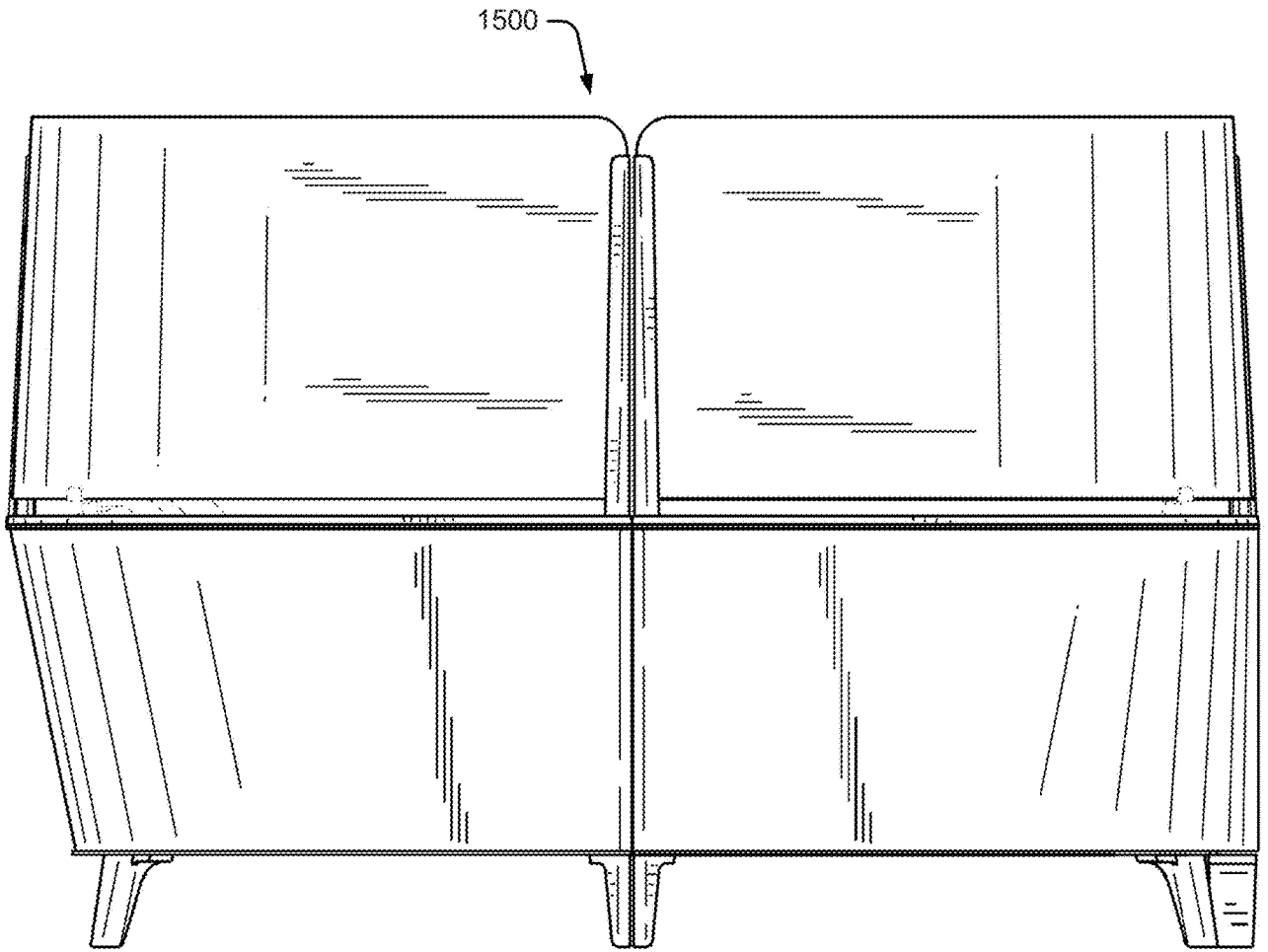
FIG. 51 is an opposite side plan view of the assembly shown in FIG. 49.
Figure 52:
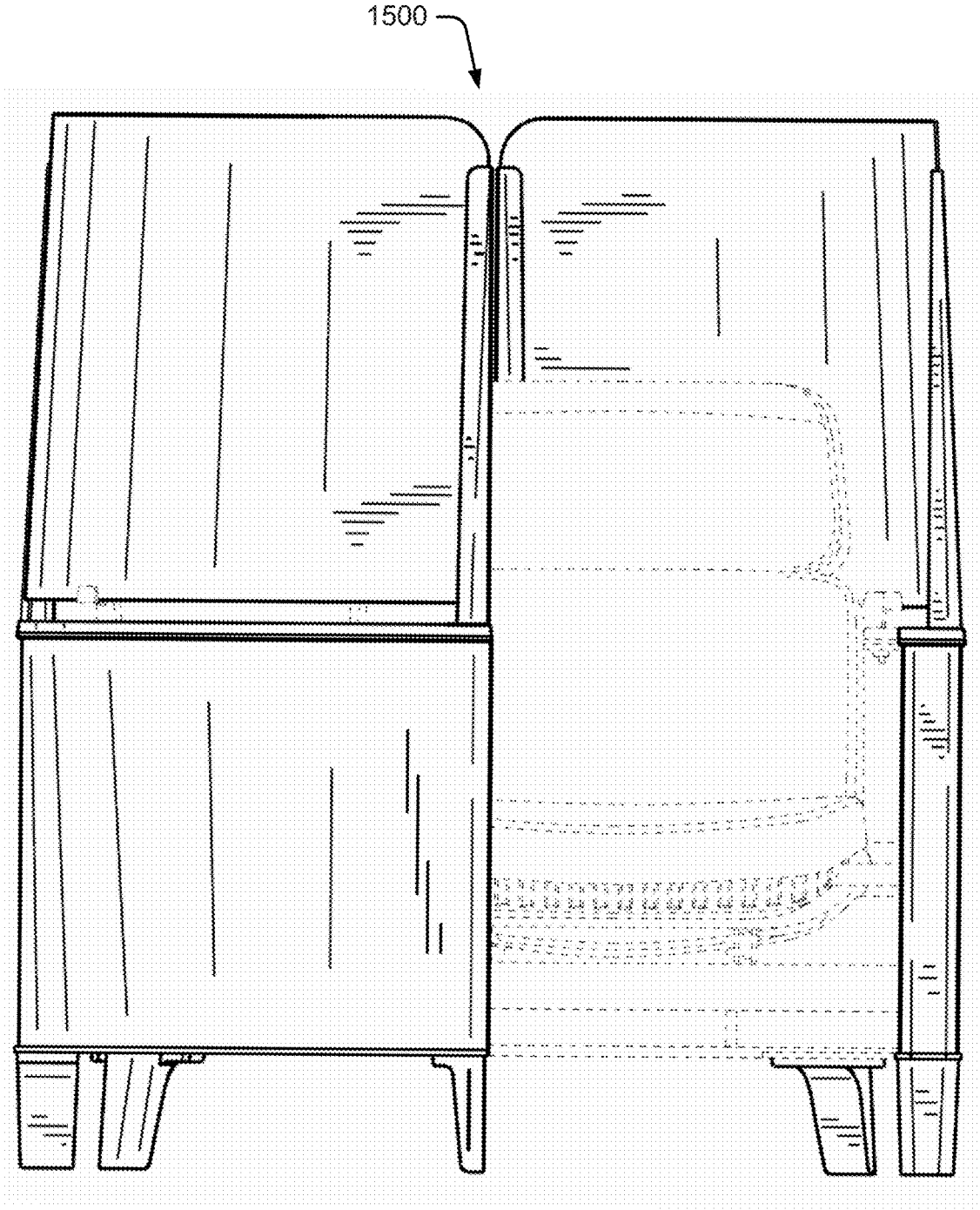
FIG. 52 is a front plan view of the assembly shown in FIG. 49.
Figure 53:
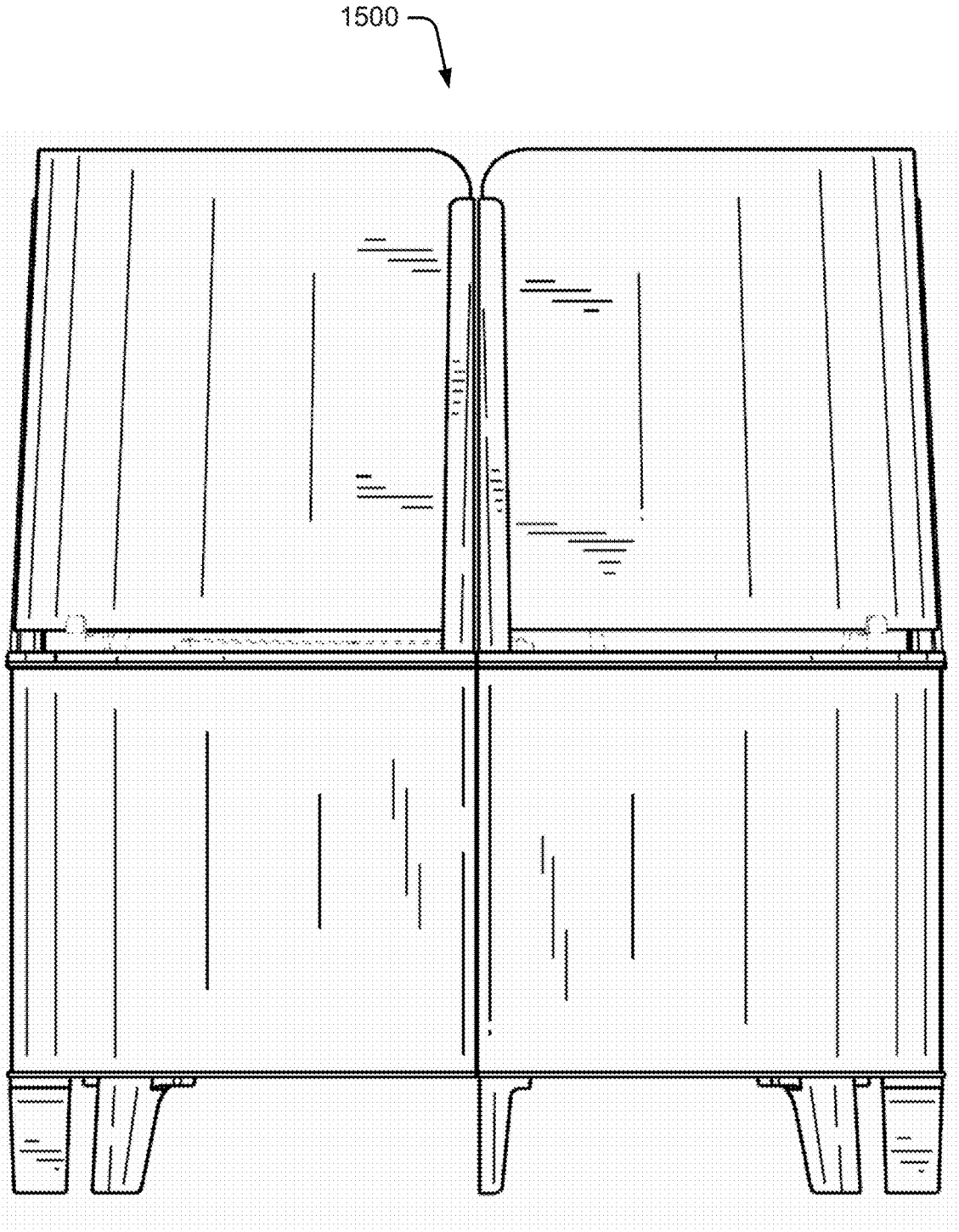
FIG. 53 is a rear plan view of the assembly shown in FIG. 49.
Figure 54:
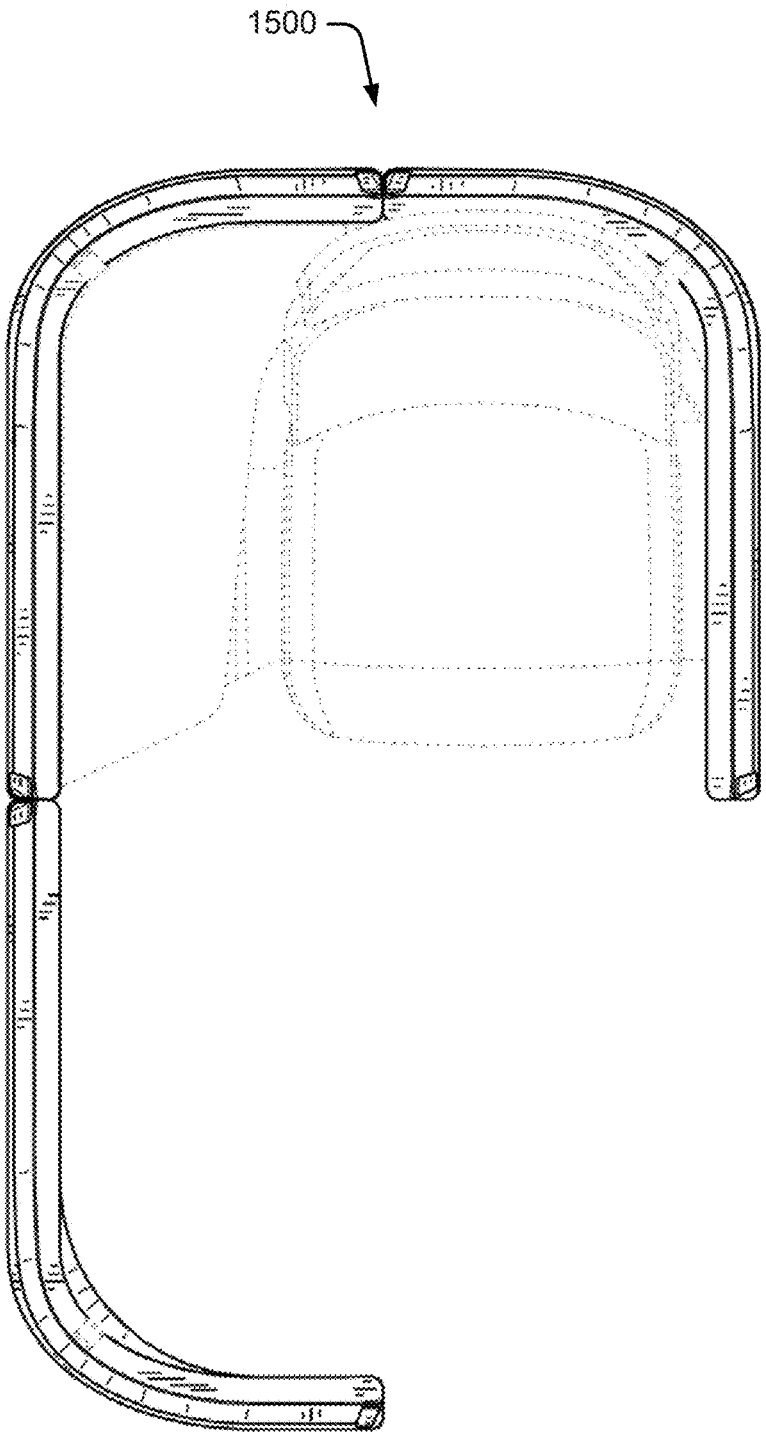
FIG. 54 is a top plan view of the assembly shown in FIG. 49.
Figure 55:
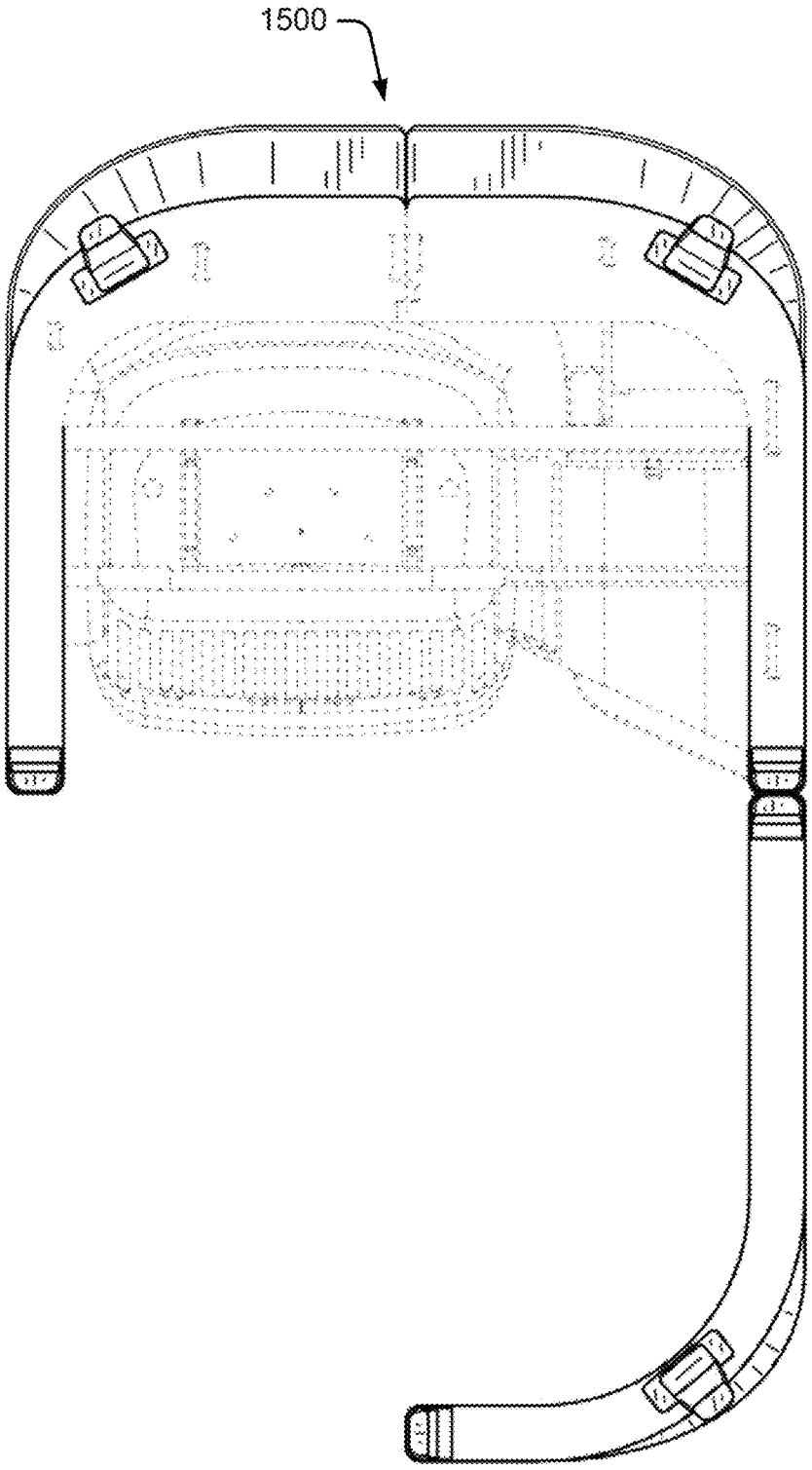
FIG. 55 is a bottom plan view of the assembly shown in FIG. 49.
Figure 56:
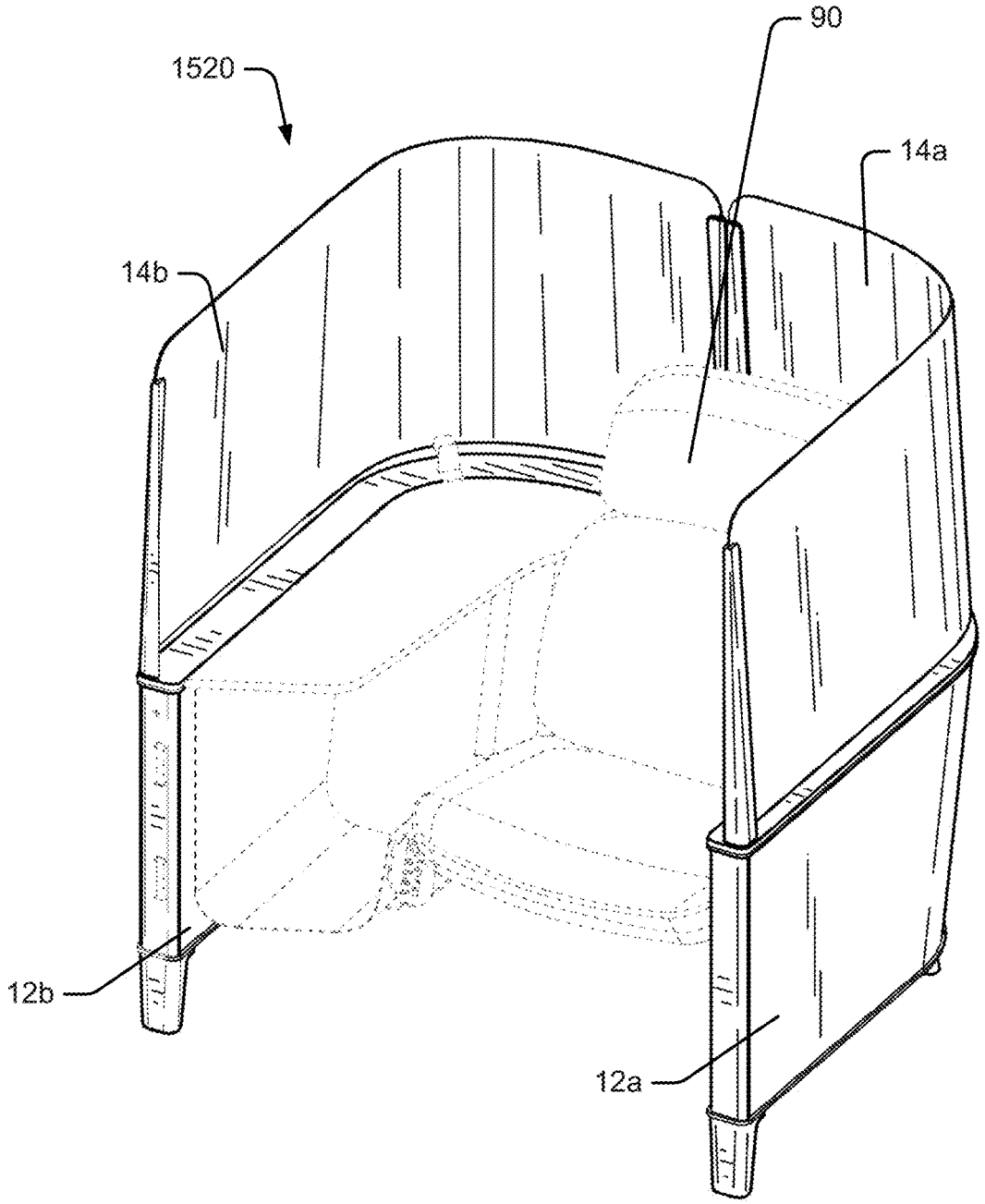
FIG. 56 is a perspective view of a dual wall and screen dividing sub-assembly that is consistent with at least some aspects of the present disclosure.
Figure 57:
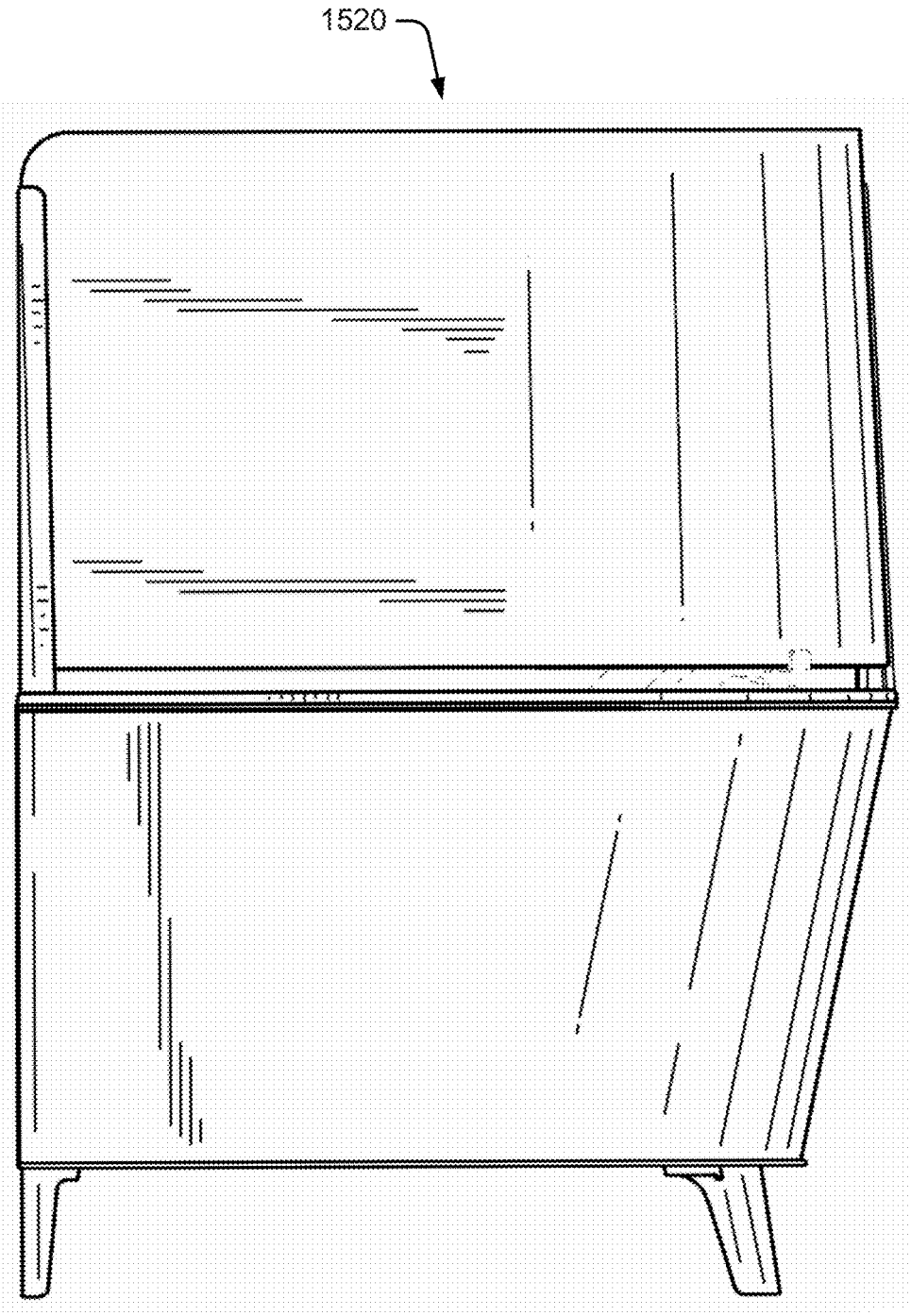
FIG. 57 is a side plan view of the assembly shown in FIG. 56.
Figure 58:
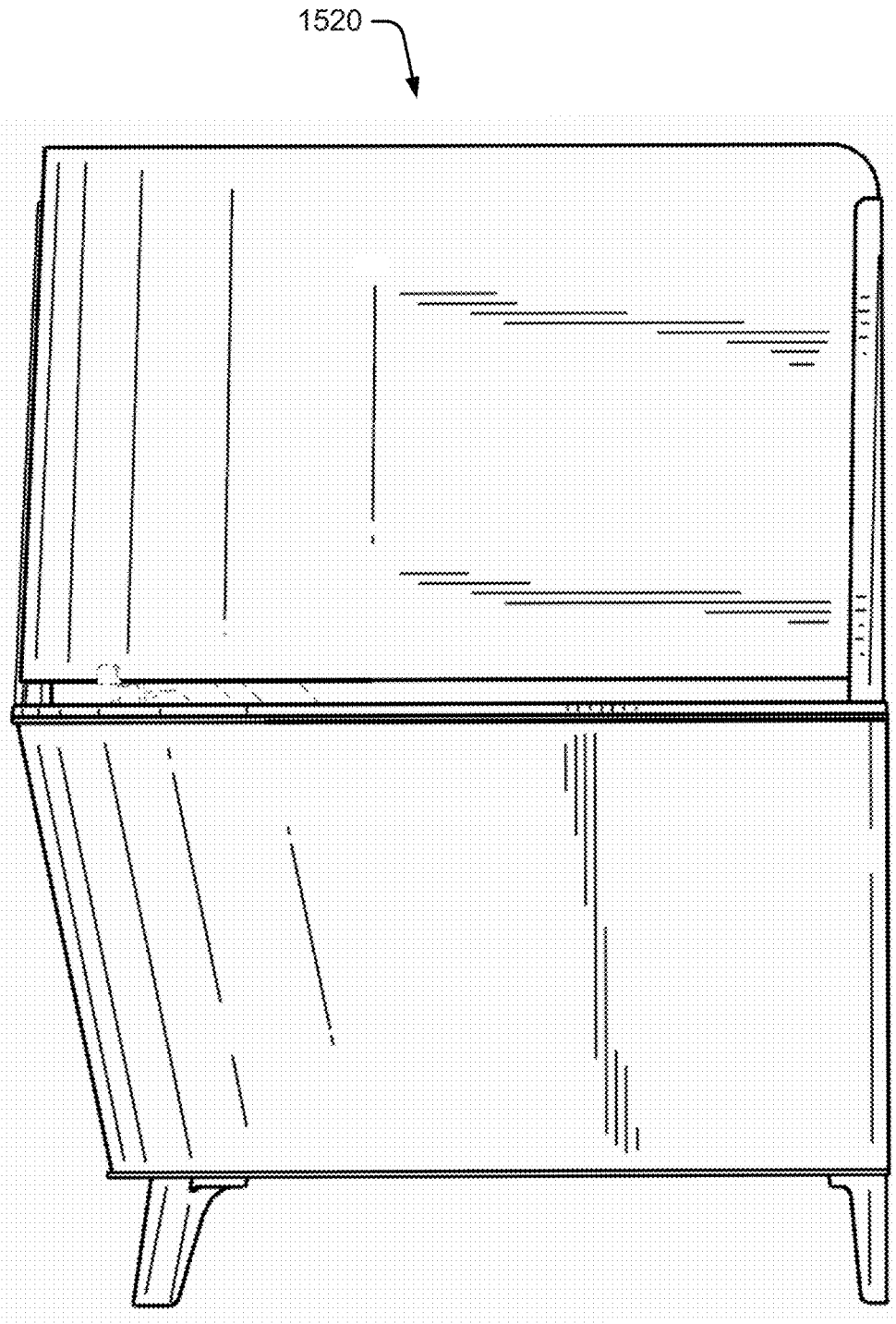
FIG. 58 is an opposite side plan view of the assembly shown in FIG. 56.
Figure 59:
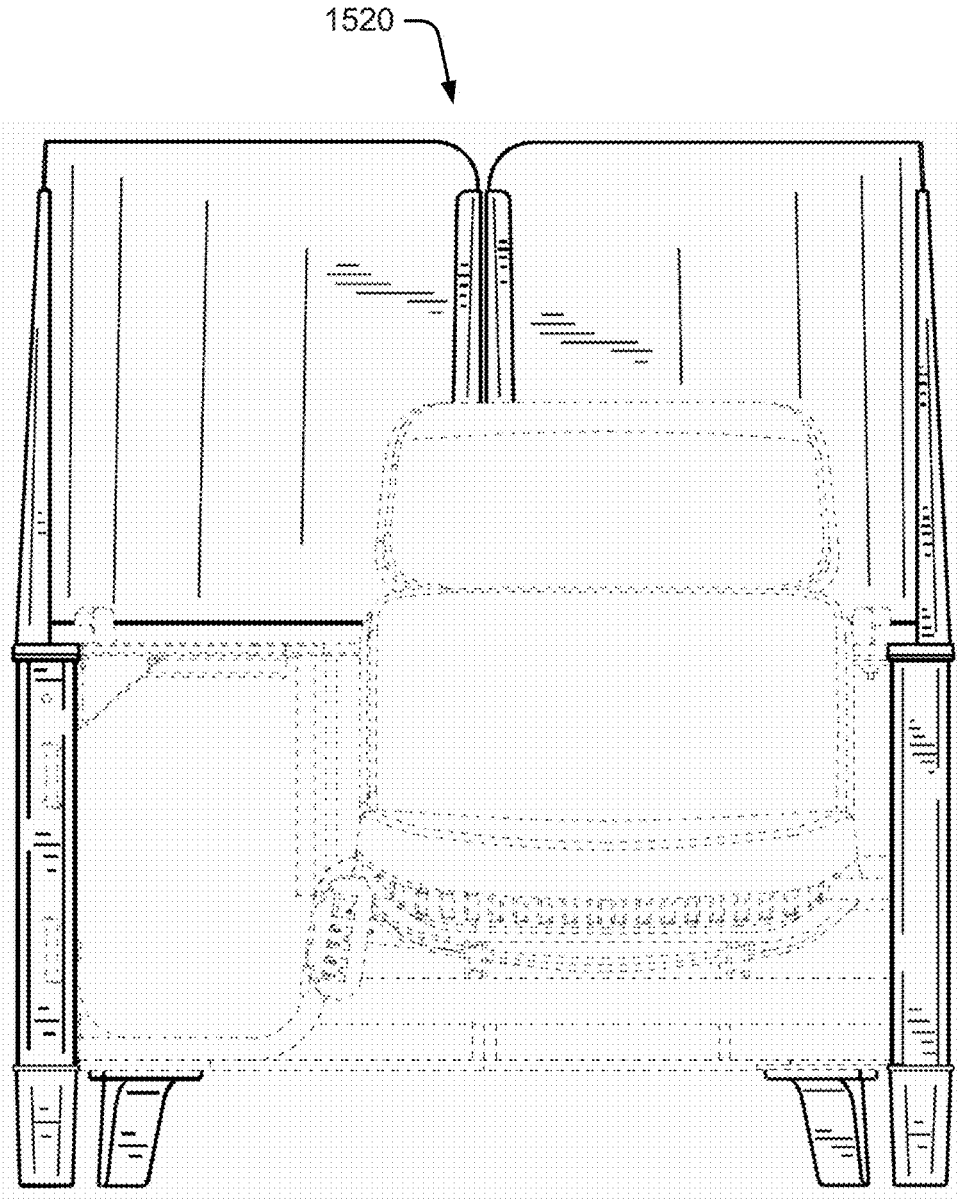
FIG. 59 is a front plan view of the assembly shown in FIG. 56.
Figure 60:
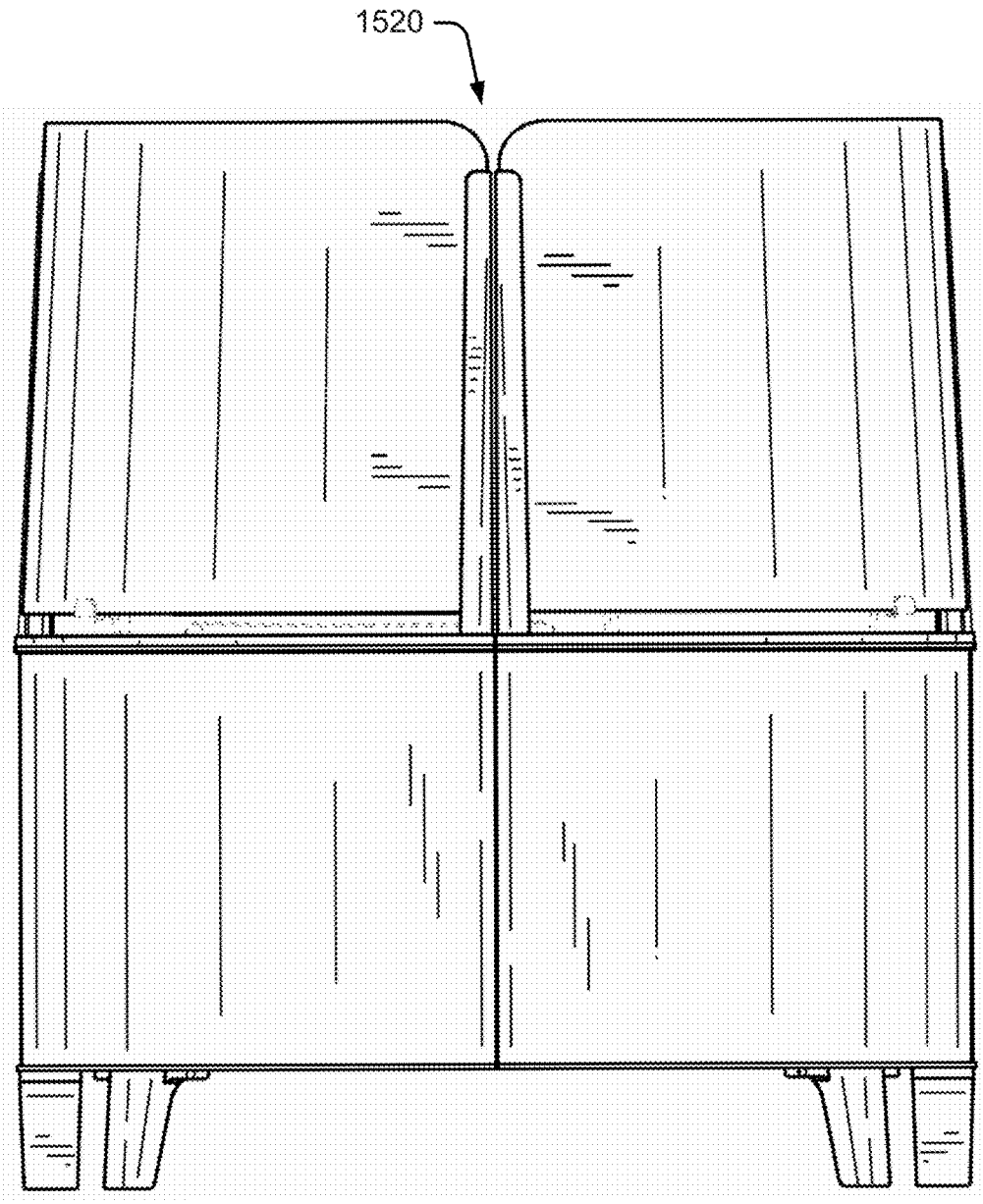
FIG. 60 is a rear plan view of the assembly shown in FIG. 56.
Figure 61:
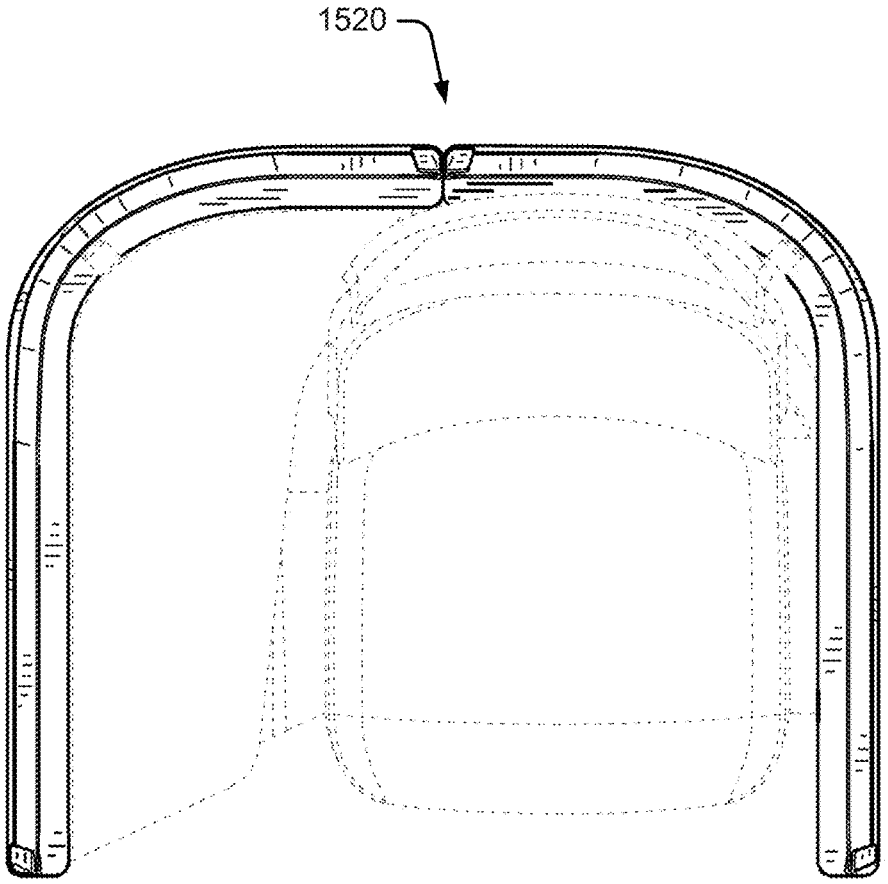
FIG. 61 is a top plan view of the assembly shown in FIG. 56.
Figure 62:
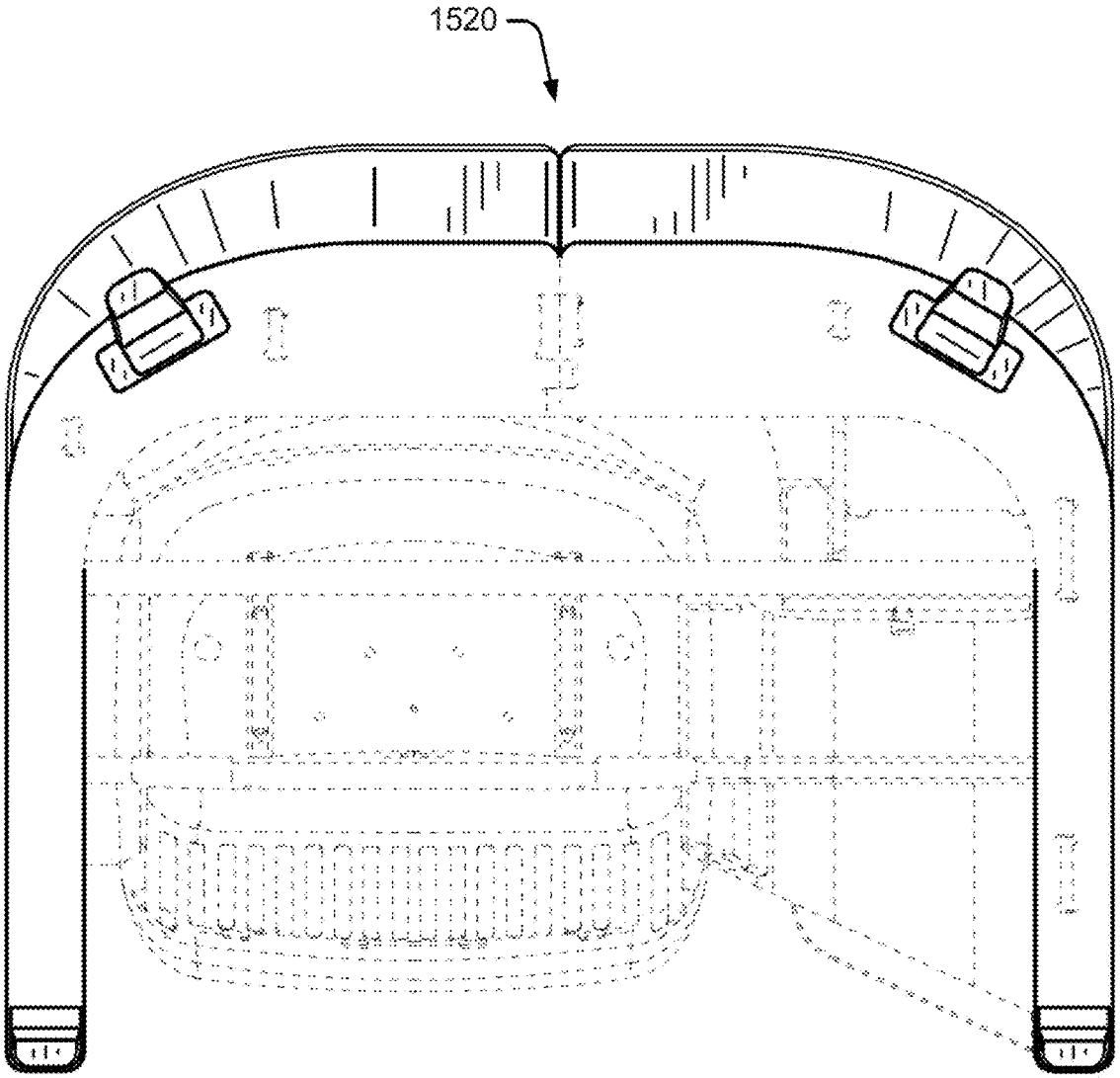
FIG. 62 is a bottom plan view of the assembly shown in FIG. 56.
Figure 63:
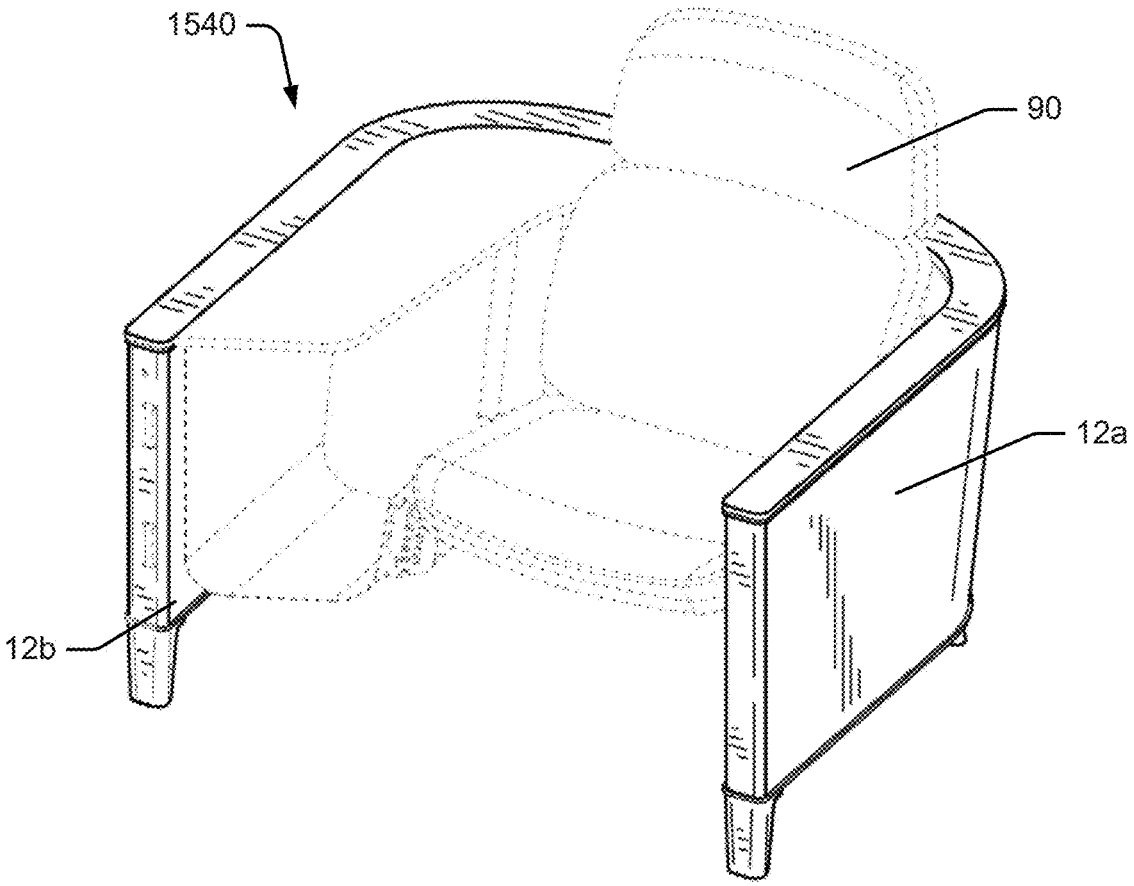
FIG. 63 is similar to FIG. 56, albeit showing a configuration that only includes two lower wall structures and does not include upper screen structures.
Figure 64:
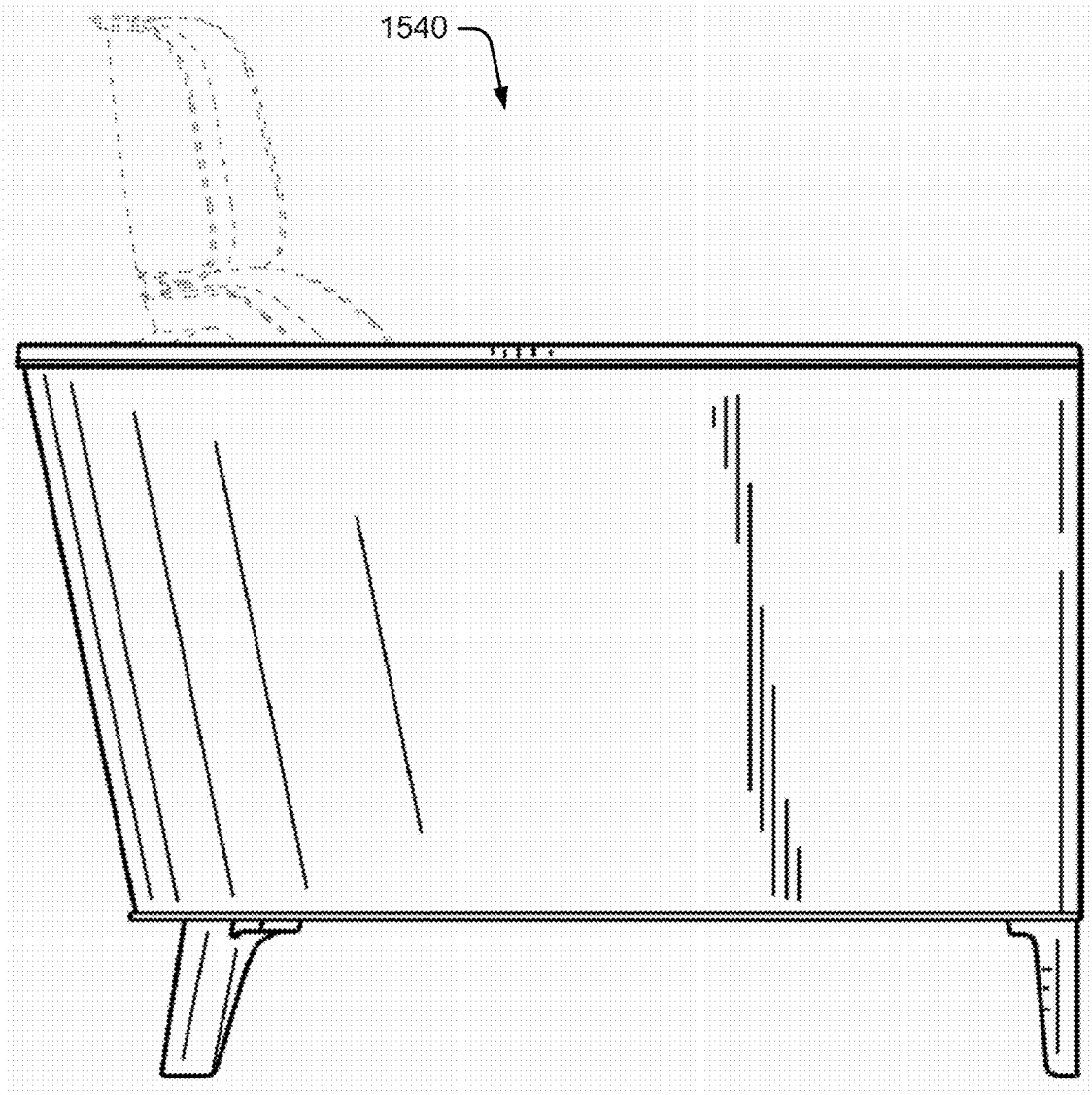
FIG. 64 is a side plan view of the assembly shown in FIG. 63.
Figure 65:
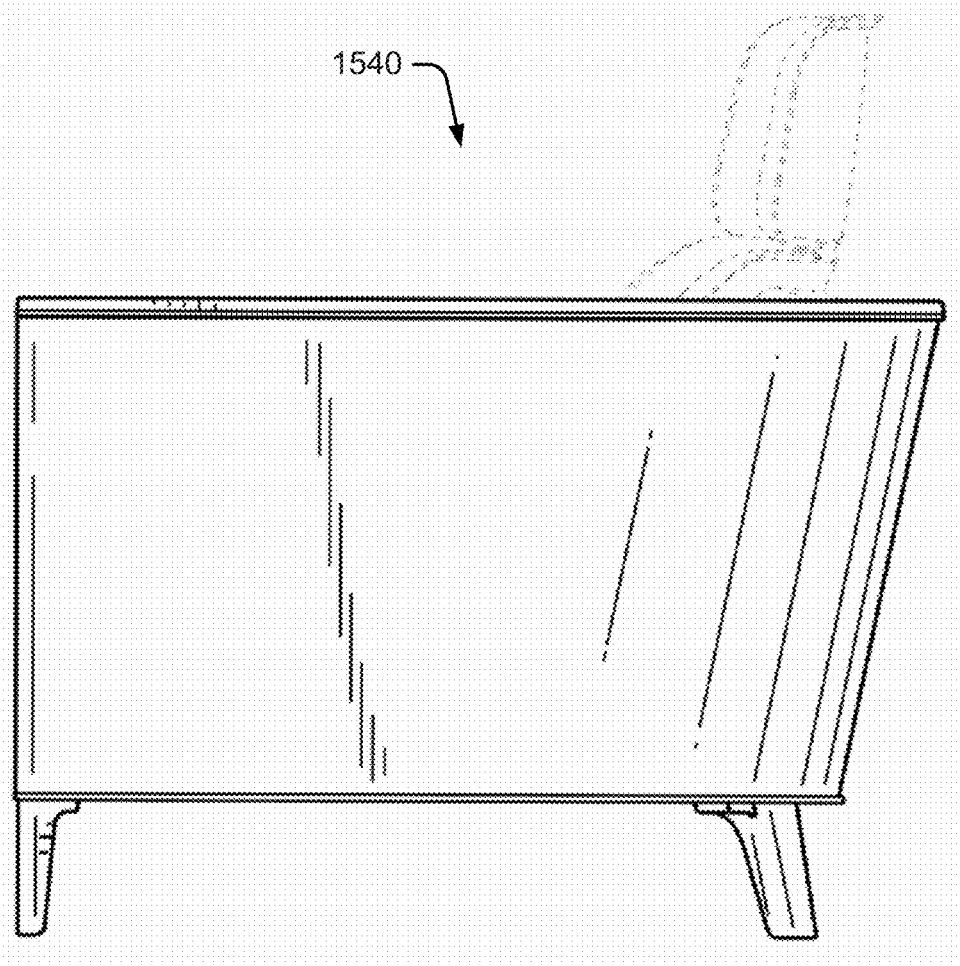
FIG. 65 is an opposite side plan view of the assembly shown in FIG. 63.
Figure 66:
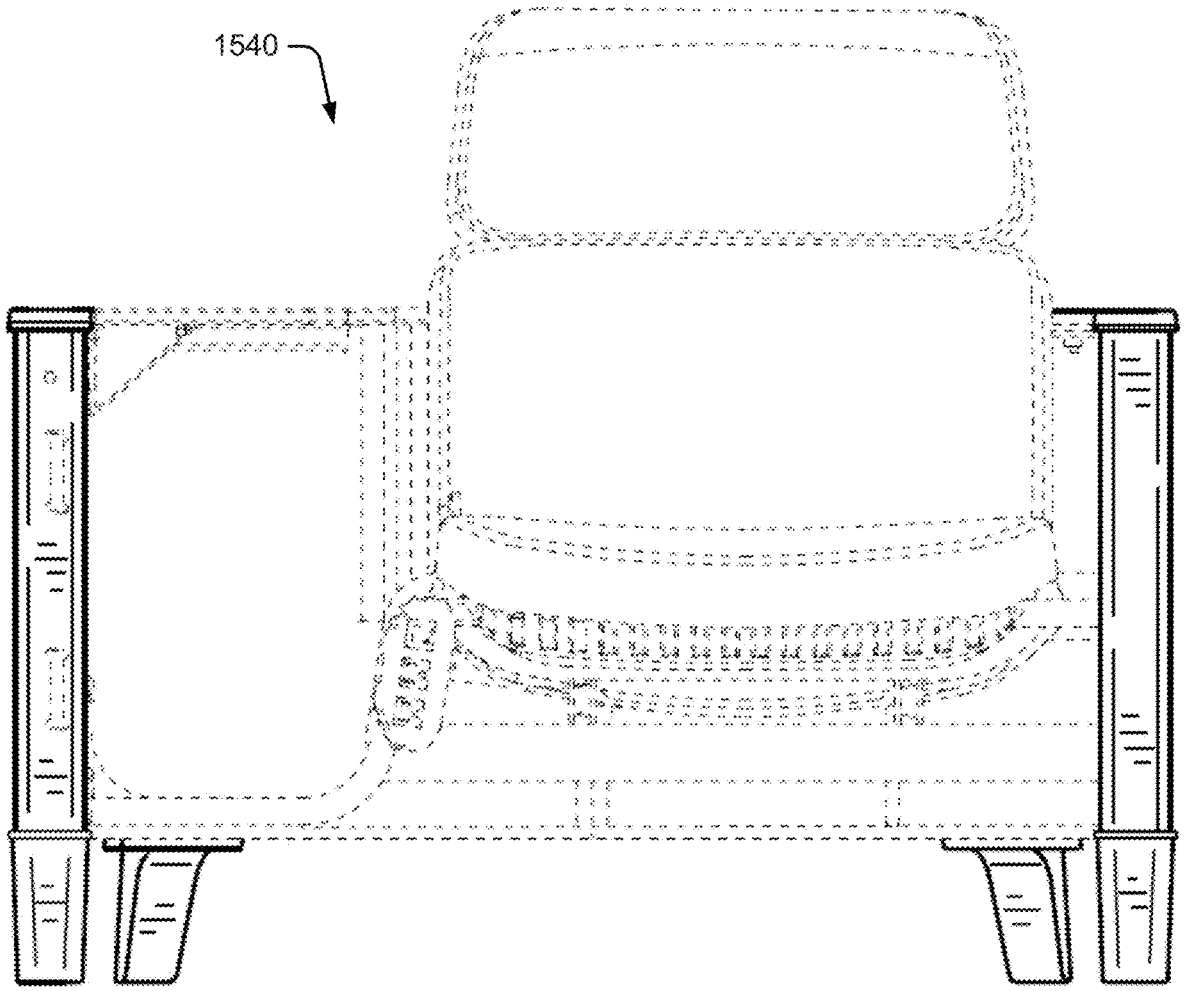
FIG. 66 is a front plan view of the assembly shown in FIG. 63.
Figure 67:
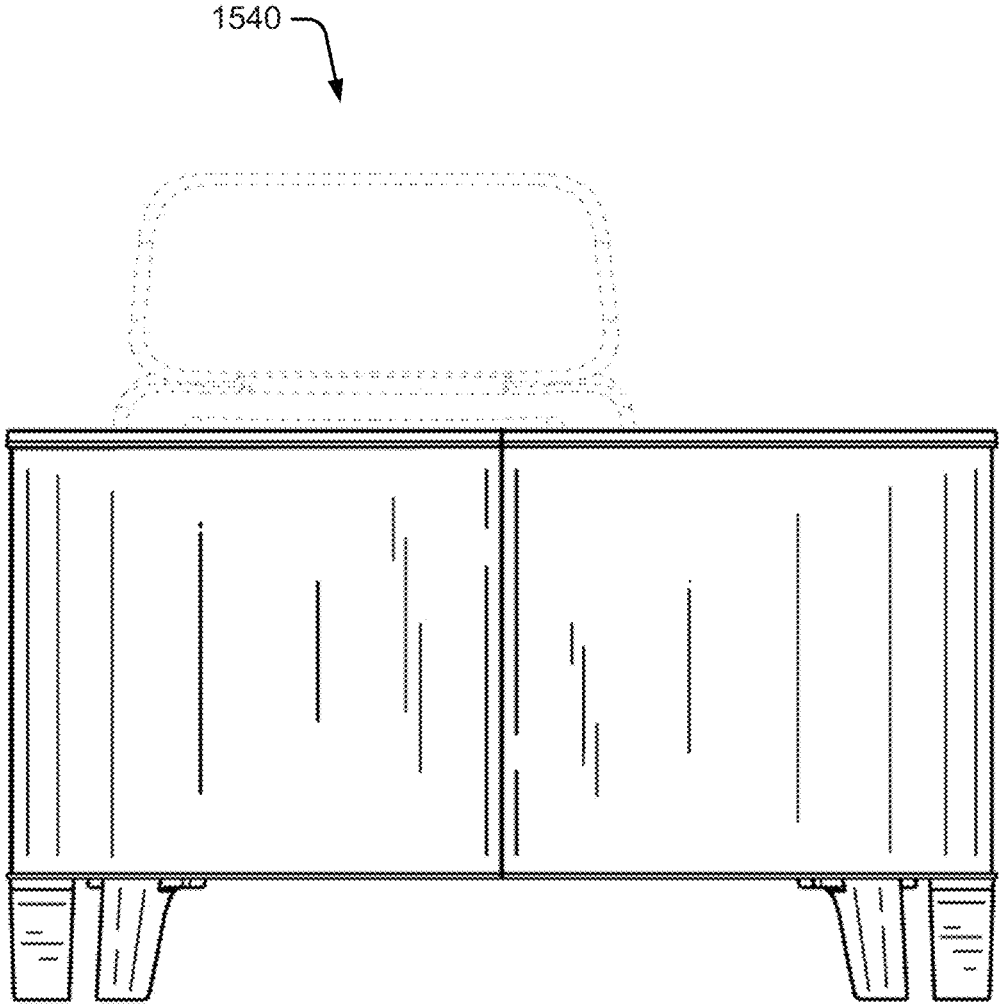
FIG. 67 is a rear plan view of the assembly shown in FIG. 63.
Figure 68:
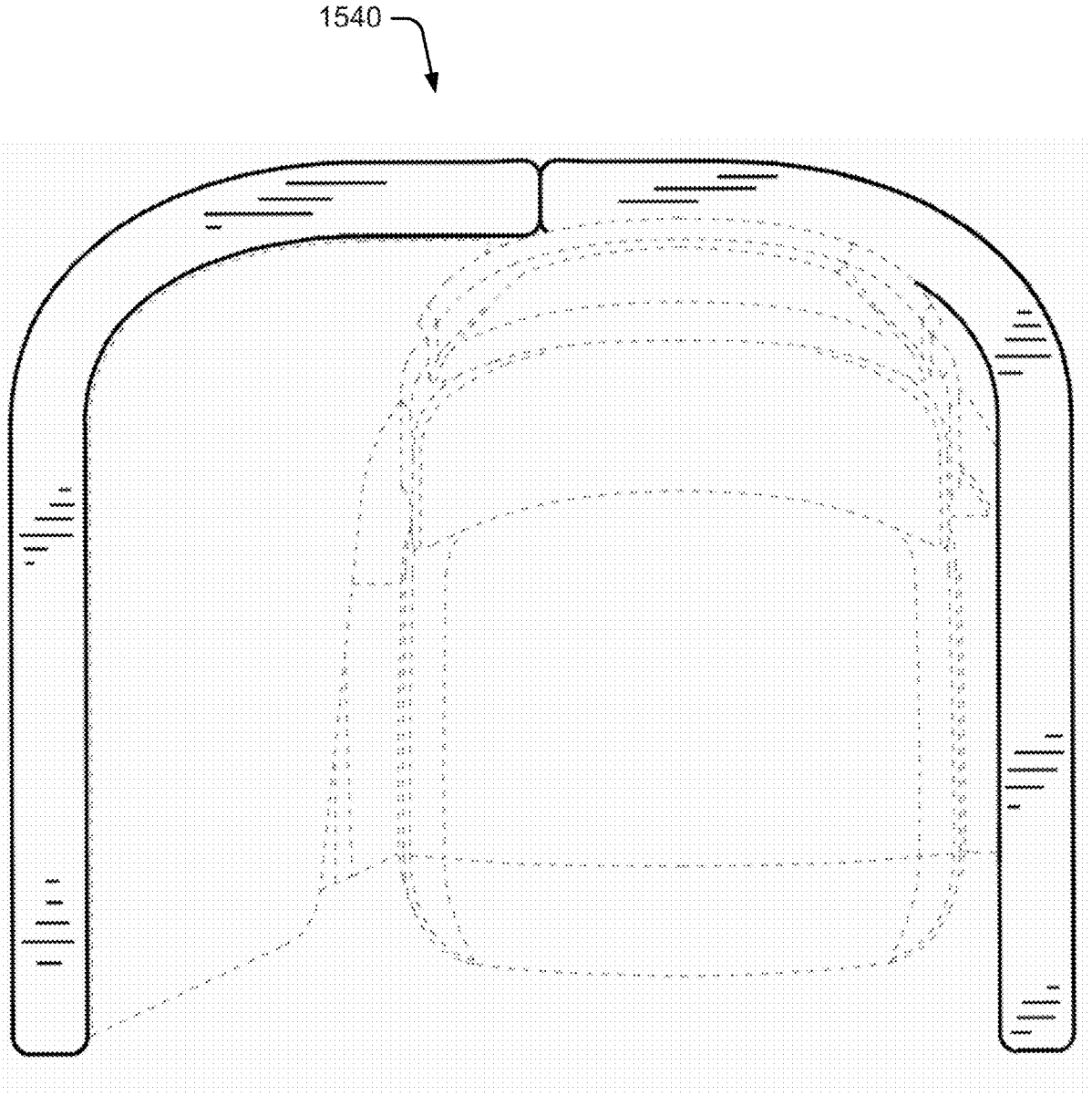
FIG. 68 is a top plan view of the assembly shown in FIG. 63.
Figure 69:
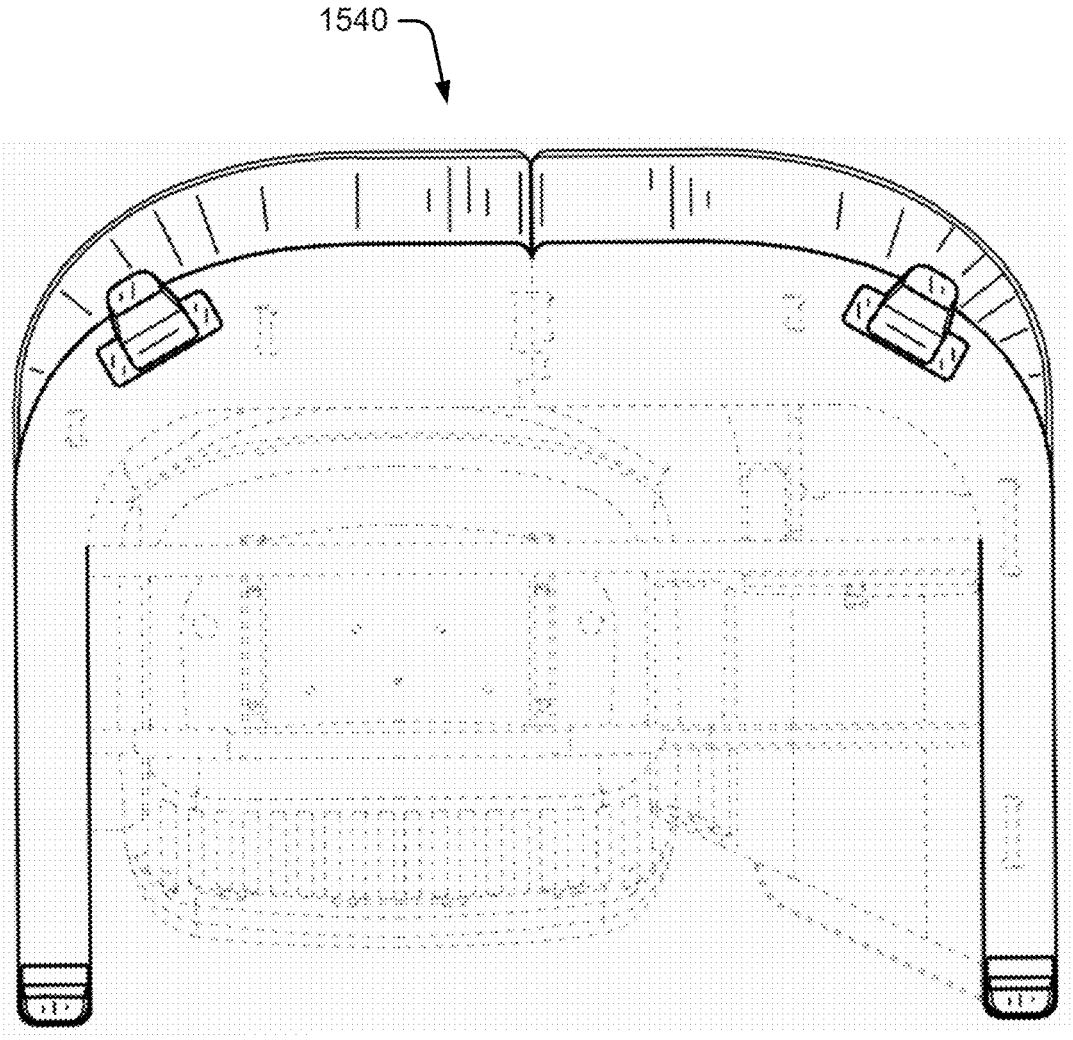
FIG. 69 is a bottom plan view of the assembly shown in FIG. 63.

Referring still to FIG. 41, sofa 1410 may be free standing or may include support structure akin to the structure that links lounge assembly 90 to the surrounding wall assembly. In the illustrated embodiment a side shelf member 22 and an arm and tablet assembly 20 akin to those describe above are mounted to wall assembly 12*z* adjacent the sofa 1410 so that a tablet 20 can be placed in a use position in front of the sofa.

Referring again to FIG. 33, while the arm assembly 15 and table and shelf structures are shown mounted to and supported by wall assembly 12*b* with lounge 90 mounted to and supported adjacent wall assembly 12*a*, in other embodiments the arm assembly 15 and storage and shelf structures may be mounted to and supported adjacent wall 12*a* while the lounge 90 is supported adjacent wall assembly 12*b*. In this regard, the tablet assembly 20 may be mounted with the distal end of the arm assembly entering the lower tablet housing structure from either side (see again openings 384 and 386) so that the arm can be mounted to either side wall structure.

The configurations above are described as having one type of upper screen subassembly that includes brackets and upper cap type members to help hold screen members in installed positions. Other screen configurations are contemplated. For instance, see the embodiment 1500 shown in FIGS. 42 through 55 and in FIGS. 77 through 83 where each screen assembly includes first and second end brackets 1502 and 1504 and a screen member 1506. In this case, each bracket assembly 1502 and 1504 has a configuration that is similar to the configuration of brackets 180 and 182 described above, except that there are no top cap members and the top ends of the elongated bracket members are finished. Brackets 1502 and 1504 of this type are particularly useful where the screen member 1506 is formed of a solid rigid material (e.g., acrylic) where no seems or other fabric stitching needs to be hidden. Here, as in the FIG. 1 embodiment, the screen member 1506 would include teeth or other machinations that mate with teeth or the like within channels formed by each of the elongated bracket member posts.

While each of the embodiments described above includes three generally J-shaped lower wall assemblies and three J-shaped upper screen assemblies, other embodiments are contemplated that include subsets of these six subassemblies. To this end, see, for instance, the 2J wall and screen embodiment 1520 shown in FIGS. 56 through 62 that includes lower wall subassemblies 12*a* and 12*b* and upper screen subassemblies 14*a* and 14*b* where storage and work surface members and a lounge are shown suspended between lateral wall members in a fashion similar to that described above with respect to the FIG. 1 embodiment. In this case, a system user would have substantial privacy which could be enhanced by providing a tablet and support arm structure (not shown in the embodiment but still contemplated).

As another instance, see the 2J lower wall configuration 1540 shown in FIGS. 63 through 69 that includes storage and work surface members and a lounge subassembly (in phantom) suspended between first and second lower wall subassemblies 12*a* and 12*b* without any upper screen assemblies. Here, the top cam members would be completely finished as shown but other lower wall structures could be identical to that described above.

Figure 70:
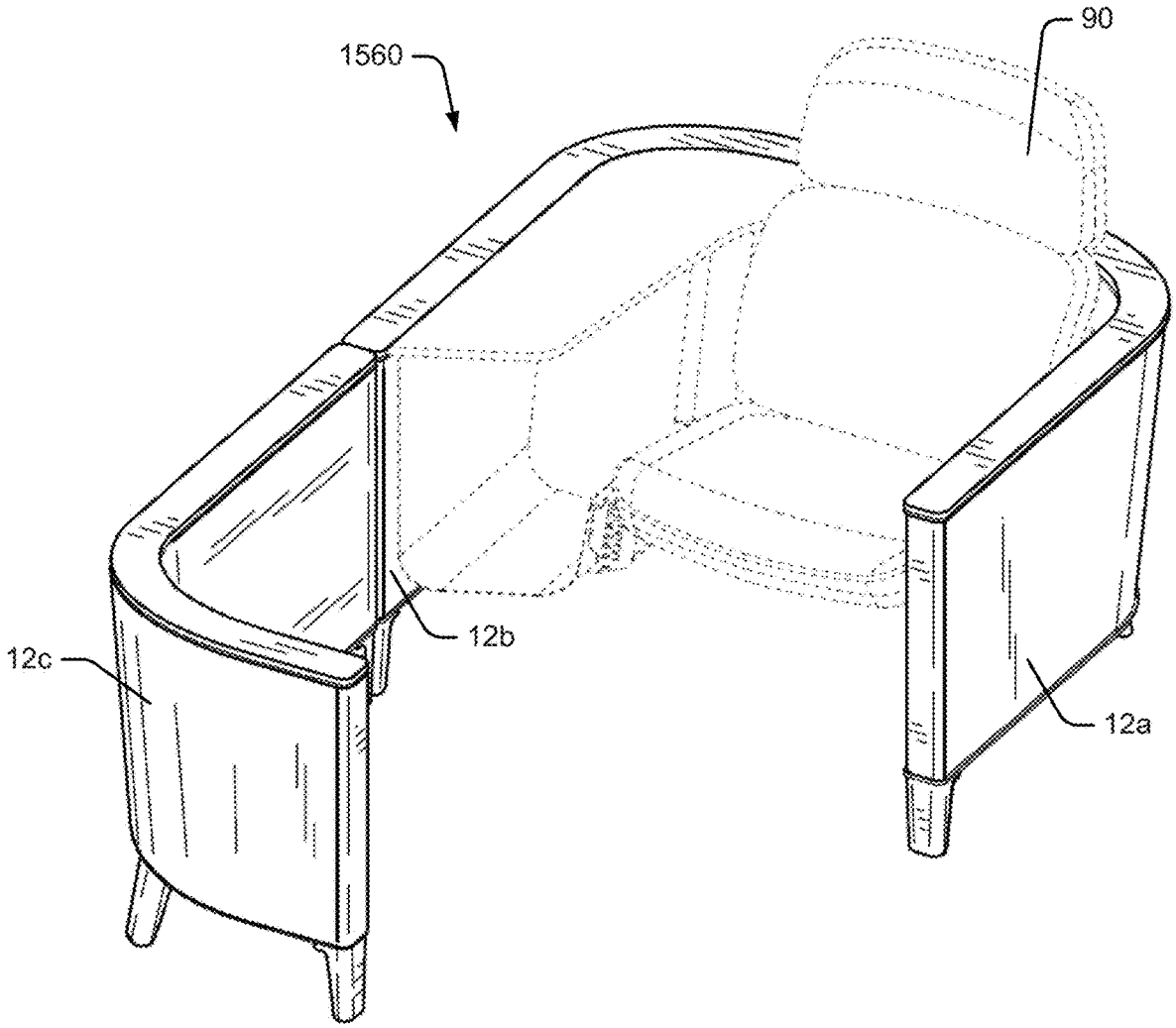
FIG. 70 is similar to FIG. 49, albeit showing three lower wall assemblies and no upper screen sub-assemblies.
Figure 71:
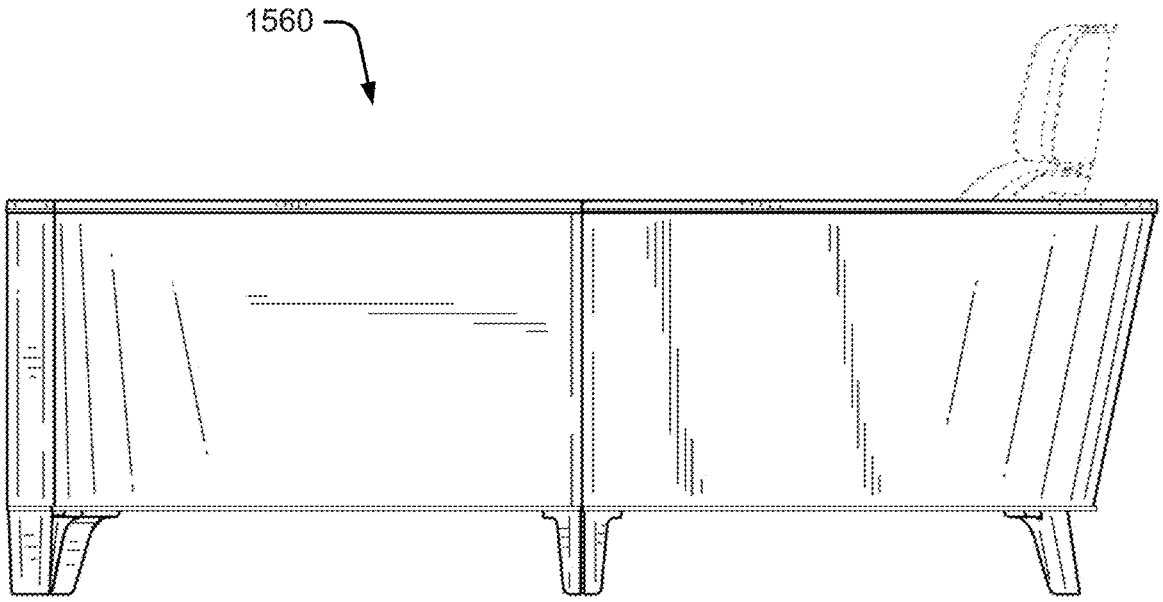
FIG. 71 is a side plan view of the assembly shown in FIG. 70.
Figure 72:
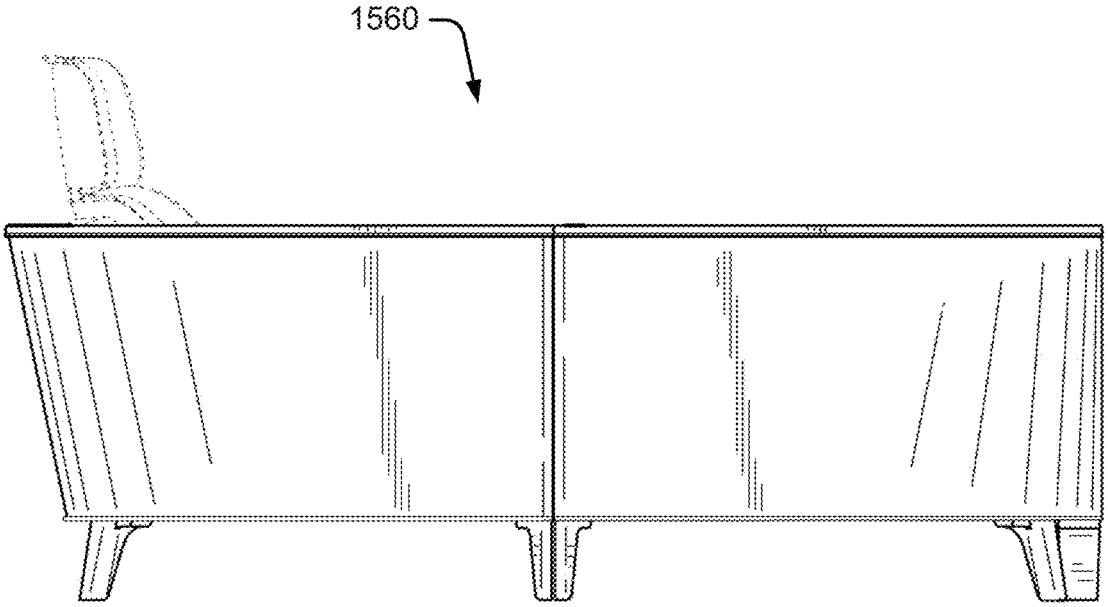
FIG. 72 is an opposite side plan view of the assembly shown in FIG. 70.
Figure 73:
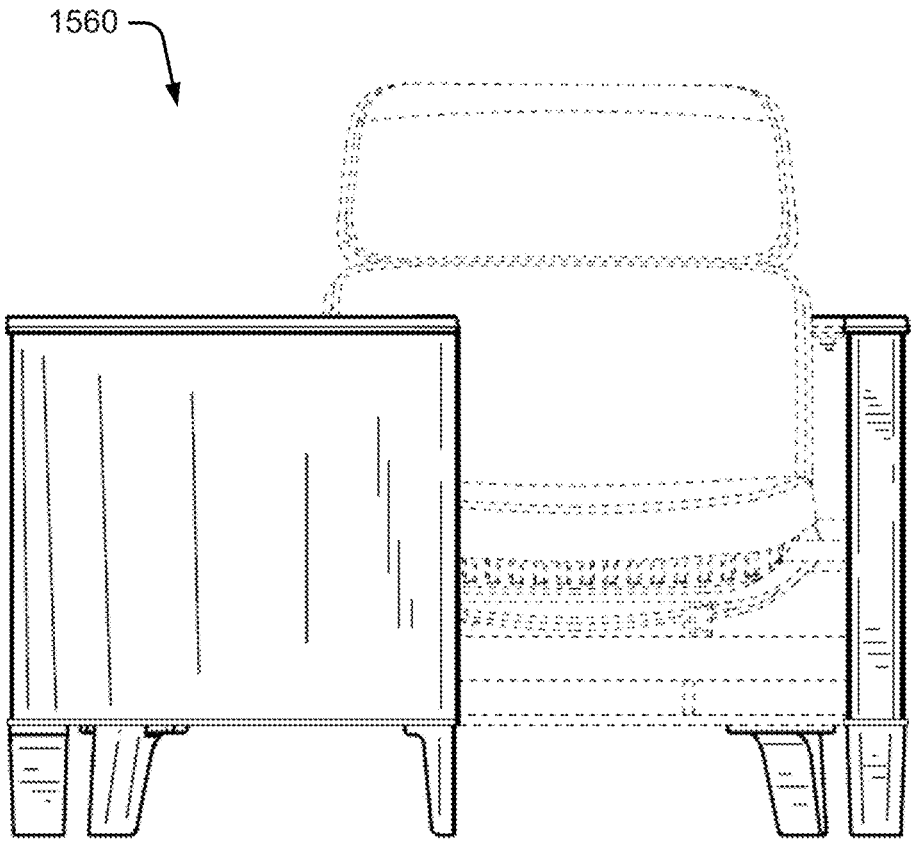
FIG. 73 is a front plan view of the assembly shown in FIG. 70.
Figure 74:
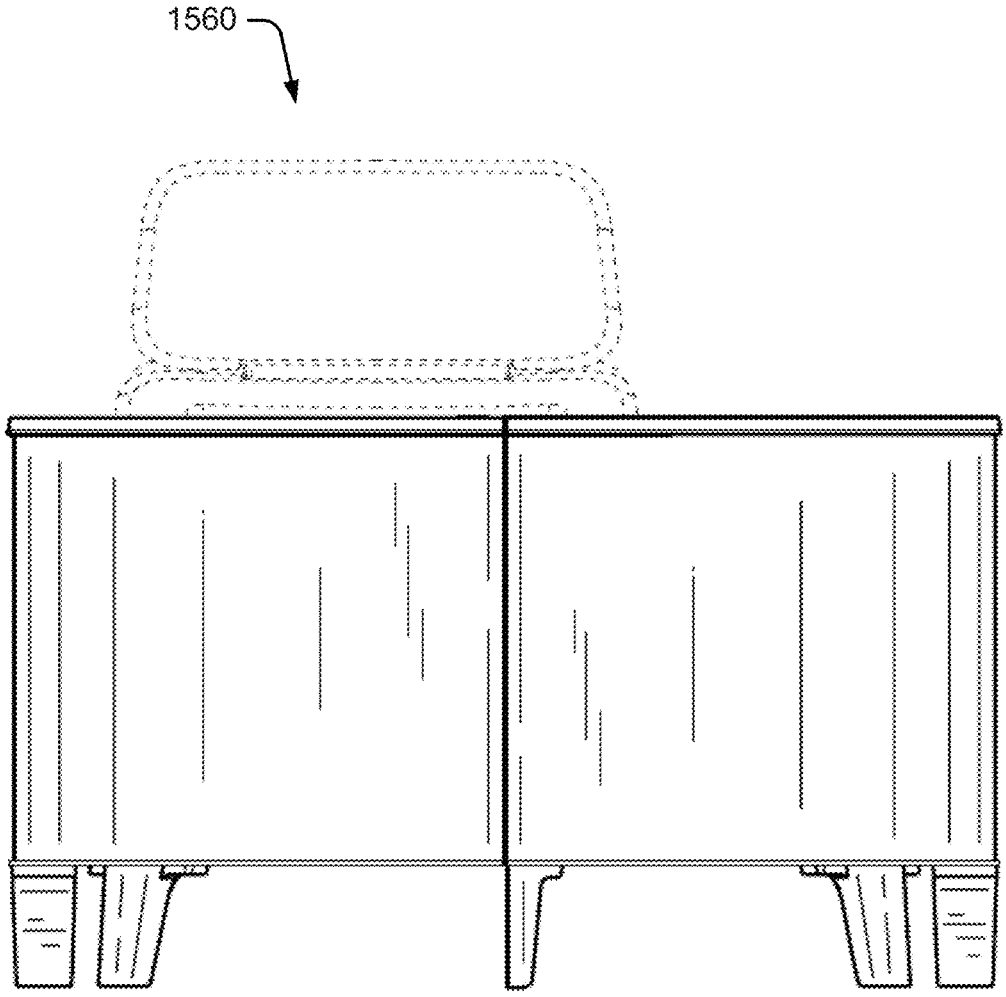
FIG. 74 is a rear plan view of the assembly shown in FIG. 70.
Figure 75:
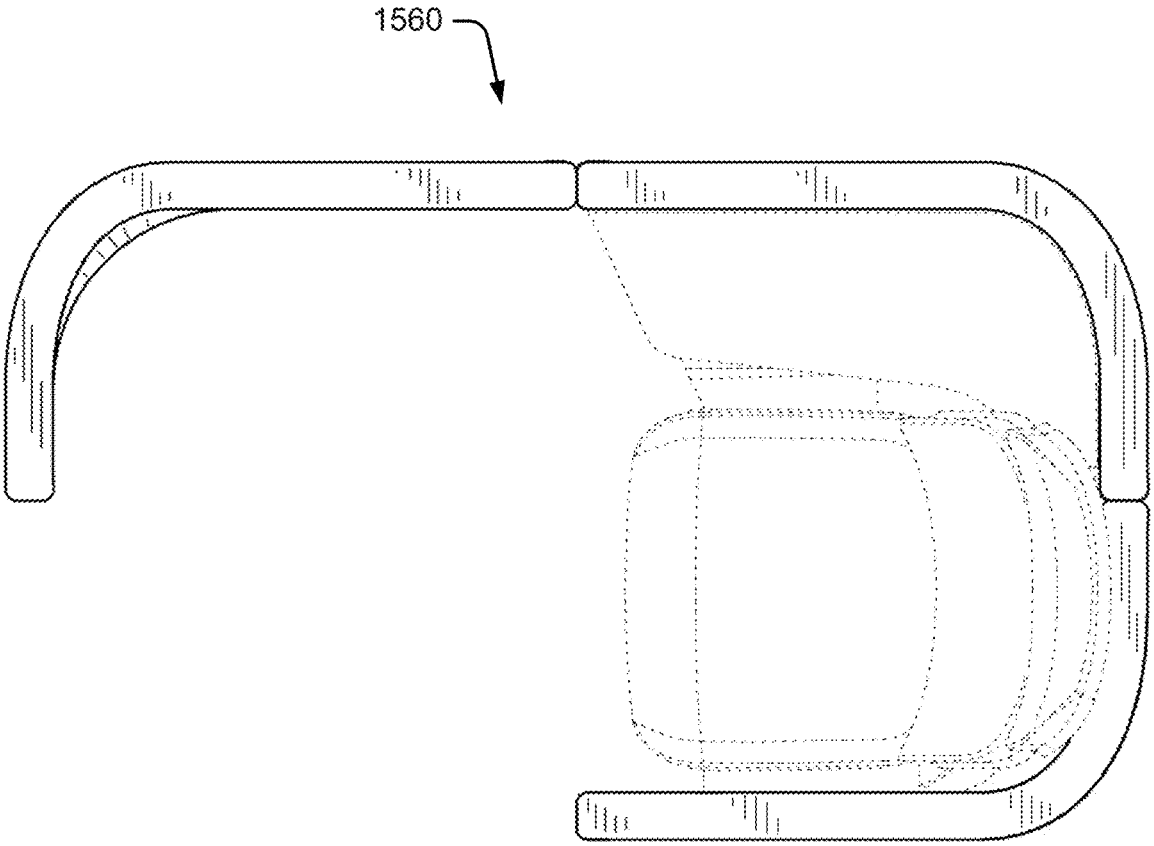
FIG. 75 is a top plan view of the assembly shown in FIG. 70.
Figure 76:
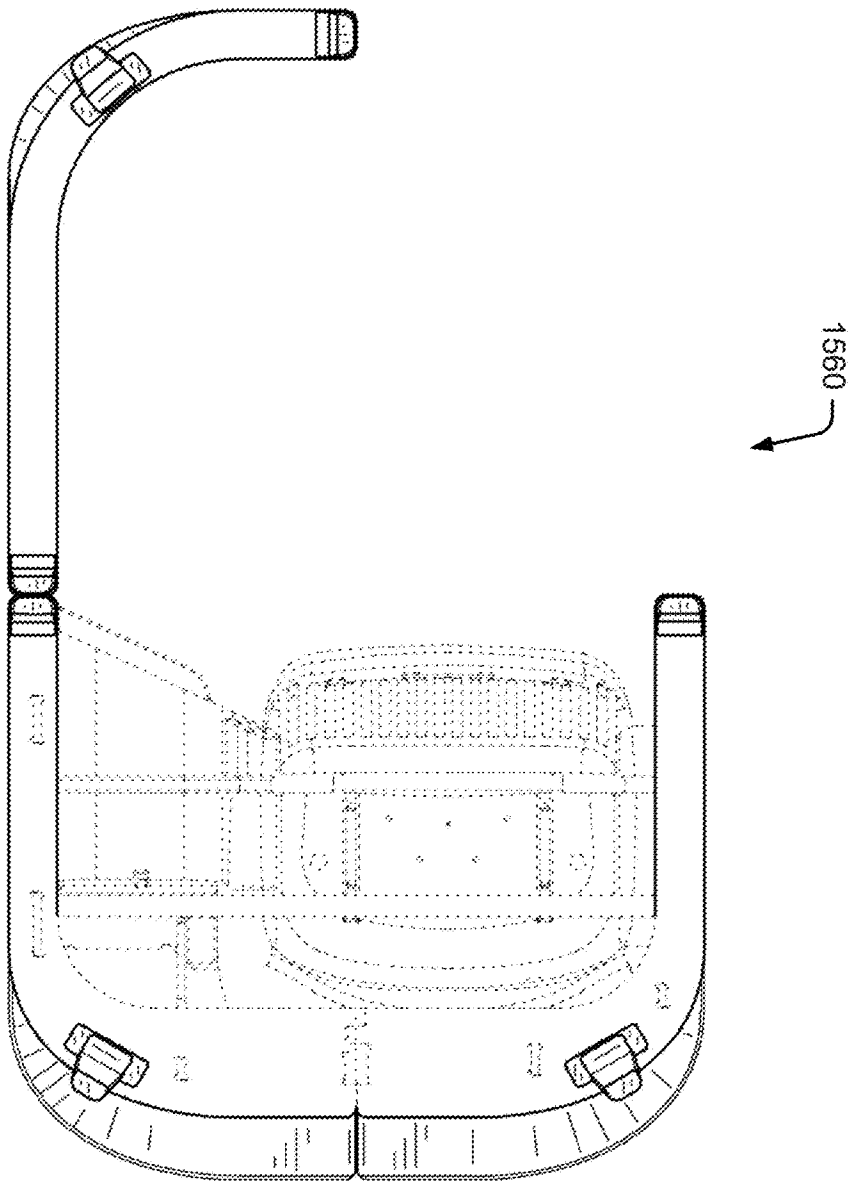
FIG. 76 is a bottom plan view of the assembly shown in FIG. 70.
Figure 77:
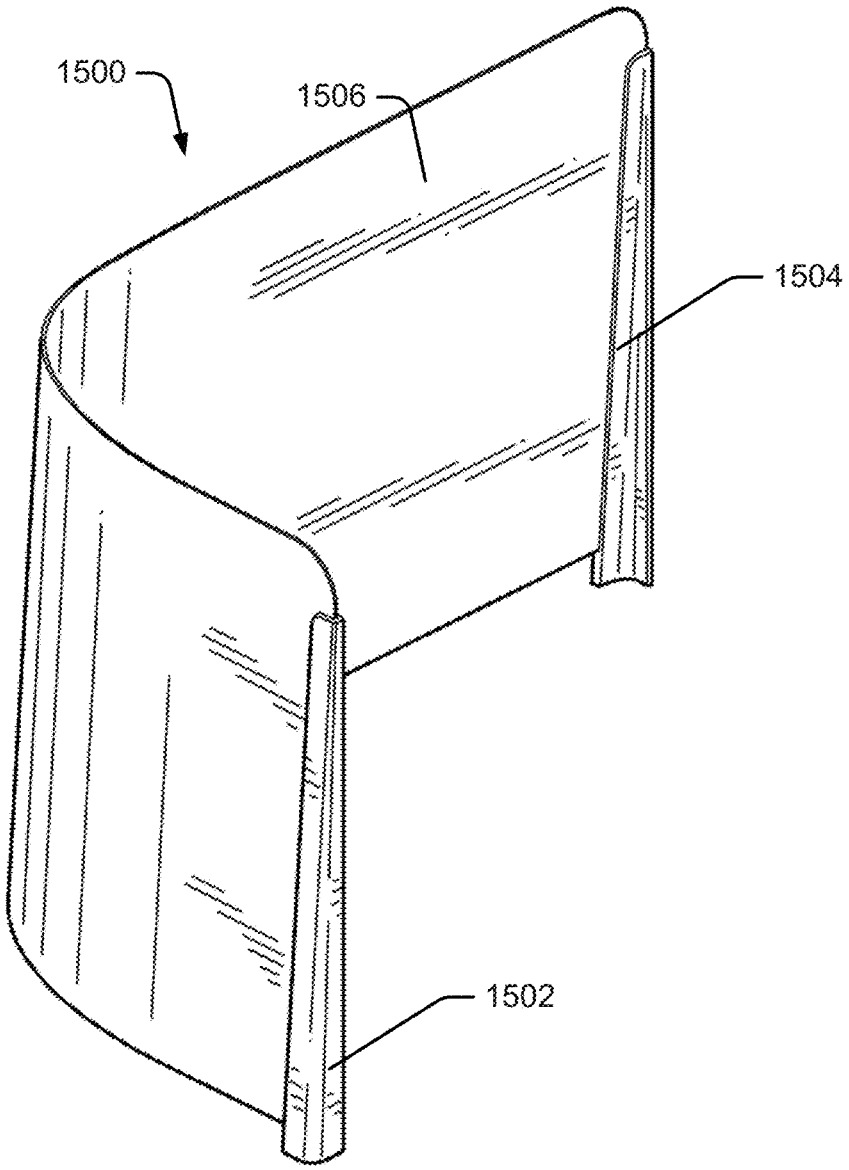
FIG. 77 is a perspective view of an exemplary screen sub-assembly including brackets and a screen member that is consistent with at least some aspects of the present disclosure.
Figure 78:
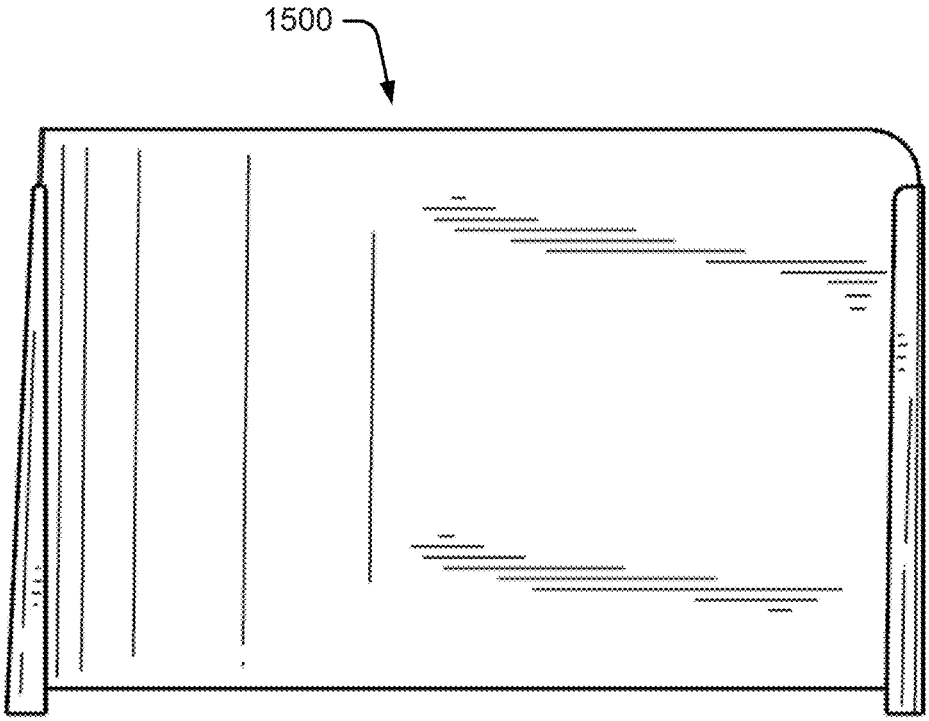
FIG. 78 is a side plan view of the assembly shown in FIG. 77.
Figure 79:
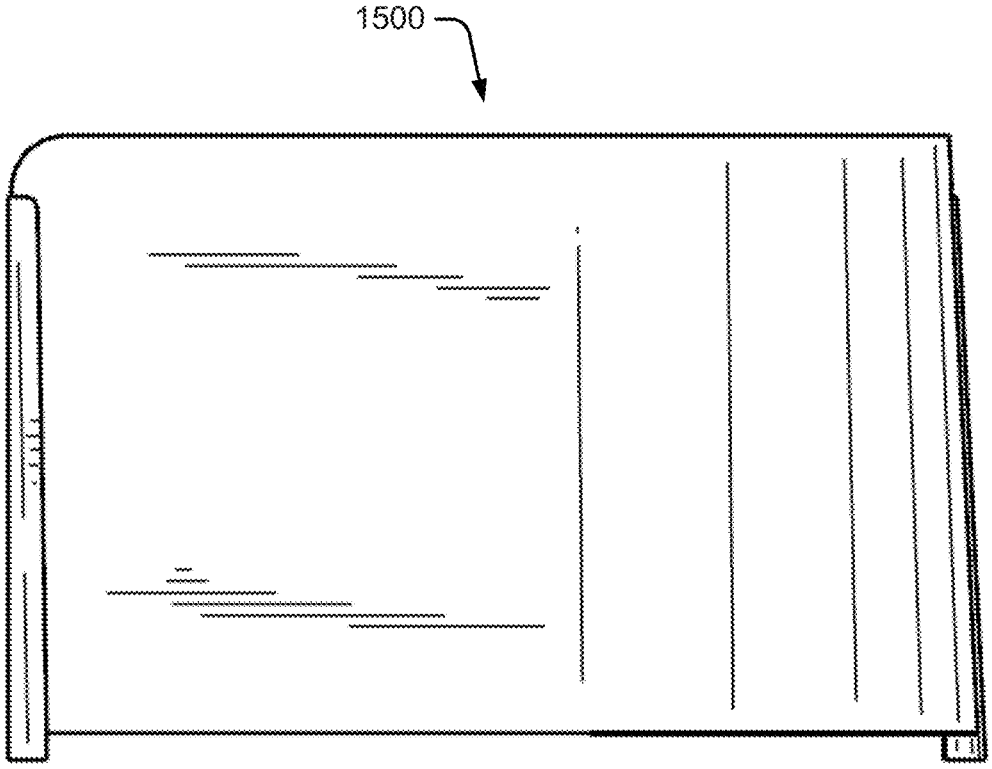
FIG. 79 is an opposite side plan view of the assembly shown in FIG. 77.
Figure 80:
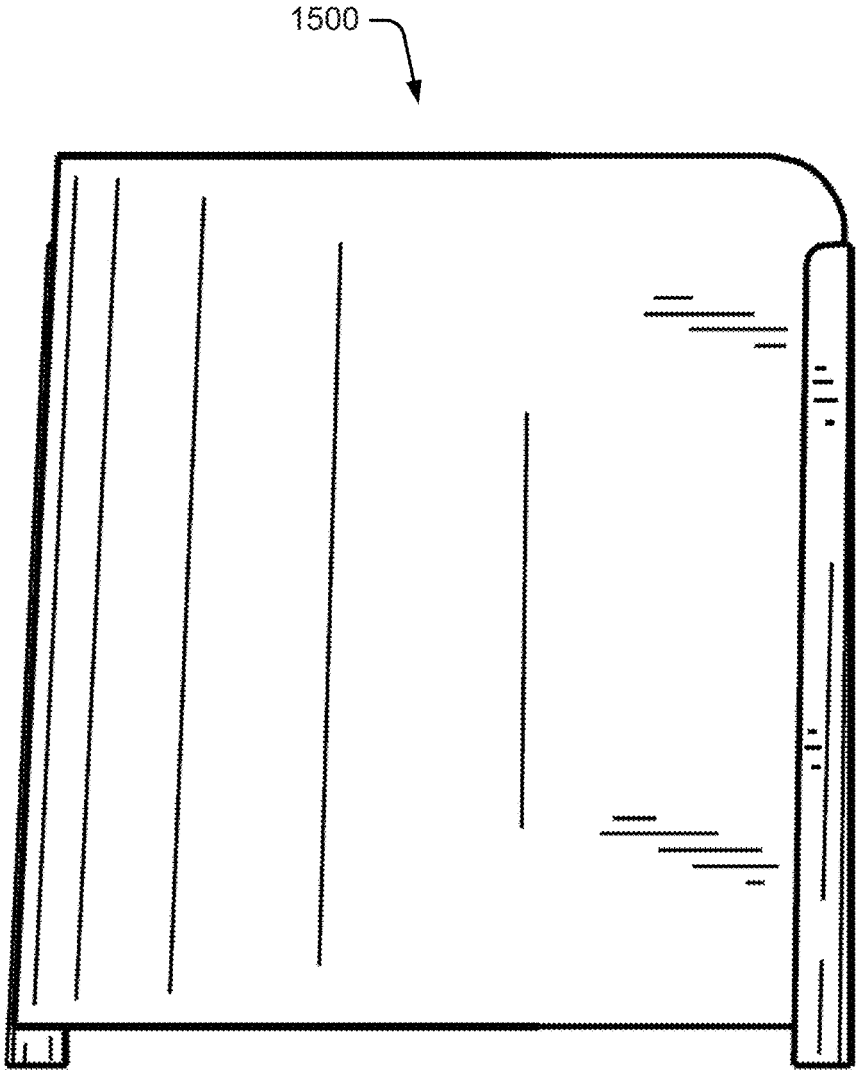
FIG. 80 is a front end view of the assembly shown in FIG. 77.
Figure 81:
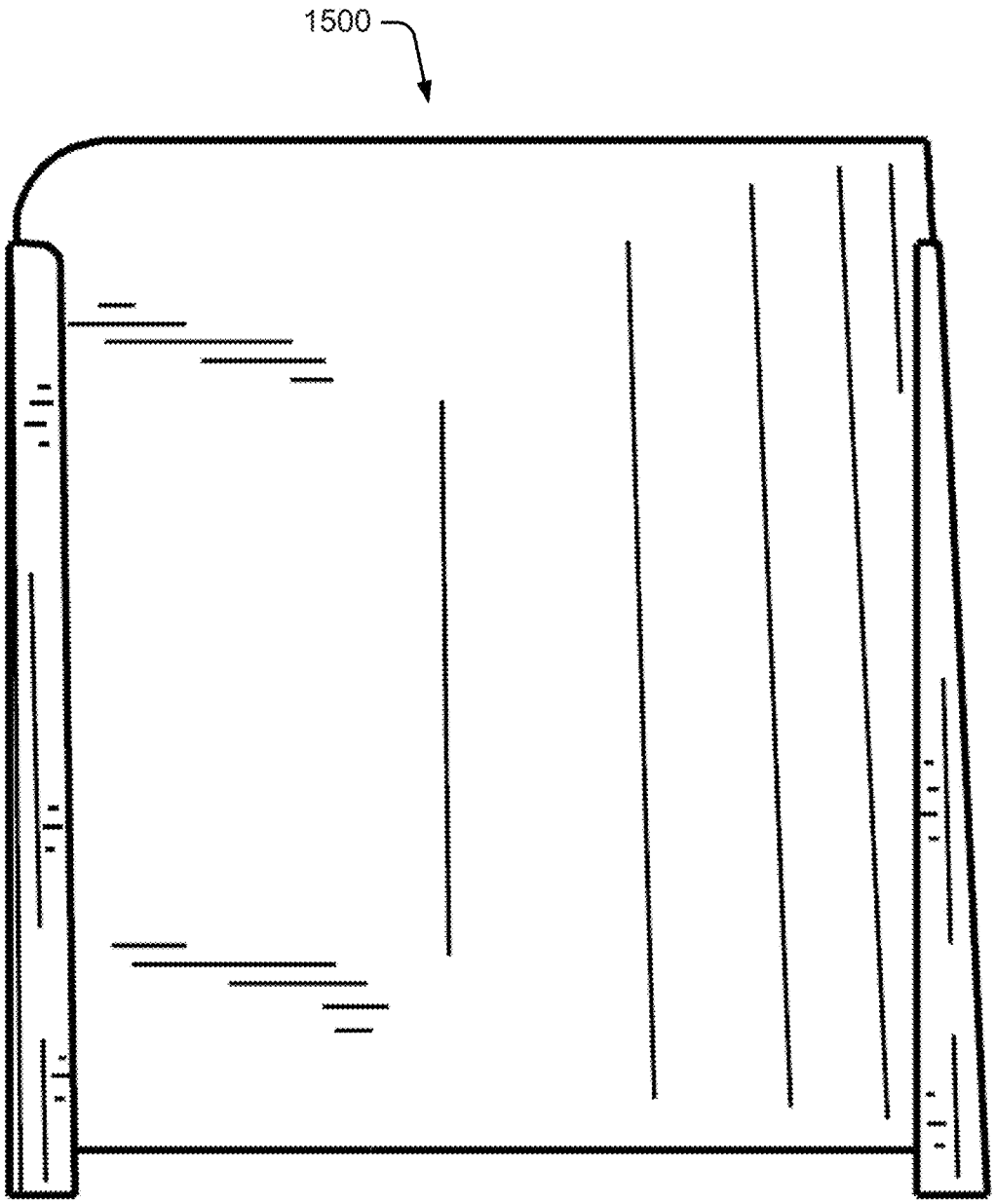
FIG. 81 is a rear end view of the assembly shown in FIG. 77.
Figure 82:
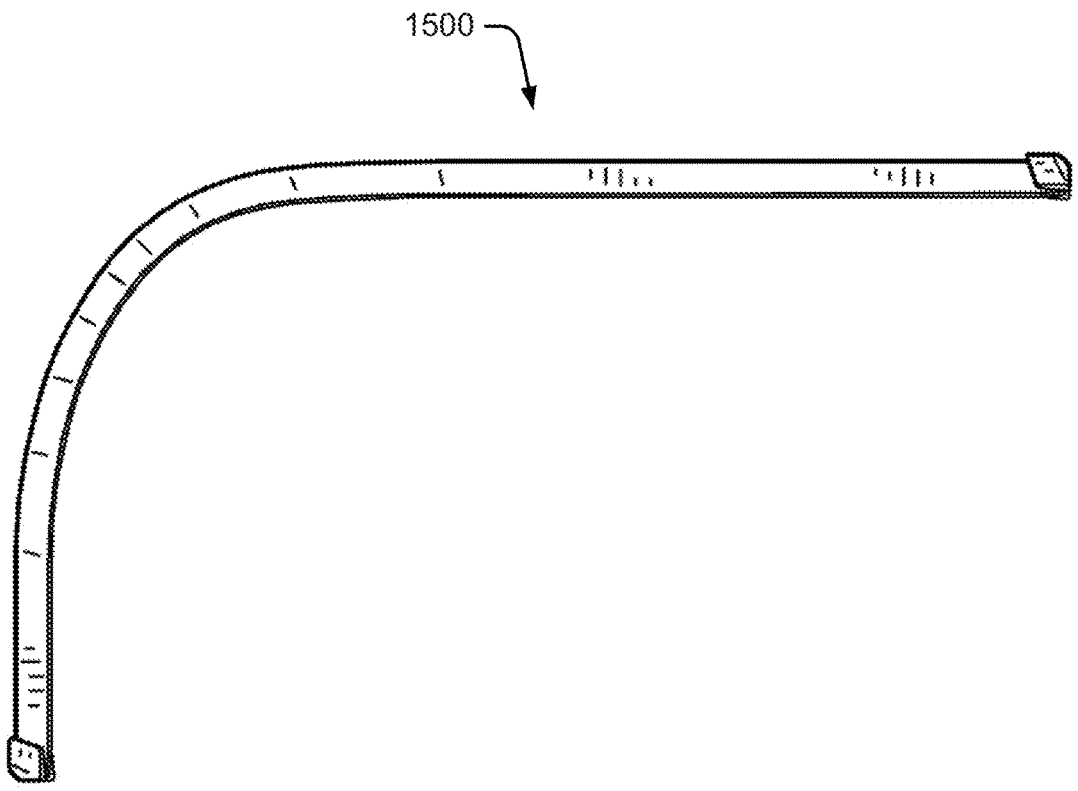
FIG. 82 is top plan view of the assembly shown in FIG. 77.
Figure 83:
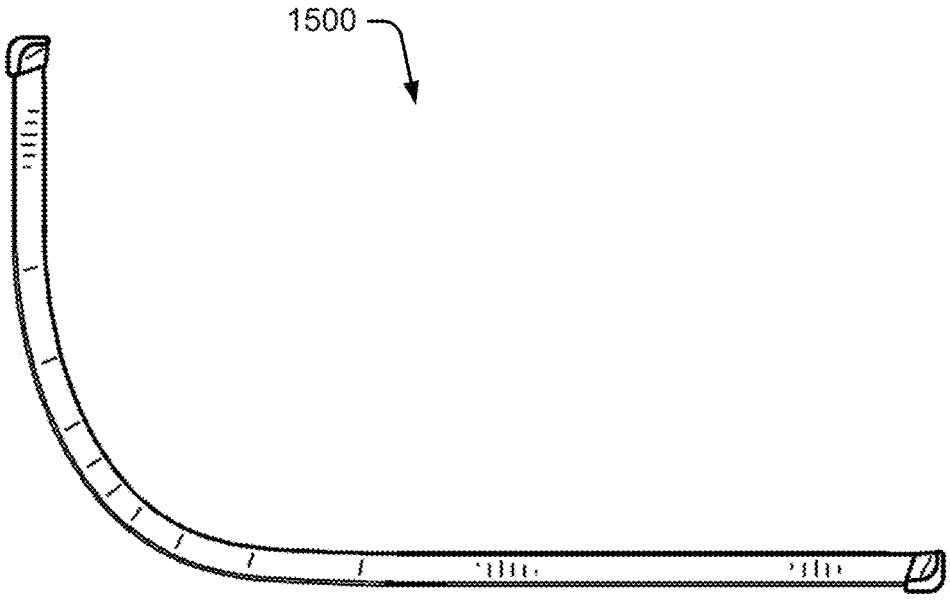
FIG. 83 is a bottom plan view of the assembly shown in FIG. 77.
Figure 84:
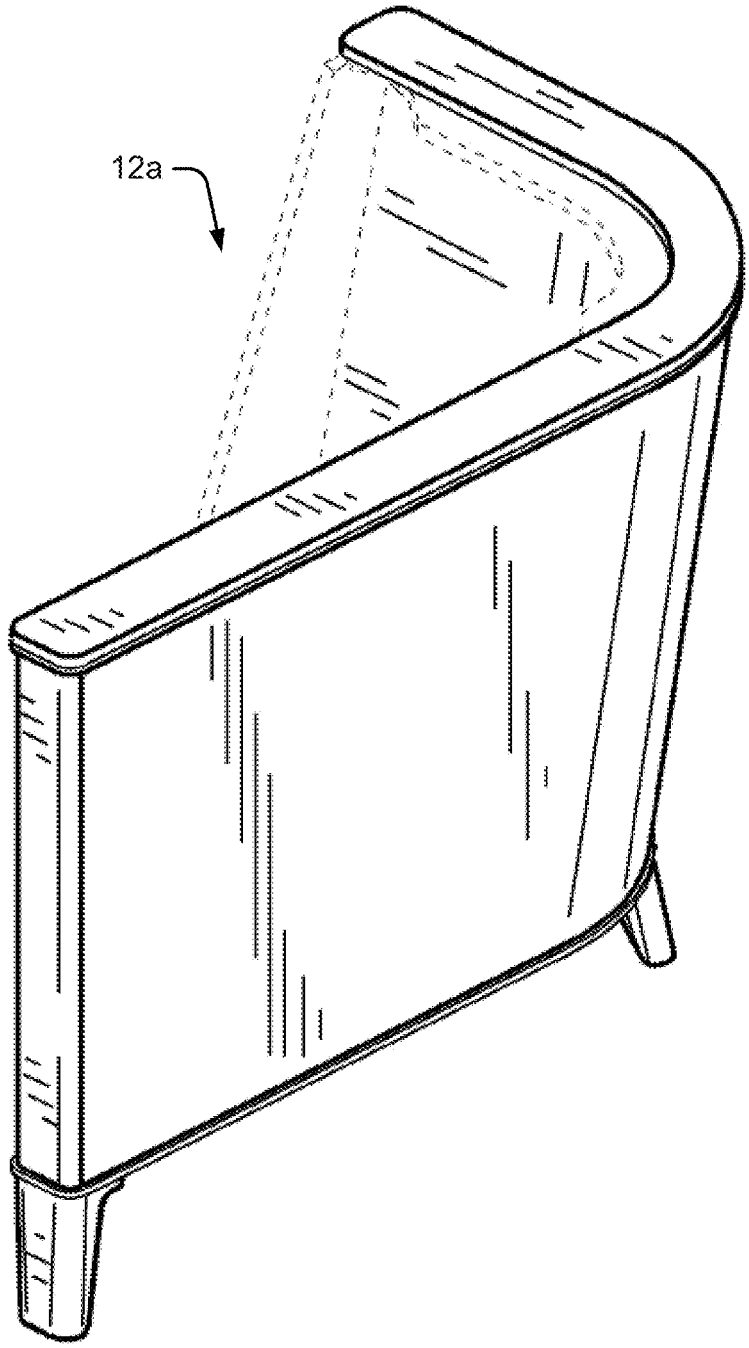
FIG. 84 is a perspective view of a lower wall sub-assembly that is consistent with at least some aspects of the present disclosure.
Figure 85:
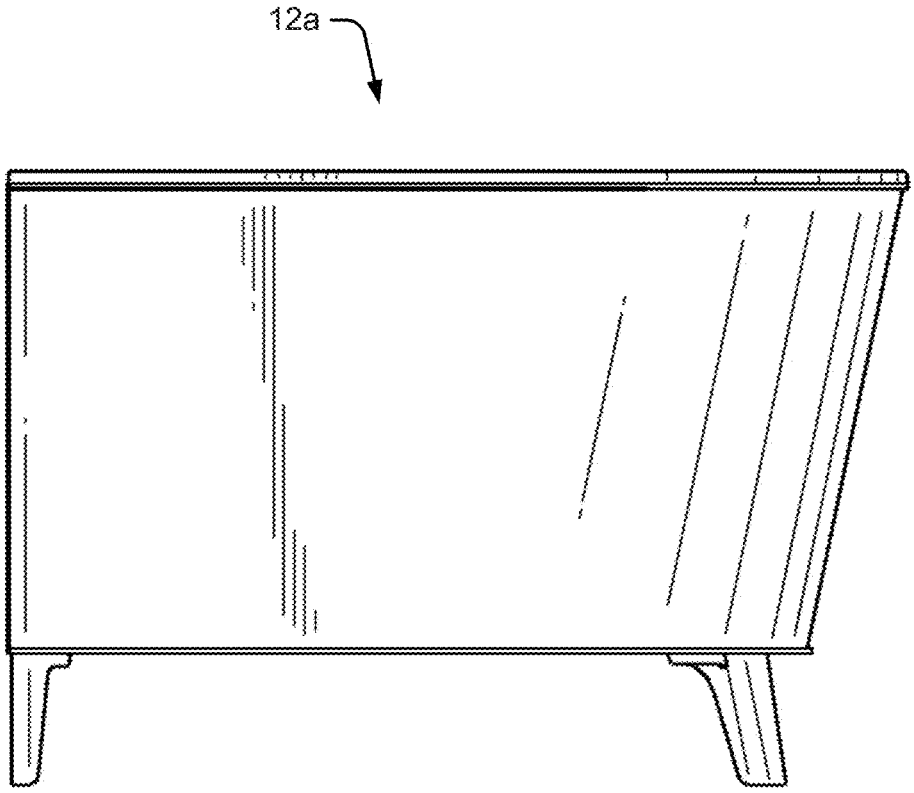
FIG. 85 is a side plan view of the assembly of FIG. 84.
Figure 86:
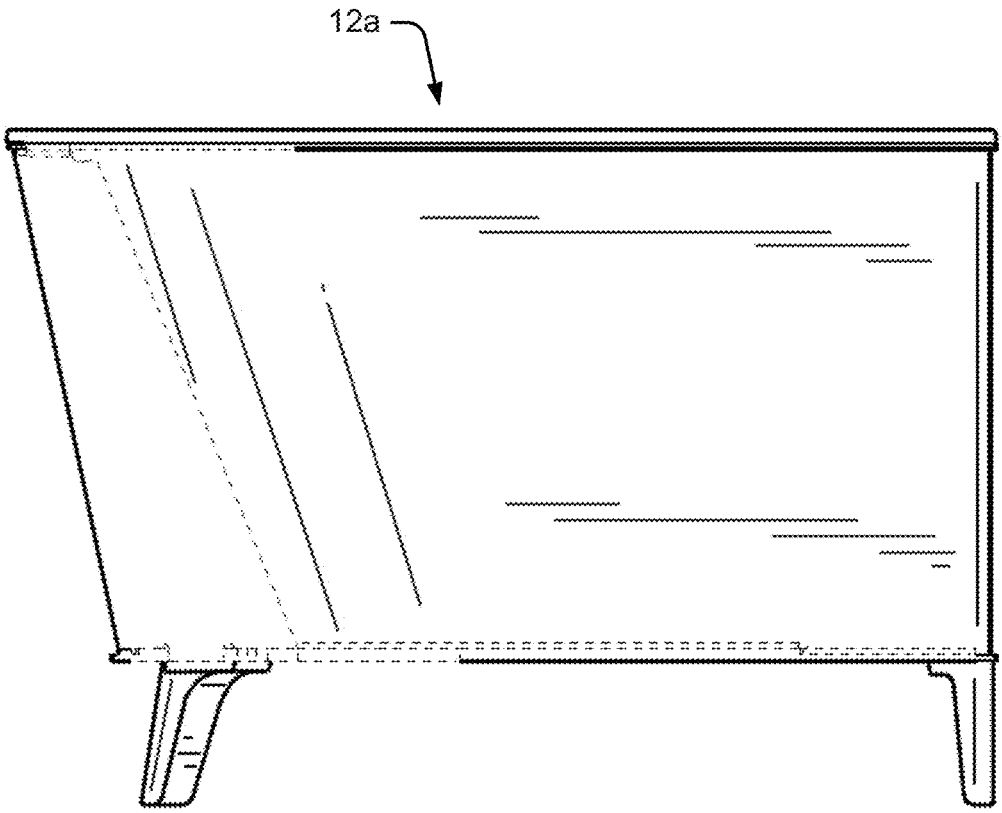
FIG. 86 is an opposite side plan view of the assembly of FIG. 84.
Figure 87:
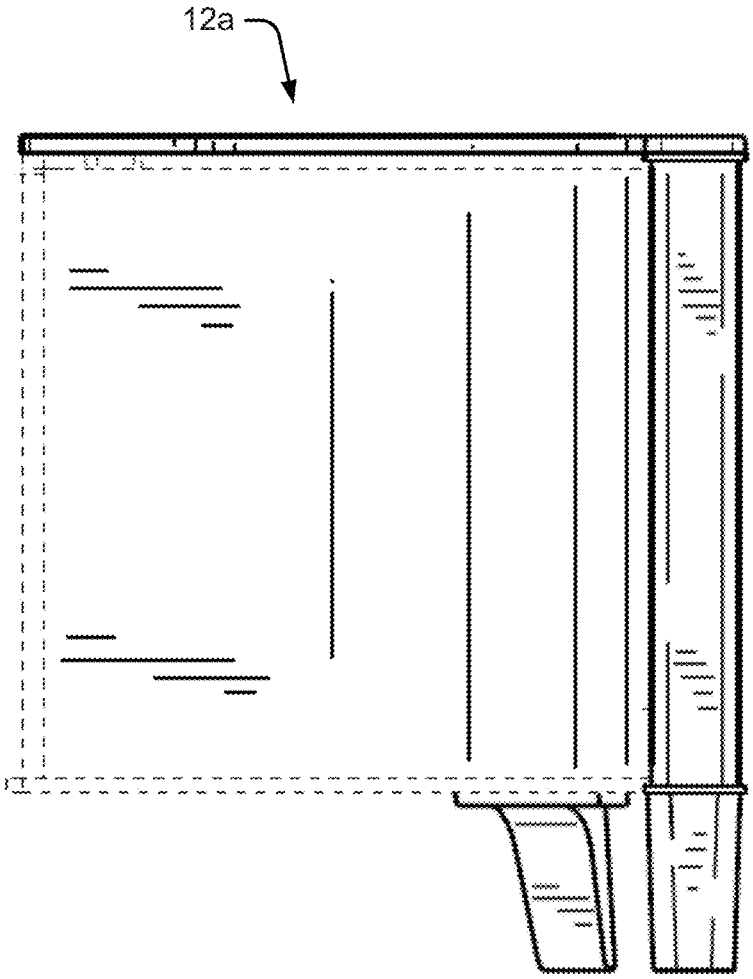
FIG. 87 is a front plan view of the assembly of FIG. 84.
Figure 88:
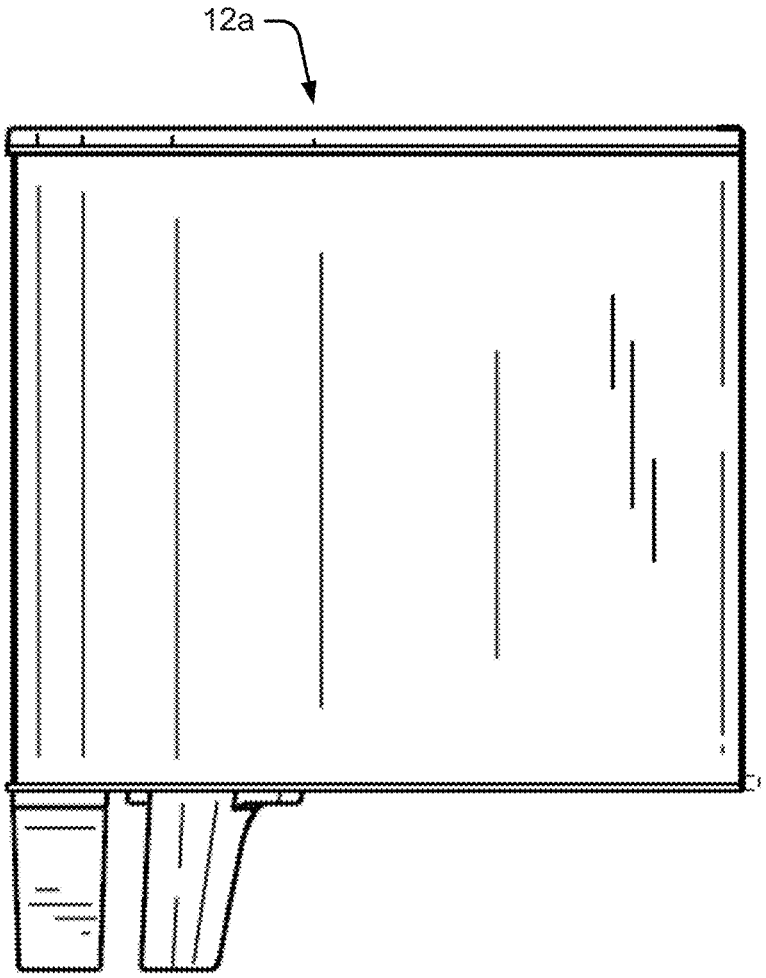
FIG. 88 is a rear plan view of the assembly of FIG. 84.
Figure 89:
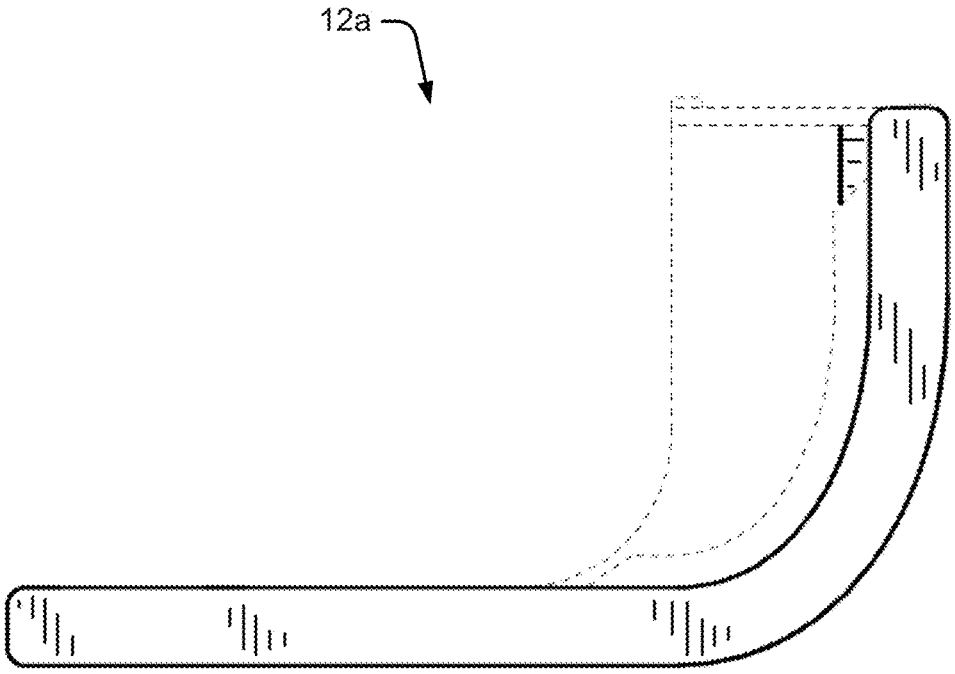
FIG. 89 is a top plan view of the assembly of FIG. 84.
Figure 90:
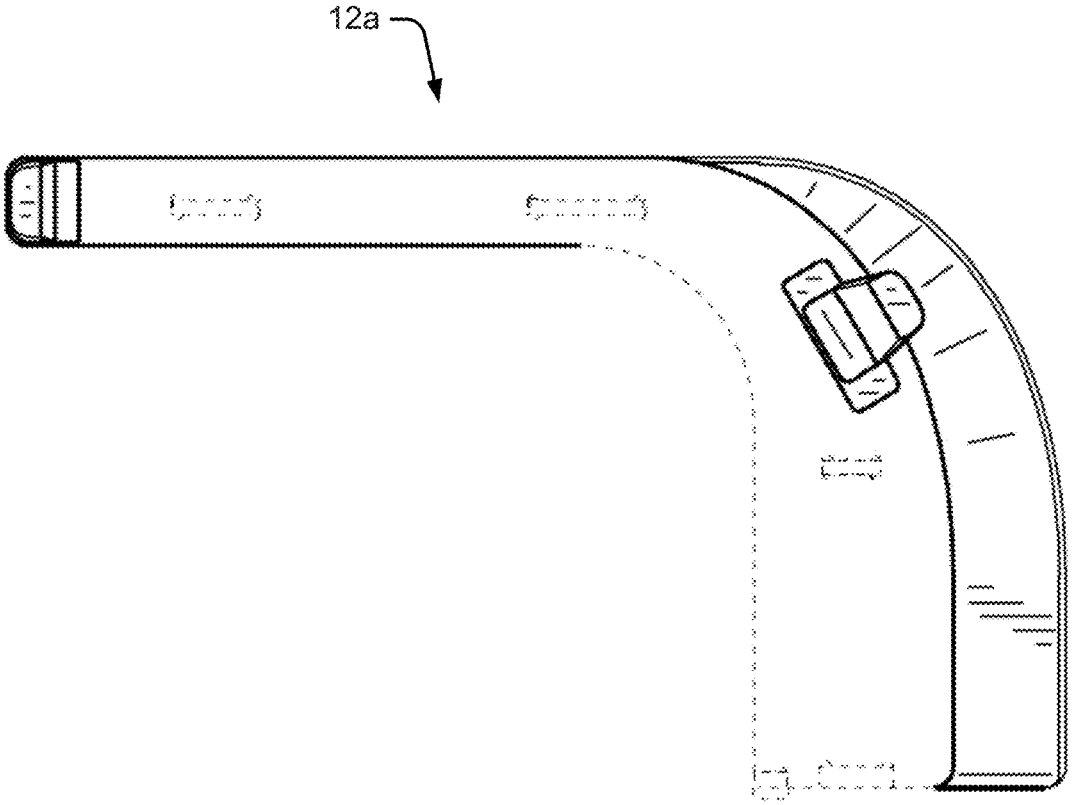
FIG. 90 is a bottom plan view of the assembly of FIG. 84.

As yet one other instance, see the 3J lower wall configuration 1560 in FIGS. 70 though 76 that includes storage and work surface members and a lounge subassembly (in phantom) suspended between first and second lower wall subassemblies 12*a* and 12*b* and an extending third lower wall subassembly 12*c* without any upper screen assemblies.

Figure 91:
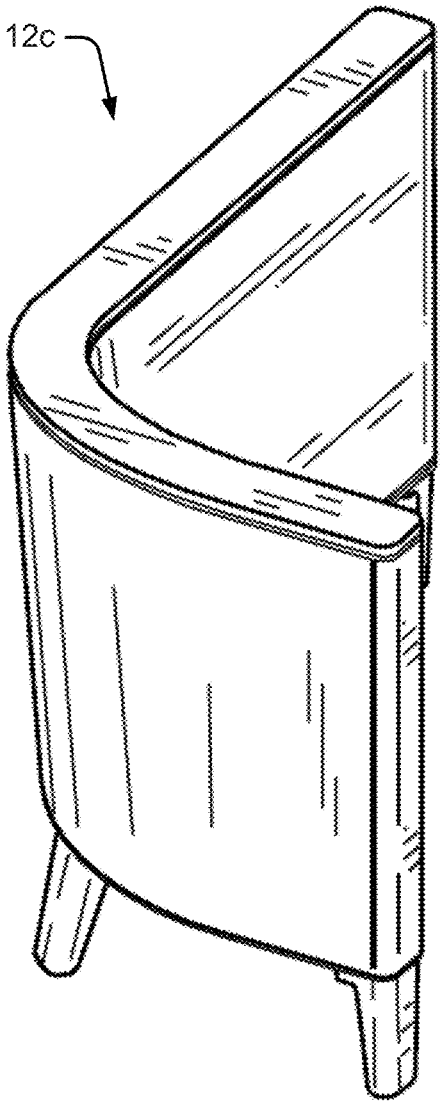
FIG. 91 is a perspective view of another lower wall sub-assembly that is consistent with at least some aspects of the present disclosure.
Figure 92:
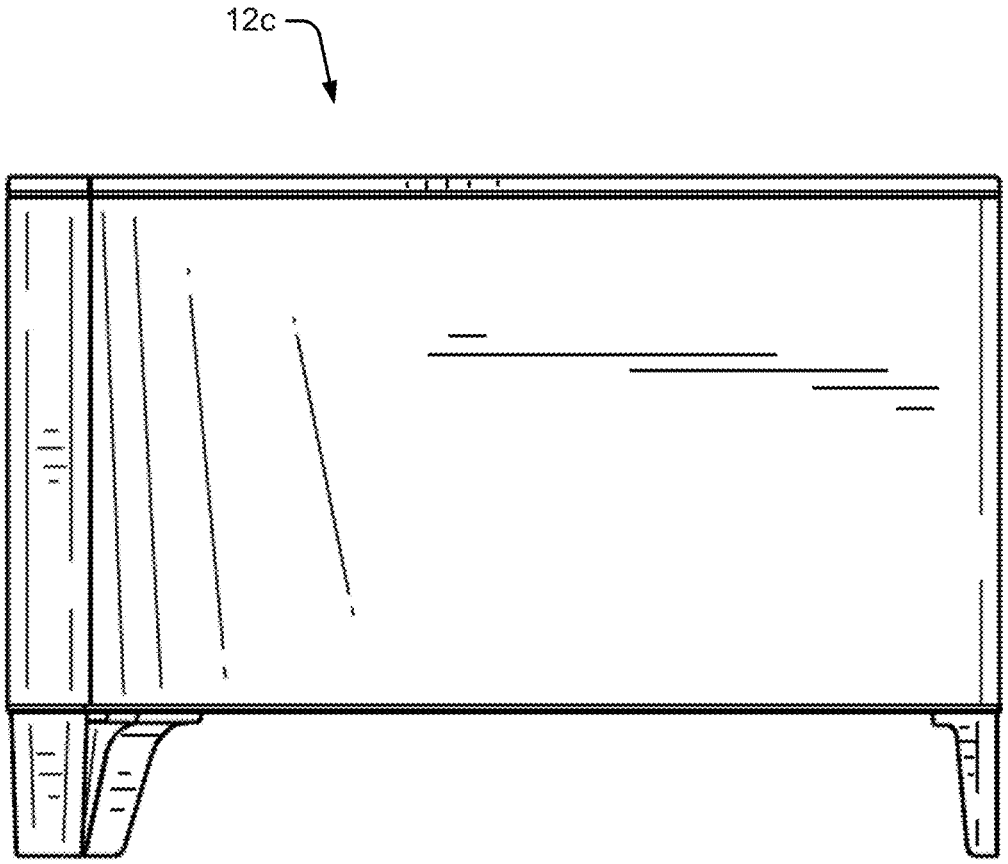
FIG. 92 is a side plan view of the assembly shown in FIG. 91.
Figure 93:
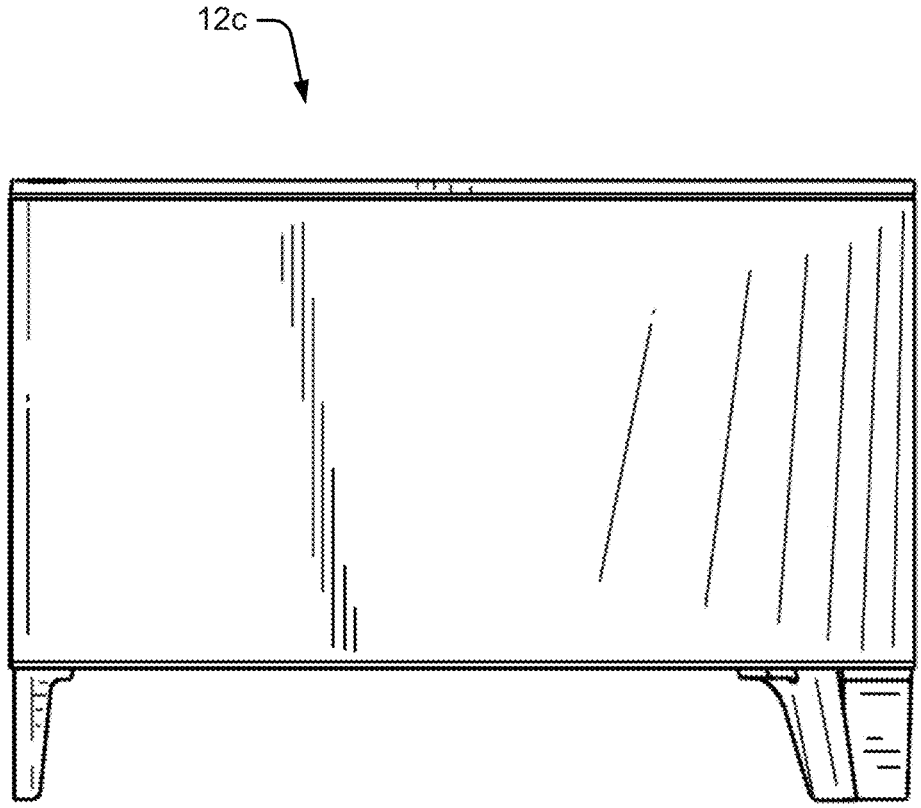
FIG. 93 is an opposite side plan view of the assembly shown in FIG. 91.
Figure 94:
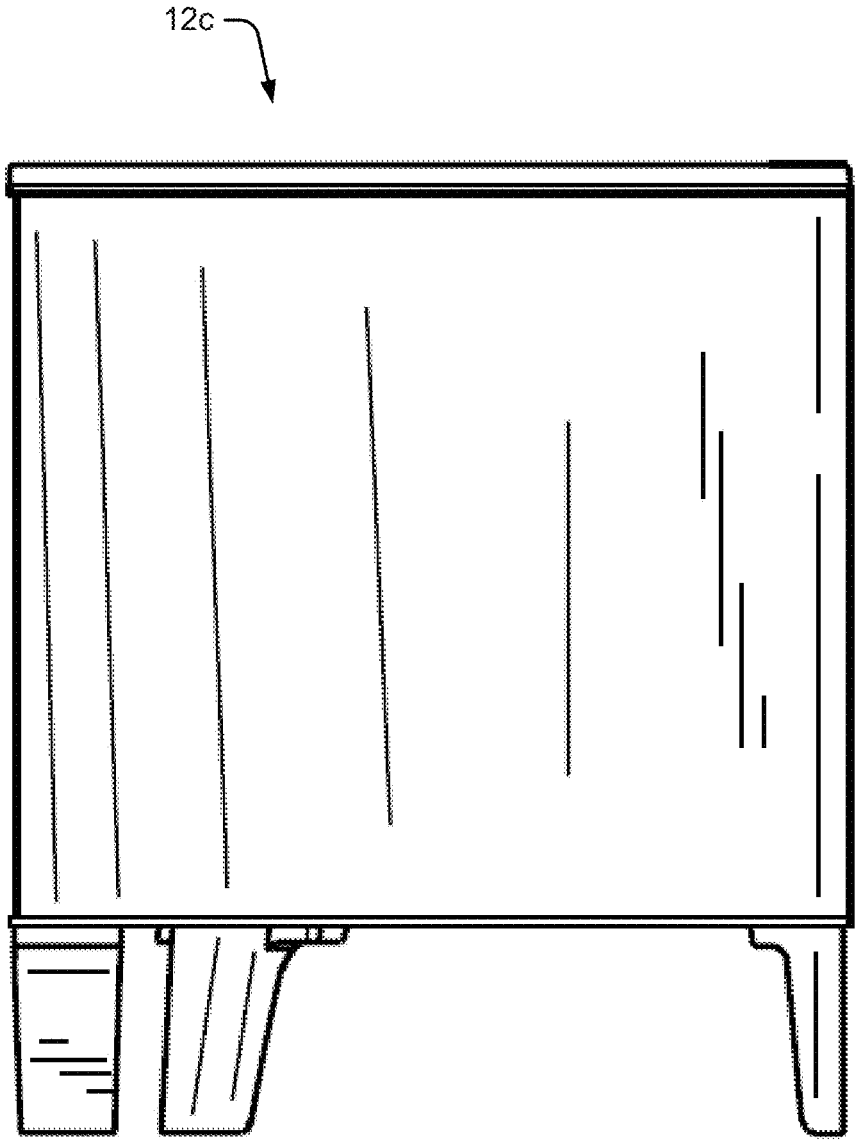
FIG. 94 is a front end plan view of the assembly shown in FIG. 91.
Figure 95:
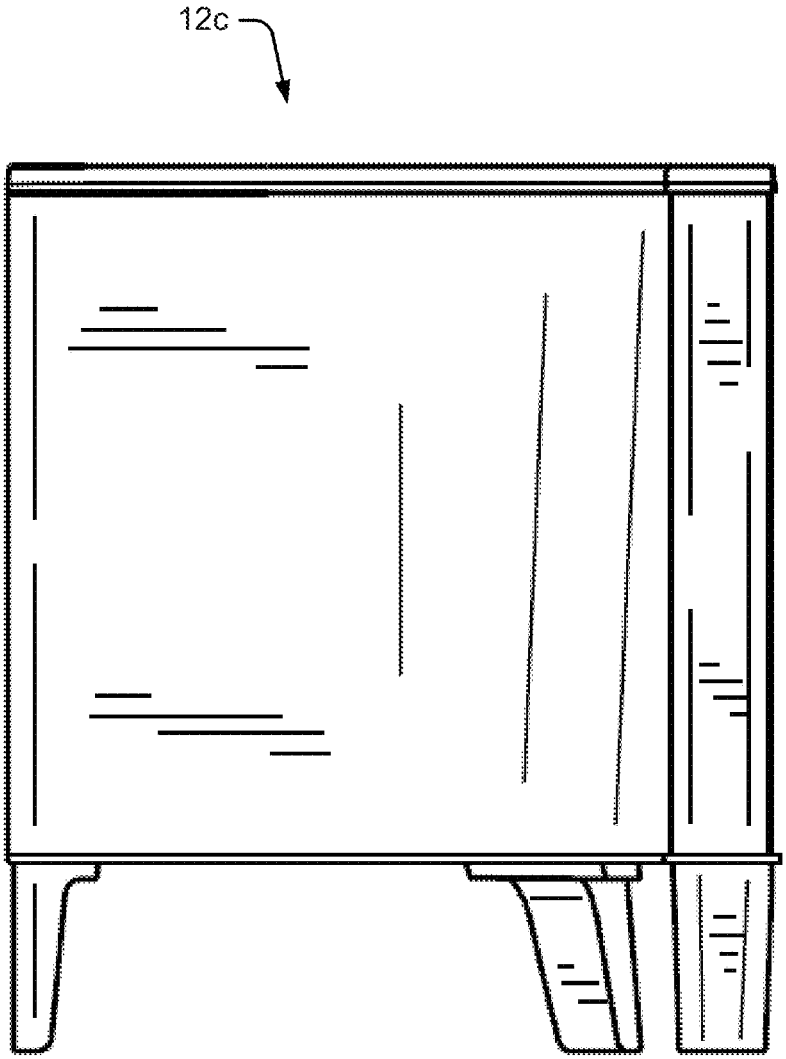
FIG. 95 is a rear end plan view of the assembly shown in FIG. 91.
Figure 96:
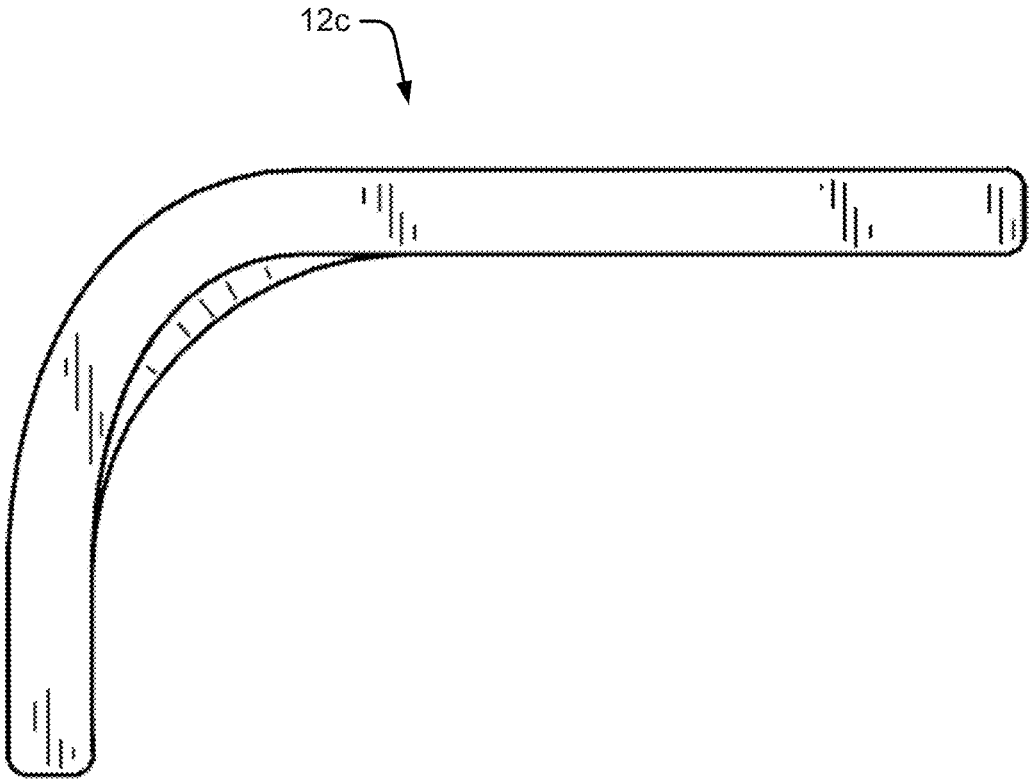
FIG. 96 is a top plan view of the assembly shown in FIG. 91.
Figure 97:
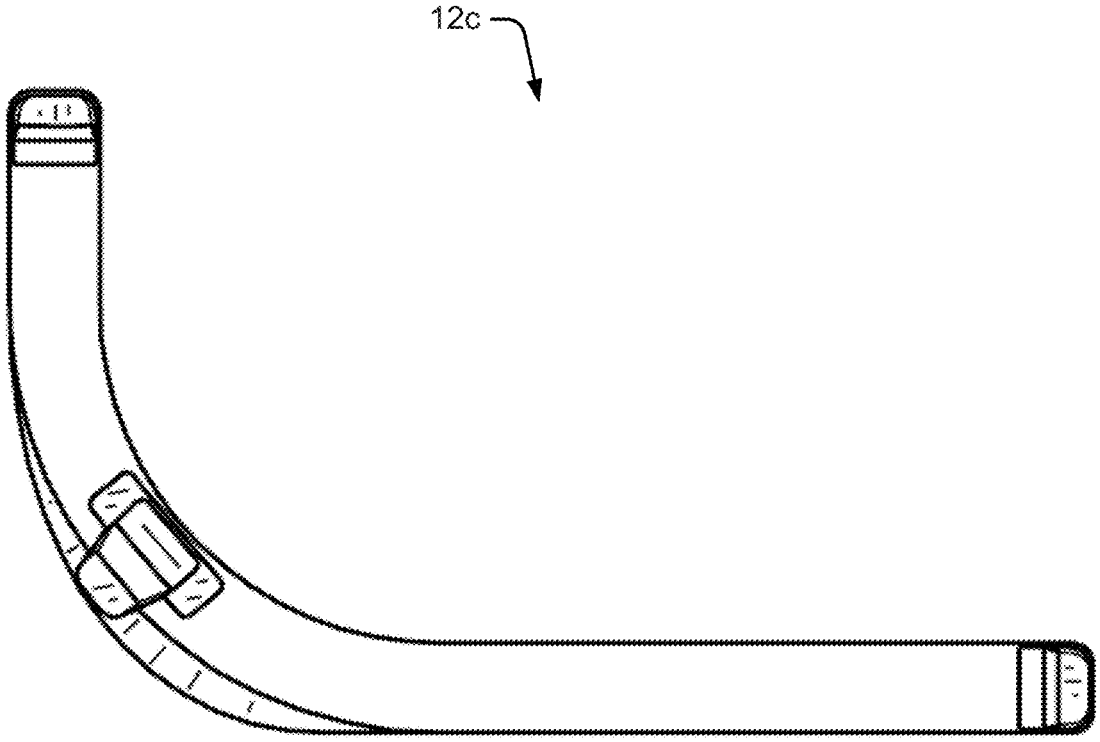
FIG. 97 is a bottom plan view of the assembly shown in FIG. 91.
Figure 98:
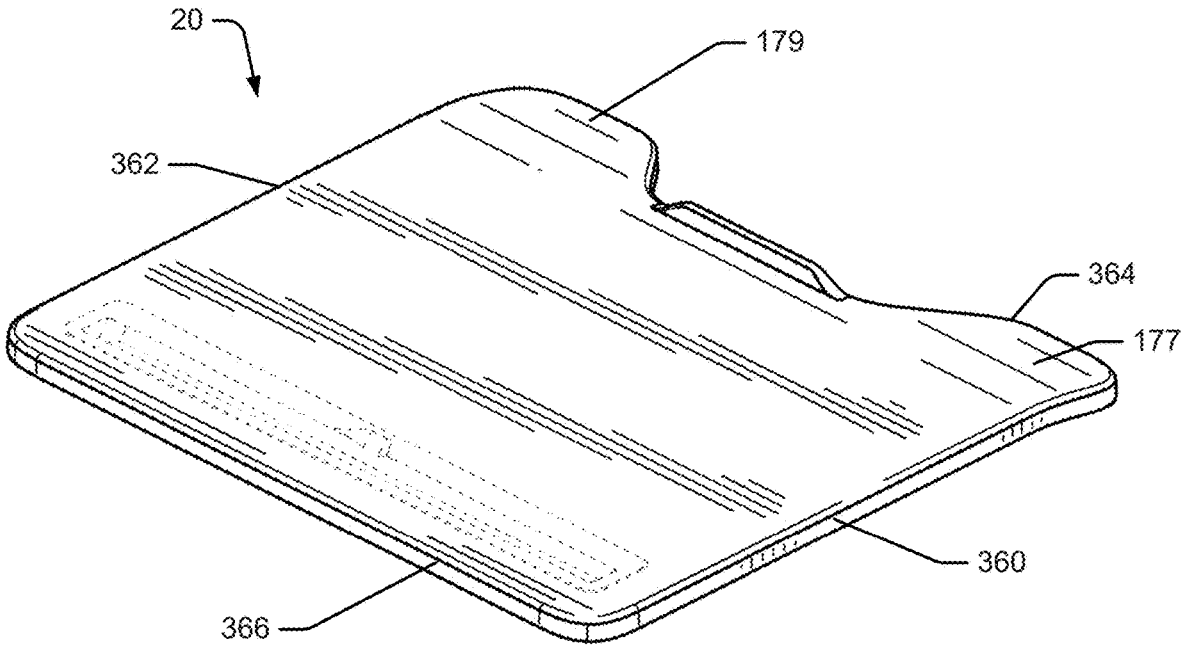
FIG. 98 is a perspective view of the tablet assembly shown in FIG. 1.
Figure 99:
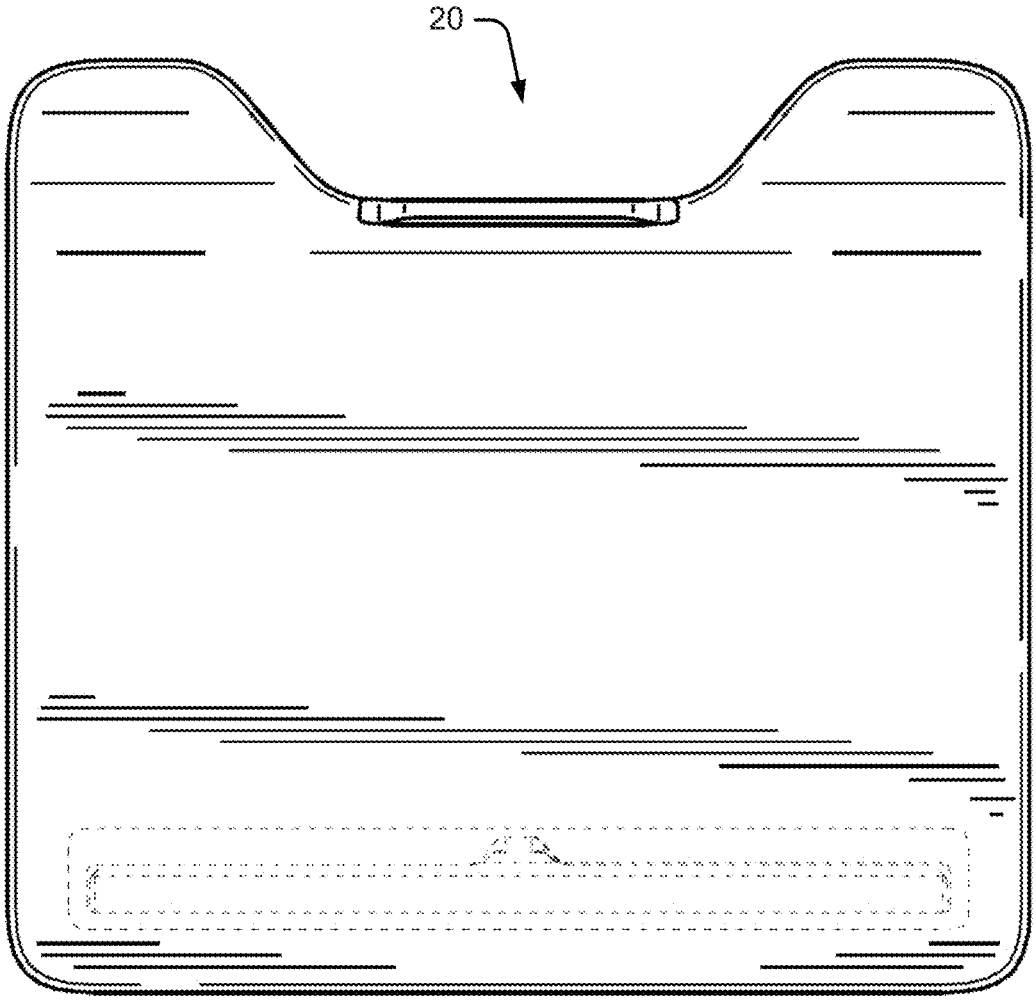
FIG. 99 is a top plan view of the tablet assembly shown in FIG. 98.
Figure 100:
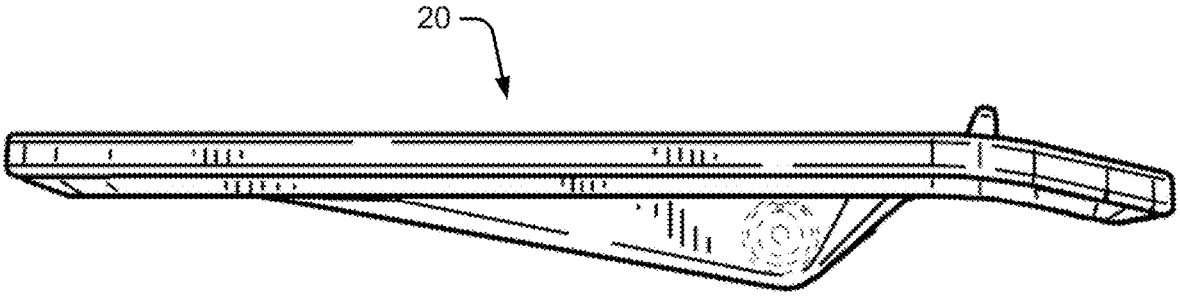
FIG. 100 is a first side plan view of the tablet assembly shown in FIG. 98.
Figure 101:
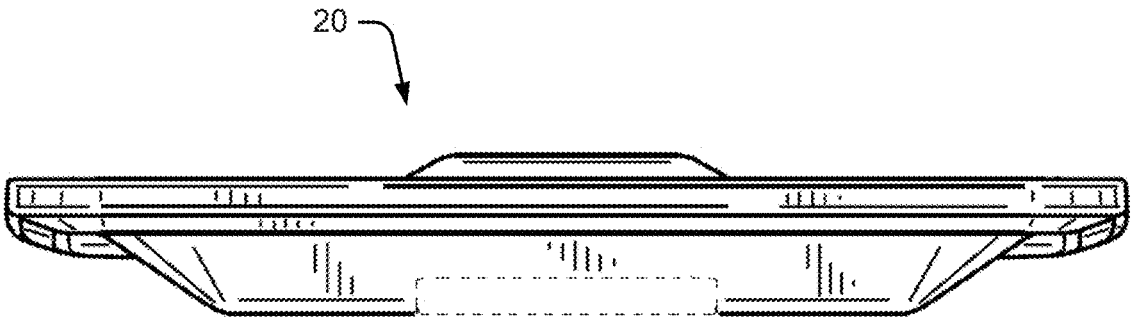
FIG. 101 is a front end view of the tablet assembly shown in FIG. 98.
Figure 102:
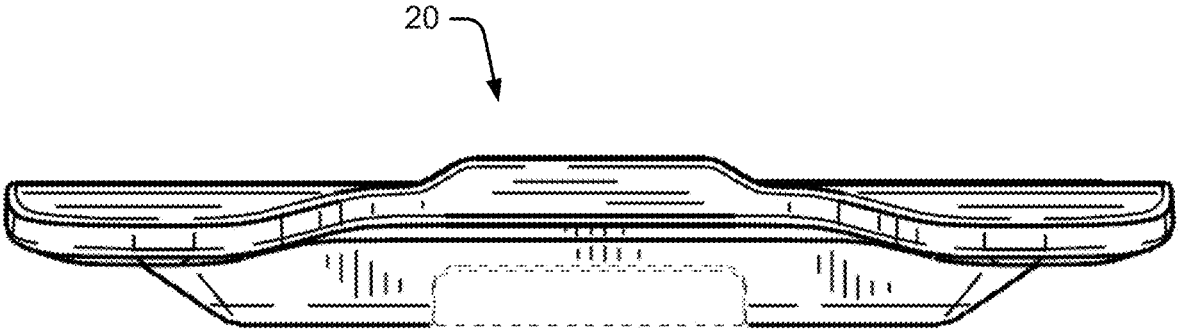
FIG. 102 is a rear end view of the tablet assembly shown in FIG. 98.
Figure 103:
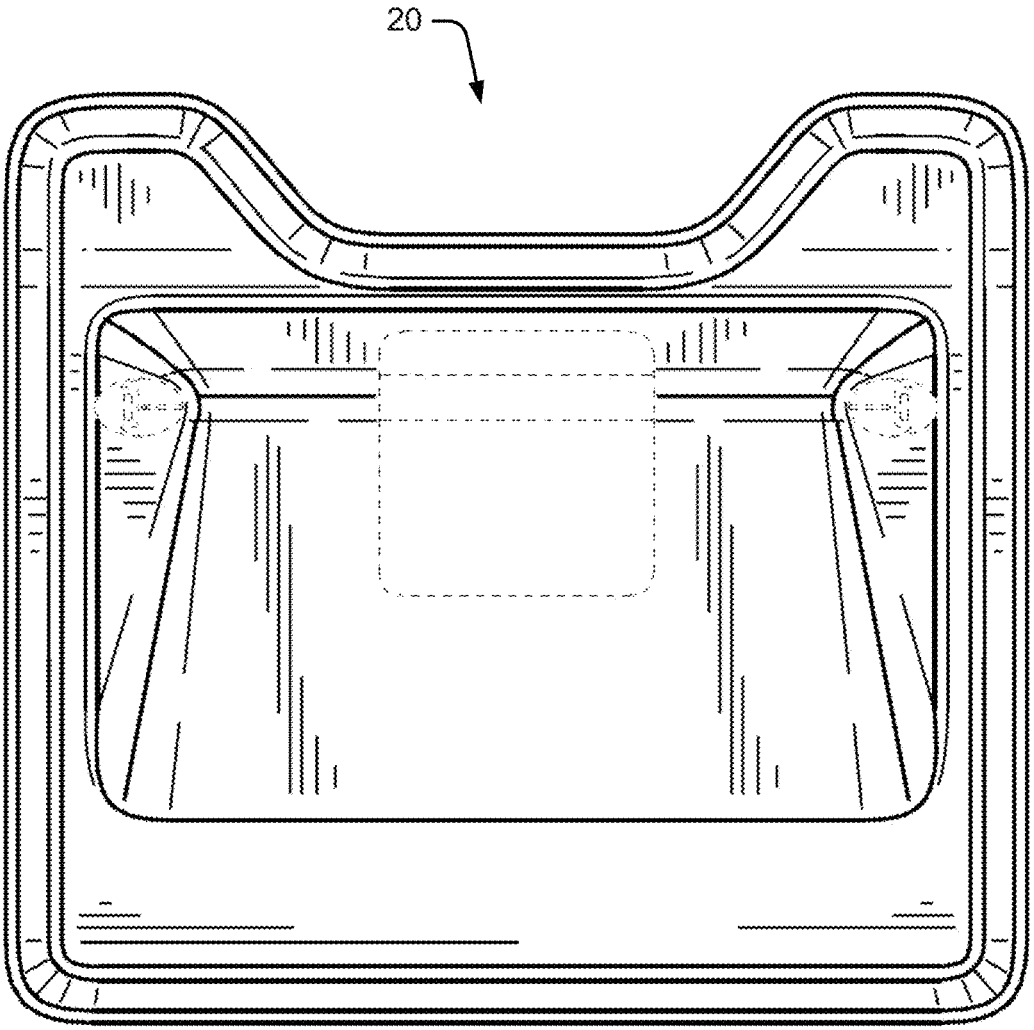
FIG. 103 is a bottom plan view of the tablet assembly shown in FIG. 98.

In at least some cases different lower wall subassemblies may be combined in different ways to provide differently shaped and functioning structures. To this end, see the exemplary lower wall subassembly 12*a* shown in FIGS. 84 through 90 and the exemplary lower wall subassembly 12*c* in FIGS. 91 though 97. In these images various aspects of the subassemblies are shown in phantom to clearly indicate that those components are optional and could be replaced by components having other shapes and operational functions. Thus, in at least some embodiments, the lower wall and upper screen subassemblies are similar to optional building blocks within a kit of parts where a subset of subassemblies may be configured initially and then reconfigured in some other fashion based on user desires. In some cases additional components and subassemblies may be bought and installed with originally configured components to expand space division and obtain additional useful arrangements.

To enable comfort for an individual using the workspace, various components of the seating assembly may also be adjustable. For example, the height of the seat and headrest could be adjustable, as could the position of the back. The height and angle of the side work surface could also be adjustable. The personal workspace 10 could also include cup holders, which could be mounted to the wall assembly, or built into either the work surface 22 or the tablet 120.

Further, although the system is shown and described here as assembled, the components required to assemble a workspace can be purchased individually and shipped and assembled on site, either in a single installation, or an installation which is supplemented with additional components over time. Various optional elements can, for example, be field installed. Various types of lighting elements, communication ports, and other electrical devices can be clipped to the lighting element 62 in the field.

It is therefore evident that the particular embodiments disclosed above may be altered or modified and all such variations are considered within the scope and spirit of the invention. Accordingly, the protection sought herein is as set forth in the claims below.

Thus, the invention is to cover all modifications, equivalents, and alternatives falling within the spirit and scope of the invention as defined by the following appended claims. For example, although the system is described above for use as a workspace, in some applications, the personal area can be used in medical applications, as, for example, when administering intravenous fluids, or collecting plasma. Under these circumstances, medical equipment can be positioned within the wall assembly, or immediately outside the wall assembly. The system can also be used in waiting rooms, cafeterias, and various other locations.

To apprise the public of the scope of this invention, the following claims are made:

1. A lounge assembly comprising:

a lower wall structure including at least first and second spaced apart side walls and a rear wall that together form an assembly space, each of the side walls and rear wall including an internal surface facing the assembly space and an external surface opposite the internal surface;

a seat assembly supported between the first and second side walls within the assembly space and suspended above an ambient floor to form a storage space there below;

a shelf member having top and bottom shelf member surfaces, the shelf member supported by the first side wall so that the top surface is substantially horizontal;

a first coupler mounted to the internal surface of the first side wall at a location below the bottom shelf member surface;

a support arm having an arm length dimension between proximal and distal ends, the proximal end mounted to the first coupler adjacent the internal surface of the first side wall for rotation about a first vertical axis; and a tablet member including a substantially planar member forming top and bottom surfaces and having a side edge between the top and bottom surfaces that defines a tablet member shape, the tablet member supported at the distal end of the support arm for rotation about a second vertical axis through a second range of motion with respect to the support arm.

2. The lounge assembly of claim 1 wherein the tablet member is supported by the support arm at an angle with respect to horizontal so that the top surface of the tablet is angled downward from a front edge to a rear edge of the tablet member.

3. The lounge assembly of claim 2 wherein the tablet member is supported at the distal end of the support arm for rotation about a horizontal axis so that the angle with respect to horizontal is adjustable.

4. The lounge assembly of claim 1 wherein the first side wall forms a front edge and wherein the first coupler is mounted to the internal surface of the first side wall at a location spaced rearward and away from the front edge of the first side wall.

5. The lounge assembly of claim 4 wherein the side walls and rear wall also form an upper surface, the first coupler mounted to the internal surface of the first side wall at a location spaced below the upper surface.

6. The lounge assembly of claim 1 wherein the side walls and rear wall also form an upper surface, the first coupler mounted to the internal surface of the first side wall at a location spaced below the upper surface.

7. A lounge assembly comprising:

a lower wall structure including at least first and second spaced apart side walls and a rear wall that together form an assembly space, each of the side walls and rear wall including an internal surface facing the assembly space and an external surface opposite the internal surface;

a seat assembly supported between the first and second side walls within the assembly space and suspended above an ambient floor to form a storage space there below;

a first coupler mounted to the internal surface of the first side wall;

a support arm having an arm length dimension between proximal and distal ends, the proximal end mounted to the first coupler adjacent the internal surface of the first side wall for rotation about a first vertical axis;

a tablet member including a substantially planar member forming top and bottom surfaces and having a side edge between the top and bottom surfaces that defines a tablet member shape, the tablet member supported at the distal end of the support arm for rotation about a second vertical axis through a second range of motion with respect to the support arm; and wherein the arm length dimension has a length such that when the support arm extends substantially perpendicular to the internal surface of the first side wall and the tablet member is aligned with the support arm, the tablet member is substantially centered in front of the seat assembly.

8. The lounge assembly of claim 1 wherein the tablet member is restricted from rotating into a vertical position.

9. The lounge assembly of claim 1 wherein the lower wall structure includes a first curved portion between the first side wall and the rear wall and a second curved portion between the second side wall and the rear wall.

10. The lounge assembly of claim 9 wherein the external surface of the rear wall angles rearward from a bottom end up to a top end.

11. The lounge assembly of claim 1 wherein the second vertical axis is proximate a lateral portion of the side edge of the tablet member.

12. The lounge assembly of claim 1 wherein the support arm is a first support arm and the assembly further including a second support arm having proximal and distal ends, the proximal end mounted at the distal end of the first support arm for rotation about the second vertical axis, the tablet member mounted to the distal end of the second support arm.

13. The lounge assembly of claim 12 wherein the tablet member is mounted to the distal end of the second support arm for rotation about at least a third axis.

14. The lounge assembly of claim 13 wherein the third axis is substantially horizontal.

15. The lounge assembly of claim 12 wherein the second support arm extends below the tablet member and wherein the table member is centrally mounted to the distal end of the second support arm.

16. The lounge assembly of claim 12 wherein the proximal end of the second support arm resides above the distal end of the first support arm.

17. The lounge assembly of claim 1 wherein the seat assembly includes a seat having a top surface, the top surface of the shelf member at a height above the height of the top surface of the seat.

18. The lounge assembly of claim 17 wherein a front edge of the shelf member angles rearward toward a front surface of the rear wall.

19. The lounge assembly of claim 1 wherein the shelf member is mounted to the internal surface of the first side wall.

20. The lounge assembly of claim 1 wherein the shelf member has a circumferential edge that defines the shelf member shape and wherein the distal end of the support arm extends past the circumferential edge of the shelf member in all support arm positions.

21. The lounge assembly of claim 1 wherein the first and second side walls form front edges that extend forward past a front edge of the seat assembly.

22. The lounge assembly of claim 1 further including a front wall extension subassembly supported by the first side wall, the front wall extension subassembly including an extension side wall that extends from the first side wall and a front wall that extends from a distal end of the extension side wall to further define the assembly space.

23. The lounge assembly of claim 1 wherein the seat assembly includes a seat having a lower surface, the lounge assembly further including a power receptacle mounted below the lower surface of the seat at a location suspended from the ambient floor.

24. The lounge assembly of claim 23 wherein the power receptacle is mounted adjacent a lateral side of the lower surface of the seat assembly.

25. The lounge assembly of claim 24 wherein the power receptacle is mounted on the first side wall side of the seat assembly.

26. The lounge assembly of claim 1 wherein the seat assembly includes a seat, the seat located adjacent an internal surface of the second side wall.

27. The lounge assembly of claim 25 wherein the seat is spaced apart from the internal surface of the first side wall.

28. The lounge assembly of claim 1 wherein the seat assembly includes a seat and a backrest wherein the backrest is spaced in front of the rear wall.

29. The lounge assembly of claim 1 wherein the lower wall structure includes a rigid frame assembly and fabric stretched over the frame assembly to substantially cover internal and external surfaces of the first and second side walls and the rear wall.

30. The lounge assembly of claim 1 wherein the tablet member has a width dimension between lateral edges within a range between 12 inches and 24 inches and has a depth dimension within a range between 10 inches and 15 inches.

31. The lounge assembly of claim 30 wherein the tablet member further includes a rib that extends upward adjacent a rear edge of the top surface of the tablet member.

32. The lounge assembly of claim 1 wherein the support arm has a top surface and the shelf member has a bottom surface and wherein a gap between the top surface of the support arm and the bottom surface of the shelf member.

33. A lounge assembly comprising:

a lower wall structure including at least first and second spaced apart side walls and a rear wall that together form an assembly space, each of the side walls and rear wall including an internal surface facing the assembly space and an external surface opposite the internal surface;

a seat assembly supported between the first and second side walls within the assembly space and suspended above an ambient floor to form a storage space there below;

a first coupler mounted to the internal surface of the first side wall;

a support arm having an arm length dimension between proximal and distal ends, the proximal end mounted to the first coupler adjacent the internal surface of the first side wall for rotation about a first vertical axis; and a tablet member including a substantially planar member forming top and bottom surfaces and having a side edge between the top and bottom surfaces that defines a tablet member shape, the tablet member supported at the distal end of the support arm for rotation about a second vertical axis through a second range of motion with respect to the support arm; and wherein the side walls and rear wall also form an upper surface, the assembly further including a screen subassembly including first and second screen side walls and a screen rear wall, each screen wall having an internal surface and an external surface and the screen walls together forming a top edge, the screen subassembly supported by the lower wall structure with the top edge extending to a height above the height of the upper surface formed by the lower wall structure.

34. The lounge assembly of claim 33 wherein the screen subassembly includes a rigid frame and a fabric applied over the screen to cover both internal and external sides of the screen.

35. The lounge assembly of claim 34 wherein the rigid frame includes a curved acrylic sheet.

36. The lounge assembly of claim 33 wherein the screen subassembly is mounted to the upper surface of the side walls and rear wall.

37. The lounge assembly of claim 33 wherein the upper surface of the side walls and the rear wall is substantially exposed adjacent the screen subassembly.

38. The lounge assembly of claim 37 wherein the lower wall structure includes a first curved portion between the first side wall and the rear wall and a second curved portion between the second side wall and, the rear wall and wherein the screen subassembly includes a first curved screen portion between the first screen side wall and the screen rear wall and a second curved screen portion between the second screen side wall and the screen rear wall.

39. The lounge assembly of claim 37 wherein the first curved screen portion has a curvature that is similar to the curvature of the first curved portion and the second curved screen portion has a curvature that is similar to the second curved portion.

40. The lounge assembly of claim 39 wherein a radius of curvature of each of the first curved portion, the second curved portion, the first curved screen portion and the second curved screen portion are within a range between 5 inches and 15 inches.

41. The lounge assembly of claim 33 wherein the screen subassembly has a thickness dimension that is between one sixteenth inch and one inch and the lower wall structure has a thickness dimension that is greater than the screen subassembly.

42. The lounge assembly of claim 33 wherein the first side wall, second side wall and rear wall each have a thickness that is within a range between one inch and three inches and wherein the screen side walls and screen rear wall have a thickness that is less than the first side wall, second side wall and the rear wall.

43. The lounge assembly of claim 33 wherein the upper surface has a height within a range between 20 inches and 30 inches.

44. A lounge assembly comprising:

a wall structure including at least first and second spaced apart side walls and a rear wall that together form an assembly space, each of the side walls and rear wall including an internal surface facing the assembly space and an external surface opposite the internal surface, each side wall having a front edge, wherein the side walls and rear wall also form an upper surface;

a screen subassembly including first and second screen side walls and a screen rear wall, each screen wall having an internal surface and an external surface and the screen walls together forming a top edge, the screen subassembly supported by the lower wall structure with the top edge extending to a height above the height of the upper surface formed by the lower wall structure;

a seat assembly including a seat supported between the internal surfaces of the first and second side walls within the assembly space, the seat having a front edge that is spaced rearward of the front edges of the side walls;

a first coupler mounted to the internal surface of the first side wall;

a support arm having proximal and distal ends, the proximal end mounted to the first coupler for rotation about a first vertical axis; and a tablet member including a substantially planar member forming top and bottom surfaces and having a side edge between the top and bottom surfaces that defines a tablet member shape, the tablet member supported at the distal end of the support arm.

* * * * *